US006905118B2

(12) United States Patent
Yamada et al.

(10) Patent No.: US 6,905,118 B2
(45) Date of Patent: Jun. 14, 2005

(54) SHEET FINISHER AND IMAGE FORMING SYSTEM USING THE SAME

(75) Inventors: Kenji Yamada, Tokyo (JP); Shuuya Nagasako, Tokyo (JP); Masahiro Tamura, Kanagawa (JP); Nobuyoshi Suzuki, Tokyo (JP); Hiromoto Saitoh, Kanagawa (JP); Hiroki Okada, Kanagawa (JP); Junichi Iida, Kanagawa (JP); Akihito Andoh, deceased, late of Kanagawa (JP); by Rika Andoh, legal representative, Kanagawa (JP); Naohiro Kikkawa, Tokyo (JP); Junichi Tokita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/629,654

(22) Filed: Jul. 30, 2003

(65) Prior Publication Data

US 2004/0070133 A1 Apr. 15, 2004

(30) Foreign Application Priority Data

| | | |
|---|---|---|
| Jul. 31, 2002 | (JP) | 2002-223879 |
| Jul. 31, 2002 | (JP) | 2002-223915 |
| Jul. 31, 2002 | (JP) | 2002-223935 |
| Sep. 17, 2002 | (JP) | 2002-270364 |
| Mar. 3, 2003 | (JP) | 2003-056234 |
| Mar. 3, 2003 | (JP) | 2003-056261 |

(51) Int. Cl.[7] ..... B41F 13/58

(52) U.S. Cl. ..... 270/8; 493/405; 493/409; 270/20.1

(58) Field of Search ..... 493/405, 409; 270/4, 8, 9, 16, 17, 20.1; 347/116

(56) References Cited

U.S. PATENT DOCUMENTS

| | | | | |
|---|---|---|---|---|
| 5,169,376 | A | * 12/1992 | Ries et al. | 493/445 |
| 5,762,328 | A | 6/1998 | Yamada et al. | |
| 6,003,853 | A | * 12/1999 | Nakazawa et al. | 270/58.11 |
| 6,042,529 | A | * 3/2000 | Hubler et al. | 493/434 |
| 6,145,825 | A | 11/2000 | Kunihiro et al. | |
| 6,199,853 | B1 | 3/2001 | Andoh et al. | |
| 6,231,045 | B1 | 5/2001 | Yamada et al. | |
| 6,264,191 | B1 | 7/2001 | Suzuki et al. | |
| 6,296,247 | B1 | 10/2001 | Tamura et al. | |
| 6,322,070 | B2 | 11/2001 | Yamada et al. | |
| 6,343,785 | B1 | 2/2002 | Yamada et al. | |
| 6,394,448 | B2 | 5/2002 | Suzuki et al. | |
| 6,416,052 | B2 | 7/2002 | Yamada et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,549,734 | B2 | 4/2003 | Yamada et al. | |
| 6,631,896 | B2 | 10/2003 | Yamada et al. | |

FOREIGN PATENT DOCUMENTS

| | | |
|---|---|---|
| JP | 62-16987 | 1/1987 |
| JP | 7-2426 | 1/1995 |
| JP | 2001-10759 | 1/2001 |
| JP | 2001-19269 | 1/2001 |
| JP | 2002-145516 | 5/2002 |

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

A sheet finisher of the present invention is included in an image forming system and folds a stack of sheets sequentially transferred from an image forming apparatus thereto. The sheet finisher includes a fold roller pair for holding the stack of sheets being conveyed via a nip thereof. A reinforce roller reinforces the fold of the folded sheet stack in cooperation with a guide plate. A drive mechanism causes the reinforce roller to move in a direction perpendicular to a direction of sheet conveyance. A shock absorbing member is located at a position where the reinforce roller and guide plate contact each other.

172 Claims, 115 Drawing Sheets

SORT-STACK MODE

SHEET FINISHER AND IMAGE FORMING SYSTEM USING THE SAME

BACKGROUND OF THE INVENTION

1. Field of the Invention

The present invention relates to a sheet finisher mounted on or operatively connected to a copier, printer or similar image forming apparatus for folding, sorting, stacking, stapling, center-stapling and binding, folding or otherwise finishing a sheet or a sheet stack, and an image forming system consisting of the sheet finisher and image forming apparatus.

2. Description of the Background Art

A sheet finisher positioned at the downstream side of an image forming apparatus for stapling or otherwise finishing a sheet stack is well known in the art. To meet the increasing demand for multiple functions, a sheet finisher having a center-stapling capability in addition to the conventional edge-stapling capability has recently been proposed. Further, a sheet finisher with a center-folding capability in addition to the center-stapling capability has been proposed to fold a center-stapled sheet stack at the center for thereby producing a pamphlet.

A sheet finisher with the binding capability mentioned above uses, in many cases, one or more pairs of fold rollers to fold a sheet stack. In this type of sheet finisher, a flat fold plate is caused to contact the stapled position of a sheet stack and push it into the nip of the fold roller pair, thereby folding the sheet stack. When use is made of, e.g., a first and a second fold roller pair, after the first roller pair has folded a sheet stack, the second roller pair presses the resulting fold of the sheet stack for thereby reinforcing it.

A problem with the above configuration, causing a fold roller pair to fold a sheet stack, is that the pressing force of the roller pair cannot be sufficiently transferred to a sheet stack because the entire width of a sheet stack passes the nip of the roller pair in an extremely short period of time. To solve this problem, Japanese Patent Laid-Open Publication Nos. 9-183566 and 9-183567, for example, propose to control the rotation speed of a fold roller pair for thereby enhancing folding quality. However, a pressing time available with a single fold roller pair is limited because the nip width of the roller pair is extremely small. Further, the above proposal reduces productivity. In light of this, Japanese Patent Laid-Open Publication No. 2000-143088 teaches the use of two fold roller pairs, which seems to be advantageous over the use of a single fold roller pair from the folding quality standpoint.

In any case, however, a period of time over which a sheet stack is pressed by the nip of a fold roller pair is short because the axis of each fold roller extends perpendicularly to a direction of sheet conveyance. This, coupled with the fact that the pressure of the fold roller pair, pressing the entire portion of a sheet stack to be folded, is scattered, prevents the sheet stack from being sharply folded.

Usually, a person folds a sheet stack by nipping the portion of the sheet stack to be folded with fingers and can therefore fold it with a relatively weak force. This is presumably because a sheet stack is not folded over the entire width at a time, but is folded part by part, so that a force to act on each part for a unit length increases. Taking this into account, Japanese Patent Laid-Open Publication No. 62-16987 proposes to surely fold a sheet stack by causing a roller to roll on the sheet stack in the direction perpendicular to the direction of sheet conveyance, i.e., parallel to the direction of a fold. More specifically, in a folding device configured to fold a sheet stack by conveying the sheet stack via the nip of a roller pair, a reinforce roller is positioned at the downstream side of the above roller pair and movable substantially perpendicularly to the direction of sheet conveyance for again pressing the fold of the sheet stack folded by the roller pair. The reinforce roller reinforces the fold of a sheet stack by being driven by a ball screw in the direction perpendicular to the direction of sheet conveyance.

In the configuration taught in Laid-Open Publication No. 62-16987 mentioned above, the reinforce roller presses the fold of a sheet stack in the direction perpendicular to the direction of sheet conveyance, so that load concentrates on one portion of the fold. In addition, the reinforce roller rolls on the fold of a sheet stack while exerting pressure on the entire fold of the sheet stack. The reinforce roller can therefore easily make the fold of the sheet stack sharper. However, the reinforce roller scheme taught in the above document has the following problems (1) through (7) when the sheet stack is thick.

(1) When the reinforce roller rolls on the fold of the sheet stack, it is likely that the roller sinks into the sheet stack and therefore moves on the fold without rotating, so that the image surface of a sheet is rubbed and smeared.

(2) The reinforce roller, fully pressed the fold of the sheet stack, comes down from the fold onto a lower guide plate. At this instant, the reinforce roller is apt to produce noise due to an impact.

(3) If a movable support member, supporting the reinforce roller, tilts while the roller is in movement, then the roller itself tilts with the result that the pressing force of the roller expected to act on the fold escapes. This prevents the reinforce roller from neatly reinforcing the fold.

(4) When a belt, which transfers a driving force to the reinforce roller, twists due to the tilt of the reinforce roller, it is likely that the durability of the belt is reduced or the belt slips out.

(5) If a guide member, which guides the movable support member, bends due to the pressing force of the reinforce roller while the roller is in movement, then the pressing force of the roller, acting on the fold, escapes, again preventing the roller from neatly reinforcing the fold.

(6) If a position where the reinforce roller and lower guide plate contact each other is different in level or height from the nip of a folding device located upstream of the roller, then it is likely that the sheet stack is formed with two folds.

(7) If the level at which the reinforce roller and lower guide plate contact each other varies in accordance with the position of the roller being moved, then the fold of the sheet stack is apt to be oblique.

Further, the reinforce roller scheme of Laid-Open Publication No. 62-16987 has the following problems (8) through (10) unsolved.

(8) When the number of sheets stapled together is small, the interval between consecutive sheet stacks is short, making a period of time necessary for the reinforce roller to press each sheet stack unavailable.

(9) When the number of sheets stapled together is large, each sheet stack cannot be sufficiently folded unless the reinforce roller presses the sheet stack a larger number of times or over a longer period of time.

(10) It is difficult to reduce the folding time of the reinforce roller while enhancing the durability of the roller.

When a roller pair is used to reinforce the fold of a sheet stack while conveying it, the roller pair is generally formed of an elastic material because it must exert a conveying force. Therefore, even when the sheet stack is relatively thick, noise to be produced when the trailing edge of the sheet stack leaves the nip of the roller pair is low and unnoticeable. By contrast, the reinforce roller, movable perpendicularly to the direction of sheet conveyance while rolling on the fold of a sheet stack, does not have to exert a conveying force, so that the reinforce roller and lower guide plate both can be formed of a hard material for the reinforcing effect. However, the reinforce roller, formed of a hard material, produces high, noticeable noise when coming down from the sheet stack onto the lower guide plate. The construction of Laid-Open Publication No. 62-16987 indicates that this problem is not addressed to.

On the other hand, if a jam occurs when the reinforce roller is moving in the direction perpendicular to the direction of sheet conveyance, then it is difficult to deal with the jam because of a relation between the direction of the nip and the direction of sheet conveyance. In the case of a roller pair, a person may forcibly pull out the jamming sheet stack or a rotatable knob may be arranged by a relatively simple, low cost method. However, when the reinforce roller stops moving halfway on the sheet stack, forcibly pulling out the sheet stack by hand is apt to damage the machine or the rotatable knob makes the configuration sophisticated.

Technologies relating to the present invention are also disclosed in, e.g., Japanese Patent Laid-Open Publication Nos. 7-2426, 2001-10759, 2001-19269 and 2002-145516.

SUMMARY OF THE INVENTION

It is an object of the present invention to provide a sheet finisher capable of neatly folding a sheet stack with a reinforce roller, and an image forming system including the same.

It is another object of the present invention to provide a sheet finisher capable of preventing a reinforce roller, rolling on the fold of a sheet stack, from rubbing the image surface of a sheet and smearing it, and an image forming system including the same.

It is another object of the present invention to provide a sheet finisher capable of preventing a reinforce roller from producing noise when coming down from the fold of a sheet stack onto a lower guide plate, and an image forming system including the same.

It is another object of the present invention to provide a sheet finisher capable of preventing a belt, which transfers a driving force to a reinforce roller, from twisting, and an image forming apparatus including the same.

It is another object of the present invention to provide a sheet finisher insuring jam processing, protecting a machine from damage and reducing the downtime of the entire system when reinforcing the fold of a sheet stack, and an image forming system including the same.

It is another object of the present invention to provide a sheet finisher capable of efficiently reinforcing the fold of a sheet stack without producing noise or dislocating the sheet stack, and an image forming system including the same.

It is another object of the present invention to provide a sheet finisher capable of sufficiently reinforcing the fold of a sheet stack without reducing productivity even when the interval between consecutive sheets is short, and an image forming system including the same.

It is still another object of the present invention to provide a sheet finisher capable of sufficiently folding a sheet stack without regard to the number of sheets constituting the sheet stack, and an image forming system including the same.

It is yet another object of the present invention to provide a sheet finisher capable of reducing the folding time and enhancing the durability of a reinforce roller, and an image forming system including the same.

It is a further object of the present invention to provide a sheet finisher capable of allowing a jamming sheet stack to be easily, surely removed, and an image forming system including the same.

A sheet finisher of the present invention is included in an image forming system and folds a stack of sheets sequentially transferred from an image forming apparatus thereto. The sheet finisher includes a fold roller pair for holding the stack of sheets being conveyed via a nip thereof. A reinforce roller reinforces the fold of the folded sheet stack in cooperation with a guide plate. A drive mechanism causes the reinforce roller to move in a direction perpendicular to a direction of sheet conveyance. A shock absorbing member is located at a position where the reinforce roller and guide plate contact each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
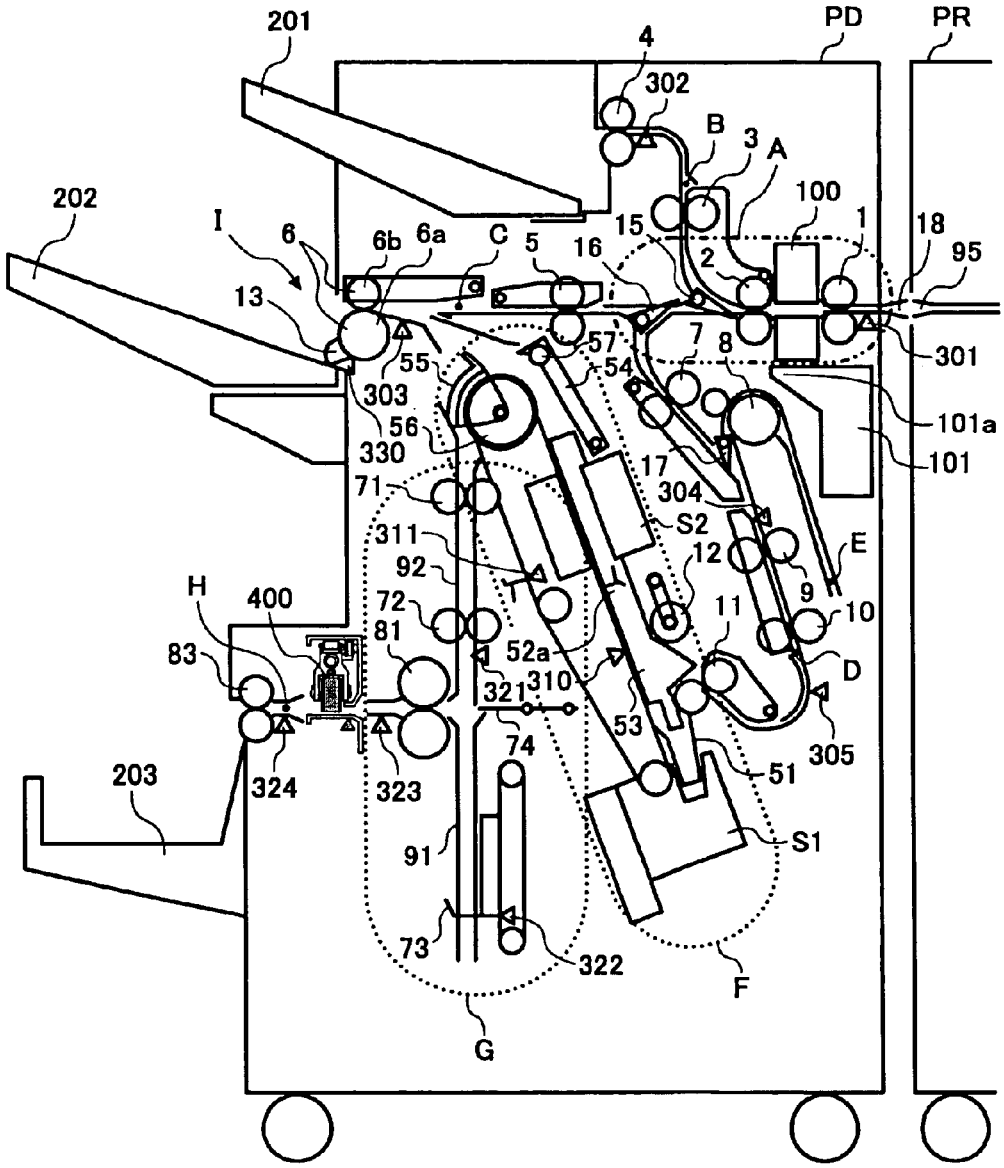
FIG. 1 is a view showing a first embodiment of the image forming system including a sheet finisher and an image forming system in accordance with the present invention.

Preferred embodiments of the sheet finisher and image forming system in accordance with the present invention will be described hereinafter. Identical structural elements are designated by identical reference numerals and will not be repeatedly described in order to avoid redundancy.

First Embodiment

Referring to FIG. 1 of the drawings, an image forming system embodying the present invention is shown and directed mainly toward the first object. As shown, the image forming system is generally made up of an image forming apparatus PR and a sheet finisher PD operatively connected to one side of the image forming apparatus PR. A sheet or recording medium driven out of the image forming apparatus PR via an outlet 95 is introduced in the sheet finisher PD via an inlet 18. In the sheet finisher PD, a path A extends from the inlet 18 and includes finishing means for finishing a single sheet. In the illustrative embodiment, this finishing means is implemented as a punch unit or punching means 100. Path selectors 15 and 16 steer the sheet coming in through the path A to any one of a path B terminating at an upper tray 201, a path C terminating at a shift tray 202, and a processing tray F. The processing tray F is used to position, staple or otherwise process a sheet or sheets and, in this sense, will sometimes be referred to as a staple tray hereinafter.

Sheets sequentially brought to the staple tray F via the paths A and D are positioned one by one, stapled or otherwise processed, and then steered by a guide plate 54 and a movable guide 55 to either one of the path C and another processing tray G. The processing tray G folds or otherwise processes the sheets and, in this sense, will sometimes be referred to as a fold tray hereinafter. The sheets folded by the fold tray G are further strongly folded by a reinforce roller 400 and then guided to a lower tray 203 via a path H. The path D includes a path selector 17 constantly biased to a position shown in FIG. 1 by a light-load spring not shown. An arrangement is made such that after the trailing edge of a sheet has moved away from the path selector 17, among rollers 9 and 10 and a staple outlet roller 11, at least the roller 9 and a refeed roller 8 are rotated in the reverse direction to convey the trailing edge of the sheet to a prestacking portion E and cause the sheet to stay there. In this case, the sheet can be conveyed together with the next sheet superposed thereon. Such an operation may be repeated to convey two or more sheets together.

On the path A merging into the paths B, C and D, there are sequentially arranged an inlet sensor 301 responsive to a sheet coming into the finisher PD, an inlet roller pair 1, the punch unit 100, a waste hopper 101, roller pair 2, and the path selectors 15 and 16. Springs, not shown, constantly bias the path selectors 15 and 16 to the positions shown in FIG. 1. When solenoids, not shown, are energized, the path selectors 15 and 16 rotate upward and downward, respectively, to thereby steer the sheet to desired one of the paths B, C and D.

More specifically, to guide a sheet to the path B, the path selector 15 is held in the position shown in FIG. 1 while the solenoid assigned thereto is deenergized. To guide a sheet to the path C, the solenoids are energized to rotate the path selectors 15 and 16 upward and downward, respectively. Further, to guide a sheet to the path D, the path selector 16 is held in the position shown in FIG. 1 while the solenoid assigned thereto is turned off; at the same time, the solenoid assigned to the path selector 15 is turned on to rotate it upward.

In the illustrative embodiment, the finisher PD is capable of selectively effecting punching (punch unit 100), jogging and edge stapling (jogger fence 53 and edge stapler S1), jogging and center stapling (jogger fence 53 and center stapler S2), sorting (shift tray 202) or folding (fold plate 74 and fold rollers 81 and reinforce roller 400), as desired.

A shift tray outlet section I is located at the most downstream position of the sheet finisher PD and includes a shift outlet roller pair 6, a return roller 13, a sheet surface sensor 330, and the shift tray 202. The shift tray outlet section I additionally includes a shifting mechanism J shown in FIG. 2 and a shift tray elevating mechanism K shown in FIG. 3.

Figure 2:
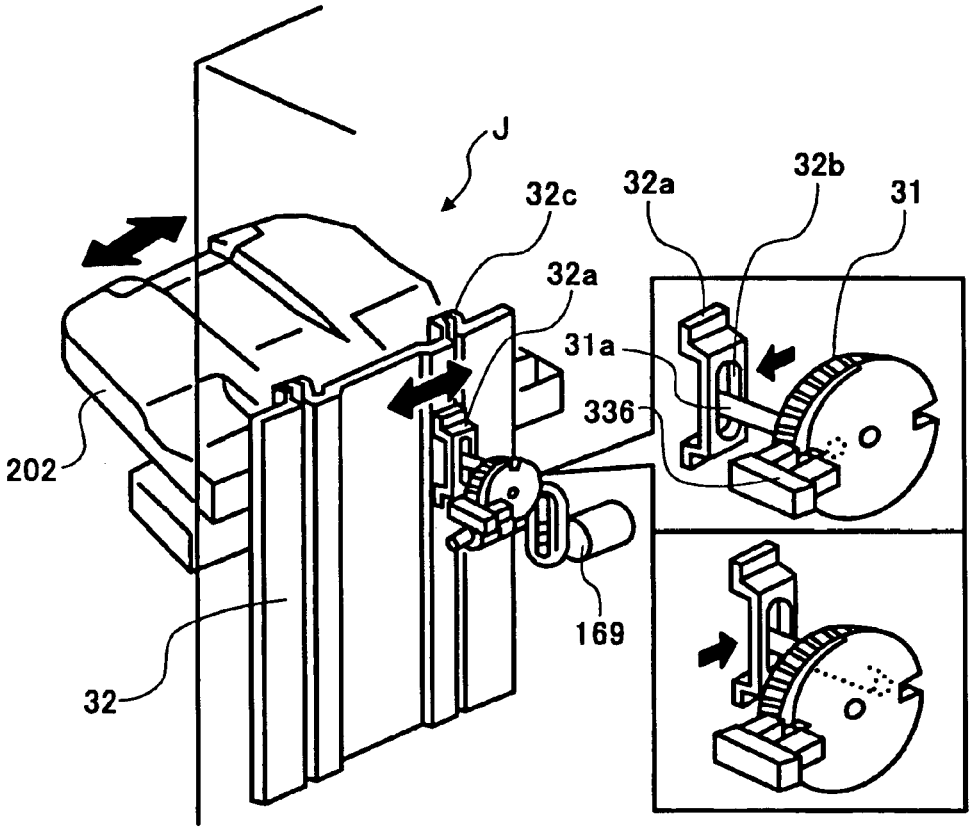
FIG. 2 is a fragmentary, enlarged isometric view showing a shifting mechanism included in the sheet finisher.
Figure 3:
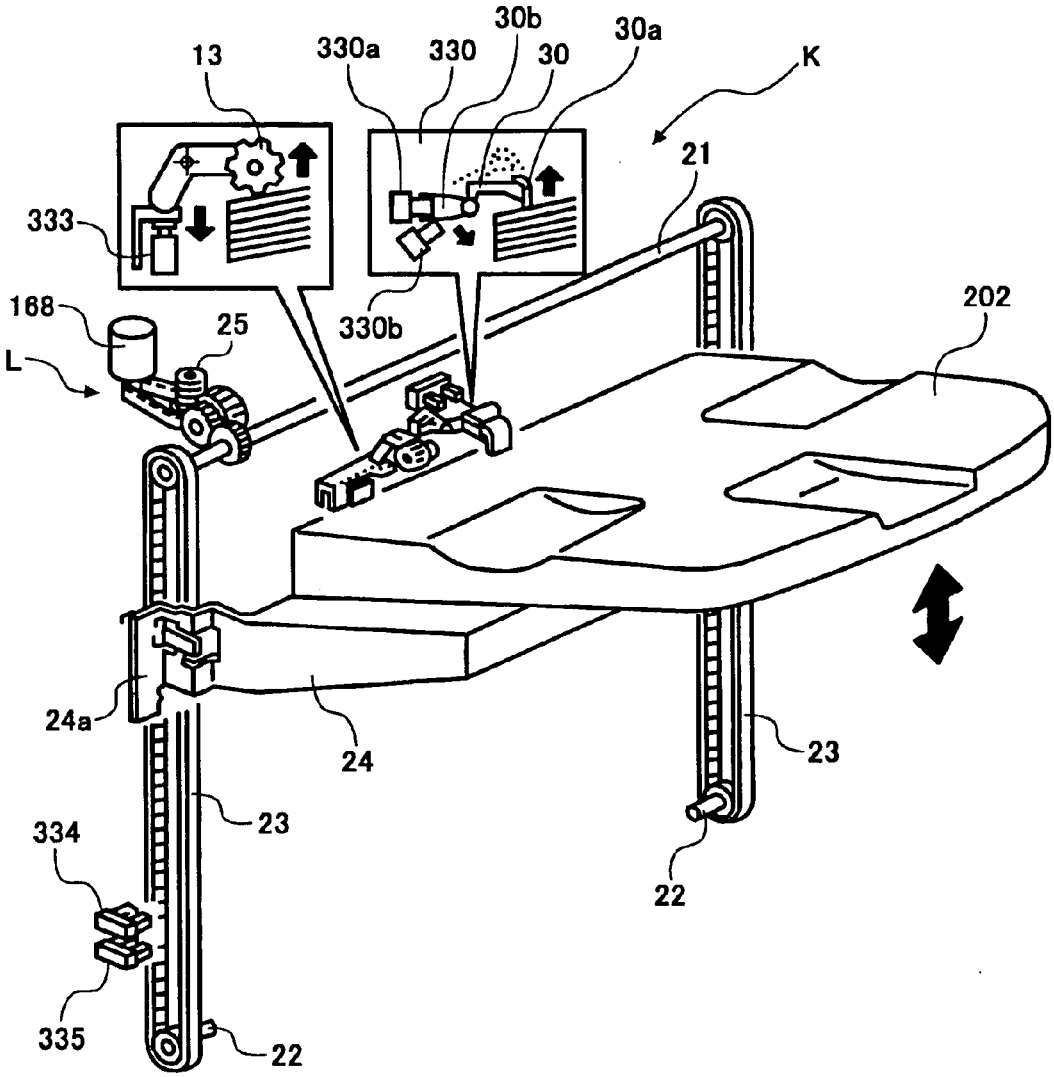
FIG. 3 is a fragmentary, enlarged isometric view showing a shift tray elevating mechanism included in the sheet finisher.

As shown in FIGS. 1 and 3, the return roller 13 contacts a sheet driven out by the shift outlet roller pair 6 and causes the trailing edge of the sheet to abut against an end fence 32 shown in FIG. 2 for thereby positioning it. The return roller 13 is formed of sponge and caused to rotate by the shift outlet roller 6. A limit switch 333 is positioned in the vicinity of the return roller 13 such that when the shift tray 202 is lifted and raises the return roller 13, the limit switch 333 turns on, causing a tray elevation motor 168 to stop rotating. This prevents the shift tray 202 from overrunning. As shown in FIG. 1, the sheet surface sensor 330 senses the surface of a sheet or that of a sheet stack driven out to the shift tray 202.

As shown in FIG. 3 specifically, the sheet surface sensor 330 is made up of a lever 30, a sensor 330*a* relating to stapling, and a sensor 330*b* relating to non-stapling 330*b*. The lever 30 is angularly movable about its shaft portion and made up of a contact end 30*a* contacting the top of the trailing edge of a sheet on the shift tray 202 and a sectorial interrupter 30*b*. The upper sensor 330*a* and lower sensor 330*b* are mainly used for staple discharge control and shift discharge control, respectively.

More specifically, in the illustrative embodiment, the sensors 330*a* and 330*b* each turn on when interrupted by the interrupter 30*b* of the lever 30. Therefore, when the shift tray 202 is lifted with the contact end 30*a* of the lever 30 moving upward, the sensor 330*a* turns off. As the shift tray 202 is further lifted, the sensor 330*b* turns off. When the outputs of the sensors 330*a* and 330*b* indicate that sheets are stacked on the shift tray 202 to a preselected height, the tray elevation motor 168 is driven to lower the shift tray 202 by a preselected amount. The top of the sheet stack on the shift tray 202 is therefore maintained at a substantially constant height.

The shift tray elevating mechanism K will be described in detail with reference to FIG. 3. As shown, the mechanism K includes a drive unit L for moving the shift tray 202 upward or downward via a drive shaft 21. Timing belts 23 are passed over the drive shaft 22 and a driven shaft 22 under tension via timing pulleys. A side plate 24 supports the shift tray 202 and is affixed to the timing belts 23. In this configuration, the entire unit including the shift tray 202 is supported by the timing belts 23 in such a manner as to be movable up and down.

The drive unit L includes a worm gear 25 in addition to the tray elevation motor 168, which is a reversible drive source. Torque output from the tray elevation motor 168 is transmitted to the last gear of a gear train mounted on the drive shaft 21 to thereby move the shift tray 202 upward or downward. The worm gear 25 included in the driveline allows the shift tray 202 to be held at a preselected position and therefore prevents it from dropping by accident.

An interrupter 24*a* is formed integrally with the side plate 24 of the shift tray 202. A full sensor 334 responsive to the full condition of the shift tray 202 and a lower limit sensor 335 responsive to the lower limit position of the shift tray 202 are positioned below the interrupter 24*a*. The full sensor 334 and lower limit sensor 335, which are implemented by photosensors, each turn off when interrupted by the interrupter 24*a*. In FIG. 3, the shift outlet roller 6 is not shown.

As shown in FIG. 2, the shifting mechanism J includes a shift motor 169 and a cam 31. When the shift motor or drive source 169 causes the cam 31 to rotate, the cam 31 causes the shift tray 202 to move back and forth in a direction perpendicular to a direction of sheet discharge. A pin 31*a* is studded on the shift cam 31 at a position spaced from the axis of the shift cam 31 by a preselected distance. The tip of the pin 31*a* is movably received in an elongate slot 32*b* formed in an engaging member 32*a*, which is affixed to the back of the end fence 32 not facing the shift tray 202. The engaging member 32*a* moves back and forth in a direction perpendicular to the direction of sheet discharge in accordance with the angular position of the pin 31*a*, entraining the shift tray 202 in the same direction. The shift tray 202 stops at a front position and a rear position in the direction perpendicular to the sheet surface of FIG. 1 (corresponding to the positions of the shift cam 31 shown in FIG. 2). A shift sensor 336 is responsive to a notch formed in the shift cam 31. To stop the shift tray at the above two positions, the shift motor 169 is selectively energized or deenergized on the basis of the output of the shift sensor 336.

Guide channels 32*c* are formed in the front surface of the end fence 32. The rear edge portions of the shift tray 202 are movably received in the guide channels 32*c*. The shift tray 202 is therefore movable up and down and movable back and forth in the direction perpendicular to the direction of sheet discharged, as needed. The end fence 32 guides the trailing edges of sheets stacked on the shift tray 202 for thereby aligning them.

Figure 4:
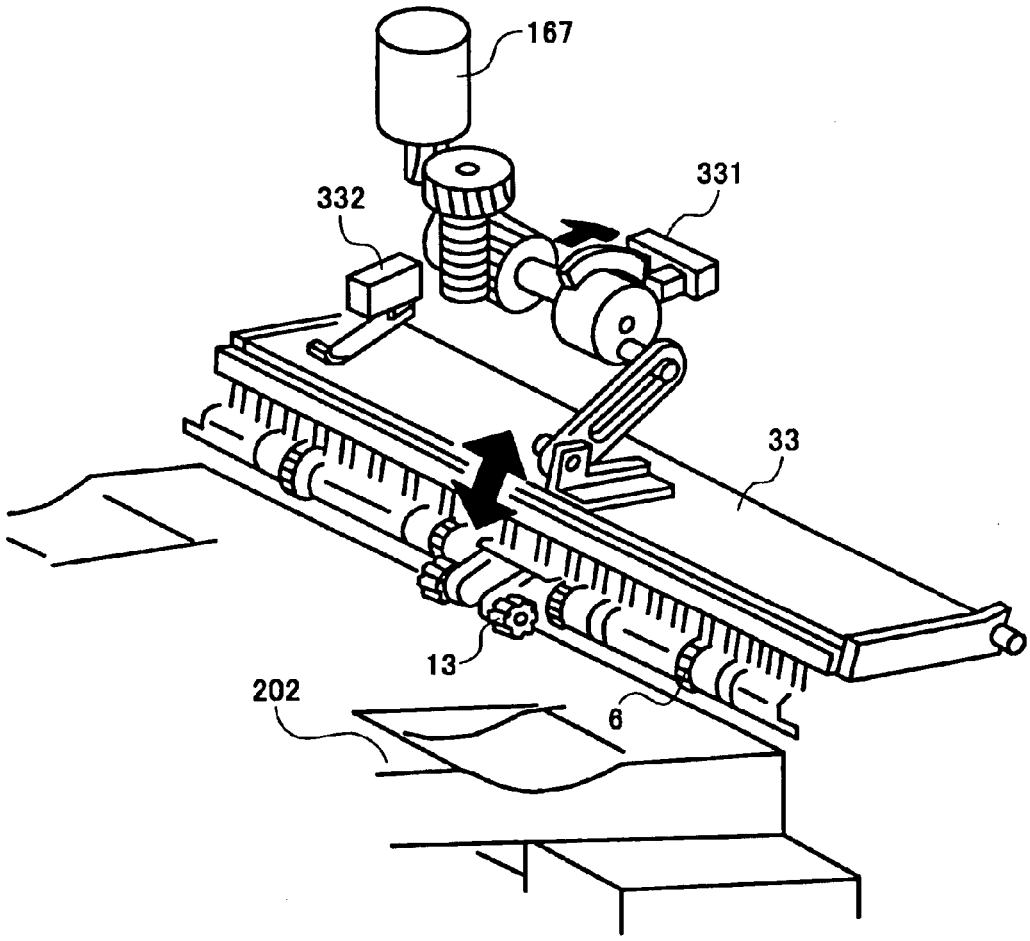
FIG. 4 is an isometric view showing part of the sheet finisher configured to discharge sheets to the shift tray.

FIG. 4 shows a specific configuration of the arrangement for discharging a sheet to the shift tray 202. As shown in FIGS. 1 and 4, the shift roller pair 6 has a drive roller 6*a* and a driven roller 6*b*. A guide plate 33 is supported at its upstream side in the direction of sheet discharge and angularly movable in the up-and-down direction. The driven roller 6*b* is supported by the guide plate 33 and contacts the drive roller 6*a* due to its own weight or by being biased, nipping a sheet between it and the drive roller 6*a*. When a stapled sheet stack is to be driven out to the shift tray 202, the guide plate 33 is lifted and then lowered at a preselected timing, which is determined on the basis of the output of a guide plate sensor 331. A guide plate motor 167 drives the guide plate 33 in such a manner in accordance with the ON/OFF state of a limit switch 332.

Figure 5:
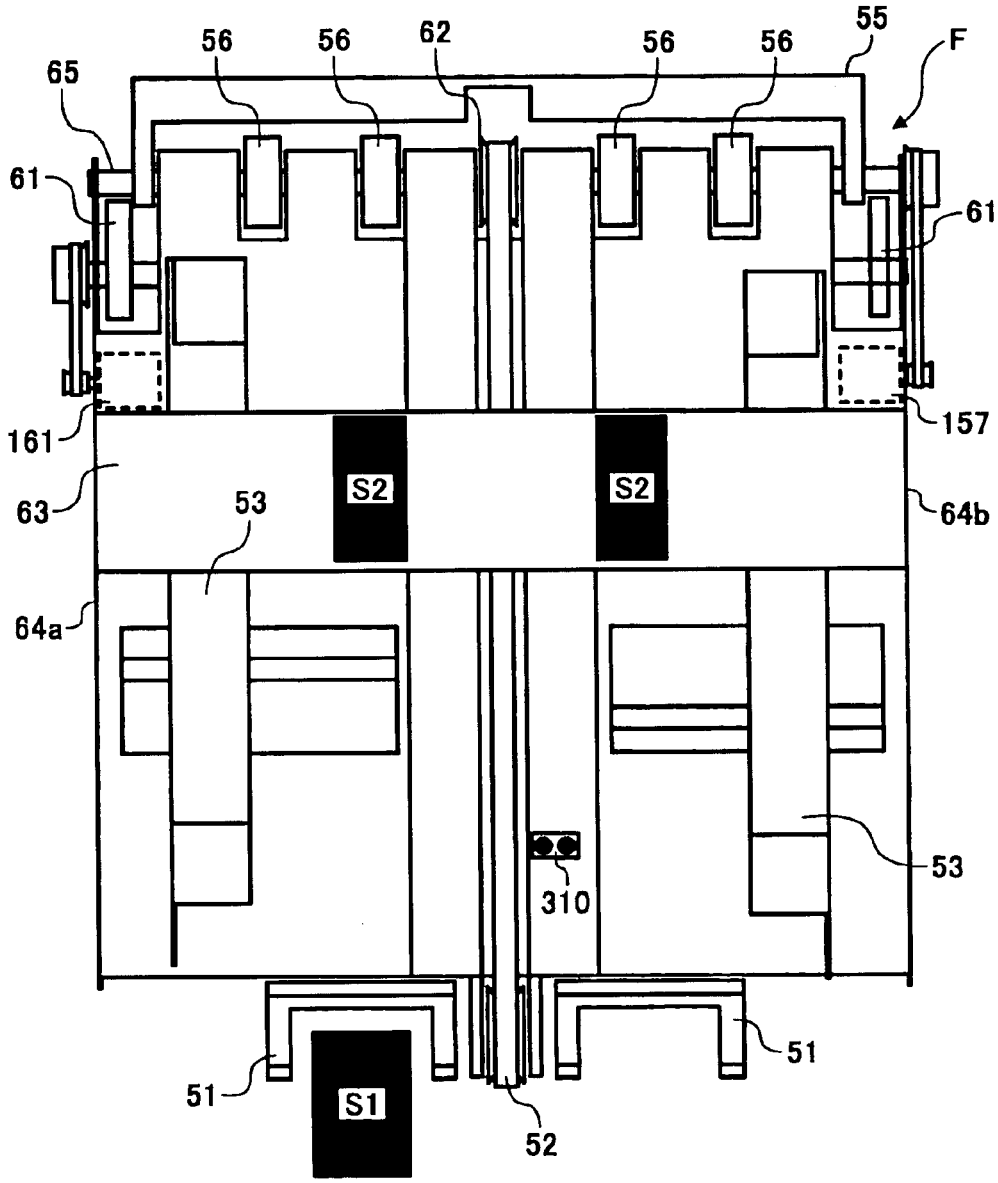
FIG. 5 is a plan view showing a staple tray included in the finisher, as seen in a direction perpendicular to a sheet conveying surface.
Figure 6:
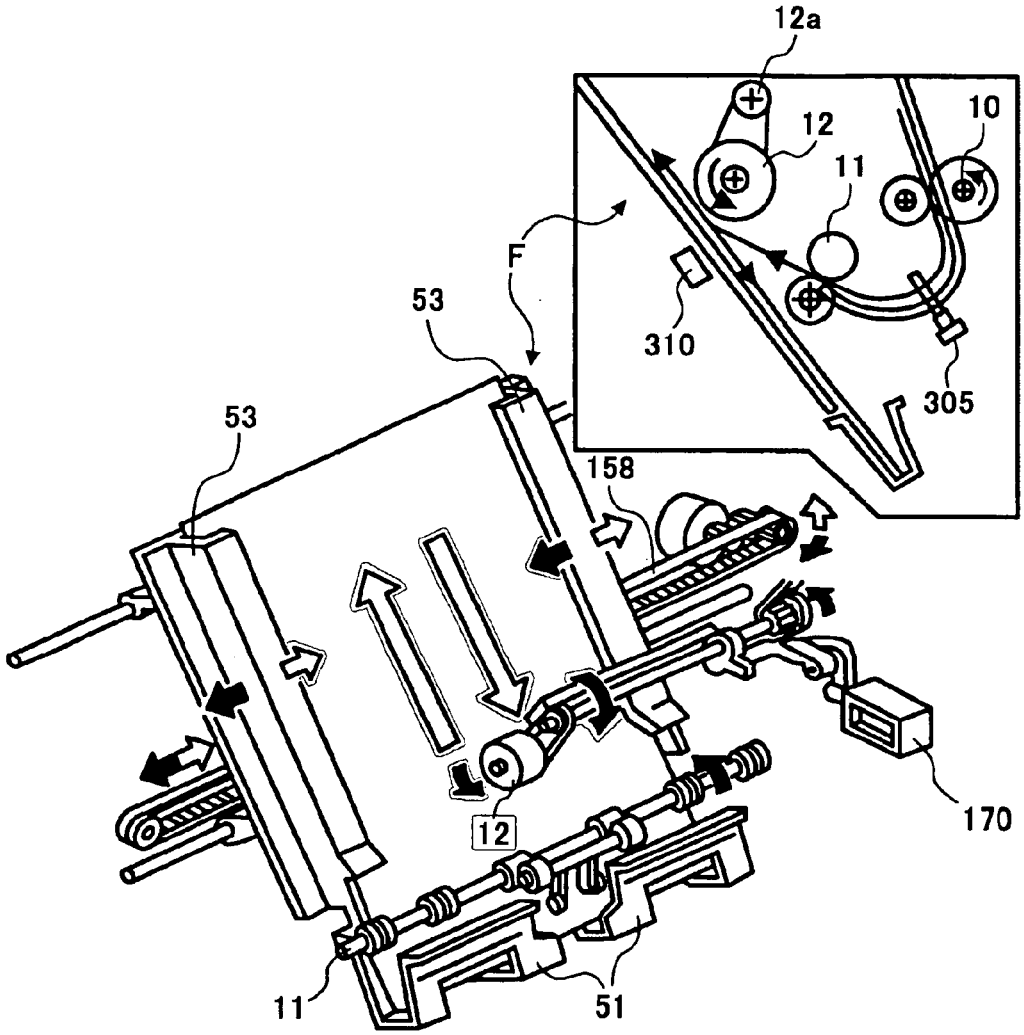
FIG. 6 is an isometric view showing the staple tray and a mechanism for driving it.
Figure 7:
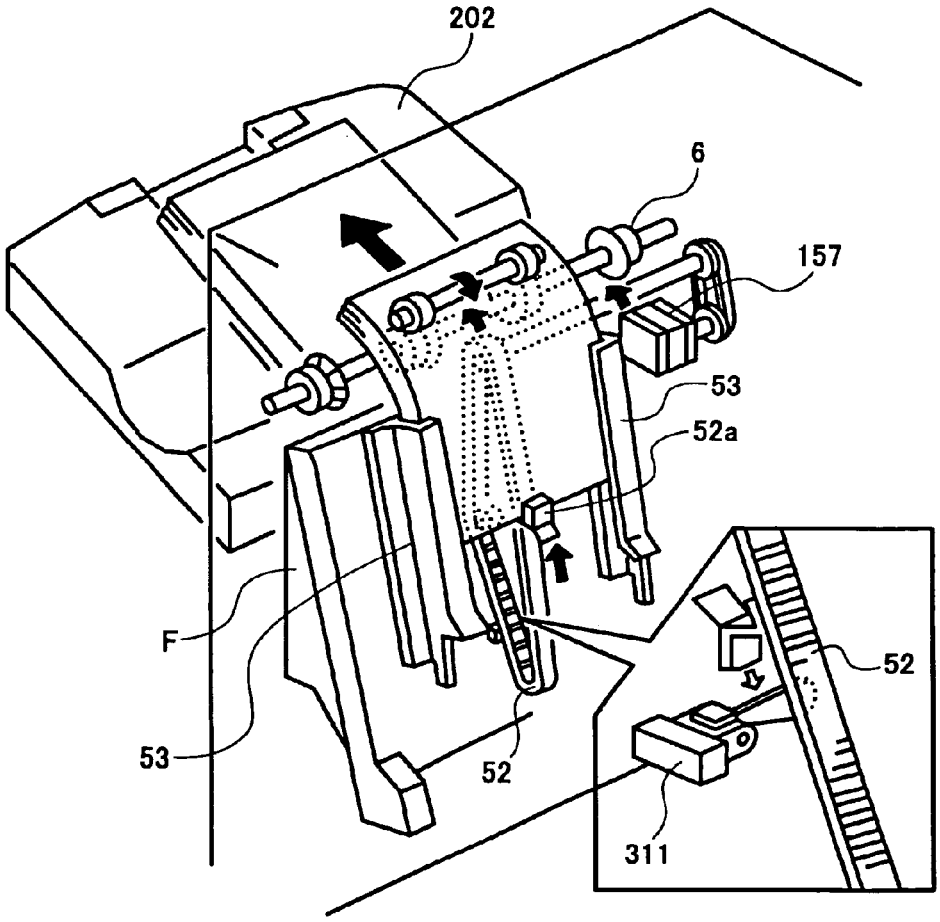
FIG. 7 is an isometric view showing a mechanism included in the sheet finisher for discharging a sheet stack.

FIG. 5 shows the staple tray F as seen in a direction perpendicular to the sheet conveyance plane. FIG. 6 shows a drive mechanism assigned to the staple tray F while FIG. 7 shows a sheet stack discharging mechanism. As shown in FIG. 6, sheets sequentially conveyed by the staple outlet roller pair 11 to the staple tray F are sequentially stacked on the staple tray F. At this instant, a knock roller 12 knocks every sheet for positioning it in the vertical direction (direction of sheet conveyance) while jogger fences 53 position the sheet in the horizontal direction perpendicular to the sheet conveyance (sometimes referred to as a direction of sheet width). Between consecutive jobs, i.e., during an interval between the last sheet of a sheet stack and the first sheet of the next sheet stack, a controller 350 (see FIG. 26) outputs a staple signal for causing an edge stapler S1 to perform a stapling operation. A discharge belt 52 with a hook 52*a* immediately conveys the stapled sheet stack to the shift outlet roller pair 6, so that the shift outlet roller pair 6 conveys the sheet stack to the shift tray 202 held at a receiving position.

Figure 37:
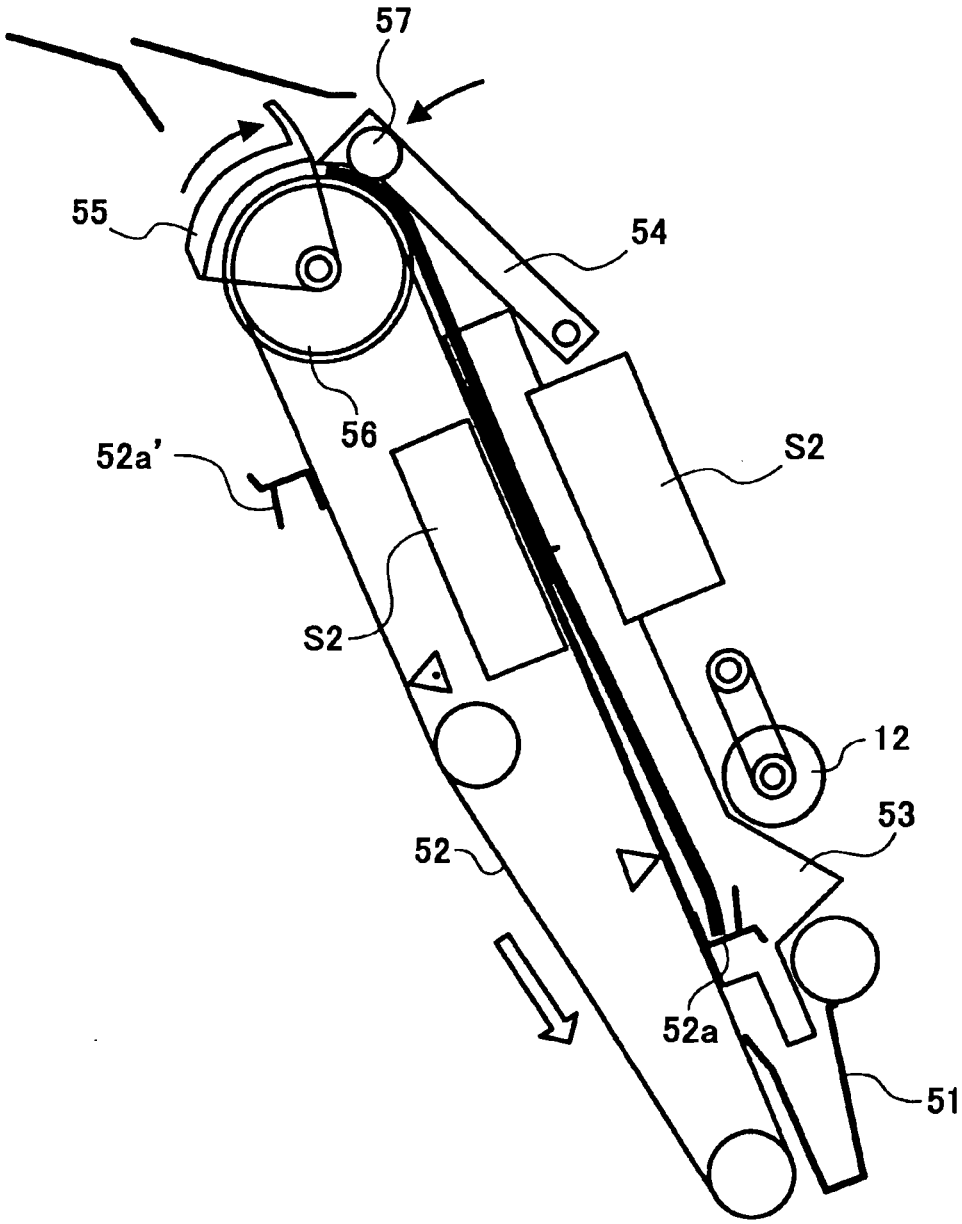
FIG. 37 shows the initial condition wherein the sheet stack steering mechanism steers a sheet stack stapled at the center on the staple tray in the center staple and fold mode.

As shown in FIG. 7, a belt HP (Home Position) sensor 311 senses the hook 52*a* of the discharge belt 52 brought to its home position. More specifically, as shown in FIG. 37, two hooks 52*a* and 52*a*' are positioned on the discharge belt 52 face-to-face at spaced locations in the circumferential direction and alternately convey sheet stacks stapled on the staple tray F one after another. The discharge belt 52 may be moved in the reverse direction such that one hook 52*a* held in a stand-by position and the back of the other hook 52*a*' position the leading edge of the sheet stack stored in the staple tray F in the direction of sheet conveyance, as needed. The hook 52*a* therefore plays the role of positioning means at the same time.

As shown in FIG. 5, a discharge motor 157 causes the discharge belt 52 to move via a discharge shaft 65. The discharge belt 52 and a drive pulley 62 therefor are positioned at the center of the discharge shaft 65 in the direction of sheet width. Discharge rollers 56 are mounted on the discharge shaft 65 in a symmetrical arrangement. The discharge rollers 56 rotate at a higher peripheral speed than the discharge belt 52.

A processing mechanism will be described hereinafter. As shown in FIG. 6, a solenoid 170 causes the knock roller 12 to move about a fulcrum 12*a* in a pendulum fashion, so that the knock roller 12 intermittently acts on sheets sequentially driven to the staple tray F and causes their trailing edges to abut against rear fences 51. The knock roller 12 rotates counterclockwise about its axis. A jogger motor 158 drives the jogger fences 53 via a timing belt and causes them to move back and forth in the direction of sheet width.

Figure 8:
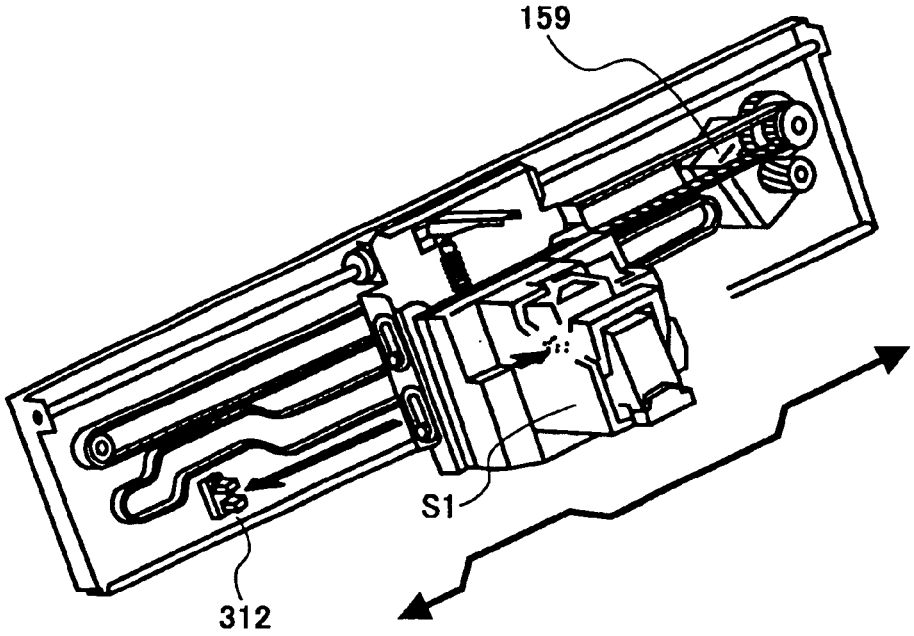
FIG. 8 is an isometric view showing an edge stapler included in the sheet finisher together with a mechanism for moving it.

As shown in FIG. 8, a mechanism for moving the edge stapler S1 includes a reversible, stapler motor 159 for driving the edge stapler S via a timing belt. The edge stapler S is movable in the direction of sheet width in order to staple a sheet stack at a desired edge position. A stapler HP sensor 312 is positioned at one end of the movable range of the edge stapler S1 in order to sense the stapler S brought to its home position. The stapling position in the direction of sheet width is controlled in terms of the displacement of the edge stapler S1 from the home position.

Figure 9:
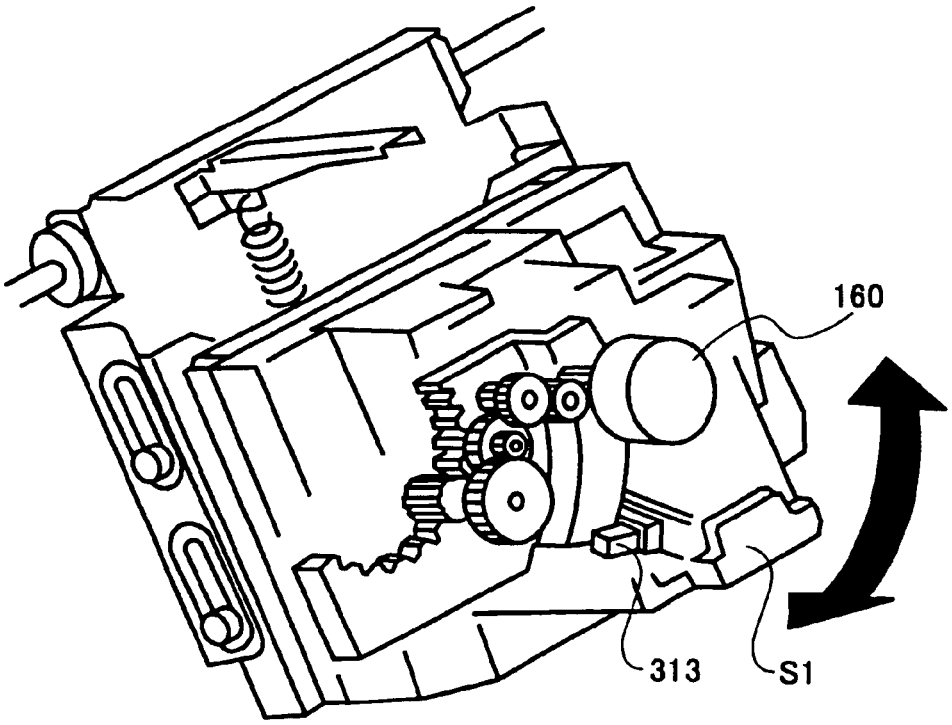
FIG. 9 is an isometric view showing a mechanism for rotating the edge stapler.

As shown in FIG. 9, the edge stapler S1 is capable of selectively driving a staple into a sheet stack in parallel to or obliquely relative to the edge of the sheet stack. Further, at the home position, only the stapling mechanism portion of the edge stapler S1 is rotatable by a preselected angle for the replacement of staples. For this purpose, an oblique motor 160 causes the above mechanism of the edge stapler S1 to rotate until a sensor 313 senses the mechanism reached a preselected replacement position. After oblique stapling or the replacement of staples, the oblique motor 160 causes the stapling mechanism portion to return to its original angular position.

As shown in FIGS. 1 and 5, a pair of center staplers S2 are affixed to a stay 63 and are located at a position where the distance between the rear fences 51 and their stapling positions is equal to or greater than one-half of the length of the maximum sheet size, as measured in the direction of conveyance, that can be stapled. The center staplers S2 are symmetrical to each other with respect to the center in the direction of sheet width. The center staplers S2 themselves are conventional and will not be described specifically. Briefly, after a sheet stack has been fully positioned by the jogger fences 53, rear fences 51 and knock roller 5, the discharge belt 52 lifts the trailing edge of the sheet stack with its hook 52 to a position where the center of the sheet stack in the direction of sheet conveyance coincides with the stapling positions of the center staplers S2. The center staplers S2 are then driven to staple the sheet stack. The stapled sheet stack is conveyed to the fold tray G and folded at the center, as will be described in detail later.

There are also shown in FIG. 5 a front side wall 64*a*, a rear side wall 64*b*, and a sensor responsive to the presence/absence of a sheet stack on the staple tray F.

Figure 15:
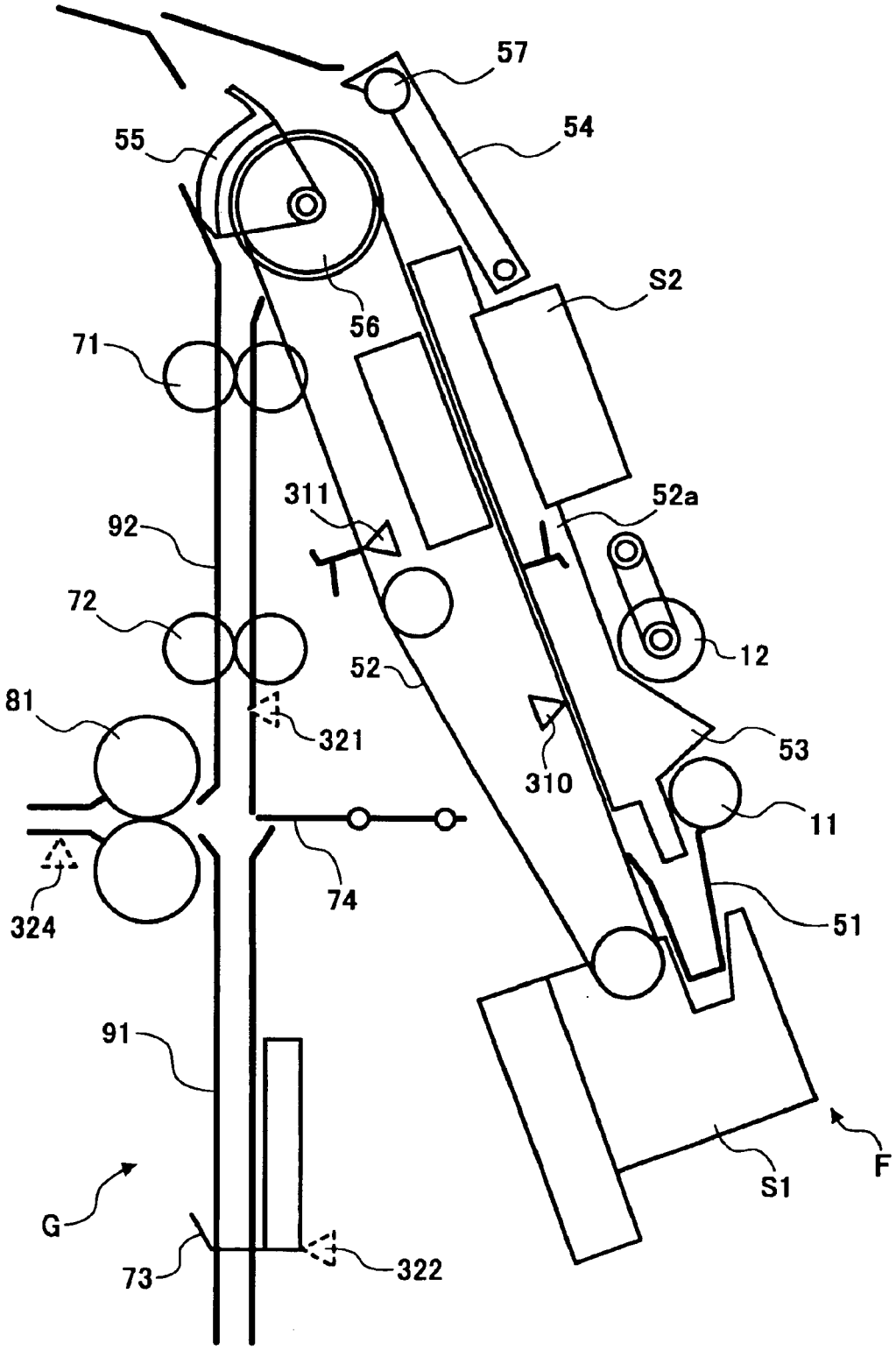
FIG. 15 shows the staple tray and fold tray in detail.

Reference will be made to FIG. 15 as well as to FIG. 1 for describing a mechanism for steering a sheet stack. To allow the sheet stack stapled by the center staplers S2 to be folded at the center on the fold tray G, sheet stack steering means is located at the most downstream side of the staple tray F in the direction of sheet conveyance in order to steer the stapled sheet stack toward the fold tray G.

Figure 10:
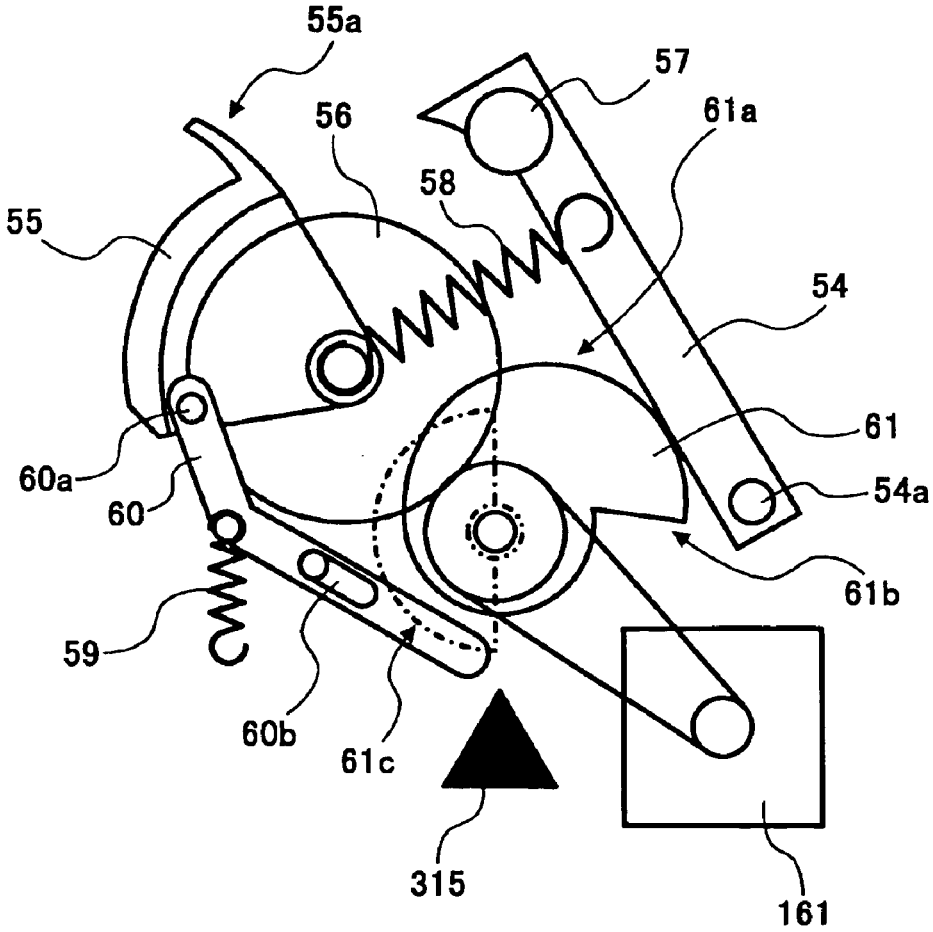
FIGS. 10 through 12 are views demonstrating the consecutive operating conditions of a sheet stack steering mechanism included in the sheet finisher.
Figure 11:
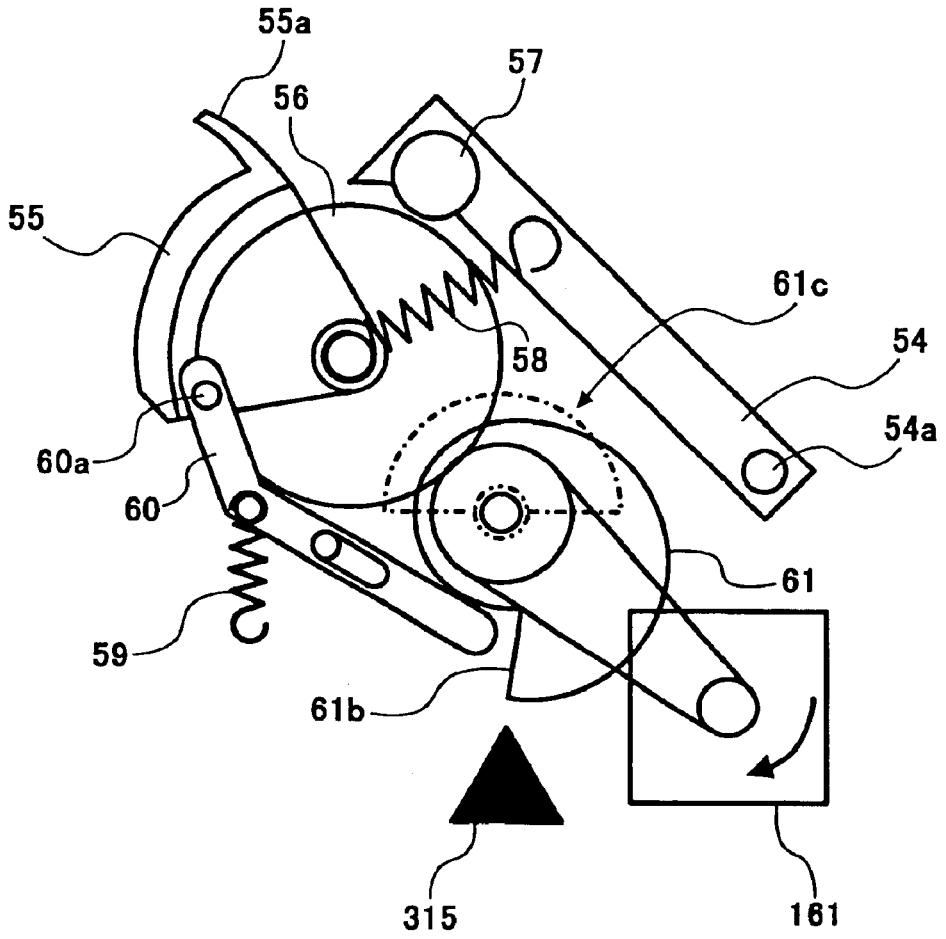
Figure 12:
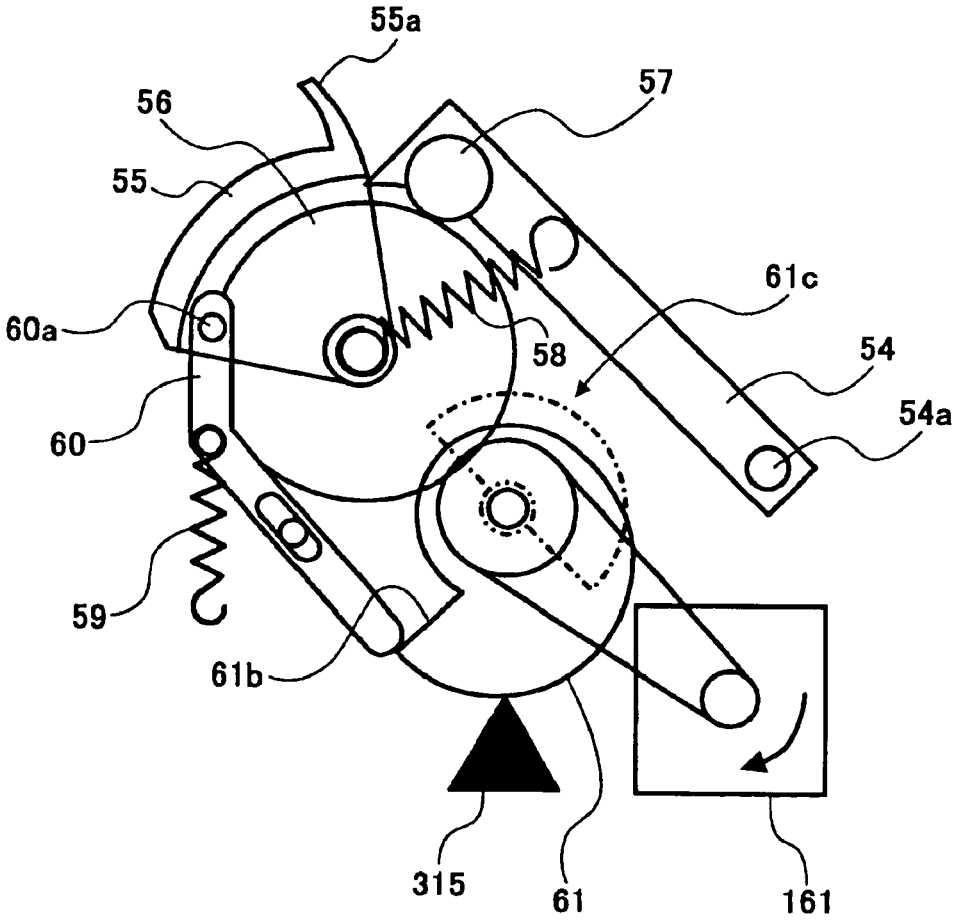

As shown in FIG. 15, the steering mechanism includes the guide plate 54 and movable guide 55 mentioned earlier. As shown in FIGS. 10 through 12, the guide plate 54 is angularly movable about a fulcrum 54*a* in the up-and-down direction and supports the press roller 57, which is freely rotatable, on its downstream end. A spring 58 constantly biases the guide plate 54 toward the discharge roller 56. The guide plate 54 is held in contact with the cam surface 61*a* of a cam 61, which is driven by a steer motor 161.

The movable guide 55 is angularly movably mounted on the shaft of the discharge roller 56. A link arm 60 is connected to one end of the movable guide 55 remote from the guide plate 54 at a joint 60*a*. A pin studded on the front side wall 64*a*, FIG. 5, is movably received in an elongate slot 60*b* formed in the link arm 60, limiting the movable range of the movable guide 55. A spring 59 holds the link arm 60 in the position shown in FIG. 10. When the steer motor 161 causes the cam 61 to rotate to a position where its cam surface 61*b* presses the link arm 60, the movable guide 55 connected to the link arm 60 angularly moves upward along the surface of the discharge roller 56. A guide HP sensor 315 senses the home position of the cam 61 on sensing the interrupter portion 61*c* of the cam 61. Therefore, the stop position of the cam 61 is controlled on the basis of the number of drive pulses input to the steer motor 161 counted from the home position of the cam 61, as will be described later in detail.

FIG. 10 shows a positional relation to hold between the guide plate 54 and the movable guide 55 when the cam 61 is held at its home position. As shown, the guide surface 55*a* of the movable guide 55 guides a sheet stack on the path extending to the shift outlet roller 6.

FIG. 11 shows a condition wherein the guide plate 54 is moved about the fulcrum 54*a* counterclockwise (downward) by the cam 61 with the press roller 57 pressing the discharge roller 57.

FIG. 12 shows a condition wherein the cam 61 has further rotated from the above position to move the movable guide 55 clockwise (upward). In this condition, the guide plate 54 and movable guide 55 form the route extending from the staple tray F toward the fold tray G. FIG. 5 shows the same relation as seen in the direction of depth.

While in the illustrative embodiment the guide plate 54 and movable guide 55 share a single drive motor, each of them may be driven by a respective drive motor, so that the timing of movement and stop position can be controlled in accordance with the sheet size and the number of sheets stapled together.

The fold tray G will be described specifically with reference to FIGS. 13 and 14. As shown, the fold tray G includes a fold plate 74 for folding a sheet stack at the center. The fold plate 74 is formed with elongate slots 74*a* each being movably received in one of pins 64*c* studded on each of the front and rear side walls 64*a* and 64*b*. A pin 74*b* studded on the fold plate 74 is movably received in an elongate slot 76*b* formed in a link arm 76. The link arm 76 is angularly movable about a fulcrum 76*a*, causing the fold plate 74 to move in the right-and-left direction as viewed in FIGS. 13 and 14. More specifically, a pin 75*b* studded on a fold plate cam 75 is movably received in an elongate slot 76*c* formed in the link arm 76. In this condition, the link arm 76 angularly moves in accordance with the rotation of the fold plate cam 75, causing the fold plate 74 to move back and forth perpendicularly to a lower guide plate 91 and an upper guide plate 92 (see FIG. 15).

Figure 13:
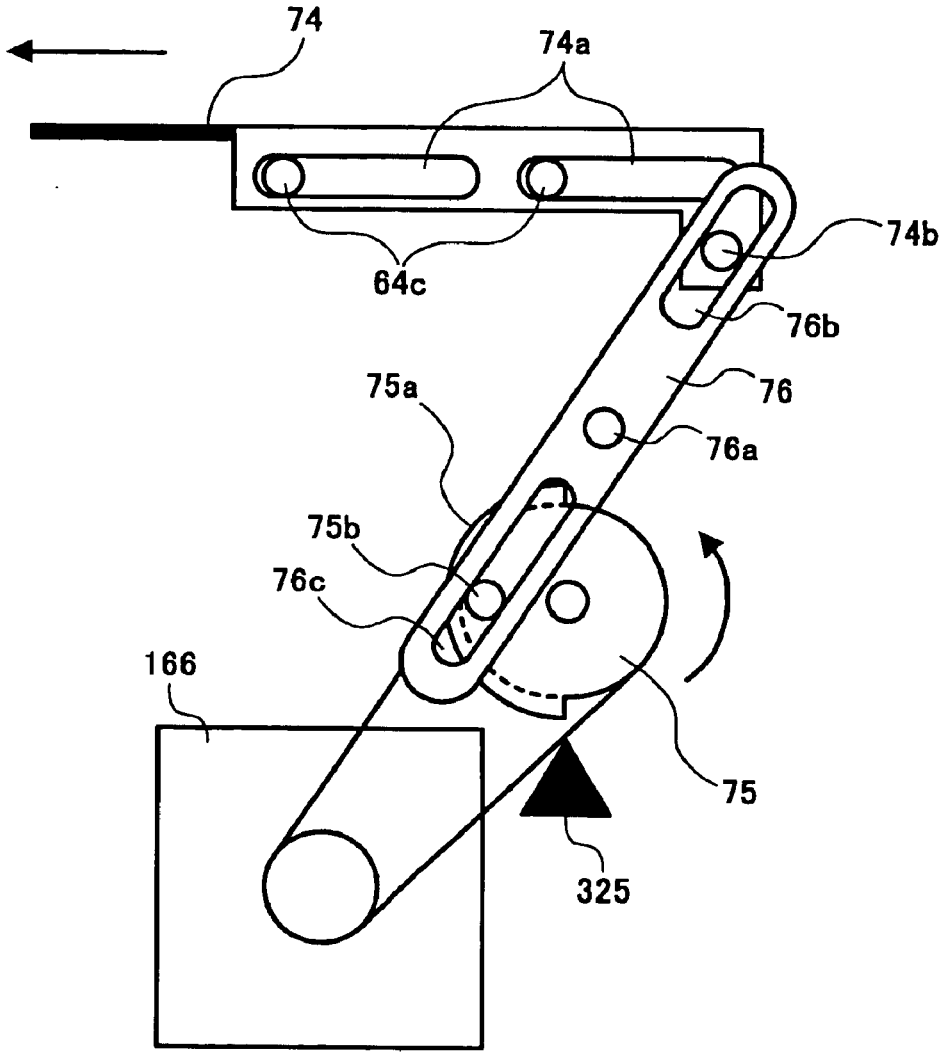
FIGS. 13 and 14 are views demonstrating the consecutive operating conditions of a fold plate included in the sheet finisher.
Figure 14:
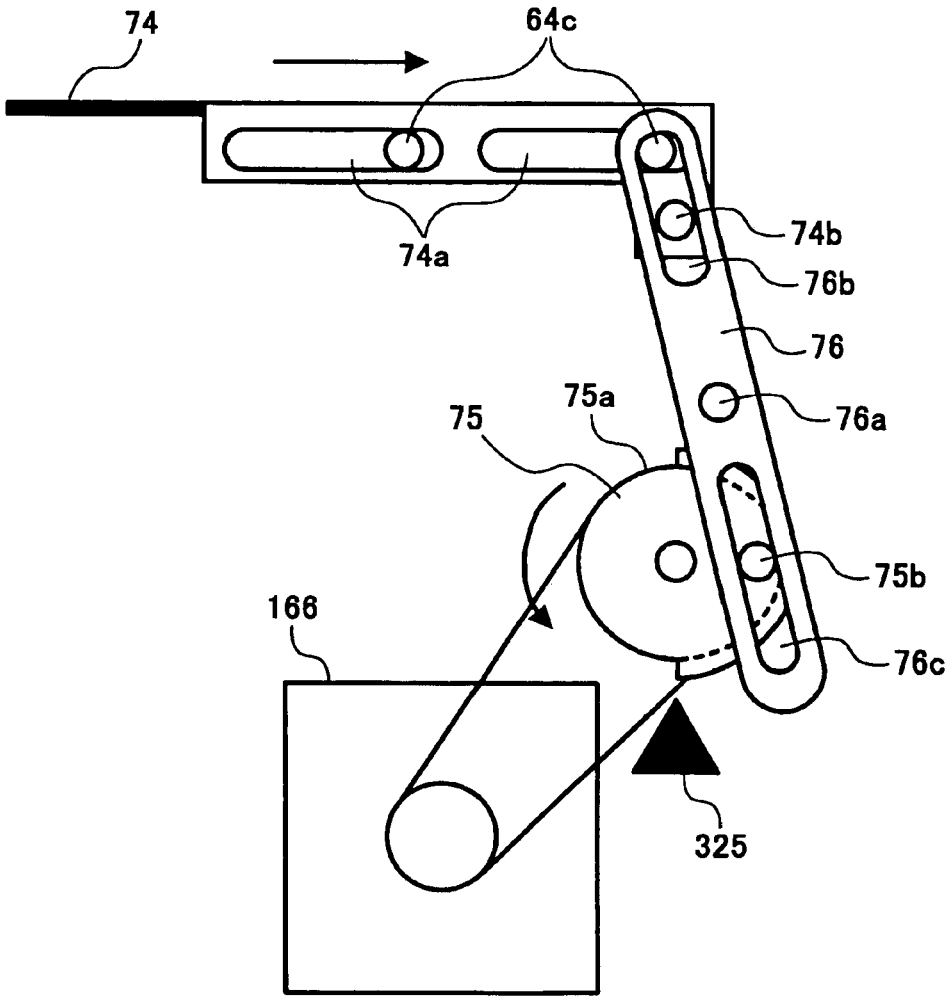

A fold plate motor 166 causes the fold plate cam 75 to rotate in a direction indicated by an arrow in FIG. 13. The stop position of the fold plate cam 75 is determined on the basis of the output of a fold plate HP sensor 325 responsive to the opposite ends of a semicircular interrupter portion 75*a* included in the cam 75.

FIG. 13 shows the fold plate 74 in the home position where the fold plate 74 is fully retracted from the sheet stack storing range of the fold tray G. When the fold plate cam 75 is rotated in the direction indicated by the arrow, the fold plate 74 is moved in the direction indicated by an arrow and enters the sheet stack storing range of the fold tray G. FIG. 14 shows a position where the fold plate 74 pushes the center of a sheet stack on the fold tray G into the nip between a pair of fold rollers 81. When the fold plate cam 75 is rotated in a direction indicated by an arrow in FIG. 14, the fold plate 74 moves in a direction indicated by an arrow out of the sheet stack storing range.

While the illustrative embodiment is assumed to fold a sheet stack at the center, it is capable of folding even a single sheet at the center. In such a case, because a single sheet does not have to be stapled at the center, it is fed to the fold tray G as soon as it is driven out, folded by the fold plate 74 and fold roller pair 81, and then delivered to the lower tray 203, FIG. 1.

The reinforce roller unit 400 will be described in detail hereinafter. As shown in FIG. 1, the reinforce roller unit 400 is positioned on the path H between the fold roller 81 and the outlet roller pair 83 and configured to reinforce the fold of a sheet stack folded by the fold plate 74.

Figure 16:
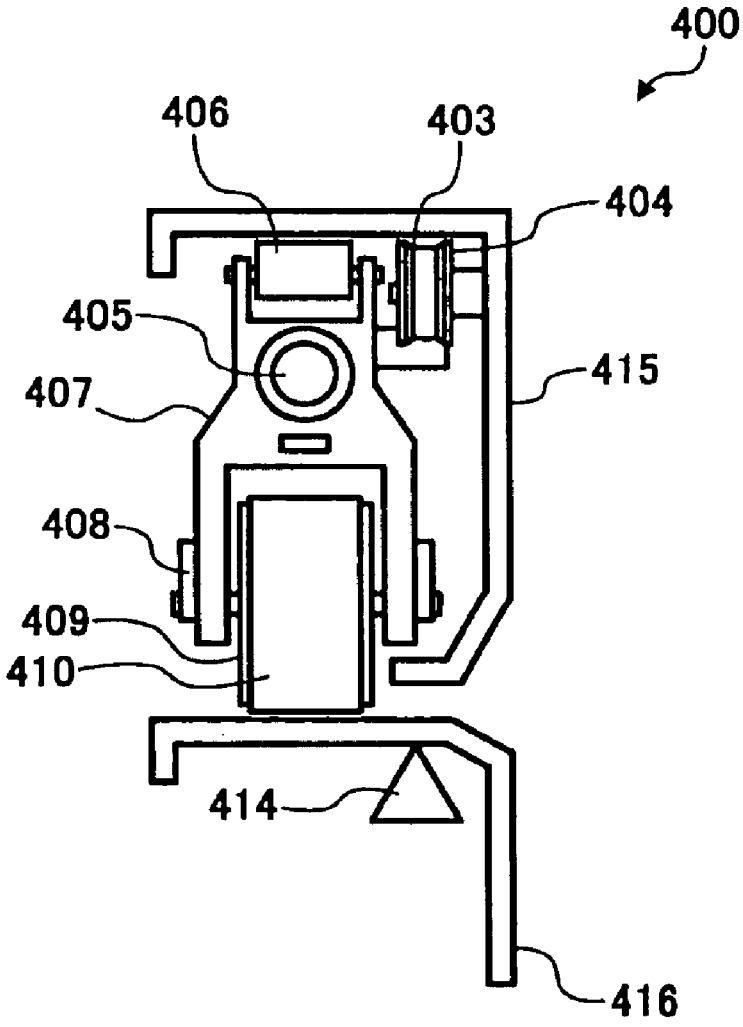
FIG. 16 is a front view showing a reinforce roller unit included in the illustrative embodiment.
Figure 17:
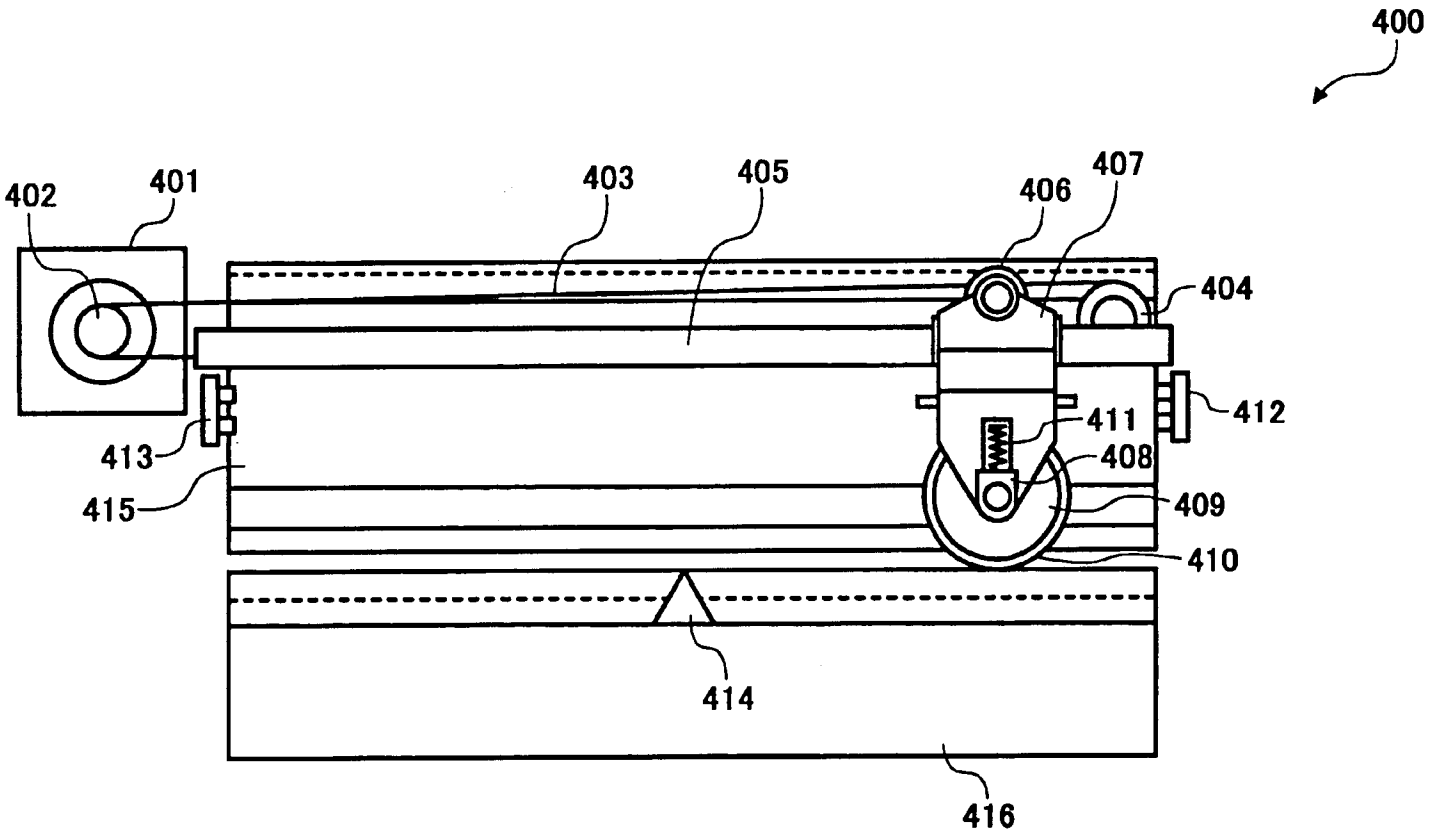
FIG. 17 is a side elevation of the reinforce roller unit.

As shown in FIGS. 16 and 17, the reinforce roller unit 400 is generally made up of a reinforce roller 409, a support mechanism supporting the reinforce roller 409, and a drive mechanism for driving the reinforce roller 409. The drive mechanism includes a drive pulley 402, a driven pulley 404, a timing belt 403 passed over the pulleys 402 and 404, and a pulse motor 401 for causing the timing belt 403 to turn. The support mechanism includes a slider or support member 407 slidable on a guide member 405 in a preselected direction, an upper guide plate 415, and a coil spring or biasing means 411. The upper guide plate 415 extends to a position above the slider 407 and remote from the reinforce roller 409 and prevents the reinforce roller 409 from tilting while preventing the guide member 405 from bending. The coil spring 411 constantly biases the reinforce roller 407 toward the folding direction, i.e., downward as viewed in FIG. 17. The support mechanism extends in the direction perpendicular to the direction of sheet conveyance. The drive mechanism causes the reinforce roller 409 to move in the direction in which the support mechanism extends.

The output torque of the pulse motor 401 is transferred to the slider 407, which is connected to the timing belt 403, via the timing belt 403 passed over the drive pulley 402 and driven pulley 404. The slider 407 therefore slides on the guide member 405 in the direction of thrust while being guided by the guide member 405. A bend-preventing member 406 is positioned between the slider 407 and the upper guide plate 415 and implemented as a roller rotatably supported by the slider 407. The bend-preventing member 406 is therefore movable integrally with the slider 407 in the axial direction of the guide member 405. The reinforce roller 409 is positioned between the slider 407 and a lower guide plate 416. A friction member 410 is fitted on the circumference of the reinforce roller 409.

The reinforce roller 409 is supported by a roller support member 408, which is supported in such a manner as to be movable in the up-and-down direction in sliding contact with the slider 407. The coil spring 111 constantly biases the roller support member 408 downward. In this configuration, the reinforce roller 409, when sliding on the guide member 405 together with the slider 407, is constantly pressed toward the lower guide plate 416 by the coil spring 411 while being movable in the up-and-down direction. Position sensors 412 and 413 are positioned at opposite sides in the direction of thrust of the guide member 405. The position sensor 412 is responsive to the slider 407 brought to a home position while the position sensor 413 is responsive to the slider 407 brought to an end-of-reinforcement position. A sheet stack sensor 414 is located at the inlet of the reinforce roller unit 400 for sensing a sheet stack introduced into the unit 400.

Figure 18:
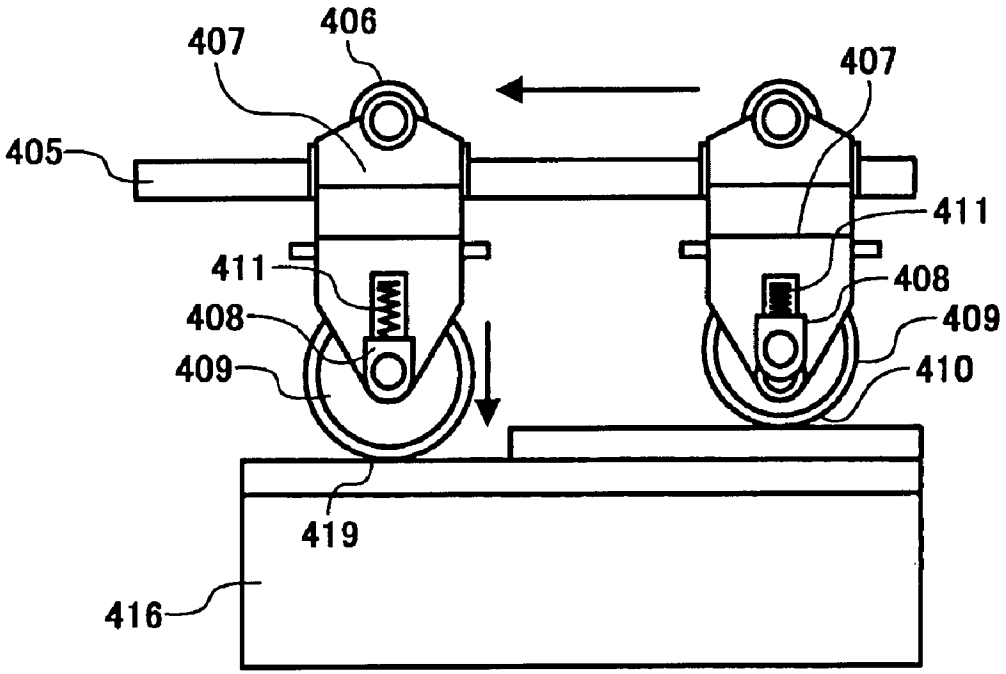
FIG. 18 shows the reinforce roller in a position where it presses a sheet stack and a position where it contacts a lower guide plate.

FIG. 18 shows the reinforce roller 409 in two different positions, i.e., one in which the roller 409 is rolling on the top of a sheet stack and the other in which it is rolling on the lower guide plate 416. As shown, a step is formed between the top of the sheet stack and the lower guide plate 416, depending on the thickness of the sheet stack. As a result, when the reinforce roller 409 comes down from the top of the sheet stack onto the lower guide plate 416, the reinforce roller 409 produces noise on directly contacting the lower guide plate 416.

To obviate noise mentioned above, a flange 419, formed of an elastic material, is mounted on one side of the reinforce roller 409 that does not contact the sheet stack. The flange 419 absorbs an impact when the reinforce roller 409 rolls down from the top of the sheet stack onto the lower guide plate 416, thereby reducing noise.

Figure 20:
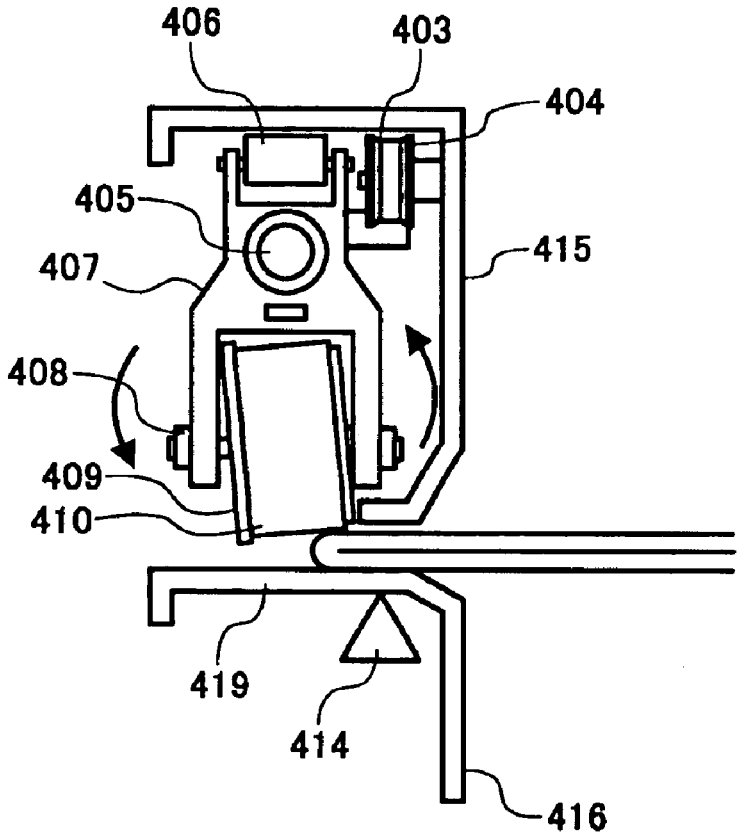
FIG. 20 is a front view showing a condition in which the reinforce roller is tilted.
Figure 21A:
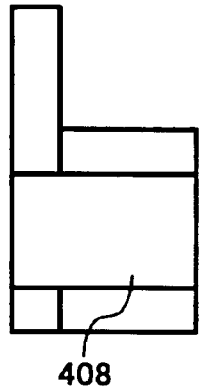
FIGS. 21A through 21C show the configuration of a support member supporting the shaft of the reinforce roller.
Figure 21B:
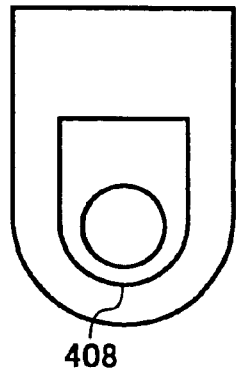
Figure 21C:
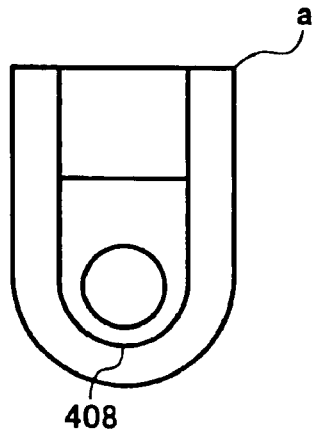
Figure 22:
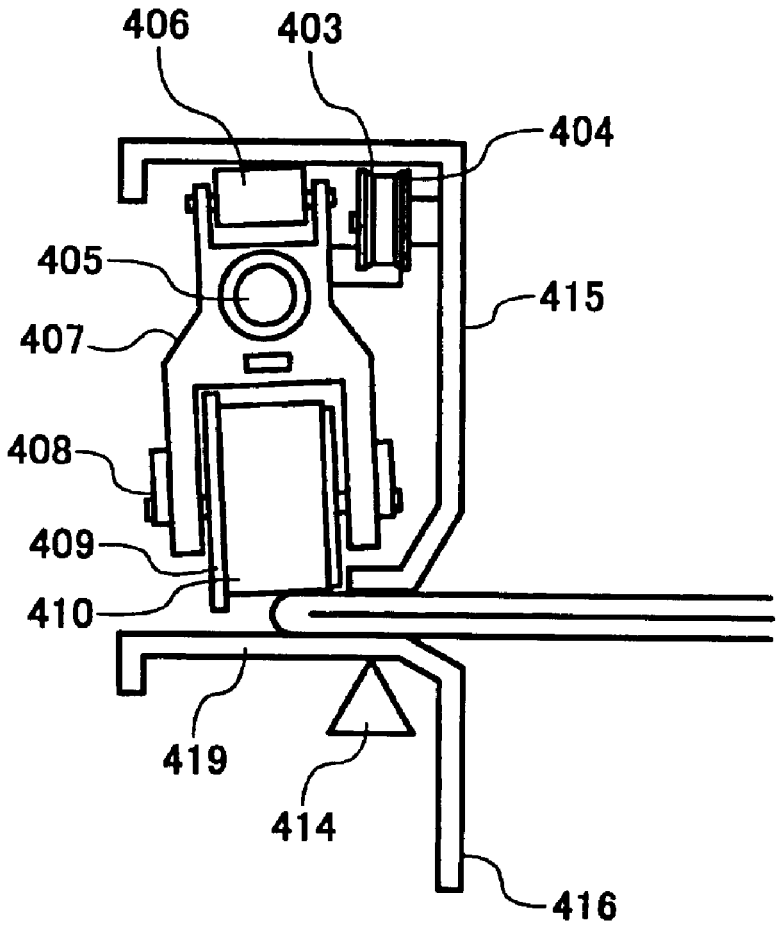
FIG. 22 is a front view of the reinforce roller unit in a condition in which the support member is tilted.

As shown in FIG. 20, when the reinforce roller 409 is pressing the top of the folded portion of a sheet stack, the reinforce roller 409 tends to tilt due to the thickness of the folded portion because the coil spring 411 constantly biases the roller support member 408 toward the lower guide plate 416. The resulting pressure obliquely acting on the folded portion fails to neatly reinforce the fold of the sheet stack. In light of this, as shown in FIG. 21, (c), a flange a is formed and held in contact with the roller support member 408. In this configuration, as shown in FIG. 22, when the reinforce roller 409 and roller support member 408 tend to tilt, they support each other and are therefore prevented from tilting. The reinforce roller 409 can therefore neatly reinforce of the fold of the sheet stack even when the sheet stack is relatively thick.

Figure 23:
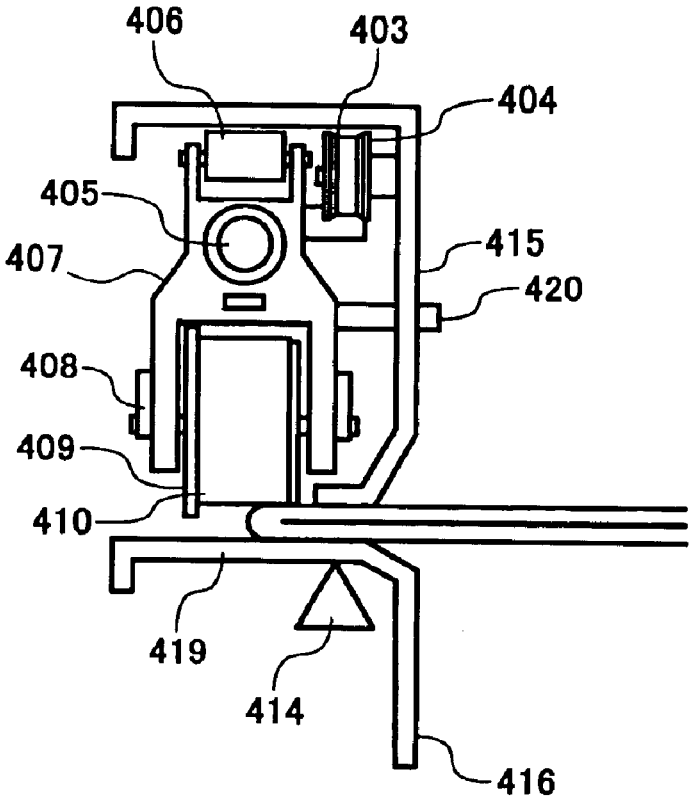
FIG. 23 is a front view of the reinforce roller unit including a member configured to prevent the support member from rotating.
Figure 24:
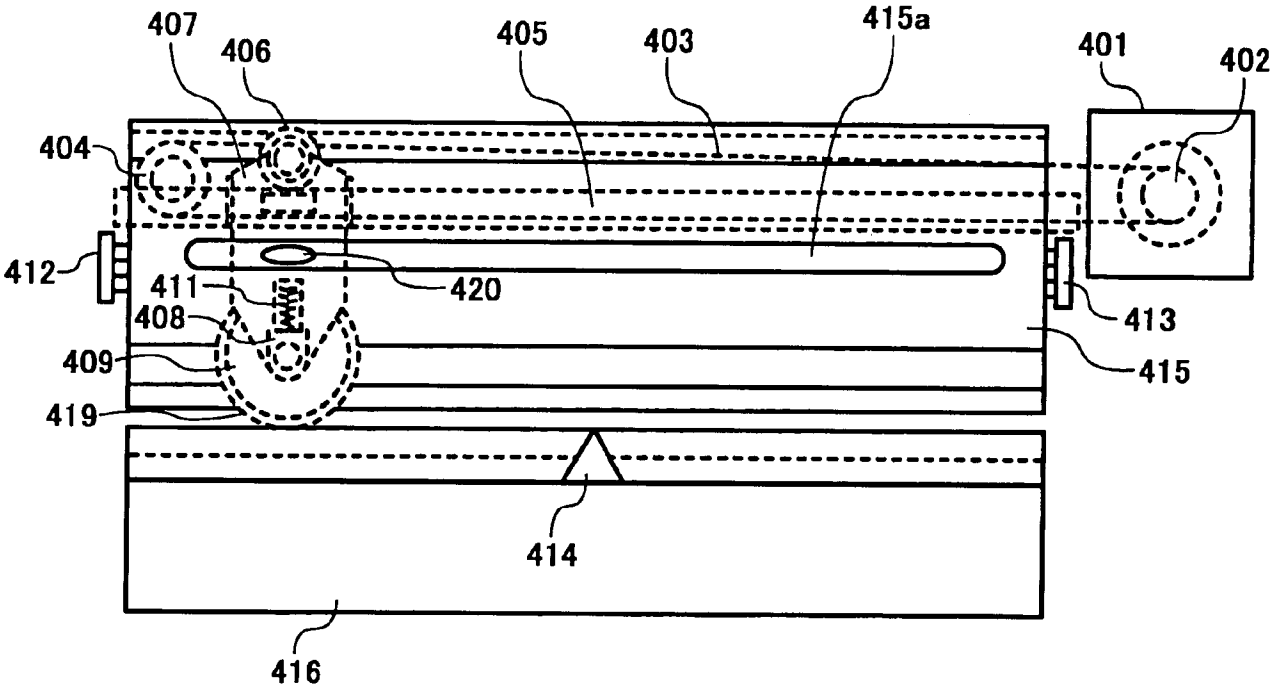
FIG. 24 is a rear view of the reinforce roller unit shown in FIG. 23.

As shown in FIG. 22, the thicker the sheet stack, the more the reinforce roller 409, roller support member 408 and slider 407 tend to tilt. This again causes the pressure to obliquely act on the fold of the sheet stack and thereby prevents the reinforce roller 409 from neatly reinforcing the fold. To solve this problem, as shown in FIG. 23, a lug 420 is provided on the slider 407 and movably received in an elongate slot 415*a* formed in the upper guide plate 415, so that the slider 407 can move along the guide member 405 without rotating about the guide member 405. This successfully prevents the roller support member 408 and reinforce roller 405 from tilting. If desired, the slot 415*a* may be formed in a stationary member separate from the upper guide member 405 so long as the slot 415*a* is parallel to the slider 407.

Figure 25:
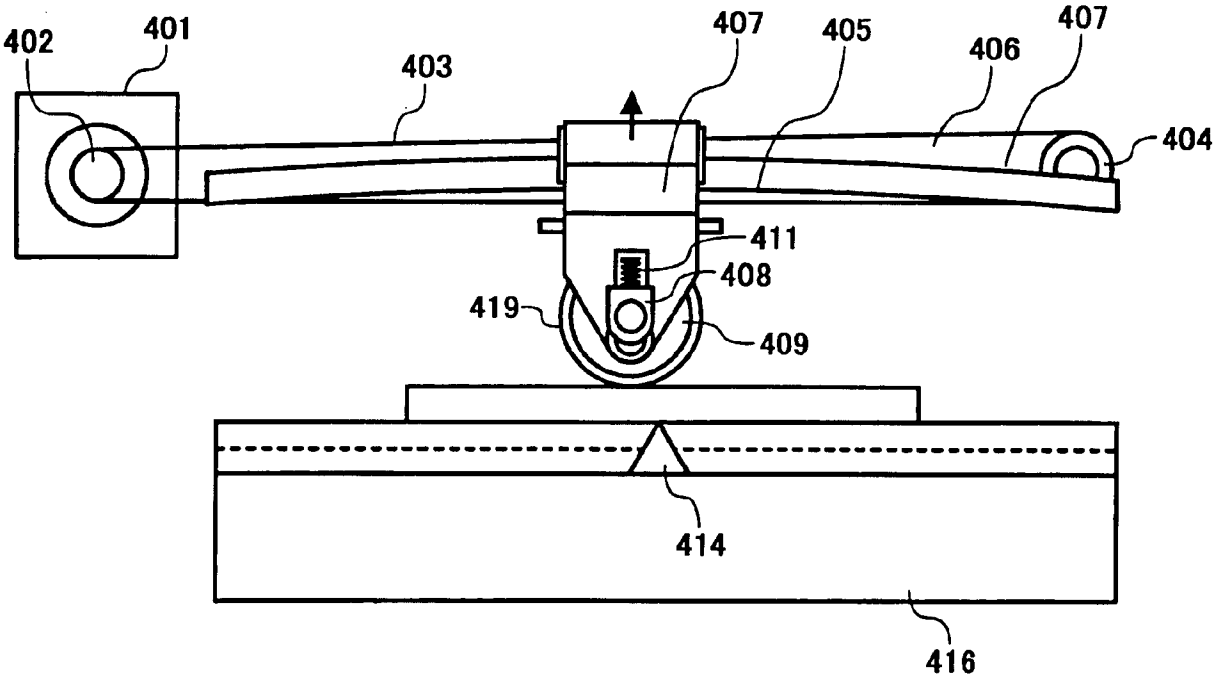
FIG. 25 shows how a guide member bends when the fold of a relatively thick sheet stack is reinforced.
Figure 26:
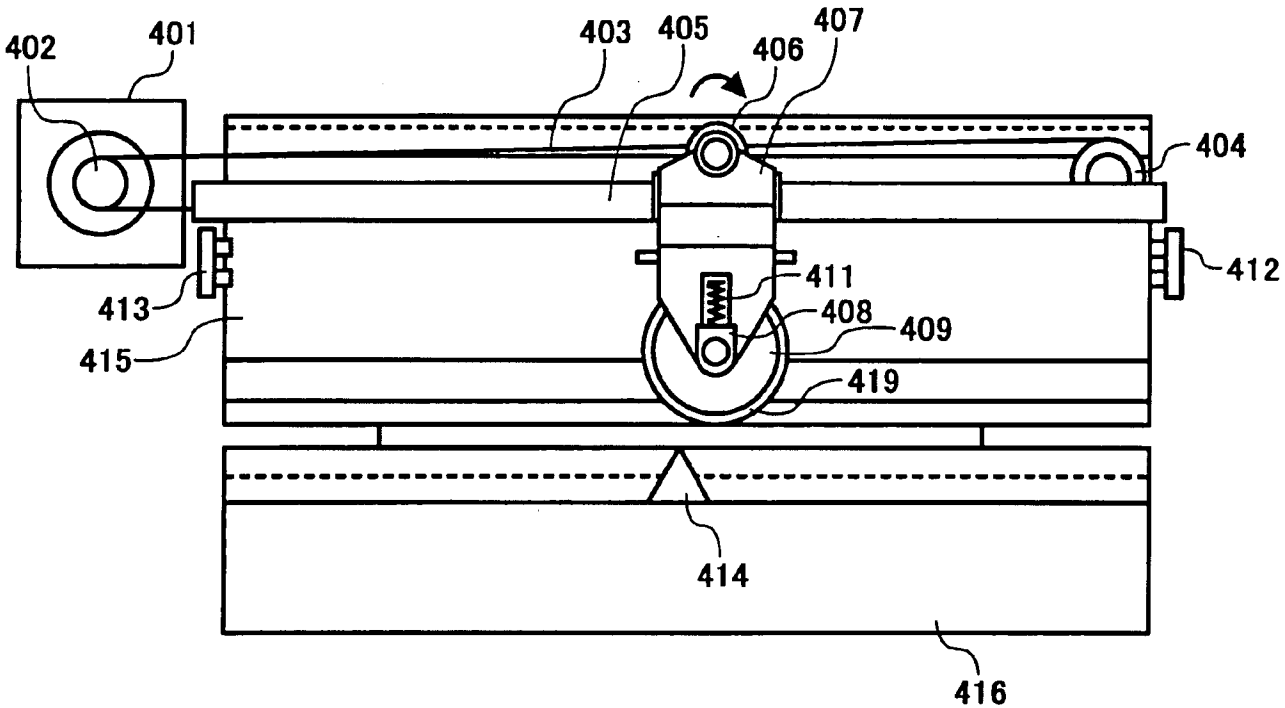
FIG. 26 is a front view of the fold roller unit including a bend-preventing member.

As shown in FIG. 25, as the thickness of the sheet stack increases, a force that acts on the guide member 405 upward due to the bias of the coil spring 411 becomes strong. As a result, the guide member 405 bends in one direction and causes the pressure expected to act on the fold of the sheet stack to escape. Moreover, the guide member 405 thus bent prevents the slider 407 to smoothly slide thereon. In light of this, as shown in FIGS. 16, 17 and 26, the bend-preventing member 406 mentioned earlier is rotatably supported by the slider 407 such that when the guide member 405 bends, the bend-preventing member 406 contacts the upper guide plate 415. The bend-preventing member 406 therefore prevents the pressure expected to act on the fold of the sheet stack from escaping even when the guide member 405 bends. Further, because the bend-preventing member 406 is rotatable, the slider 407 can smoothly move in the direction of thrust of the guide member 405 even when the member 406 contacts the upper guide plate 415.

Figure 27:
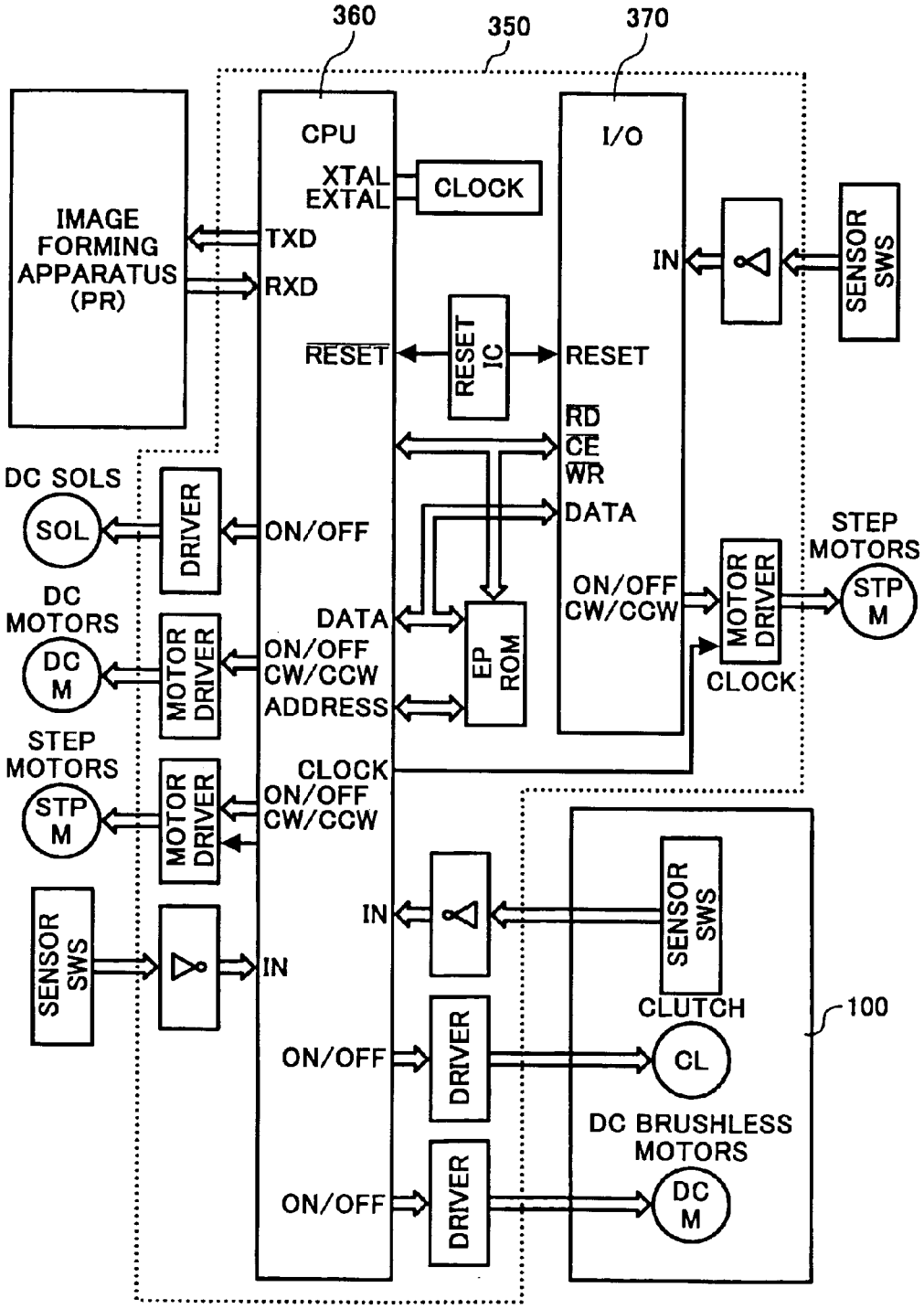
FIG. 27 is a schematic block diagram showing a control system included in the illustrative embodiment.

Reference will be made to FIG. 27 for describing a control system included in the illustrative embodiment. As shown, the control system includes a control unit 350 implemented as a microcomputer including a CPU (Central Processing Unit) 360 and an I/O (Input/Output) interface 370. The outputs of various switches arranged on a control panel, not shown, mounted on the image forming apparatus PR are input to the control unit 350 via the I/O interface 370. Also input to the control unit 350 via the I/O interface 370 are the output of the inlet sensor 301, the output of an upper outlet sensor 302, the output of a shift outlet sensor 303, the output of a prestack sensor 304, the output of a staple discharge sensor 305, the output of a sheet sensor 310, the output of the belt HP sensor 311, the output of the staple HP sensor 312, the output of the stapler oblique HP sensor 313, the output of a jogger fence HP sensor 314, the output of the guide home position sensor 315, the output of a stack arrival sensor 321, the output of a movable rear fence HP sensor 322, the output of a fold position pass sensor 323, the output of a lower outlet sensor 324, the output of a fold plate HP sensor 325, the output of sheet surface sensors 330, 330*a* and 330*b*, and the output of the guide plate sensor 331.

The CPU 360 controls, based on the above various inputs, the tray motor 168 assigned to the shift tray 202, the guide plate motor 167 assigned to the guide plate, the shift motor 169 assigned to the shift tray 202, a knock roller motor, not shown, assigned to the knock roller 12, various solenoids including the knock solenoid (SOL) 170, motors for driving the conveyor rollers, outlet motors for driving the outlet rollers, the discharge motor 157 assigned to the belt 52, the stapler motor 159 assigned to the edge stapler S1, the jogger motor 158 assigned to the jogger fences 53, the steer motor 161 assigned to the guide plate 54 and movable guide 55, a motor, not shown, assigned to rollers for conveying a sheet stack, a rear fence motor assigned to the movable rear fence 73, a fold roller motor, not shown, assigned to the fold roller 81, and the pulse motor 401 assigned to the reinforce roller 409. The pulse signals of a staple conveyance motor, not shown, assigned to the staple discharge rollers are input to the CPU 360 and counted thereby. The CPU 360 controls the knock SOL 170 and jogger motor 158 in accordance with the number of pulse signals counted. The fold roller motor is implemented by a stepping motor and controlled by the CPU 360 either directly via a motor driver or indirectly via the I/O 370 and motor driver.

Further, the CPU 360 causes the punch unit 100 to operate by controlling a clutch or a motor. The CPU 360 controls the finisher PD in accordance with a program stored in a ROM (Read Only Memory), not shown, by using a RAM (Random Access Memory) as a work area.

Specific operations to be executed by the CPU 360 in various modes available with the illustrative embodiment will be described hereinafter.

Figure 28:
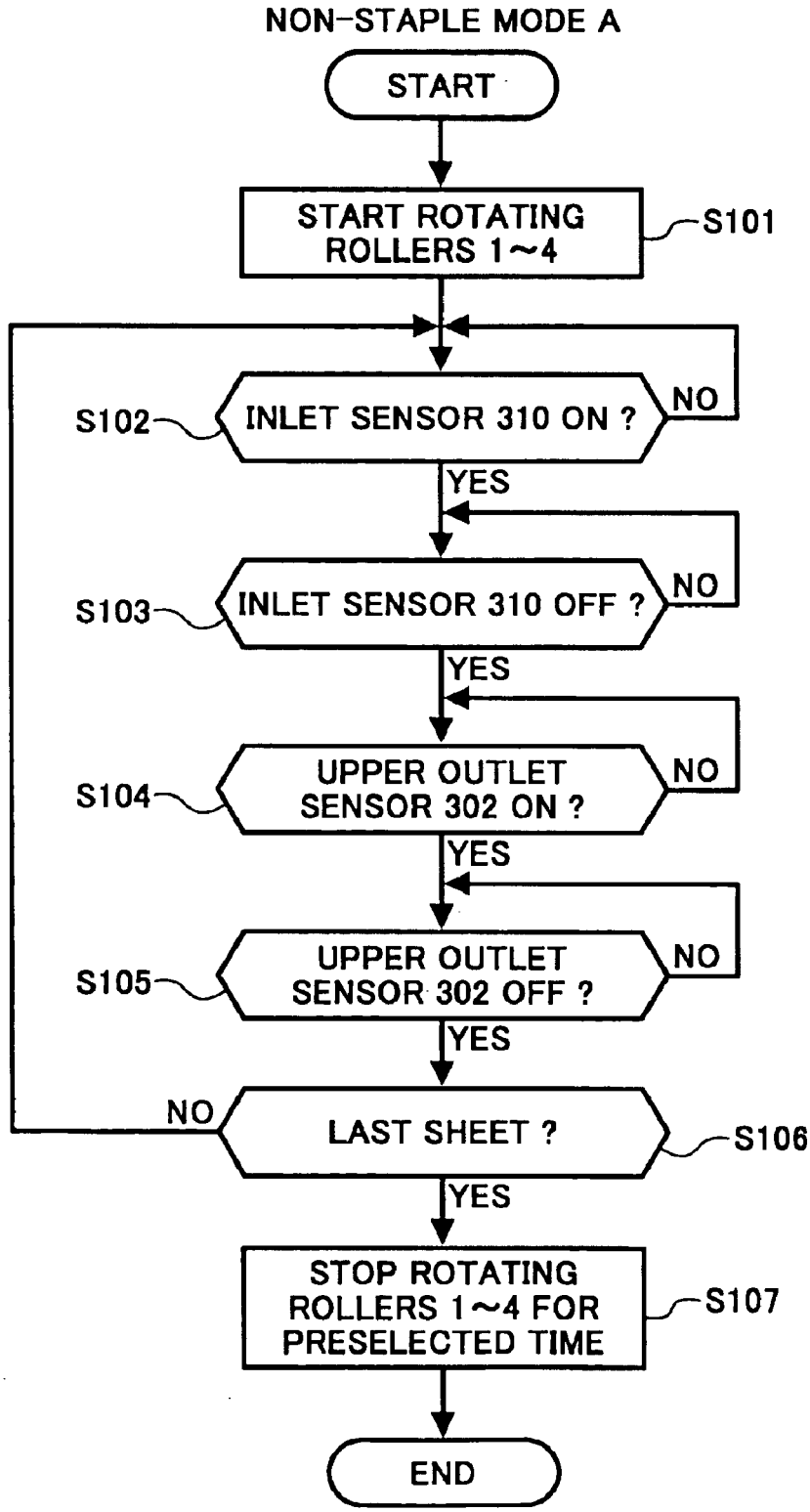
FIG. 28 is a flowchart demonstrating a non-staple mode A available with the sheet finisher.

First, in a non-staple mode A, a sheet is conveyed via the paths A and B to the upper tray 201 without being stapled. To implement this mode, the path selector 15 is moved clockwise, as viewed in FIG. 1, to unblock the path B. The operation of the CPU 360 in the non-staple mode A will be described with reference to FIG. 28.

As shown, before a sheet driven out of the image forming apparatus PR enters the finisher PD, CPU 360 causes the inlet roller pair 1 and conveyor roller pair 2 on the path A to start rotating (step S101). The CPU 360 then checks the ON/OFF state of the inlet sensor 301 (steps S102 and S103) and the ON/OFF state of the upper outlet sensor 302 (steps S014 and S105) for thereby confirming the passage of sheets. When a preselected period of time elapses since the passage of the last sheet (YES, step S106), the CPU 360 causes the above rollers to stop rotating (step S107). In this manner, all the sheets handed over from the image forming apparatus PR to the finisher PD are sequentially stacked on the upper tray 201 without being stapled. If desired, the punch unit 100, which intervenes between the inlet roller pair 1 and conveyor roller pair 2, may punch the consecutive sheets.

Figure 29:
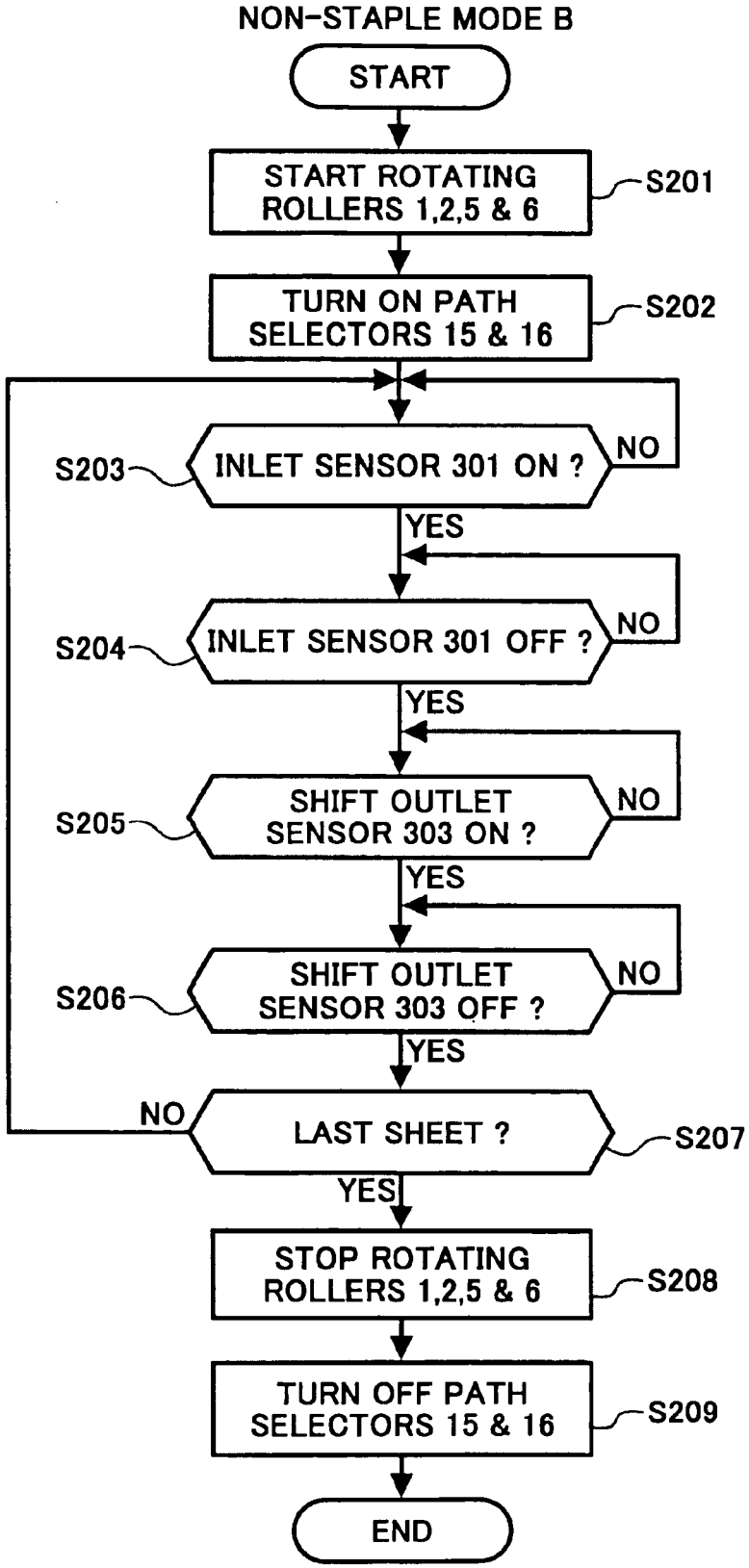
FIG. 29 is a flowchart demonstrating a non-staple mode B available with the sheet finisher.

In a non-staple mode B, the sheets are routed through the paths A and C to the shift tray 202. In this mode, the path selectors 15 and 16 are respectively moved counterclockwise and clockwise, unblocking the path C. The non-staple mode B will be described with reference to FIG. 29.

As shown, before a sheet driven out of the image forming apparatus PR enters the finisher PD, CPU 360 causes the inlet roller pair 1 and conveyor roller pair 2 on the path A and the conveyor roller pair 5 and shift outlet roller pair 6 on the path C to start rotating (step S201). The CPU 360 then energizes the solenoids assigned to the path selectors 15 and 16 (step S202) to thereby move the path selectors 15 and 16 counterclockwise and clockwise, respectively. Subsequently, the CPU 360 checks the ON/OFF state of the inlet sensor 301 (steps S203 and S204) and the ON/OFF state of the shift outlet sensor 303 (steps S205 and S206) to thereby confirm the passage of the sheets.

On the elapse of a preselected period of time since the passage of the last sheet (YES, step S207), the CPU 360 causes the various rollers mentioned above to stop rotating (S208) and deenergizes the solenoids (steps S209). In this manner, all the sheets entered the finisher PD are sequentially stacked on the shift tray 202 without being stapled. Again, the punch unit 100 intervening between the inlet roller pair 1 and conveyor roller pair 2 may punch the consecutive sheets, if desired.

Figure 30A:
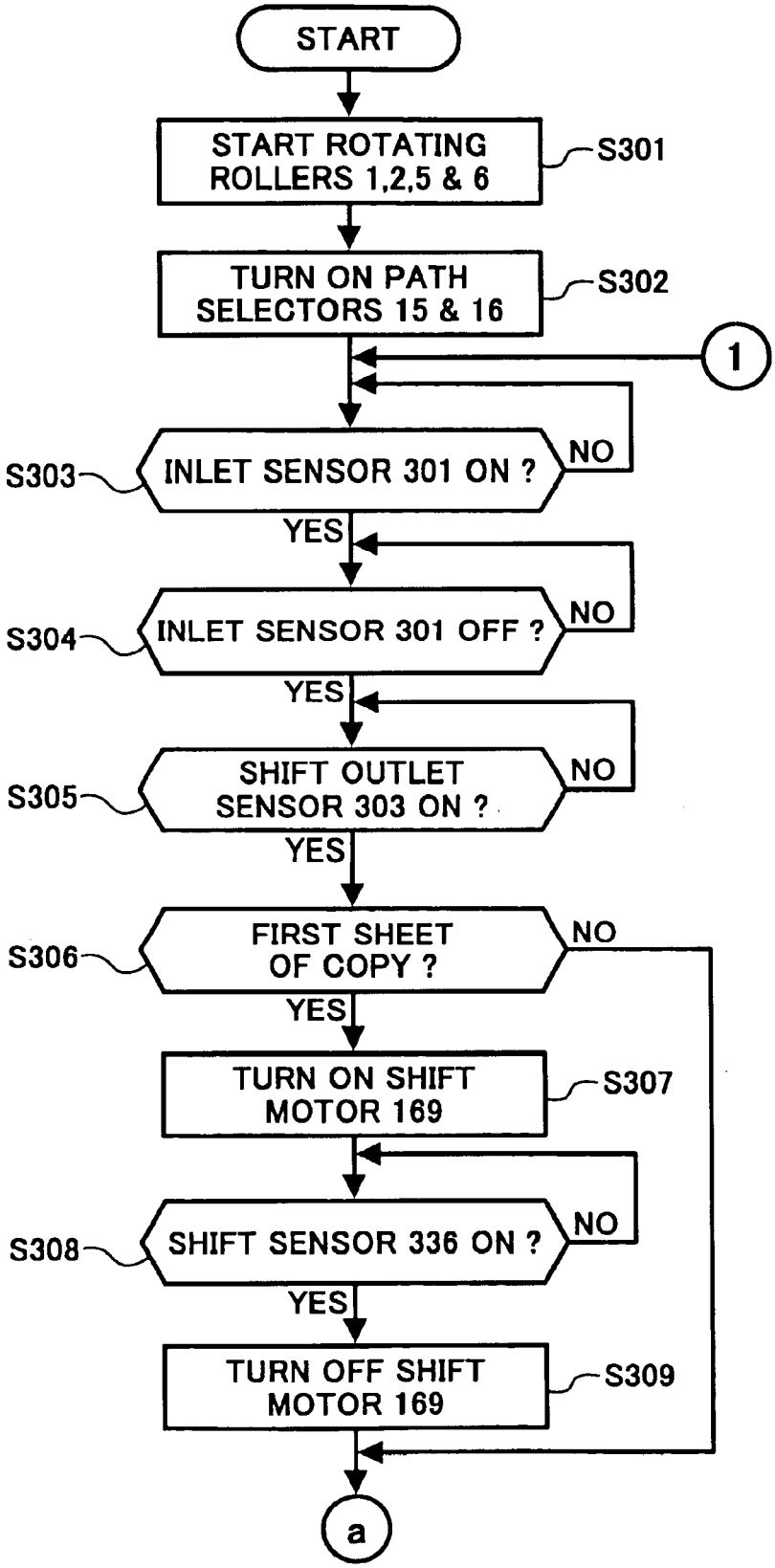
FIGS. 30A and 30B are flowcharts demonstrating a sort/stack mode available with the sheet finisher.
Figure 30B:
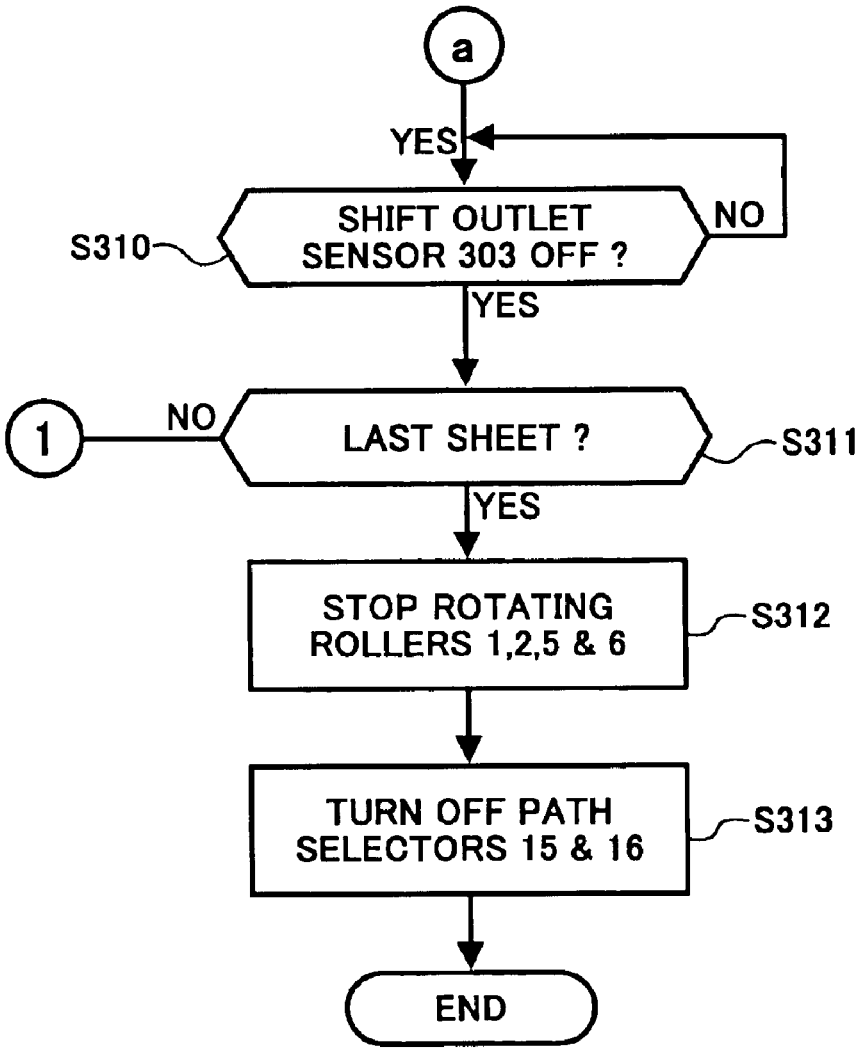

In a sort/stack mode, the sheets are also sequentially delivered from the path A to the shift tray 202 via the path C. A difference is that the shift tray 202 is shifted perpendicularly to the direction of sheet discharge copy by copy in order to sort the sheets. The path selectors 15 and 16 are respectively rotated counterclockwise and clockwise as in the non-staple mode B, thereby unblocking the path C. The sort/stack mode will be described with reference to FIGS. 30A and 30B.

As shown, before a sheet driven out of the image forming apparatus PR enters the finisher PD, CPU 360 causes the inlet roller pair 1 and conveyor roller pair 2 on the path A and the conveyor roller pair 5 and shift outlet roller pair 6 on the path C to start rotating (step S301). The CPU 360 then energizes the solenoids assigned to the path selectors 15 and 16 (step S302) to thereby move the path selectors 15 and 16 counterclockwise and clockwise, respectively. Subsequently, the CPU 360 checks the ON/OFF state of the inlet sensor 301 (steps S303 and S304) and the ON/OFF state of the shift outlet sensor 303 (step S305)

If the sheet passed the shift outlet sensor 303 is the first sheet of a copy (YES, step S306), then the CPU 360 turns on the shift motor 169 (step S307) to thereby move the shift tray 202 perpendicularly to the direction of sheet conveyance until the shift sensor 336 senses the tray 202 (steps S308 and S309). When the sheet moves away from the shift outlet sensor 303 (YES, step S310), the CPU 360 determines whether or not the sheet is the last sheet (step S311). If the answer of the step S311 is NO, meaning that the sheet is not the last sheet of a copy, and if the copy is not a single sheet, then the procedure returns to the step S303. If the copy is a single sheet, then the CPU 360 executes a step S312.

If the answer of the step S306 is NO, meaning that the sheet passed the shift outlet sensor 303 is not the first sheet of a copy, then the CPU 360 discharges the sheet(step S310) because the shift tray 202 has already been shifted. The CPU 360 then determines whether or not the discharged sheet is the last sheet (step S311). If the answer of the step S311 is NO, then the CPU 360 repeats the step S303 and successive steps with the next sheet. If the answer of the step S311 is YES, then the CPU 360 causes, on the elapse of a preselected period of time, the inlet roller pair 1, conveyor roller pairs 2 and 5 and shift outlet roller pair 6 to stop rotating (step S312) and deenergizes the solenoids assigned to the path selectors 15 and 16 (step S313). In this manner, all the sheets sequentially entered the finisher PD are sorted and stacked on the shift tray 202 without being stapled. In this mode, too, the punch unit 100 may punch the consecutive sheets, if desired.

Figure 31A:
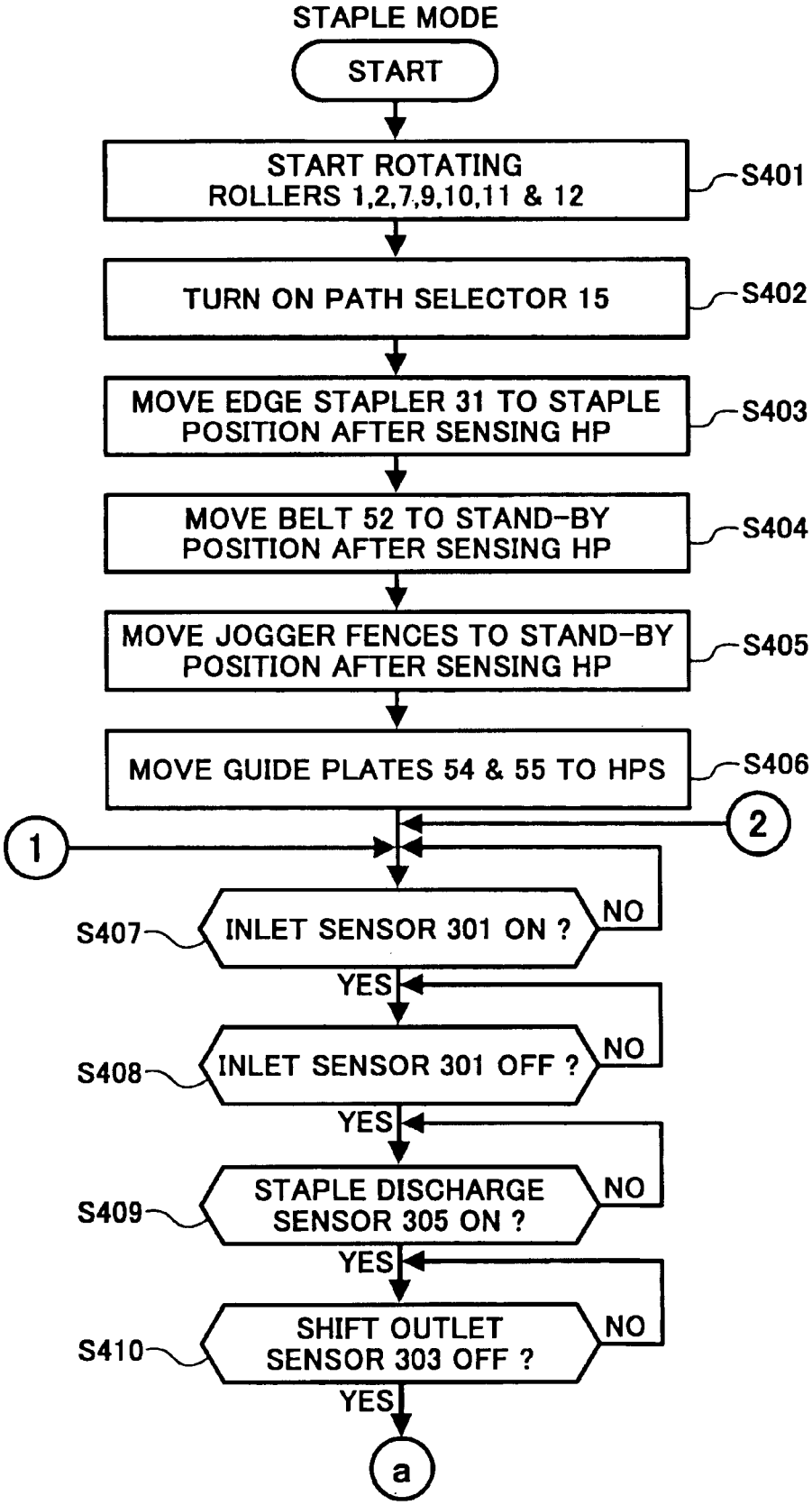
FIGS. 31A through 31C are flowcharts demonstrating a staple mode available with the sheet finisher.
Figure 31B:
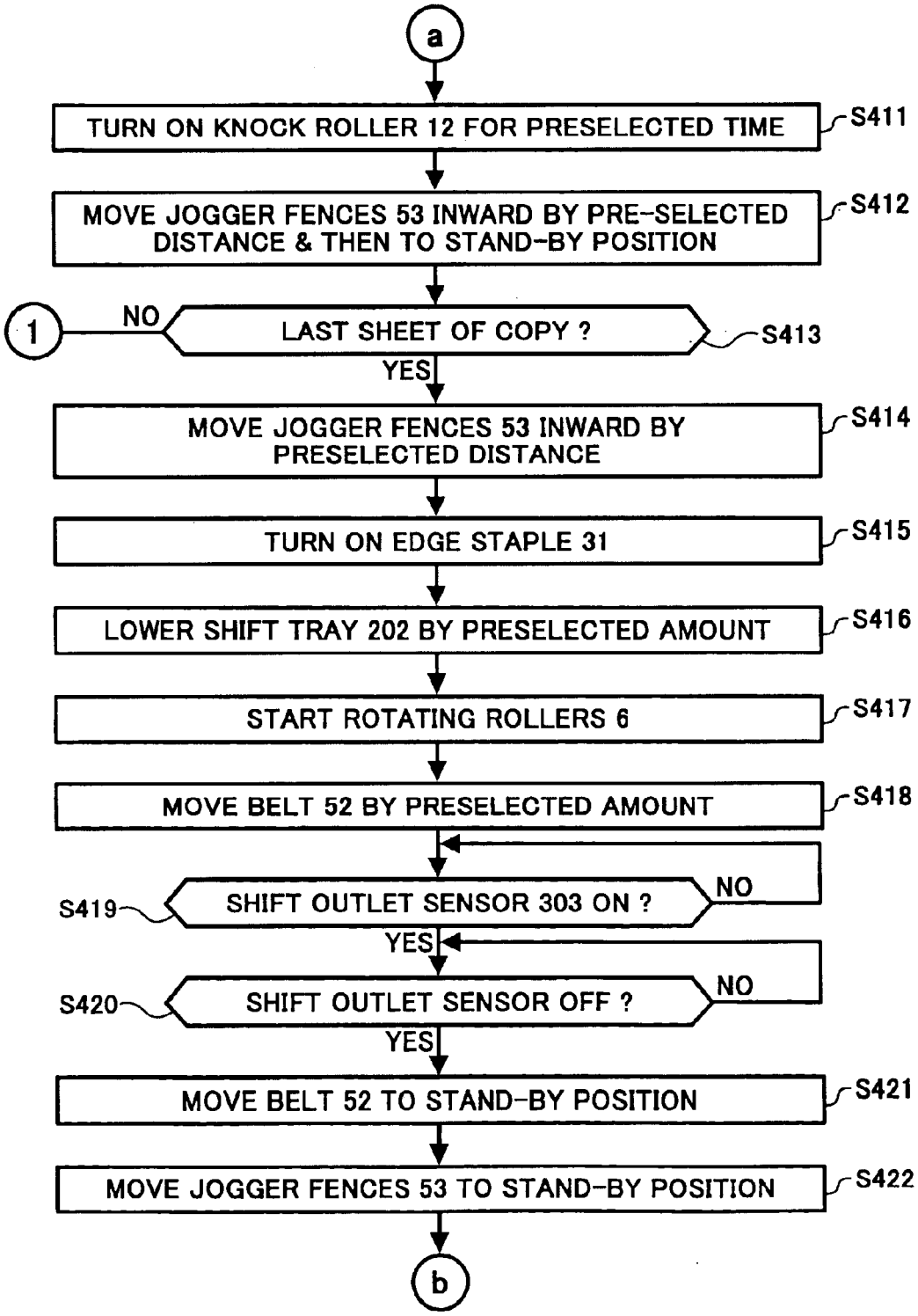
Figure 31C:
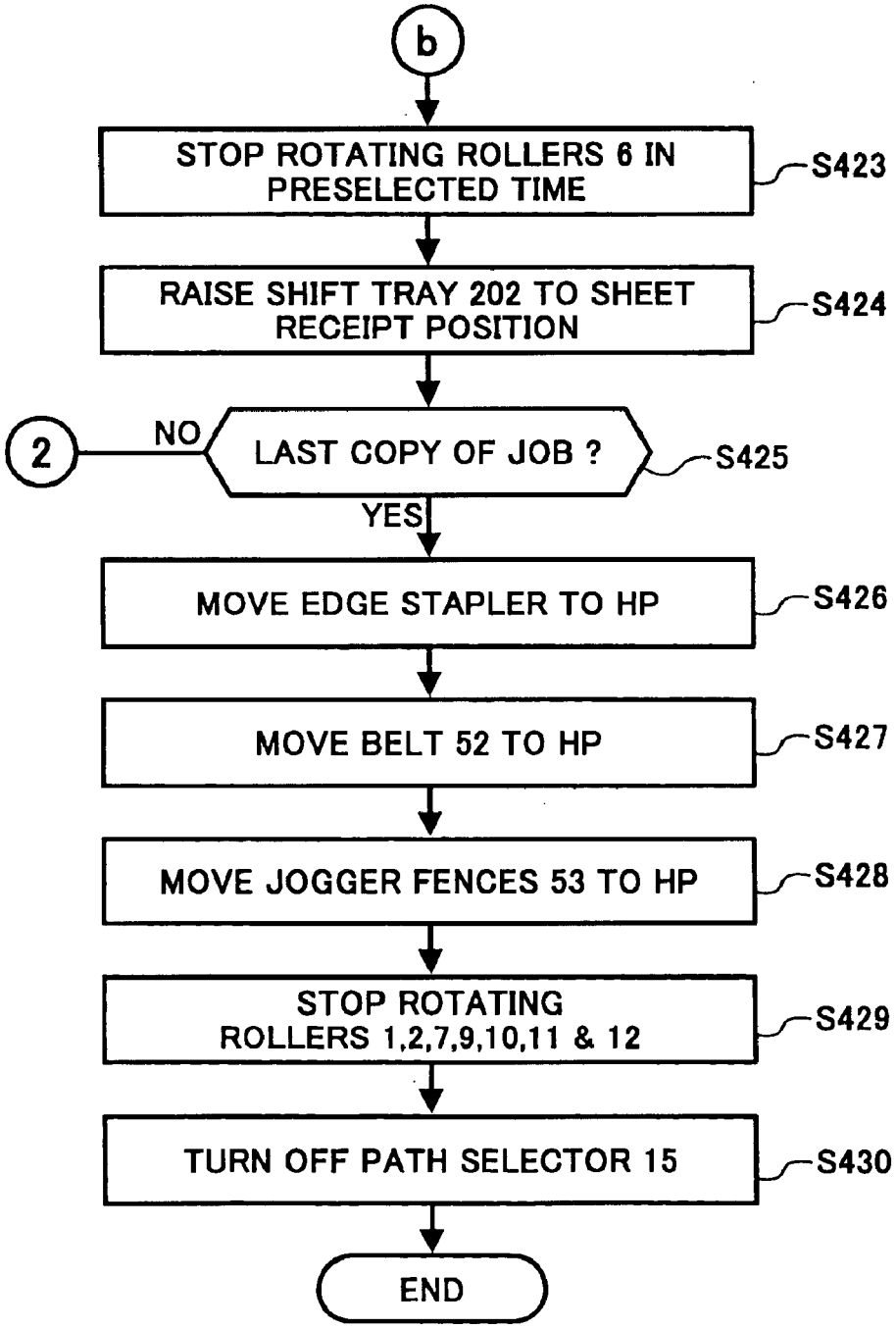

In a staple mode, the sheets are conveyed from the path A to the staple tray F via the path D, positioned and stapled on the staple tray F, and then discharged t the shift tray 202 via the path C. In this mode, the path selectors 15 and 16 both are rotated counterclockwise to unblock the route extending from the path A to the path D. The staple mode will be described with reference to FIGS. 31A through 31C.

As shown, before a sheet driven out of the image forming apparatus PR enters the finisher PD, CPU 360 causes the inlet roller pair 1 and conveyor roller pair 2 on the path A and the conveyor roller pairs 7, 9 and 10 and staple outlet roller 11 on the path D and knock roller 12 to start rotating (step S401). The CPU 360 then energizes the solenoid assigned to the path selector 15 (step S402) to thereby cause the path selector 15 to rotate counterclockwise.

After the stapler HP sensor 312 has sensed the edge stapler S1 at the home position, the CPU 360 drives the stapler motor 159 to move the edge stapler S1 to a preselected stapling position (step S403). Also, after the belt HP sensor 311 has sensed the belt 52 at the home position, the CPU 360 drives the discharge motor 157 to bring the belt 52 to a stand-by position (step S404). Further, after the jogger fence motor HP sensor has sensed the jogger fences 53 at the home position, the CPU 360 moves the jogger fences 53 to a stand-by position (step S405). In addition, the CPU 360 causes the guide plate 54 and movable guide 55 to move to their home positions (step S406).

If the inlet sensor 301 has turned on (YES, step S407) and then turned off (YES, step S408), if the staple discharge sensor 305 has turned on (YES, step S409) and if the shift outlet sensor 303 has tuned on (YES, step S410), then the CPU 360 determines that a sheet is present on the staple tray F. In this case, the CPU 360 energizes the knock solenoid 170 for a preselected period of time to cause the knock roller 12 to contact the sheet and force it against the rear fences 51, thereby positioning the rear edge of the sheet (step S411). Subsequently, the CPU 360 drives the jogger motor 158 to move each jogger fence 53 inward by a preselected distance for thereby positioning the sheet in the direction of width perpendicular to the direction of sheet conveyance and then returns the jogger fence 53 to the stand-by position (step S412). The CPU 360 repeats the step S407 and successive steps with every sheet. When the last sheet of a copy arrives at the staple tray F (YES, step S413), the CPU 360 moves the jogger fences 53 inward to a position where they prevent the edges of the sheets from being dislocated (step S414). In this condition, the CPU 360 turns on the stapler S1 and causes it to staple the edge of the sheet stack (step S415).

On the other hand, the CPU 360 lowers the shift tray 202 by a preselected amount (step S416) in order to produce a space for receiving the stapled sheet stack. The CPU 360 then drives the shift discharge roller pair 6 via the shift discharge motor (step S417) and drives the belt 52 by a preselected amount via the discharge motor 157 (step S418), so that the stapled sheet stack is raised toward the path C. As a result, the stapled sheet stack is driven out to the shift tray 202 via the shift outlet roller pair 6. After the shift outlet sensor 303 has turned on (step S419) and then turned off (step S420), meaning that the sheet stack has moved away from the sensor 303, the CPU 360 moves the belt 52 and jogger fences 53 to their stand-by positions (steps S421 and S422), causes the shift outlet roller pair 6 to stop rotating on the elapse of a preselected period of time (step S423), and raises the shift tray 202 to a sheet receiving position (step S424). The rise of the shift tray 202 is controlled in accordance with the output of the sheet surface sensor 330 responsive to the top of the sheet stack positioned on the shift tray 202.

After the last copy or set of sheets has been driven out to the shift tray 202, the CPU 360 returns the edge stapler S1, belt 52 and jogger fences 53 to their home positions (steps S426, S427 and S428) and causes the inlet roller pair 1, conveyor roller pairs 2, 7, 9 and 10, staple discharge roller pair 11 and knock roller 12 to stop rotating (step S429). Further, the CPU 360 deenergizes the solenoid assigned to the path selector 15 (step S430. Consequently, all the structural parts are returned to their initial positions. In this case, too, the punch unit 100 may punch the consecutive sheets before stapling.

The operation of the staple tray F in the staple mode will be described more specifically herein after. As shown in FIG. 6, when the staple mode is selected, the jogger fences 53 each are moved from the home position to a stand-by position 7 mm short of one end of the width of sheets to be stacked on the staple tray F (step S405). When a sheet being conveyed by the staple discharge roller pair 11 passes the staple discharge sensor 305 (step S409), the jogger fence 53 is moved inward from the stand-by position by 5 mm.

The staple discharge sensor 305 senses the trailing edge of the sheet and sends its output to the CPU 360. In response, the CPU 360 starts counting drive pulses input to the staple motor, not shown, driving the staple discharge roller pair 11. On counting a preselected number of pulses, the CPU 360 energizes the knock solenoid 170 (step S412). The knock solenoid 170 causes the knock roller 12 to contact the sheet and force it downward when energized, so that the sheet is positioned by the rear fences 51. Every time a sheet to be stacked on the staple tray F1 passes the inlet sensor 301 or the staple discharge sensor 305, the output of the sensor 301 or 305 is sent to the CPU 360, causing the CPU 360 to count the sheet.

On the elapse of a preselected period of time since the knock solenoid 170 has been turned off, the CPU 360 causes the jogger motor 158 to move each jogger fence 53 further inward by 2.6 mm and then stop it, thereby positioning the sheet in the direction of width. Subsequently, the CPU 360 moves the jogger fence 53 outward by 7.6 mm to the stand-by position and then waits for the next sheet (step S412). The CPU 360 repeats such a procedure up to the last page (step S413). The CPU 360 again causes the jogger fences 53 to move inward by 7 mm and then stop, thereby causing the jogger fences 53 to retain the opposite edges of the sheet stack to be stapled. Subsequently, on the elapse of a preselected period of time, the CPU 360 drives the edge stapler S1 via the staple motor for thereby stapling the sheet stack (step S415). If two or more stapling positions are designated, then the CPU 360 moves, after stapling at one position, the edge stapler S1 to another designated position along the rear edge of the sheet stack via the stapler motor 159. At this position, the edge stapler S1 again staples the sheet stack. This is repeated when three or more stapling positions are designated.

After the stapling operation, the CPU 360 drives the belt 52 via the discharge motor 157 (step S418). At the same time, the CPU 360 drives the outlet motor to cause the shift outlet roller pair 6 to start rotating in order to receive the stapled sheet stack lifted by the hook 52*a* (step S417). At this instant, the CPU 360 controls the jogger fences 53 in a different manner in accordance with the sheet size and the number of sheets stapled together. For example, when the number of sheets stapled together or the sheet size is smaller than a preselected value, then the CPU 360 causes the jogger fences 53 to constantly retain the opposite edges of the sheet stack until the hook 52*a* fully lifts the rear edge of the sheet stack. When a preselected number of pulses are output since the turn-on of the sheet sensor 310 or the belt HP sensor 311, the CPU 360 causes the jogger fences 53 to retract by 2 mm and release the sheet stack. The preselected number of pulses corresponds to an interval between the time when the hook 52*a* contacts the trailing edge of the sheet stack and the time when it moves away from the upper ends of the jogger fences 53.

On the other hand, when the number of sheets stapled together or the sheet size is larger than the preselected value, the CPU 360 causes the jogger fences 53 to retract by 2 mm beforehand. In any case, as soon as the stapled sheet stack moves away from the jogger fences 53, the CPU 360 moves the jogger fences 53 further outward by 5 mm to the stand-by positions (step S422) for thereby preparing it for the next sheet. If desired, the restraint to act on the sheet stack may be controlled on the basis of the distance of each jogger fence from the sheet stack.

Figure 32:
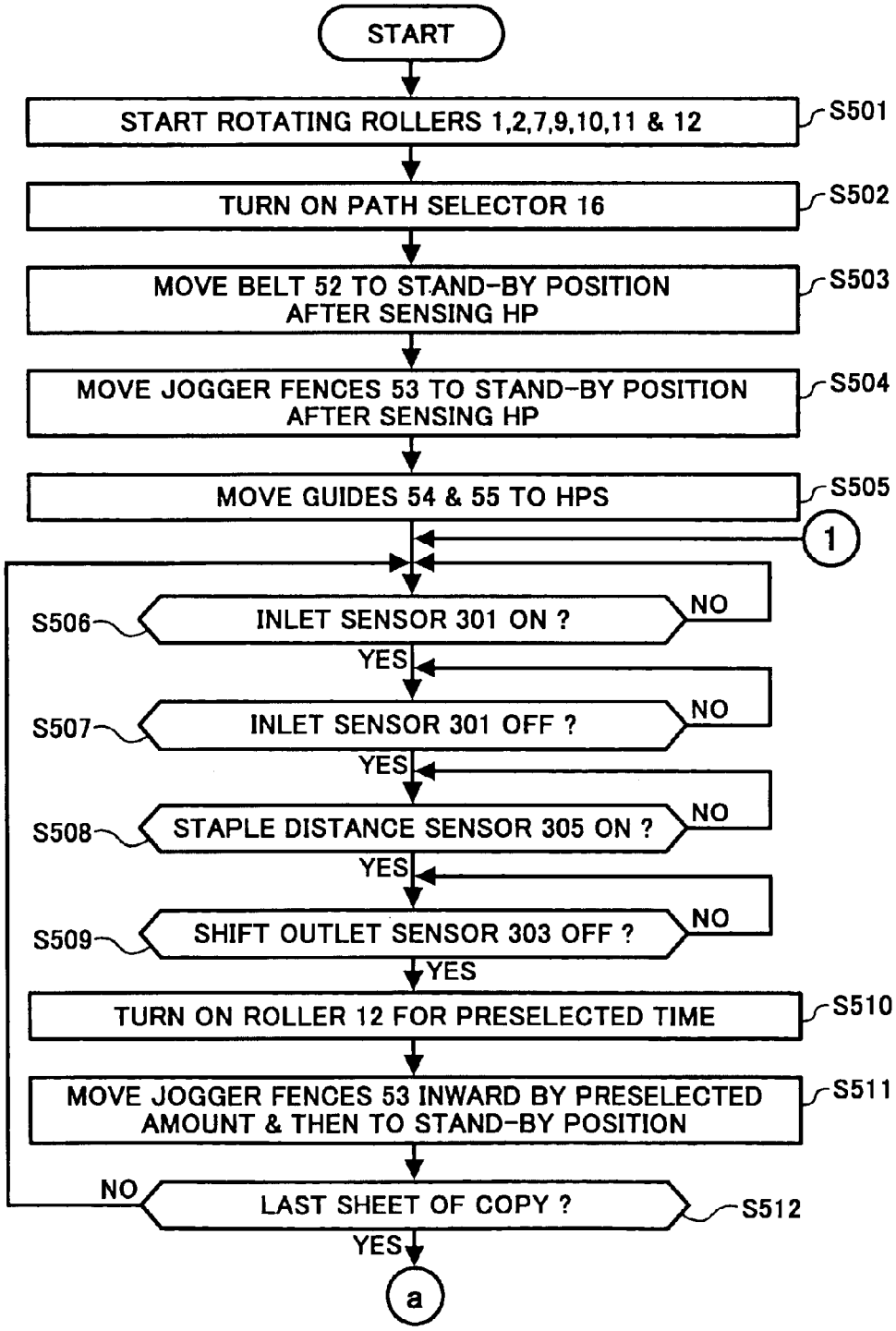
FIG. 32 is a flowchart demonstrating part of a center staple and bind mode available with the sheet finisher.
Figure 33:
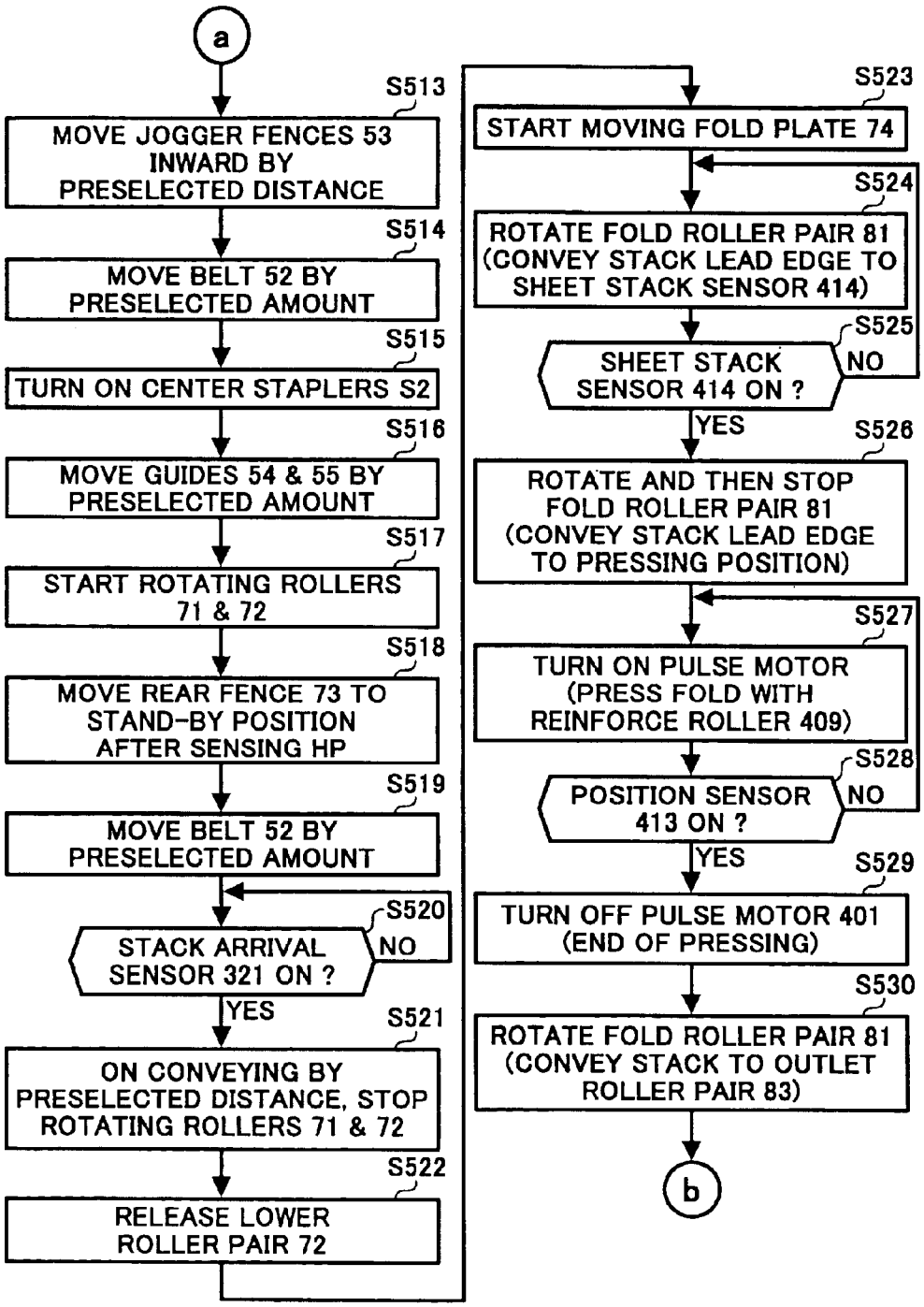
FIG. 33 is a flowchart demonstrating another part of the center staple and bind mode.
Figure 34:
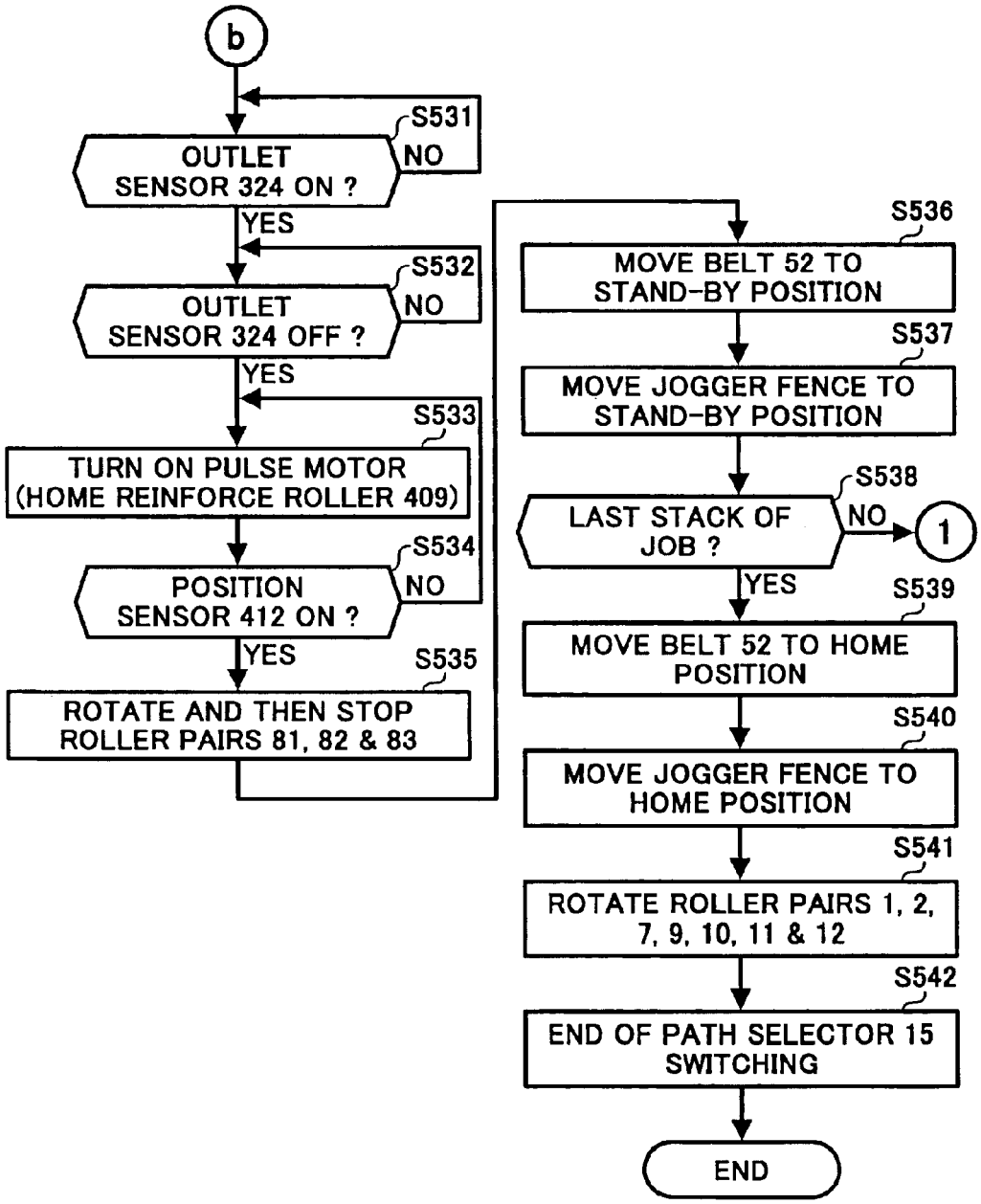
FIG. 34 is a flowchart demonstrating still another part of the center staple and bind mode.
Figure 36:
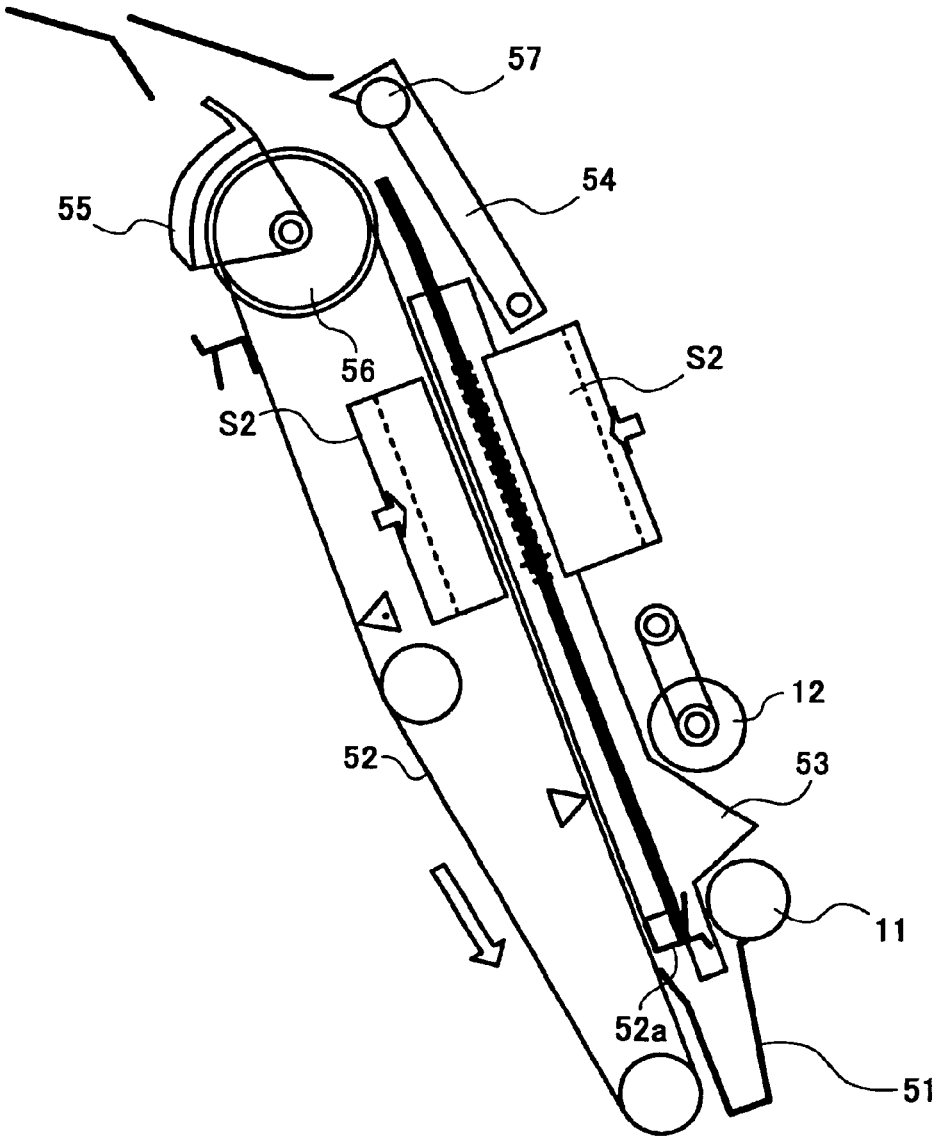
FIG. 36 shows how a sheet stack is stacked and stapled at the center on the staple tray in the center staple and bind mode.

FIGS. 32 through 34 demonstrate a center staple and bind mode or fold reinforcement mode. In this mode, the sheets are sequentially conveyed from the path A to the staple tray F via the path D, positioned and stapled at the center on the tray F, folded on the fold tray G, again pressed by the reinforce roller 409, and then driven out to the lower tray 203 via the path H. In this mode, the path selectors 15 and 16 both are rotated counterclockwise to unblock the route extending from the path A to the path D. Also, the guide plate 54 and movable guide plate 55 are closed, as shown in FIG. 36, guiding the stapled sheet stack to the fold tray G. The center staple and bind mode will be described with reference to FIG. 32.

As shown, before a sheet driven out of the image forming apparatus PR enters the finisher PD, CPU 360 causes the inlet roller pair 1 and conveyor roller pair 2 on the path A and the conveyor roller pairs 7, 9 and 10 and staple outlet roller 11 on the path D and knock roller 12 to start rotating (step S401). The CPU 360 then energizes the solenoid assigned to the path selector 15 (step S402) to thereby cause the path selector 15 to rotate counterclockwise.

Subsequently, after the belt HP sensor 311 has sensed the belt 52 at the home position, the CPU 360 drives to the discharge motor 157 to move the belt 52 to the stand-by position (step S503). Also, after the jogger fence HP sensor has sensed each jogger fence 53 at the home position, the CPU 360 moves the jogger fence 53 to the stand-by position (step S504). Further, the CPU 360 moves the guide plate 54 and movable guide 55 to their home positions (steps S505).

If the inlet sensor 301 has turned on (YES, step S506) and then turned off (YES, step S507), if the staple discharge sensor 305 has turned on (YES, step S508) and if the shift outlet sensor 303 has tuned on (YES, step S509), then the CPU 360 determines that a sheet is present on the staple tray F. In this case, the CPU 360 energizes the knock solenoid 170 for the preselected period of time to cause the knock roller 12 to contact the sheet and force it against the rear fences 51, thereby positioning the trailing edge of the sheet (step S510). Subsequently, the CPU 360 drives the jogger motor 158 to move each jogger fence 53 inward by the preselected distance for thereby positioning the sheet in the direction of width perpendicular to the direction of sheet conveyance and then returns the jogger fence 53 to the stand-by position (step S511). The CPU 360 repeats the step S407 and successive steps with every sheet. As shown in FIG. 33, when the last sheet of a copy arrives at the staple tray F (YES, step S512), the CPU 360 moves the jogger fences 53 inward to the position where they prevent the edges of the sheets from being dislocated (step S513).

After the step S513, the CPU 360 turns on the discharge motor 157 to thereby move the belt 52 by a preselected amount (step S514), so that the belt 52 lifts the sheet stack to a stapling position assigned to the center staplers S2. Subsequently, the CPU 360 turns on the center staplers S2 at the intermediate portion of the sheet stack for thereby stapling the sheet stack at the center (step S515). The CPU 360 then moves the guides 54 and 55 by a preselected amount each in order to form a path directed toward the fold tray G (step S516) and causes the upper and lower roller pairs 71 and 72 of the fold tray G to start rotating (step S517). As soon as the movable rear fence 73 of the fold tray G is sensed at the home position, the CPU 360 moves the fence 73 to a stand-by position (step S518). The fold tray G is now ready to receive the stapled sheet stack.

After the step S518, the CPU 360 further moves the belt 52 by a preselected amount (step S519) and causes the discharge roller 56 and press roller 57 to nip the sheet stack and convey it to the fold tray G. When the leading edge of the sheet stack arrives at the stack arrival sensor 321 (step S520) and then moves a preselected distance, the CPU 360 causes the upper and lower roller pairs 71 and 72 to stop rotating (step S521) and then releases the lower rollers 72 from each other (step S522). Subsequently, the CPU 360 causes the fold plate 74 to start folding the sheet stack (step S523) and causes the fold roller pairs 81 and 82 and lower outlet roller pair 83 to start rotating (step S524). The CPU 360 causes the fold roller pairs 81 to continuously rotate until the sheet stack sensor 414 included in the reinforce roller unit 400 turns on. When the sheet stack sensor 414 turns on (YES, step S525), the CPU 360 causes the fold roller 81 to rotate by a preselected amount and then stop rotating (step S526). By this operation, the leading edge of the sheet stack is conveyed to a position where the reinforce roller 409 can press the fold of the sheet stack.

When the leading edge of the sheet stack is stopped at the above position, the CPU 360 drives the pulse motor 401 assigned to the reinforce roller 409 (step S527) for thereby causing the reinforce roller 409 to roll on the leading edge or fold of the sheet stack. When the position sensor 413 senses the reinforce roller 409 reached the end-of-reinforcement position (YES, step S528), the CPU 360 stops driving the pulse motor 401 (step S529) to thereby complete the reinforcement of the fold. The CPU 360 then causes the fold roller pairs 81 to rotate and convey the sheet stack to the lower outlet roller pair 83 (step S530).

In the above condition, as shown in FIG. 34, the CPU 360 determines whether or not the trailing edge of the folded sheet stack has moved away from the lower outlet sensor 324 (steps S531 and S532). If the answer of the step S532 is YES, then the CPU 360 drives the step motor 401 to return the reinforce roller 409 to the home position (step S533). When the position sensor 412 senses the reinforce roller 409 reached the home position (YES, step S534), the CPU 360 stops driving the pulse motor 401 while causing the fold roller pairs 81 and 82 and lower outlet roller pair 83 to further rotate for a preselected period of time and then stop (step S535). Subsequently, the CPU 360 causes the belt 52 and jogger fences 53 to return to the stand-by positions (steps S536 and S537). The CPU 360 then determines whether or not the above sheet stack is the last copy of a single job to perform (step S538). If the answer of the step S538 is NO, then the procedure returns to the step S506. If the answer of the step S538 is YES, then the CPU 360 returns the belt 52 and jogger fences 53 to the home positions (steps S539 and S540). At the same time, the CPU 360 causes the inlet roller pair 1, roller pairs 2, 7, 9 and 10, staple discharge roller pair 11 and knock roller 12 to stop rotating (step S541) and turns off the solenoid assigned to the path selector 15 (step S542). As a result, all the structural parts are returned to their initial positions.

As stated above, sheets sequentially introduced from the image forming apparatus PR are stapled at the center by the staple tray F, folded at the center by the fold tray G, again pressed by the reinforce roller 409, and then stacked on the lower tray 203.

Figure 35:
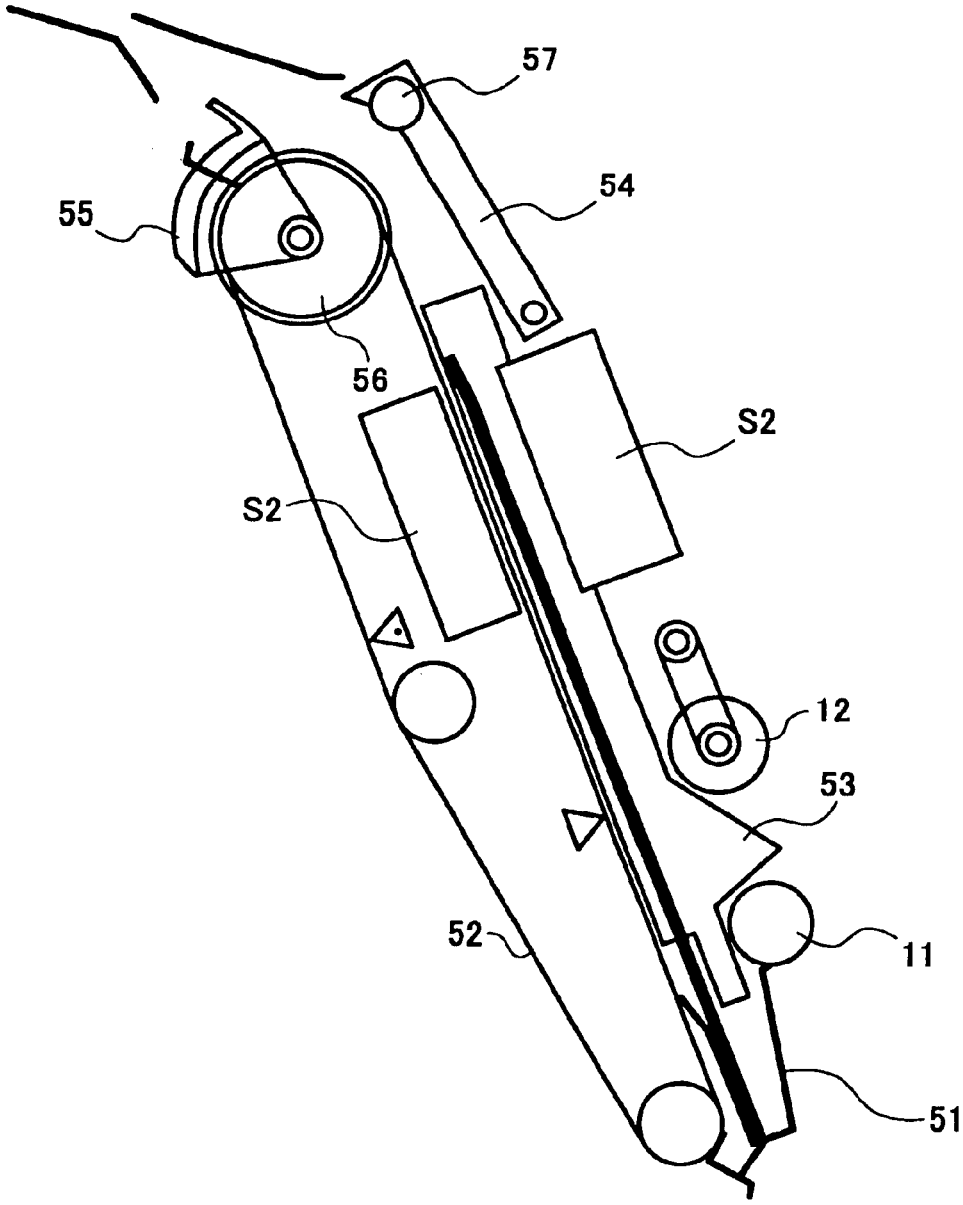
FIG. 35 shows how a sheet stack is positioned on the staple tray in the center staple and bind mode.

The stapling and folding operations to be performed in the center fold mode will be described in more detail hereinafter. A sheet is steered by the path selectors 15 and 16 to the path D and then conveyed by the roller pairs 7, 9 and 10 and staple discharge roller 11 to the staple tray F. The staple tray F operates in exactly the same manner as in the staple mode stated earlier before positioning and stapling (see FIG. 34). Subsequently, as shown in FIG. 35, the hook 52*a* conveys the sheet stack to the downstream side in the direction of conveyance by a distance matching with the sheet size. After the center staplers S2 have stapled the center of the sheet stack, the sheet stack is conveyed by the hook 62*a* to the downstream side by a preselected distance matching with the sheet size and then brought to a stop. The distance of movement of the sheet stack is controlled on the basis of the drive pulses input to the discharge motor 157.

Figure 38:
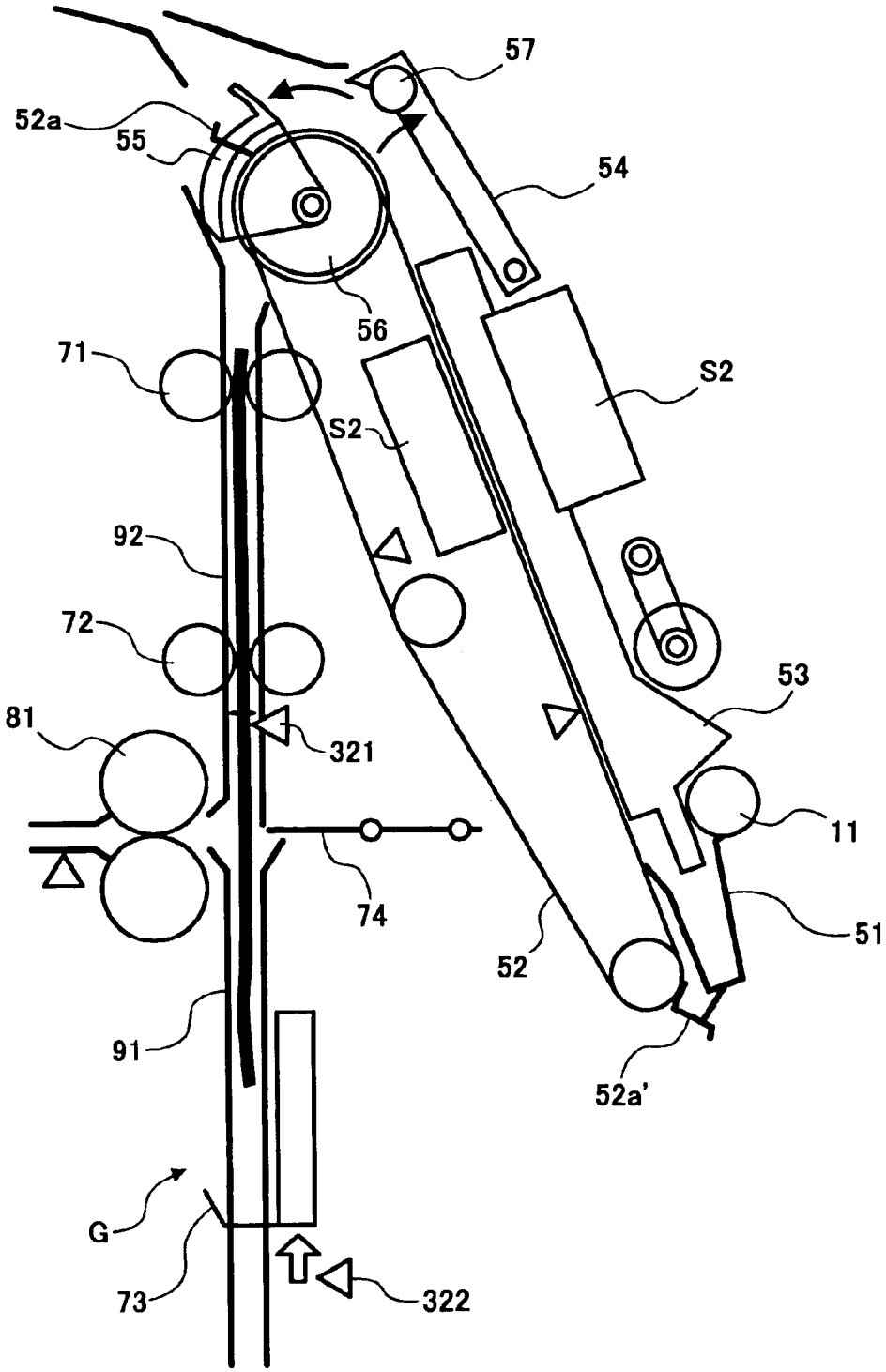
FIG. 38 shows a condition wherein the sheet stack steering mechanism has steered the sheet stack stapled in the center staple and bind mode toward a fold tray.

Subsequently, as shown in FIG. 37, the sheet stack is nipped by the discharge roller 56 and press roller 57 and then conveyed by the hook 52*a* and discharge roller 56 to the downstream side such that it passes through the path formed between the guides 54 and 55 and extending to the fold tray G. The discharge roller 56 is mounted on a drive shaft associated with the belt 52 and therefore driven in synchronism with the belt 52, as stated earlier. Subsequently, as shown in FIG. 38, the sheet stack is conveyed by the upper and lower roller pairs 71 and 72 to the movable rear fence 73, which is moved from its home position to a position matching with the sheet size beforehand and held in a stop for guiding the lower edge of the sheet stack. At this instant, as soon as the other hook 52' on the belt 52 arrives at a position close to the rear fence 51, the hook 52*a* is brought to a stop while the guides 54 and 55 are returned to the home positions to wait for the next sheet stack.

Figure 39:
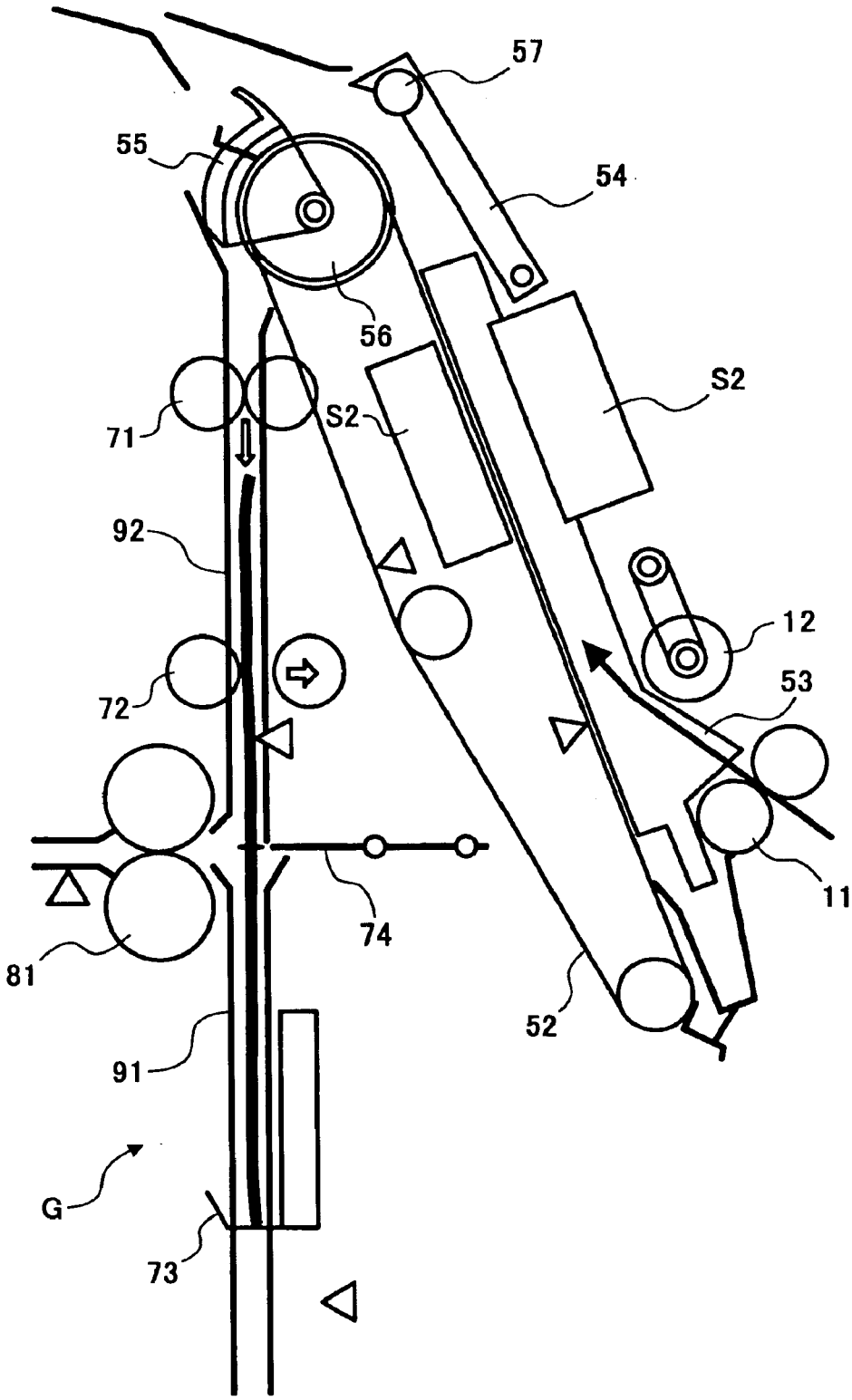
FIG. 39 shows a condition wherein the sheet stack is positioned at a fold position on the fold tray in the center staple and bind mode.
Figure 40:
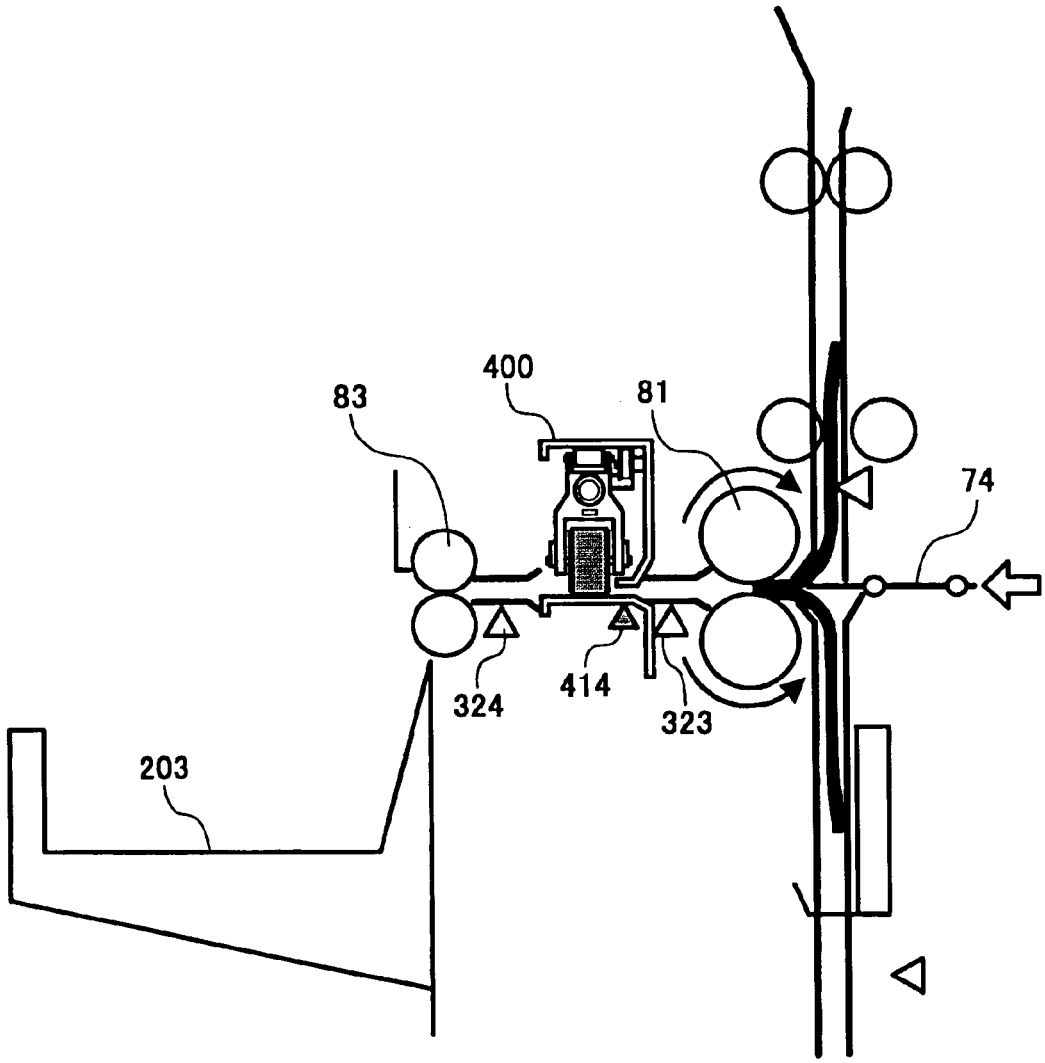
FIG. 40 shows a condition wherein a fold plate has started folding the sheet stack on the fold tray in the center staple and bind mode.

As shown in FIG. 39, the sheet stack abutted against the movable rear fence 73 is freed from the pressure of the lower roller pair 72. Subsequently, as shown in FIG. 40, the fold plate 74 pushes part of the sheet stack close to a staple toward the nip of the fold roller pair 81 substantially perpendicularly to the sheet stack. The fold roller pair 81, which is caused to rotate beforehand, conveys the sheet stack reached its nip while pressing it. As a result, the sheet stack is folded at its center.

Figure 41:
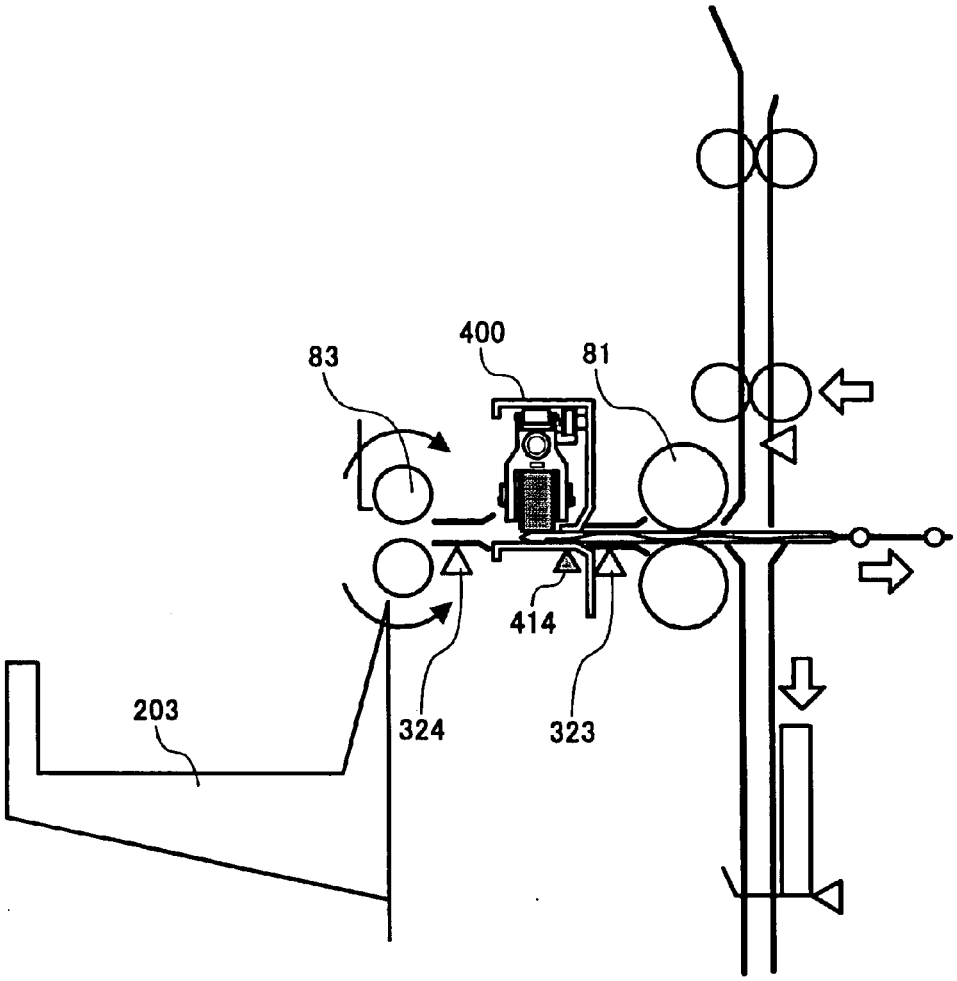
FIG. 41 shows a condition wherein after the fold plate has started folding the sheets stack on the fold tray in the center staple and bind mode, the reinforce roller is reinforcing the fold of the sheet stack.

As shown in FIG. 41, the center-folded sheet stack is conveyed to the reinforce roller unit 400 and then stopped there on the basis of the output of the sheet stack sensor 414. Subsequently, the reinforce roller 409 is driven at a position shown in FIG. 41 in order to reinforce the fold of the sheet stack. The sheet stack is then driven out to the lower tray 203 by the fold roller pair and lower outlet roller pair 83. At this instant, as soon as the pass sensor 323 senses the trailing edge of the sheet stack, the fold plate 74 and movable rear fence 73 are returned to their home positions while the lower roller pair 72 is released from each other so as to wait for the next sheet stack. Alternatively, the rear fence 73 may be held at the same position without being returned to the home position if the next job deals with the same sheet size and the same number of sheets.

Figure 42:
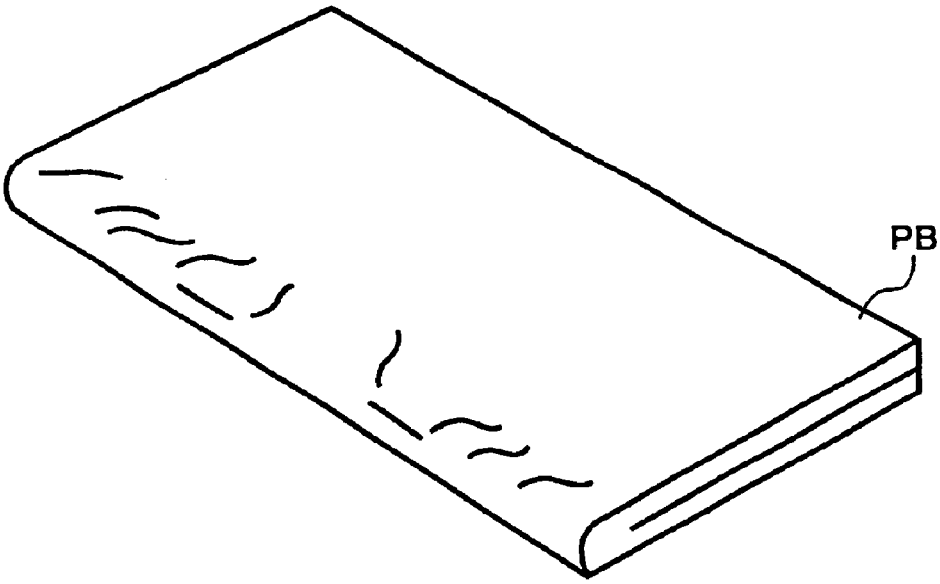
FIG. 42 shows a condition wherein the fold of a sheet stack is creased.

As shown in FIG. 42, the fold roller pair 81 continuously holds the sheet stack when the reinforce roller 409 is rolling on the fold or leading edge of the sheet stack in the direction perpendicular to the direction of sheet feed to reinforce the fold. Otherwise, as shown in FIG. 42, the folded portion of the sheet stack PB is, in many cases, creased without being neatly folded because the individual sheet is warped.

Figure 43:
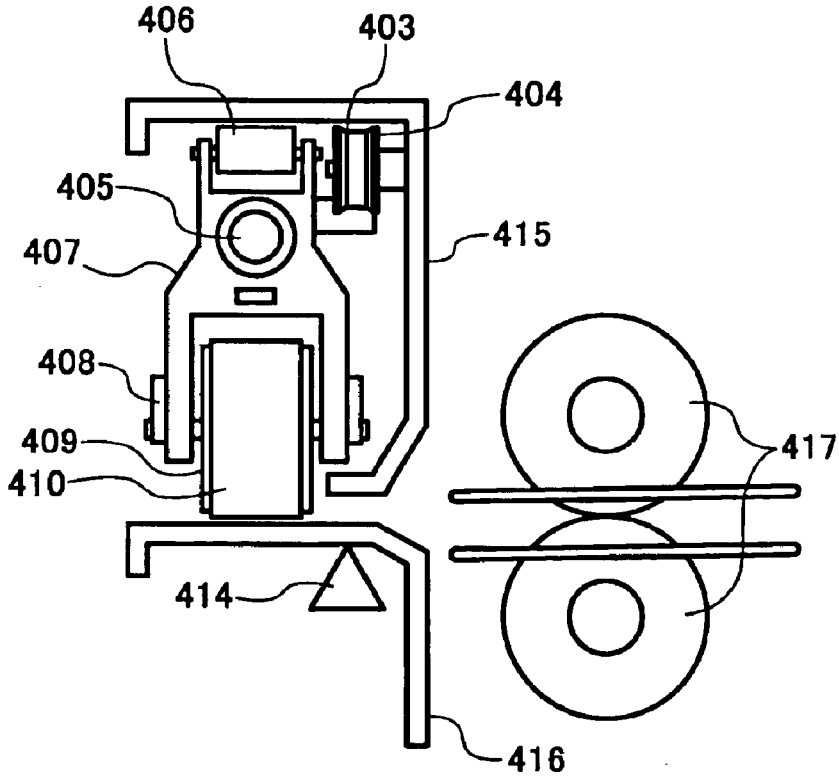
FIG. 43 is a front view showing the reinforce roller unit in which holding members are provided for holding a sheet stack during reinforcement.
Figure 44:
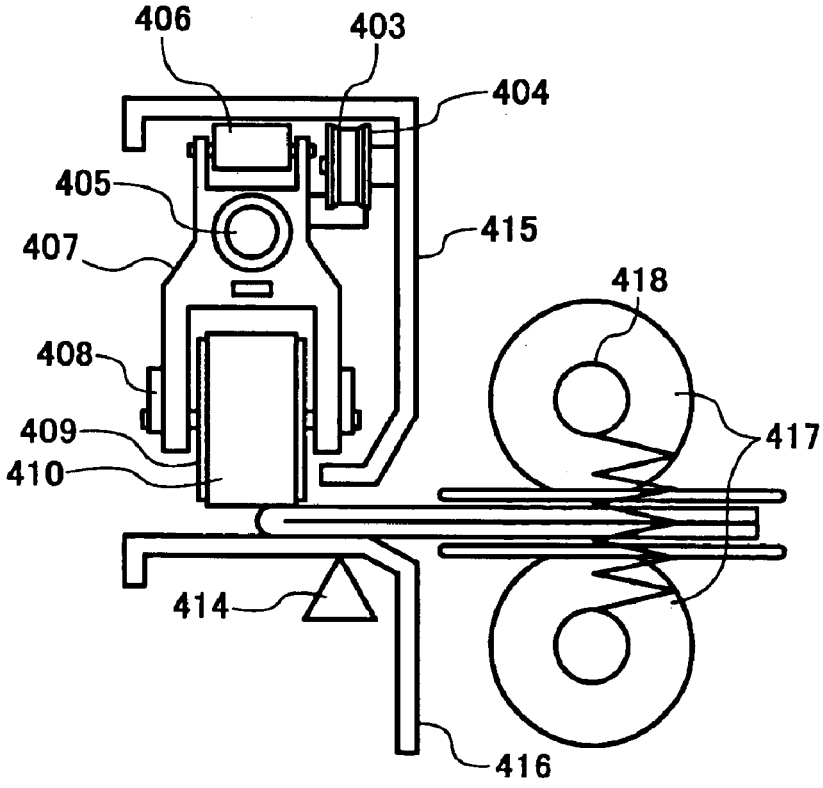
FIG. 44 is a front view of the reinforce roller unit in which the holding members are biased toward each other.

The fold roller pair 81, however, may fail to firmly nip the sheet stack alone, e.g., when the individual sheet is relatively hard. In light of this, as shown in FIG. 43, a roller pair 417, serving as a holding member, may be used to nip the upstream portion of the sheet stack from the time when the reinforce roller 409 starts pressing the fold of the sheet stack to the time when it stops pressing the fold. As shown in FIG. 44, a biasing member 418 constantly biases the rollers of the roller pair 417 toward each other. The roller pair 417 may be freely rotatable or rotated by a pulse motor not shown, as desired.

Figure 45:
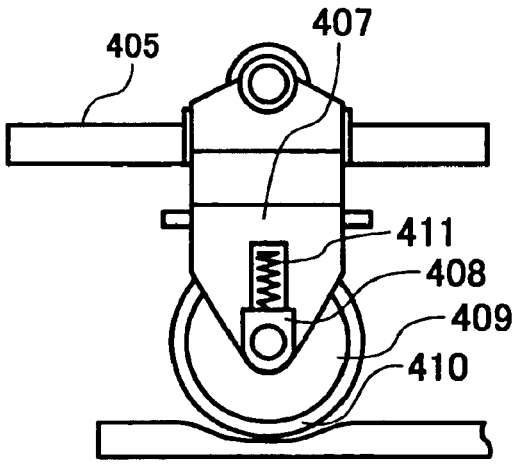
FIG. 45 shows how the reinforce roller rolls on a sheet stack.

As shown in FIG. 45, the friction member 410 mentioned earlier is fitted on part of the reinforce roller 409 that contacts the sheet stack when pressing the fold of the sheet stack, i.e., on at least the circumference of the roller 409 that contacts the sheet stack. More specifically, when the sheet stack is relatively thick, the point where the reinforce roller 409 and sheet stack contact sinks and makes it difficult for the roller 409 to rotate. In such a condition, the friction member 410 guarantees a frictional force necessary for rotation between the sheet stack and the reinforce roller 409, preventing the fold roller 409 from slipping on and rubbing an image, which may exist on the top of the sheet stack. The image is therefore protected from smearing.

Figure 46:
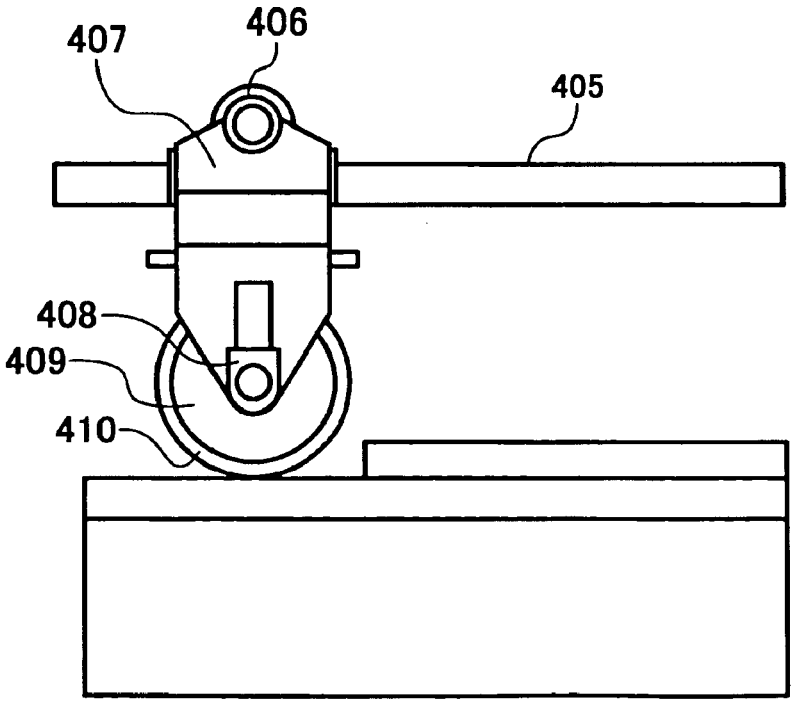
FIG. 46 shows the reinforce roller and support member supported by a movable support member such that they are rotatable, but not movable in the up-and-down direction.
Figure 47:
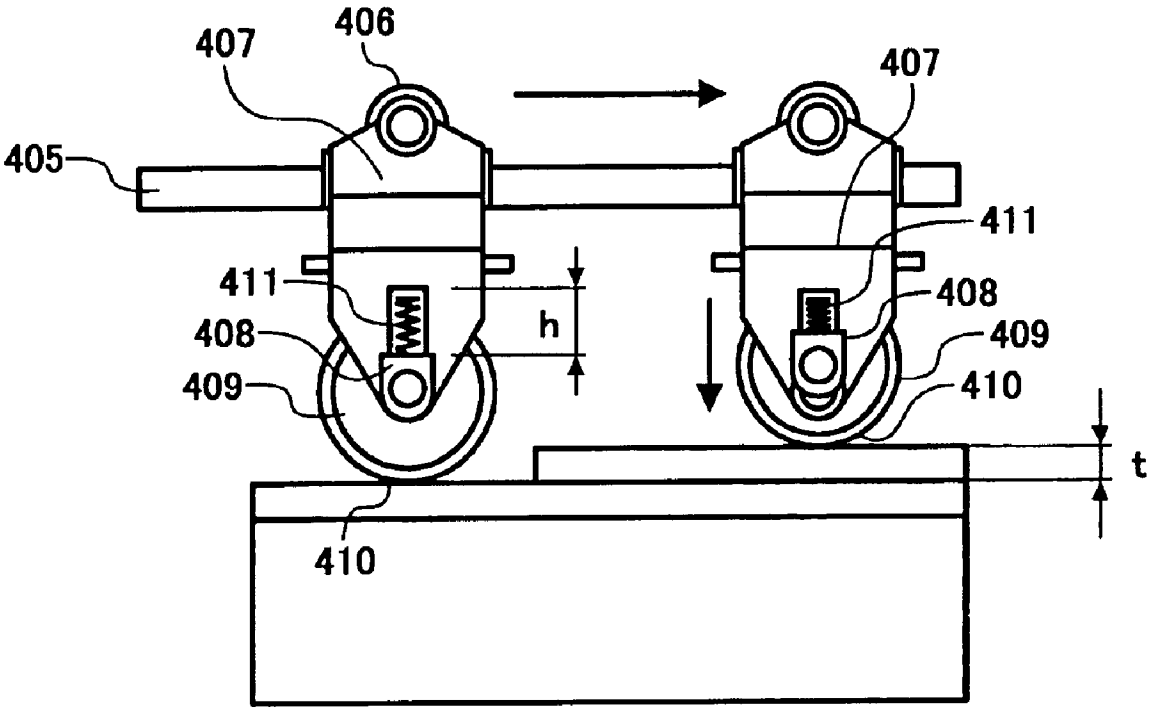
FIG. 47 shows the reinforce roller rotatably supported by the support member and the support member configured to be movable in the up-and-down direction while sliding on the movable support member.

As shown in FIG. 46, assume that the reinforce roller 409 and roller support member 408 are rotatable relative to the slider 407, but not movable in the up-and-down direction. Then, when the sheet stack is relatively thick, the reinforce roller 409 may fail to get on the sheet stack and reinforce the fold. By contrast, in the illustrative embodiment, not only the reinforce roller 409 is rotatably supported by the roller support member 408, but also the roller support member 408 is movable in the up-and-down direction while sliding on the slider 407, as shown in FIG. 47. In FIG. 47, if the distance h by which the roller support member 408 is movable in the up-and-down direction is selected to be greater than the maximum thickness t of a sheet stack folded by the folding device preceding the reinforce roller unit 400, the reinforce roller 409 can easily get on fold of the sheet stack. Further, the coil spring 411, pressing the reinforce roller 409 downward, allows the roller 409 to further neatly reinforce the fold of the sheet stack.

Figure 48:
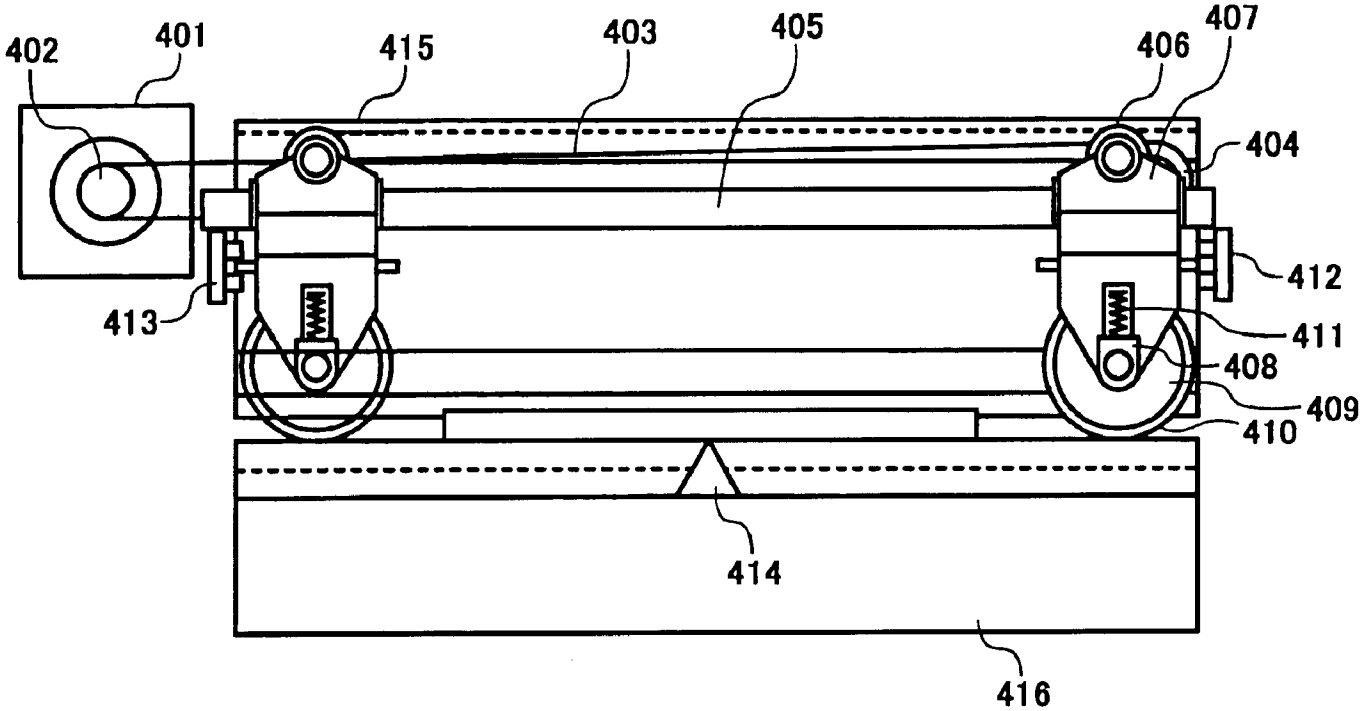
FIG. 48 is a side elevation showing a specific position where a sheet stack sensor is located.

If the reinforce roller 409 is positioned on the sheet stack conveyance path when a sheet stack is transferred from the folding device to the reinforce roller unit 400, then reinforce roller 409 will stop the sheet stack on the path and will therefore fail to press the fold of the sheet stack. The reinforce roller 409 must therefore be retracted from the above path before a sheet stack enters the reinforce roller unit 400. For this purpose, as shown in FIG. 48, the illustrative embodiment locates at least one sheet stack sensor 414 below the lower guide plate 416 at the center portion of the guide member 405. The sheet stack sensor 414 senses a sheet stack via a hole formed in the lower guide plate 416. When the sheet stack sensor 414 senses the leading edge of a sheet stack, the reinforce roller 409 is surely retracted from the conveyance path on the basis of the output of the sensor 414.

Figure 49:
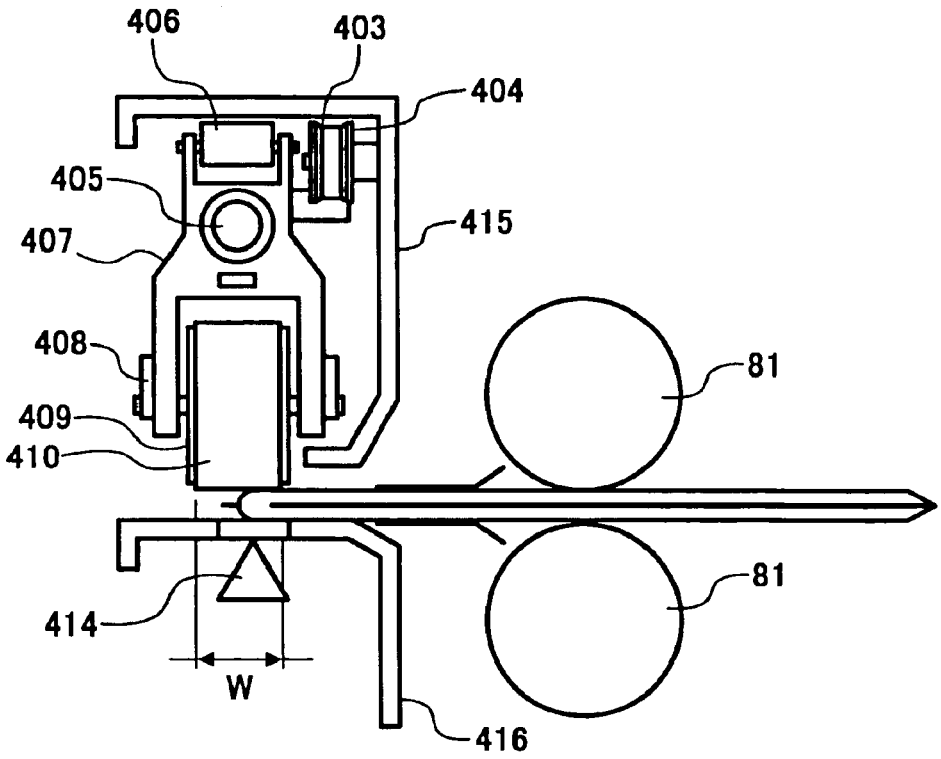
FIG. 49 shows the sheet stack sensor located in the pressing range of the reinforce roller.
Figure 50:
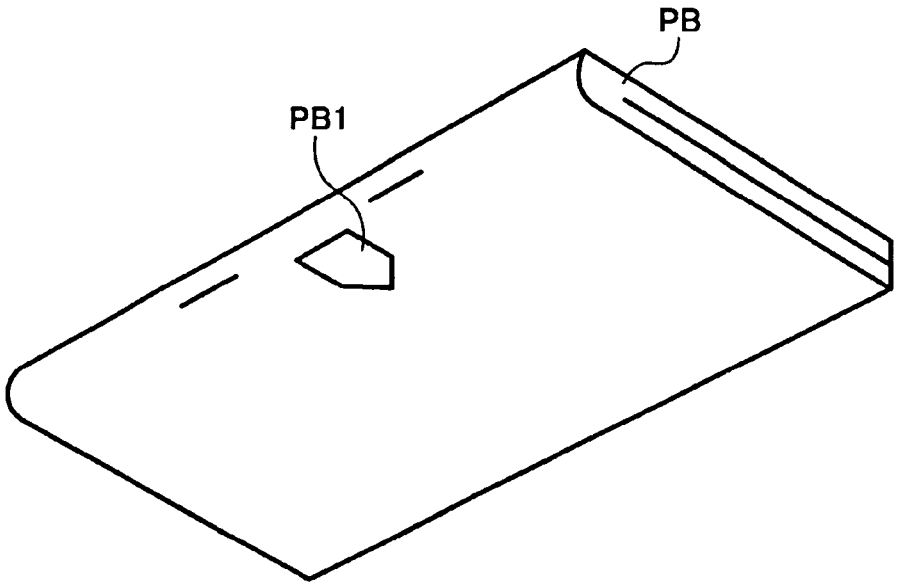
FIG. 50 shows a protuberance formed in a sheet stack.
Figure 51:
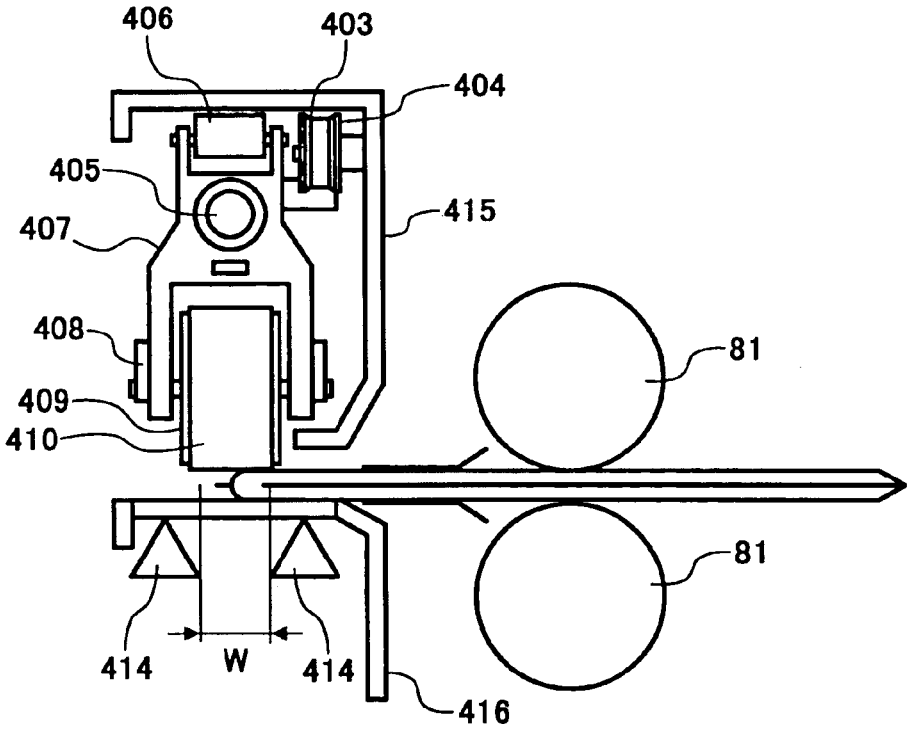
FIG. 51 shows the sheet stack sensor located outside of the pressing range of the reinforce roller.

As shown in FIG. 49, assume that the sheet stack sensor 414 lies in a pressing range w over which the reinforce roller 409 presses a sheet stack. Then, as shown in FIG. 50, when the reinforce roller 409 presses the fold of a sheet stack, part PB1 of the surface of the sheet stack protrudes in accordance with the shape of the hole formed in the lower guide plate 416 and assigned to the sheet stack sensor 414. By contrast, as shown in FIG. 51, if the sheet stack sensor 414 and the hole of the lower guide plate 416 are positioned outside of the above range w and if a sheet stack is conveyed by preselected pulses into the range after it has been sensed by the sheet stack sensor 414, then the reinforce roller 409 can press the fold of the sheet stack while obviating the protuberance PB1.

Figure 52:
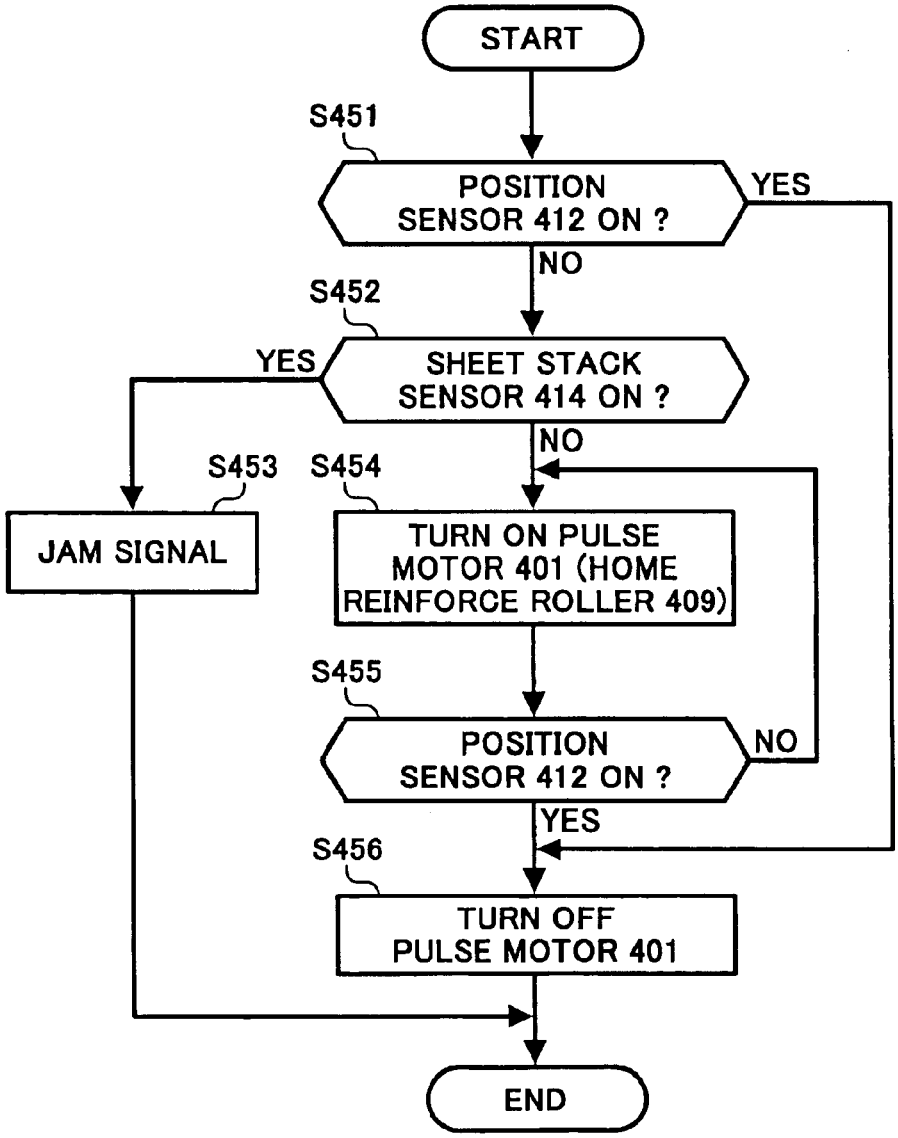
FIG. 52 is a flowchart demonstrating a reinforce roller initializing procedure.

Reference will be made to FIG. 52 for describing more specifically the return of the reinforce roller 409 to the home position effected in the step S533 of the procedure shown in FIG. 34. As shown, if the position sensor 412 is in an OFF state (NO, step S451) and if the sheet stack sensor 414 is in an OFF state (NO, step S452), then the pulse motor 401 is driven to move the reinforce roller 409 toward the home position (step S454). Subsequently, when the other position sensor or home position sensor 412 turns on, the pulse motor 410 is turned off (step S455). If the sheet stack sensor 414 is in an ON state, as determined in the step S452, meaning that the sensor 414 has sensed a sheet stack before the arrival of the reinforce roller 409 at the home position, then a jam signal is output (step S453).

Figure 19:
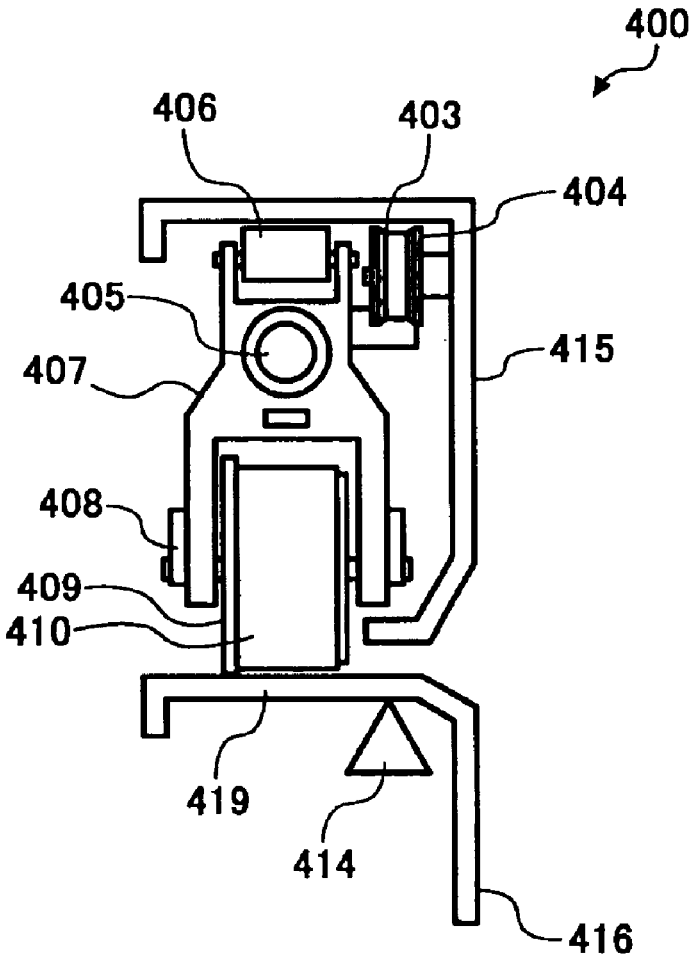
FIG. 19 is a front view of the reinforce roller unit in which a flange is formed on one side of the reinforce roller.
Figure 53:
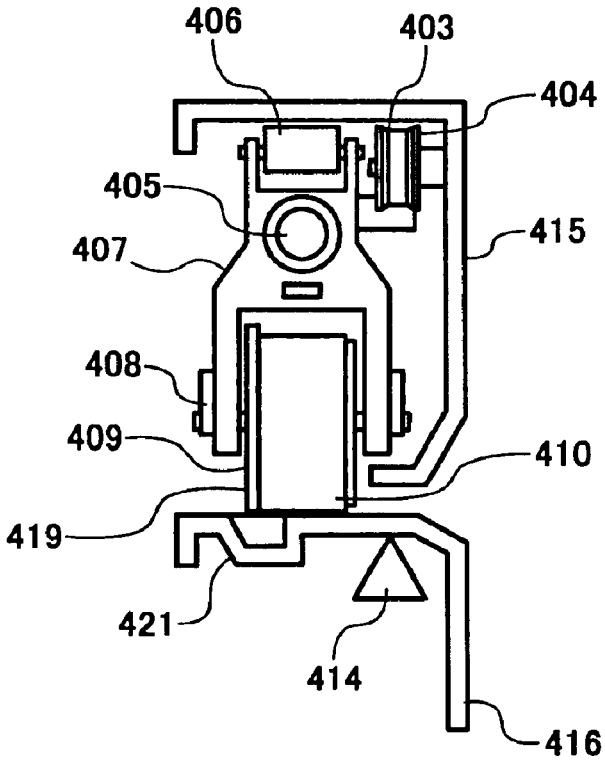
FIG. 53 is a front view showing a modification of the lower guide plate.

FIG. 53 shows a modification of the lower guide plate 416 effective when the flange 419, FIG. 19 cannot sufficiently cope with noise alone. As shown, an elastic material 421 is positioned on part of the lower guide plate 416 which the flange 419 contacts. The elastic material 421 sufficiently reduces noise in cooperation with the flange 419.

Figure 54:
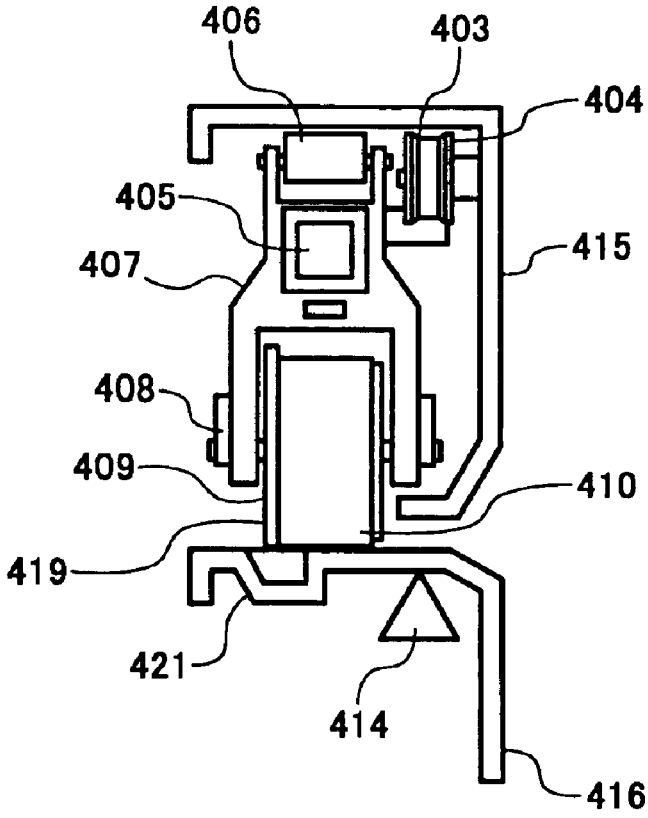
FIG. 54 is a front view showing a modification of the guide member.

FIG. 54 shows a modification of the guide member 405. As shown, while the guide member 405 shown in FIG. 53 has a circular section, the modified guide member 405 shown in FIG. 54 has a rectangular section in order to prevent the reinforce roller 409 from tilting when the sheet stack is relatively thick, as described with reference to FIG. 20. However, the crux is that the guide member 405 includes at least one corner in a section so as to prevent the slider 407, slidable along the guide member 405, from tilting. This allows the reinforce roller 409 to surely press the fold of a sheet stack without causing the pressure from escaping.

Figure 55:
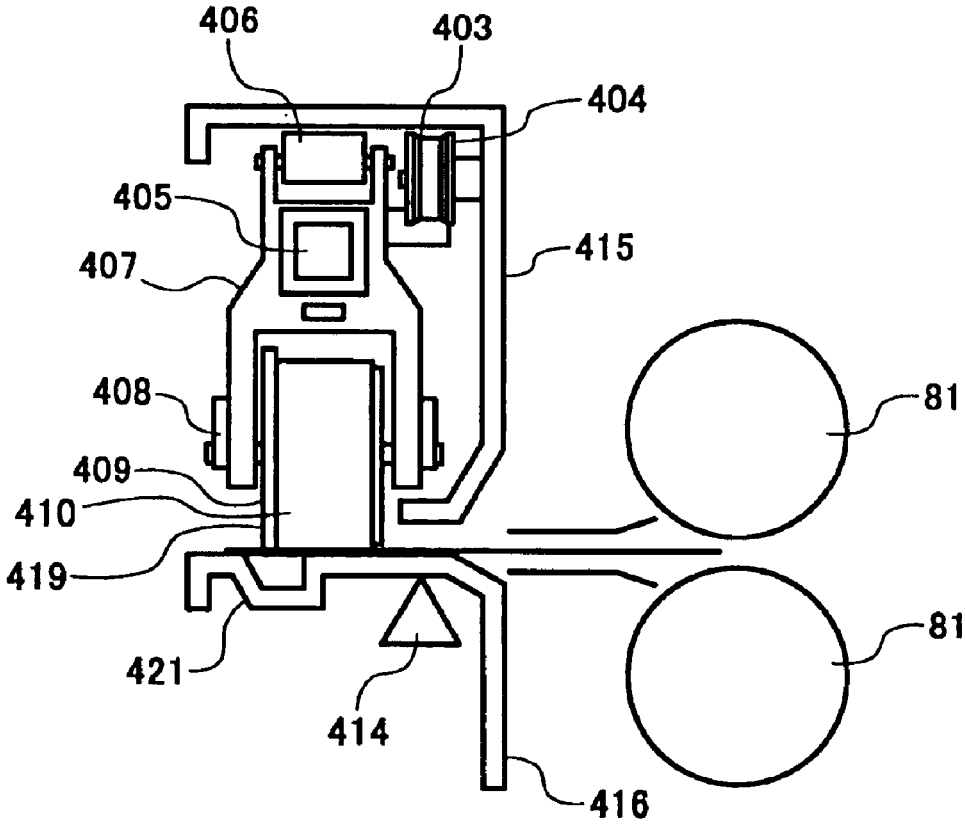
FIG. 55 is a front view of the reinforce roller unit in which the position of the lower guide plate is determined in relation to the position of the nip of the fold roller pair.
Figure 56:
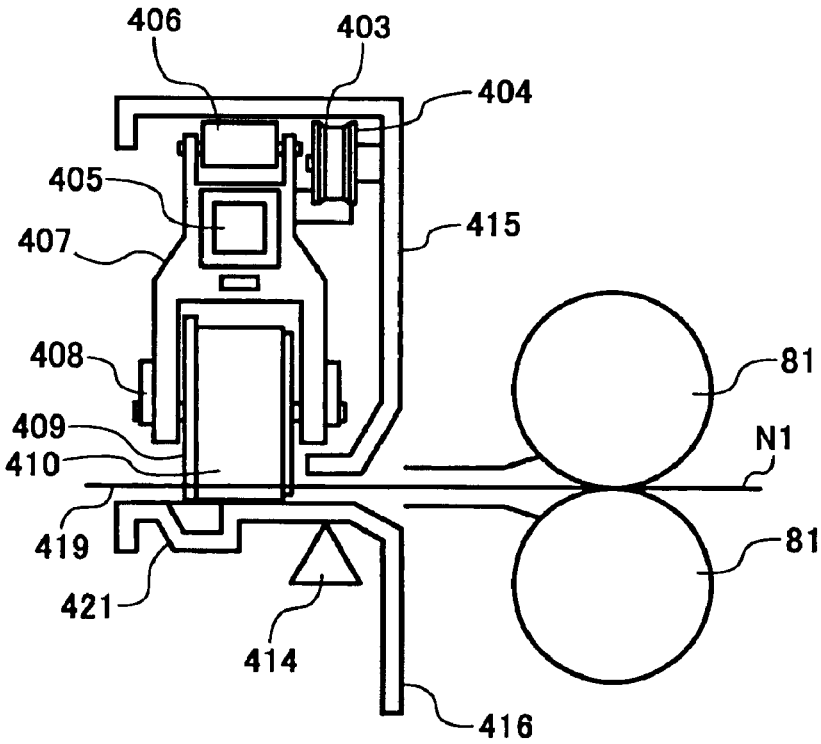
FIG. 56 is a front view showing the reinforce roller unit in a condition in which the above two positions are shifted from each other.
Figure 57:
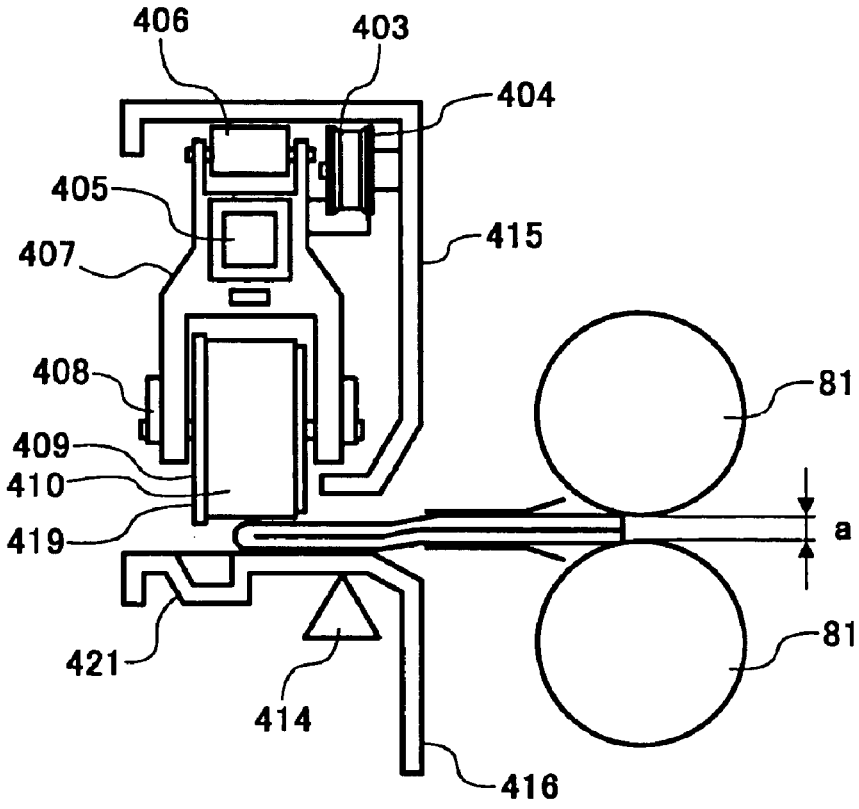
FIG. 57 shows a condition in which the reinforce roller presses a sheet stack introduced into the reinforce roller unit in a bent position.

FIG. 55 shows a specific configuration providing a particular positional relation between the lower guide member 416 and the nip of the fold roller pair 81. As shown in FIG. 56, assume that the nip between the reinforce roller 409 and the lower guide plate 416 is difference in level or height from the nip, labeled N1, of the fold roller pair 81. Then, as shown in FIG. 57, the sheet stack is bent with the result that a gap a is produced between the position of the fold provided by the fold roller pair 81 and the position where the reinforce roller 409 again presses the fold. To solve this problem, in the configuration of FIG. 55, when the reinforce roller 409 is held in a stand-by position before pressing the fold of a sheet stack and when the former presses the latter, the nip between the reinforce roller 409 and the lower guide plate 416 is maintained at the same level or height as the nip of the fold roller pair 81. This prevents the fold of a sheet stack from being shifted.

Figure 58:
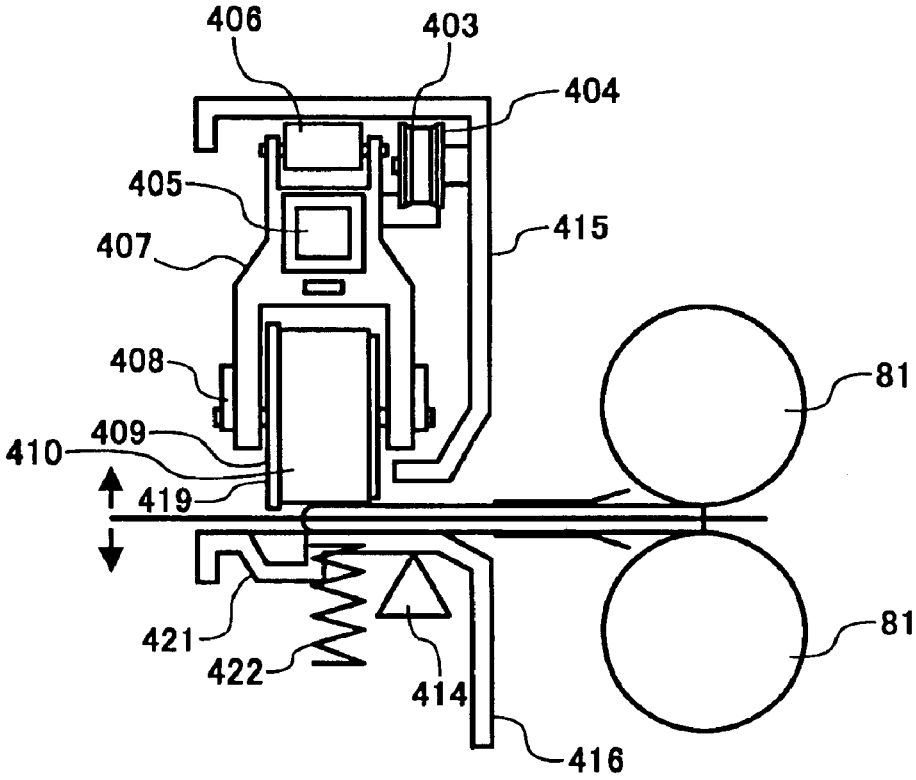
FIG. 58 is a front view showing a modification of the lower guide plate.
Figure 59:
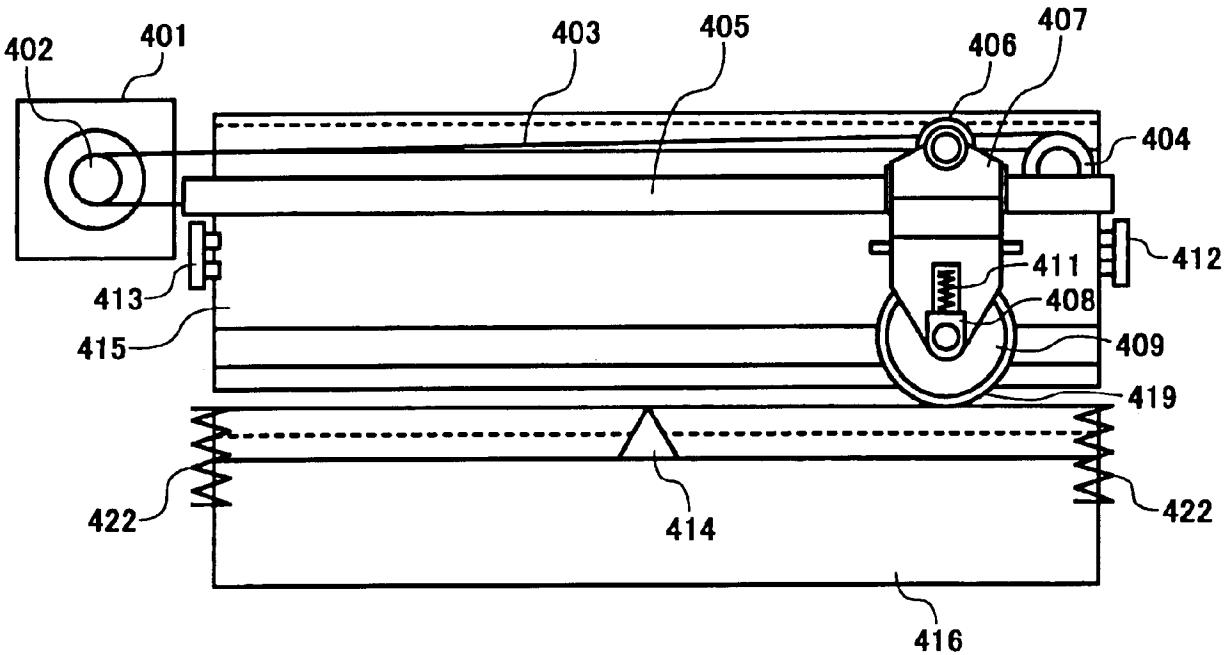
FIG. 59 is a side elevation showing another modification of the lower guide plate.

FIGS. 58 and 59 show a modified form of the modification described with reference to FIG. 55. As shown, to obviate the gap a, FIG. 57, the lower guide plate 416 is configured to be movable in the up-and-down direction perpendicularly to the axis of the reinforce roller 409. A biasing member 422 constantly biases the lower guide plate 416 with the same force as, but in the opposite direction to, the biasing member 411 biasing the reinforce roller 409. Even when the sheet stack is relatively thick, the biasing member 422 maintains the nip between the reinforce roller 409 and the lower guide plate 416 at the same level as the nip of the fold roller pair 81, as shown in FIG. 58. The fold of a sheet stack is therefore free from shift.

Figure 60:
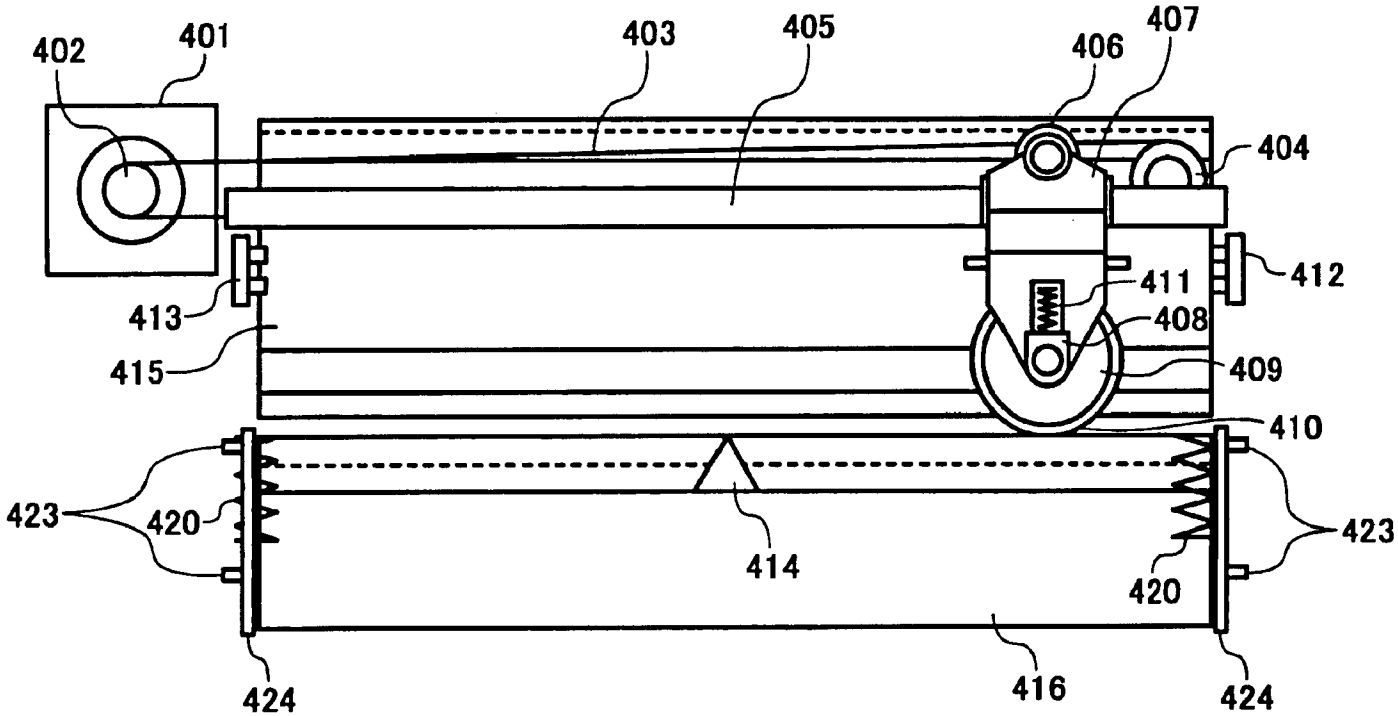
FIG. 60 is a side elevation showing another modification in which position control members are provided on the lower guide member of FIG. 58 or 59.
Figure 61:
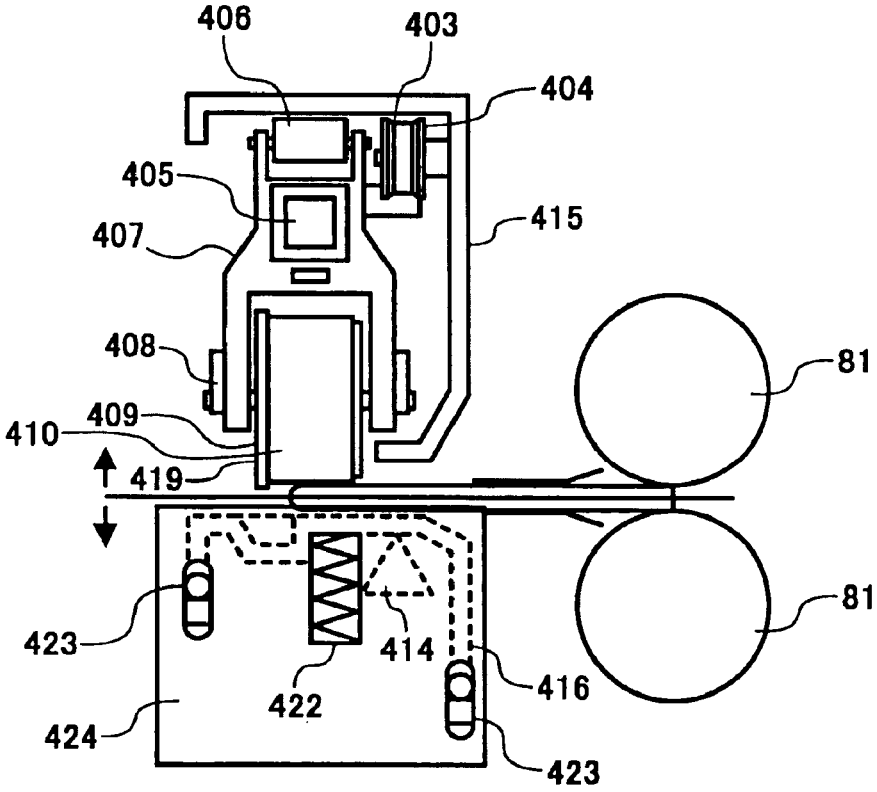
FIG. 61 is a front view showing the modification of FIG. 60.
Figure 62:
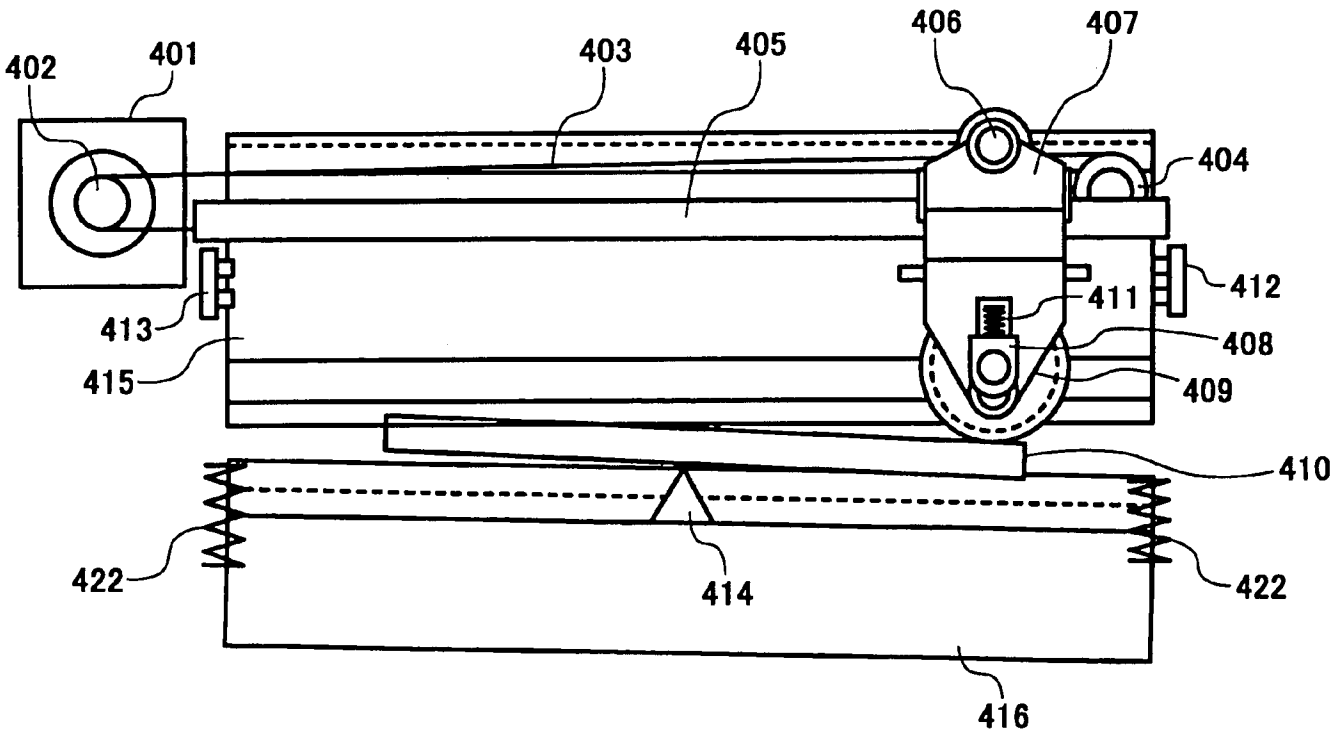
FIG. 62 is a side elevation showing a condition in which the position of the lower guide plate is not controlled.
Figure 63:
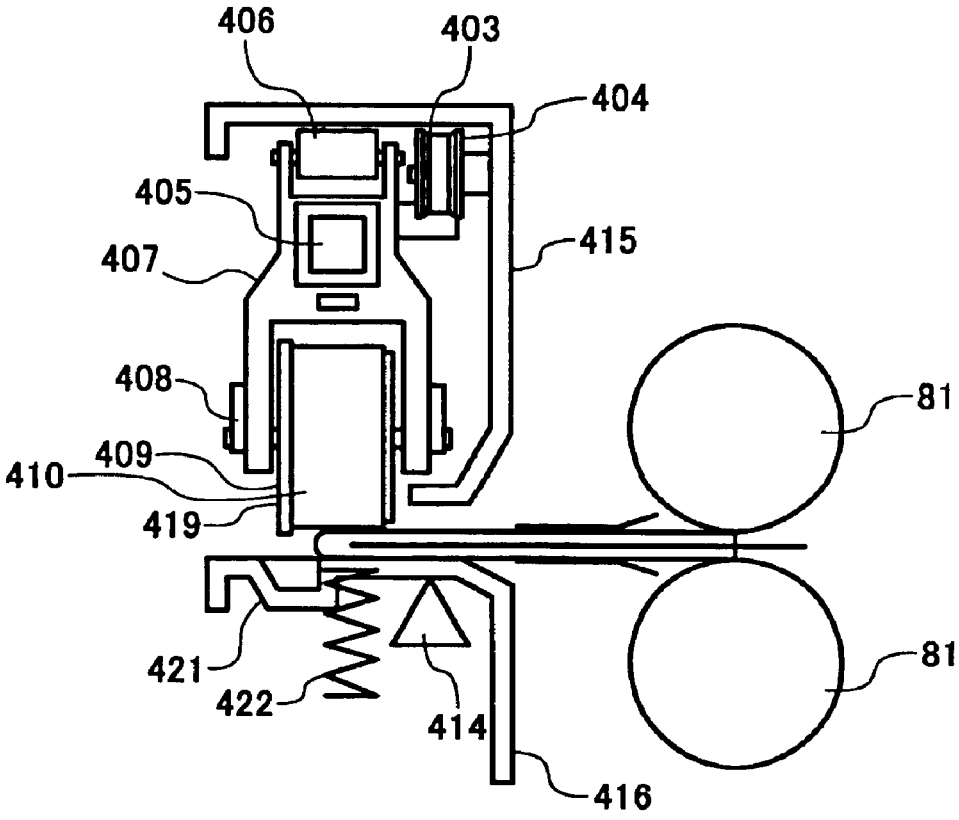
FIG. 63 is a front view showing a condition in which the position of the lower guide plate is not controlled.

FIGS. 60 and 61 show another modified form of the modification shown in FIG. 55. As shown in FIG. 62 or 63, if the position of the lower guide plate 416 is not restricted, then the lower guide plate 416 may tilt when the reinforce roller 409 is pressing the fold of a sheet stack. As a result, the nip between the reinforce roller 409 and the lower guide plate 416 is shifted or the pressure expected to act on the fold of a sheet stack escapes, preventing the reinforce roller 409 from neatly reinforcing the fold.

In light of the above, as shown in FIG. 60, position regulating members or control members 423 are provided on the lower guide plate 416 and movably received in elongate slots formed in side plates 424, so that the lower guide plate 416 can move in the up-and-down direction without tilting. In this configuration, as shown in FIG. 61, when the reinforce roller 409 presses the fold of a sheet stack, the nip between the reinforce roller 409 and the lower guide plate 416 is located at the same level as the nip of the fold roller pair 81 positioned upstream of the reinforce roller unit 400. The reinforce roller 400 can therefore neatly reinforce the fold of the sheet stack. The slots in which the position regulating members 423 are received may be formed in any other members so long as they are stationary, if desired.

Second Embodiment

Figure 64:
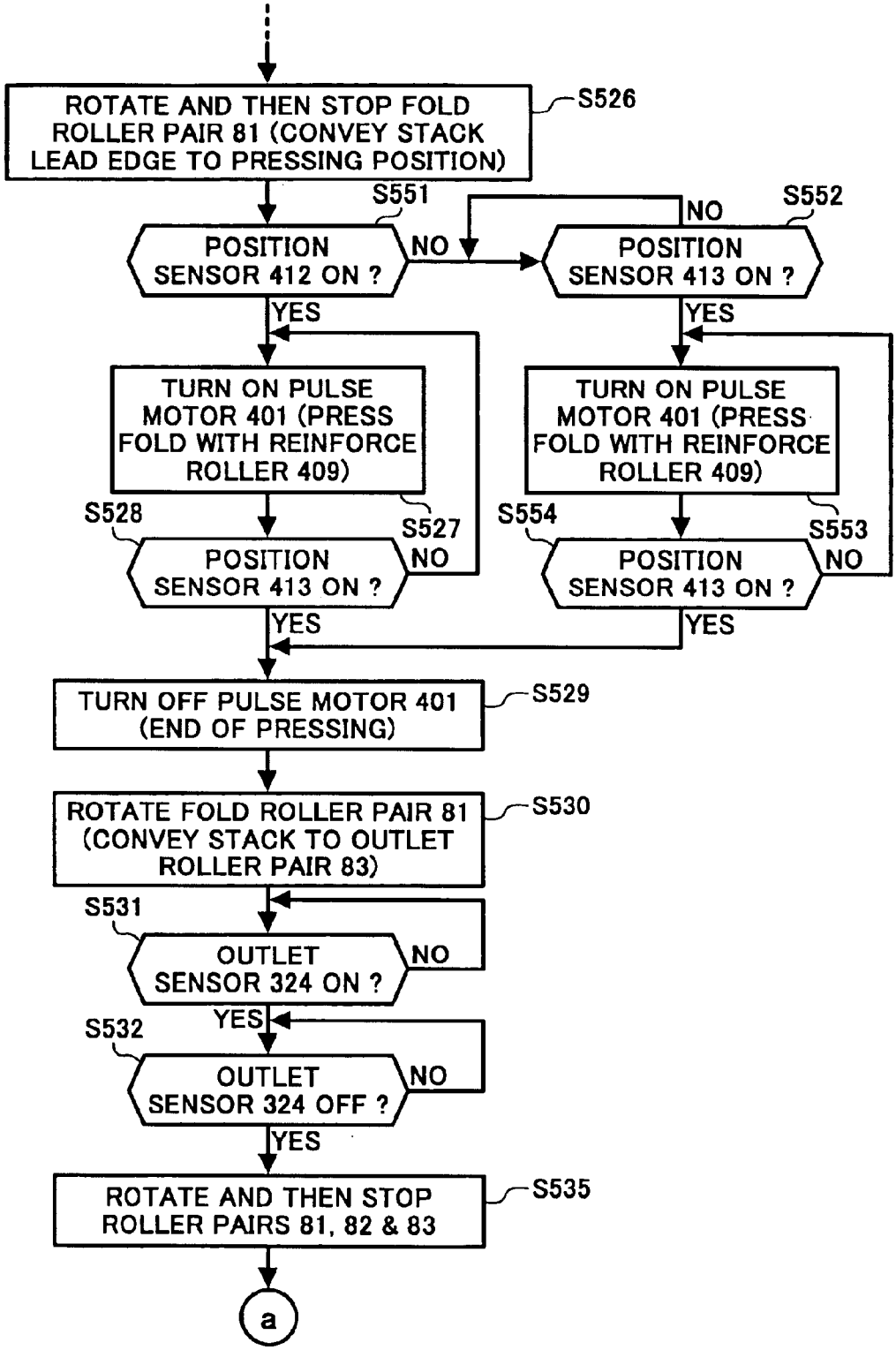
FIG. 64 is a flowchart demonstrating part of a center staple and bind mode representative of a second embodiment of the present invention.
Figure 65:
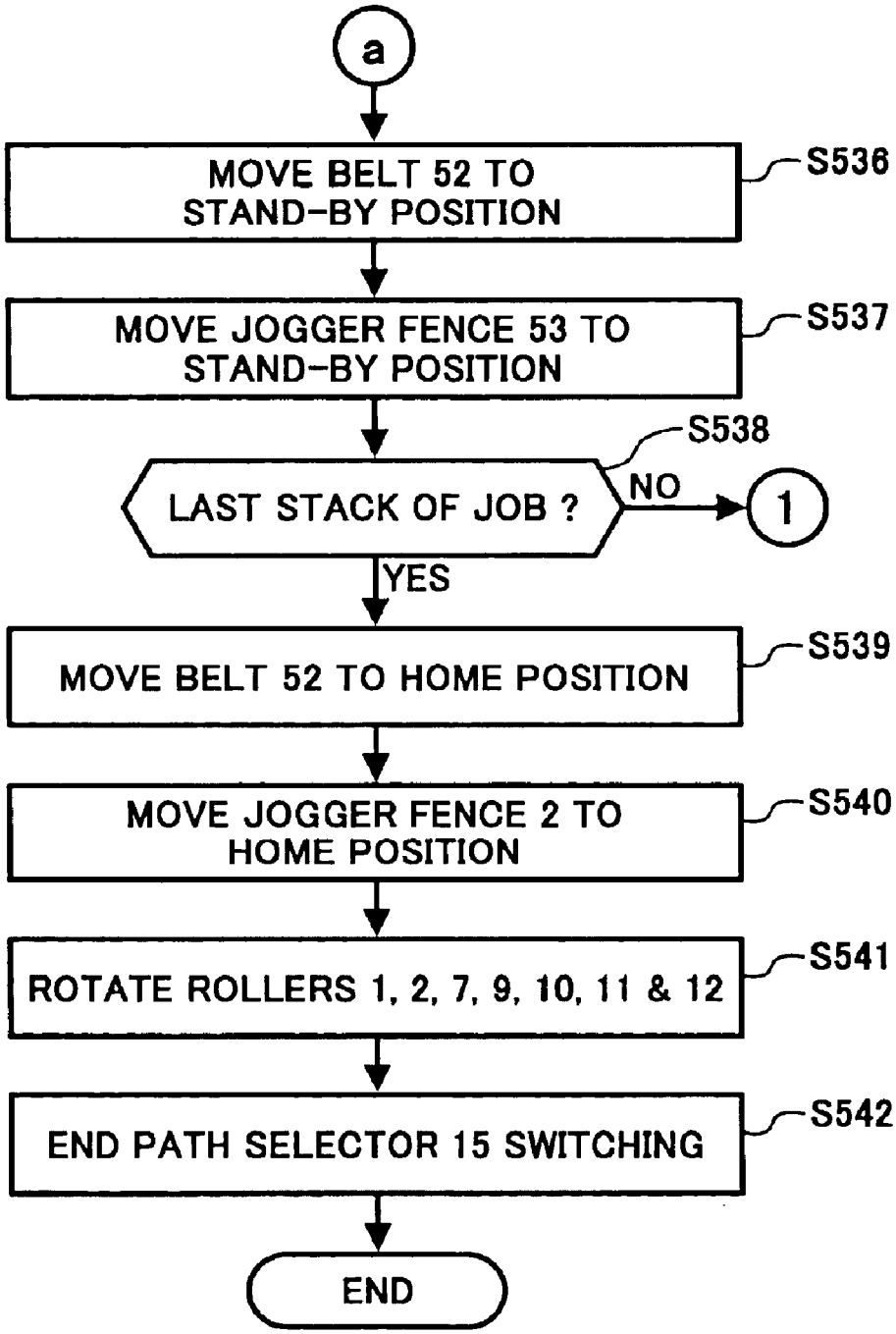
FIG. 65 is a flowchart demonstrating another part of the center staple and bind mode.

Reference will be made to FIGS. 64 and 65 for describing a second embodiment of the present invention Briefly, in the center staple and bind mode or fold reinforcement mode, the illustrative embodiment causes the reinforce roller 409 to press the fold of a sheet stack during each of forward and backward movements. A step S513 at which a procedure shown in FIG. 64 starts follows the step S512 of FIG. 32. Because the procedure of FIG. 65 is identical with the procedure described with reference to FIGS. 32 through 34 except for the steps S526 through S519, the following description will concentrate on differences between the two procedures.

As shown in FIG. 64, after a sheet stack has been conveyed to the pressing position assigned to the reinforce roller 409 in the step S526, whether or not the position sensor 412 responsive to the home position of the reinforce roller 409 has turned on is determined (step S551). If the answer of the step S551 is YES, then the pulse motor 401 is energized to cause the reinforce roller 409 to move forward while pressing the fold of the sheet stack (step S527). The pulse motor 401 is then turned off when the other position sensor responsive to the end-of-reinforcement turns on.

If the answer of the step S551 is NO, meaning that the reinforce roller 409 is not located at the home position, then whether or not the reinforce roller 409 is located at the end-of-reinforcement position is determined (step S552) on the basis of the output of the position sensor 413. If the answer of the step S552 is YES, then the pulse motor 401 is driven in the reverse direction to move the reinforce roller 409 toward the home position in the backward direction while again pressing the fold of the sheet stack (S553). Subsequently, when the position sensor 412 at the home position side turns on (YES, step S554), the pulse motor 401 is turned off (step S529). This is followed by the step S530 and successive steps.

As stated above, in the illustrative embodiment, the reinforce roller 409 presses the fold of a sheet stack during each of forward and backward movements for thereby reinforcing the fold of the sheet stack. In addition, the reinforce roller 409 does not have to be returned to the home position every time it reaches the end-of-reinforcement position, promoting efficient operation.

If desired, the reinforce roller 409 may be moved back and forth while pressing the fold of a sheet stack two times. In this case, when the position sensor 413 at the end-of-reinforcement side turns on in the step S528, the procedure returns to the step S551. At this instant, because the position sensor 412 at the home position side is in an OFF state, whether or not the position sensor 413 is in an ON state is determined in the step S552. At this instant, because the position sensor 413 is in an ON state, the steps S553 and S554 are executed until the position sensor 413 turns on. When the position sensor 413 turns on, the pulse motor 401 is turned off. In this manner, the reinforce roller 409 presses the fold of the sheet stack two times.

As for the rest of the configuration, the illustrative embodiment is identical with the second embodiment.

Third Embodiment

A third embodiment of the present invention will be described with reference to FIGS. 66 through 72. In the first embodiment, the flange 419 is formed of an elastic material while the elastic material 421 is provided on the lower guide member 416, thereby reducing noise ascribable to the step between the sheet stack and the lower guide plate 416. The third embodiment is configured to control the moving speed of the reinforce roller 409 for the same purpose as the first embodiment.

Figure 66:
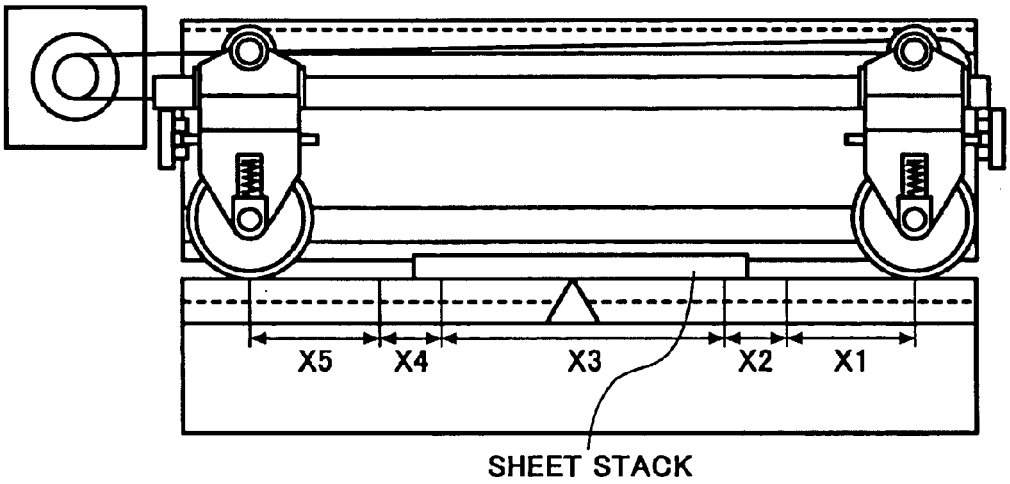
FIGS. 66 through 71 are views for describing speed control unique to a third embodiment of the present invention.
Figure 67:
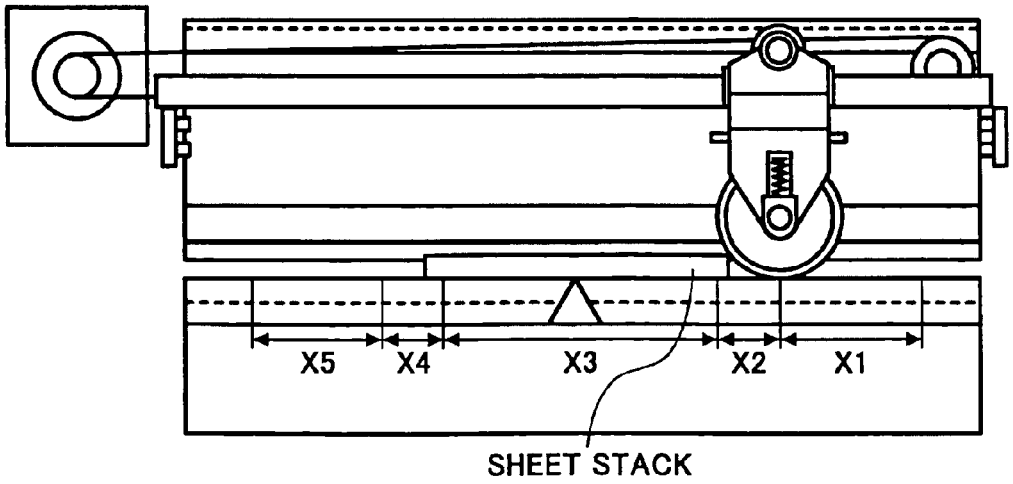
Figure 68:
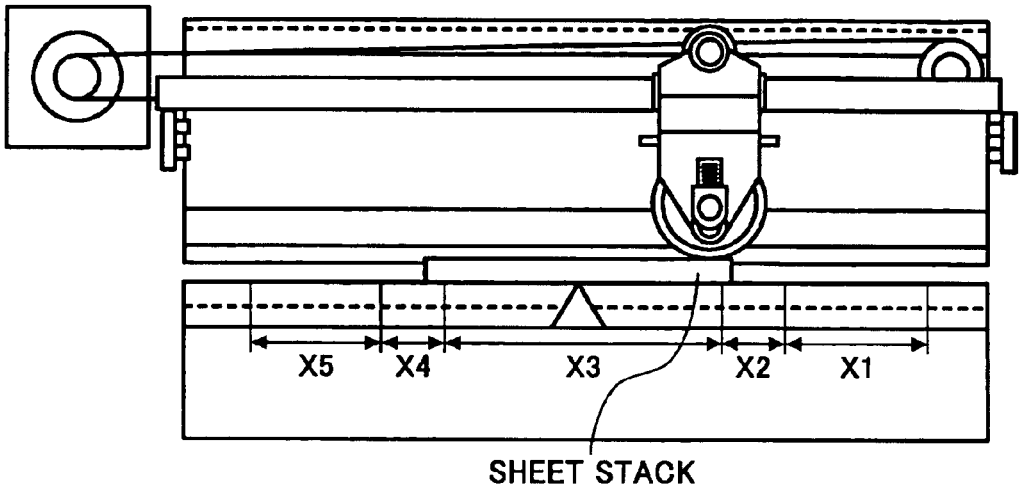
Figure 69:
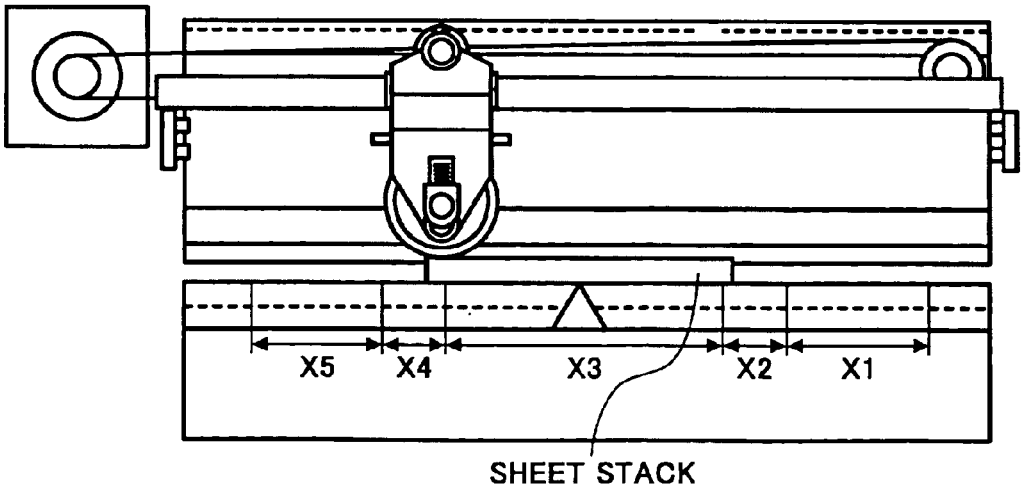
Figure 70:
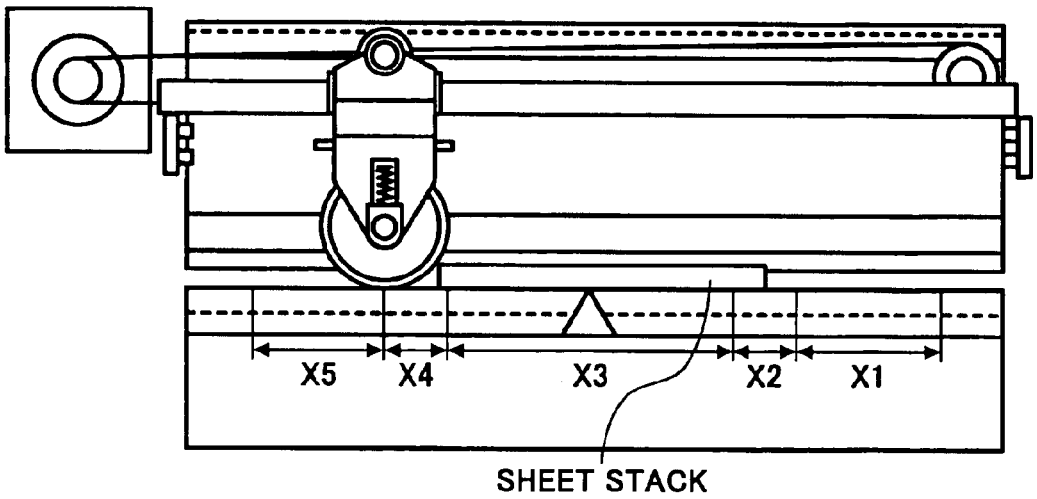
Figure 71:
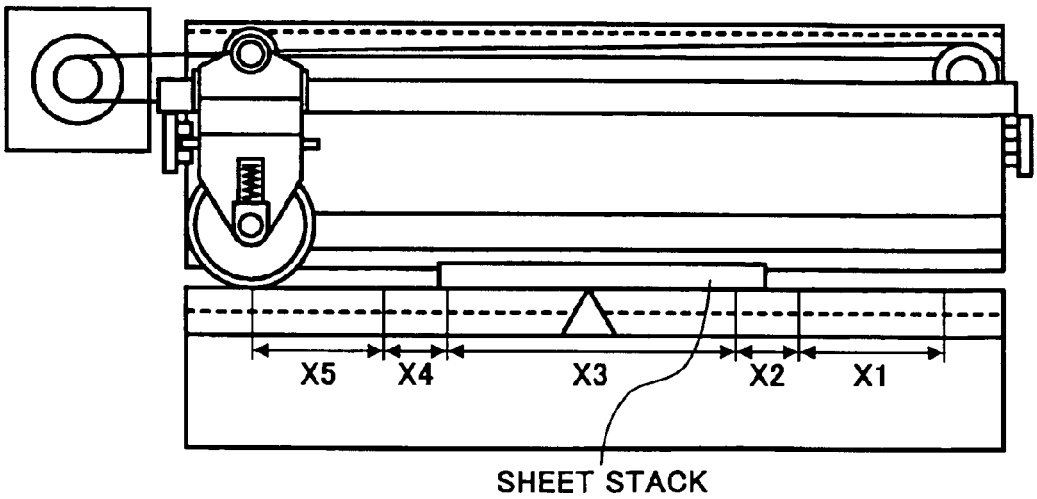

A distance from the home position (abbreviated as HP hereinafter) of the reinforce roller 409 to one edge of a sheet stack, i.e., a press start position and a distance from the other edge of the sheet stack, i.e., a press end position to the stop position of the roller 409 can be calculated on the basis of sheet size information received from the image forming apparatus PR. Every sheet stack is dislocated in the direction perpendicular to the direction of conveyance before arriving at the reinforce roller unit 400. Taking this into account, as shown in FIG. 66, there can be set a zone X1 in which the reinforce roller 409 does not get on a sheet stack, a zone X2 in which the roller 409 may get on the sheet stack, a zone X3 in which the roller 409 presses the sheet stack, a zone X4 in which the roller 409 comes down from the sheet stack onto the lower guide plate 416, and a zone X5 terminating at the stop position of the roller 409.

Assume that a usual speed necessary for the reinforce roller 409 to move is V1, that a speed that allows the roller 409 to get on one edge of a sheet stack without leaving a roller mark on the edge is V2, that a speed necessary for the roller 409 to reinforce the fold of the sheet stack is V3, and that a speed that allows the roller 409 to come down from the other edge of the sheet stack onto the lower guide plate 416 without producing noise is V4. Then, as shown in FIGS. 67 through 70, the roller 409 is moved from HP at the speed V1 over the zone X1, moved at the speed V2 over the zone X2, moved at the speed V3 over the zone X3, and then moved at the speed V4 over the zone X4. Finally, as shown in FIG. 71, the roller 409 is again moved at the speed V1 over the zone X5. This allows the roller 409 to press the sheets tack without leaving a roller mark on the sheet stack or producing noise.

In the above description, the reinforce roller 409 is assumed to start moving at the same HP every time it presses a sheet stack. By contrast, assume that the position where the roller 409 has ended pressing the preceding sheet stack is used as a press start position (HP) for the following sheet stack. Then, a relation to be described hereinafter holds between the speeds V1 through V4 and the zones X1 through X5 when the roller 409 is moved from the HP opposite to the original HP.

The roller 409 is moved at the speed V1 over the zone X5 and then moved at the speed V2 over the range X4 when getting on a sheet stack. Subsequently, the roller 409 is moved at the speed V3 over the zone X3 while pressing the sheet stack, moved at the speed V4 over the zone X2 when coming down from the sheet stack onto the lower guide plate 416, and then moved at the speed V1 over the zone X1. Such a procedure will be described more specifically with reference to FIG. 72.

Figure 72:
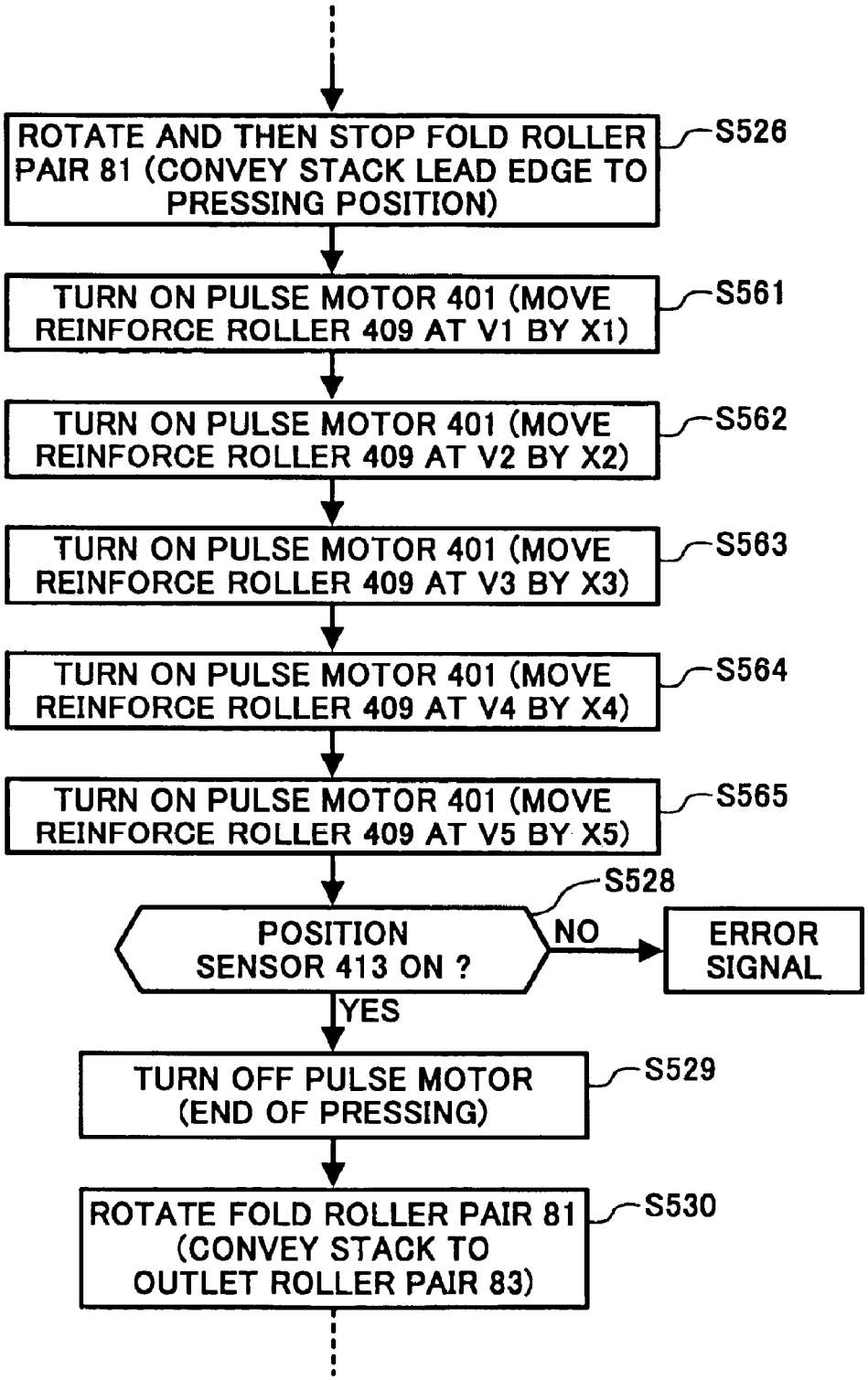
FIG. 72 is a flowchart showing a speed control procedure particular to the third embodiment.

The procedure shown in FIG. 72 is executed between the steps S501 through S512 of FIG. 32 and the steps S531 through S542 of FIG. 65. Steps S561 through S565 of FIG. 72 are substituted for the step S527 of FIG. 33. Because a step S513 of FIG. 72 follows the step S512 of FIG. 32 and because a step S531 and successive steps are identical with the corresponding steps of FIG. 65, let the following description concentrate on differences between such procedures.

As shown in FIG. 72, when the fold roller pair 81 conveys a sheet stack until the fold or leading edge of a sheet stack arrives at the pressing position (step S526), the pulse motor 401 is driven to move the reinforce roller 409 at the speed V1 over the zone X1 (step S561), move it at the speed V2 over the zone X2 (step S562), moves it at the speed V3 over the zone X3 (step S563), moves it at the speed V4 over the zone X4 (step S564), and then moves it at the speed V1 over the zone X5 (step S565). Subsequently, when the position sensor 413 positioned at the end-of-reinforcement side, the pulse motor 401 is turned off (step S528).

By controlling the speed of the reinforce roller 409 when the roller 409 gets on a sheet stack and when the former comes down the latter as stated above, it is possible to obviate noise and protect the surface of a sheet stack from damage or smear.

As for the rest of the configuration, the illustrative embodiment is identical with the first embodiment.

Fourth Embodiment

Figure 73:
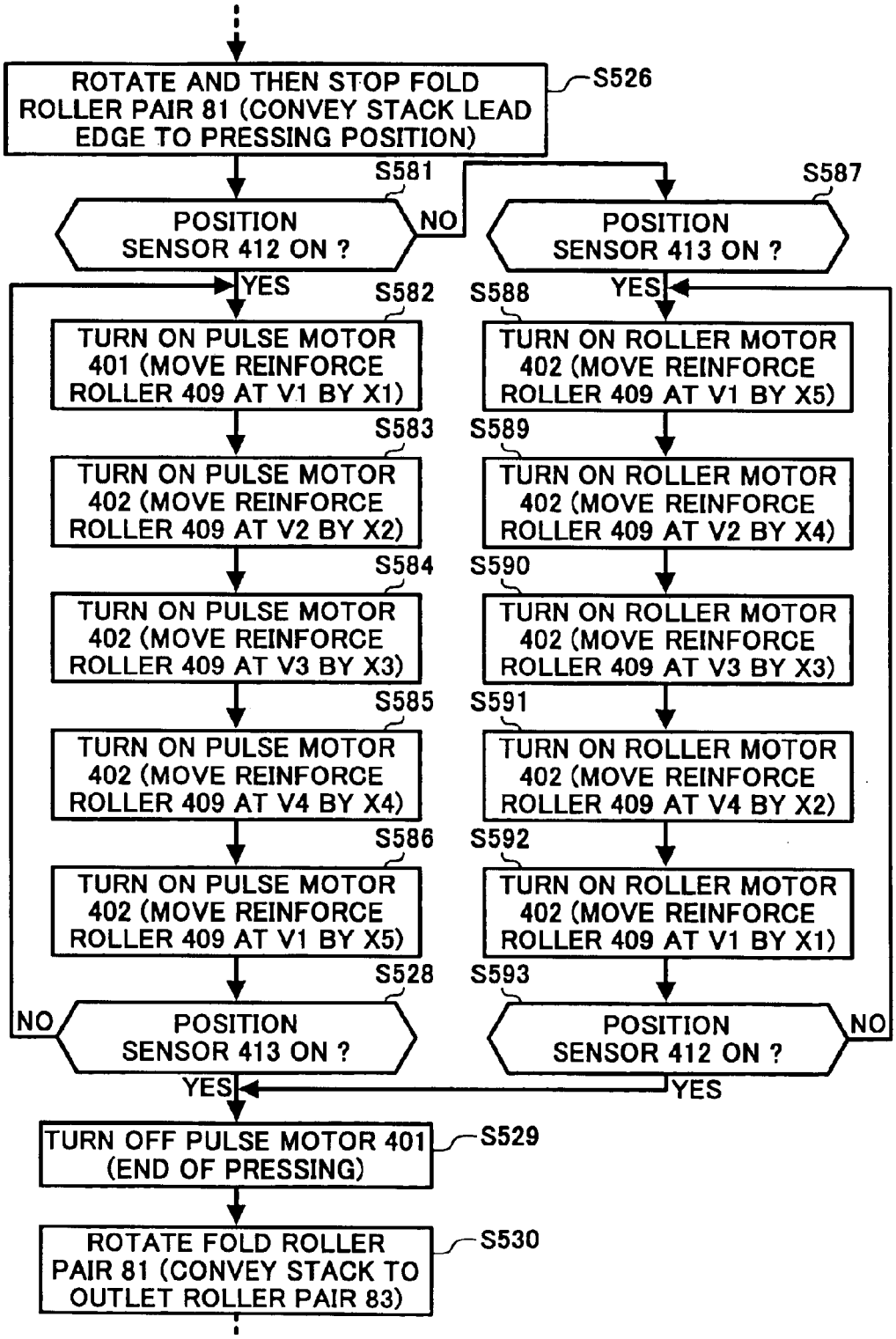
FIG. 73 is a flowchart showing a speed control procedure representative of a fourth embodiment of the present invention.

A fourth embodiment of the present invention will be described with reference to FIG. 73. In the illustrative embodiment, the second embodiment is combined with the first embodiment. More specifically, a procedure shown in FIG. 73 is executed between the steps S501 through S512 of FIG. 32 and the steps S531 through S542 of FIG. 65. Steps S561 through S565 of FIG. 73 are substituted for the step S527 of FIG. 33. Because a step S513 of FIG. 73 follows the step S512 of FIG. 32 and because a step S531 and successive steps are identical with the corresponding steps of FIG. 65, let the following description concentrate on differences between such procedures.

Briefly, in the illustrative embodiment, the reinforce roller 409 presses a sheet stack during both of forward and backward movements while being controlled in speed for obviating noise and protecting the surface of a sheet stack from damage and smear as in the third embodiment.

Assume that, when a sheet stack is brought to the pressing position and stopped there, the position sensor 412 at the HP side is in an ON state, i.e., the reinforce roller 409 is located at the HP. Then, the steps S582 through S583 shown in FIG. 73 are sequentially executed in the same manner as the steps S561 through S565 of the third embodiment. When the other position sensor 413 at the end-of-reinforcement side turns on, the pulse motor 401 is turned off, stopping the reinforce roller 409 at the end-of-reinforcement side. On the other hand, if the position sensor 412 at the HP side is in an OFF state (NO, step S581), then whether or not the position sensor 413 at the end-of-reinforcement side is in an ON state is determined (step S587). If the answer of the step S587 is YES, the steps S588 through S593 are executed, causing the reinforce roller 409 to move in the forward direction. The steps S588 through S593 are opposite to the steps S582 through S586.

The procedure described above is also successful to promote the efficient movement of the reinforce roller 409 while reducing noise and protecting a sheet stack from damage and smear.

As for the rest of the configuration, the illustrative embodiment is identical with the first through third embodiments.

Fifth Embodiment

Figure 74:
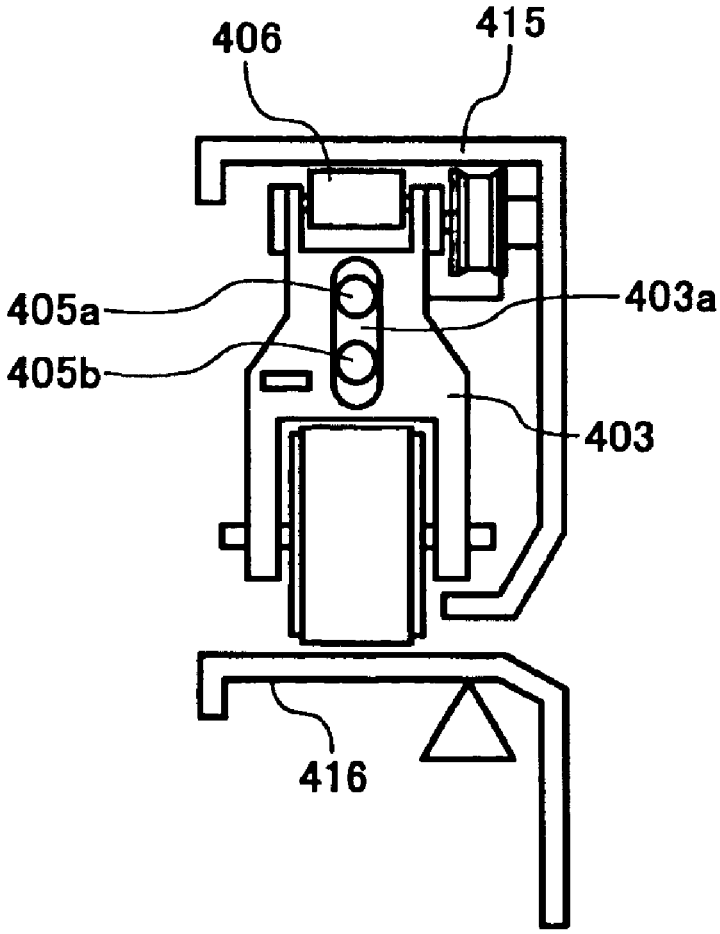
FIG. 74 is a front view showing a reinforce roller unit representative of a fifth embodiment of the present invention.
Figure 75:
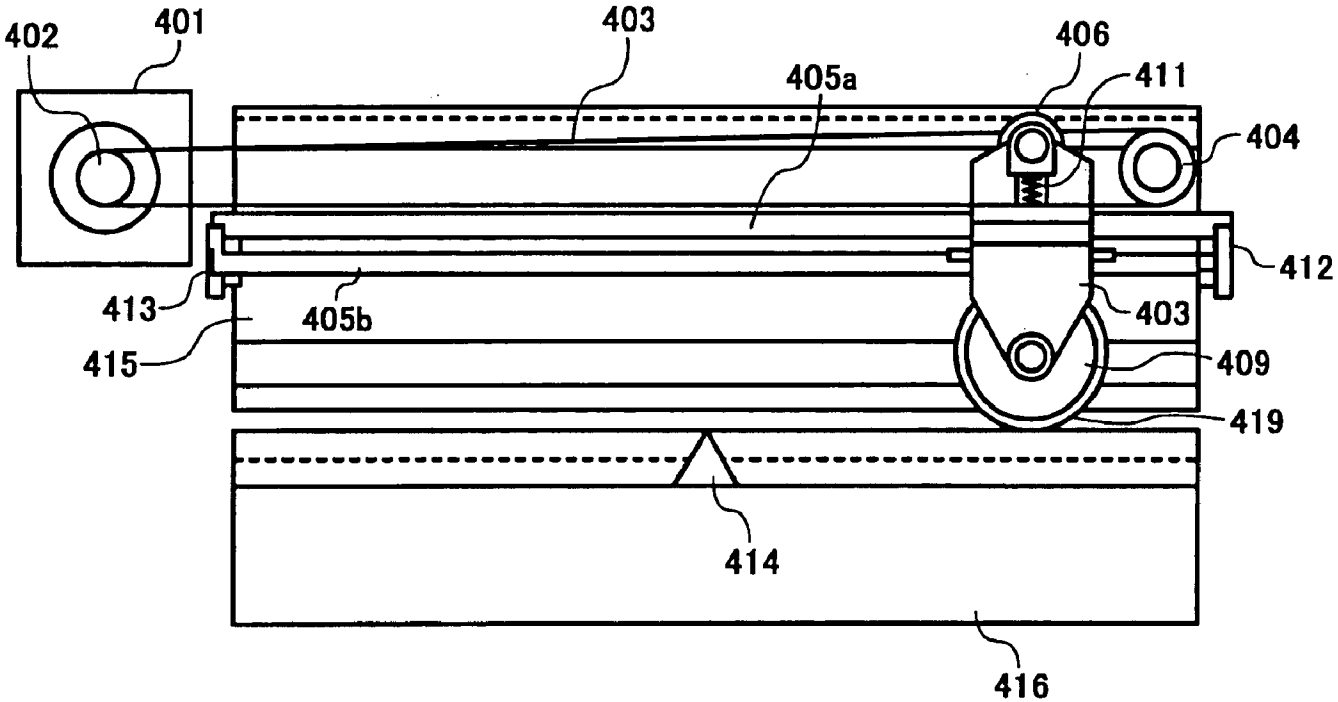
FIG. 75 is a side elevation of the reinforce roller unit shown in FIG. 74.

FIGS. 74 and 75 show a fifth embodiment of the present invention. As shown in FIG. 73, the illustrative embodiment includes a first and a second guide member 405*a* and 405*b* extending perpendicularly to the lower guide plate 416. The elastic member 411 is fitted on the shaft portion of the bend-preventing member 406 intervening between the slider 407 and the upper guide plate 415. The guide members 405*a* and 405*b* are received in a guide slot 403*a* formed in the slider 407 in the vertical direction, as viewed in FIG. 74. Spaces exist between the top of the guide member 405*a* and bottom of the guide member 405*b* and the edge of the guide slot 403*a*, so that the guide members 405*a* and 405*b* are movable vertically relative to the lower guide plate 416.

In the above configuration, when the reinforce member 409 presses a sheet stack, the slider 401 is elastically biased toward or away from the upper guide plate 415 in accordance with the thickness of a sheet stack to be reinforced. In addition, the two guide members 405*a* and 405*b*, supporting the slider 407, prevent the reinforce roller 409 from tilting.

As for the rest of the configuration, the illustrative embodiment is identical with the first to fourth embodiments.

As stated above, in accordance with the first to fifth embodiments of the present invention, the reinforce roller 409 can neatly reinforce the fold of a sheet stack by pressing the fold. Further, the reinforce roller 409 does not slip on the sheet of a sheet stack while pressing its fold and therefore does not rub an image, which may be present on the surface of a sheet stack. Moreover, the reinforce roller 409 does not produce noise when coming down from a sheet stack onto the lower guide plate 416. In addition, because the guide member 405 or guide members 405*a* and 405*b* do not bend, there can be obviated defective reinforcement ascribable to the bend of the guide member 405 and the twist of a belt, which is included in drive means for driving the reinforce roller 405.

Sixth Embodiment

Figure 76:
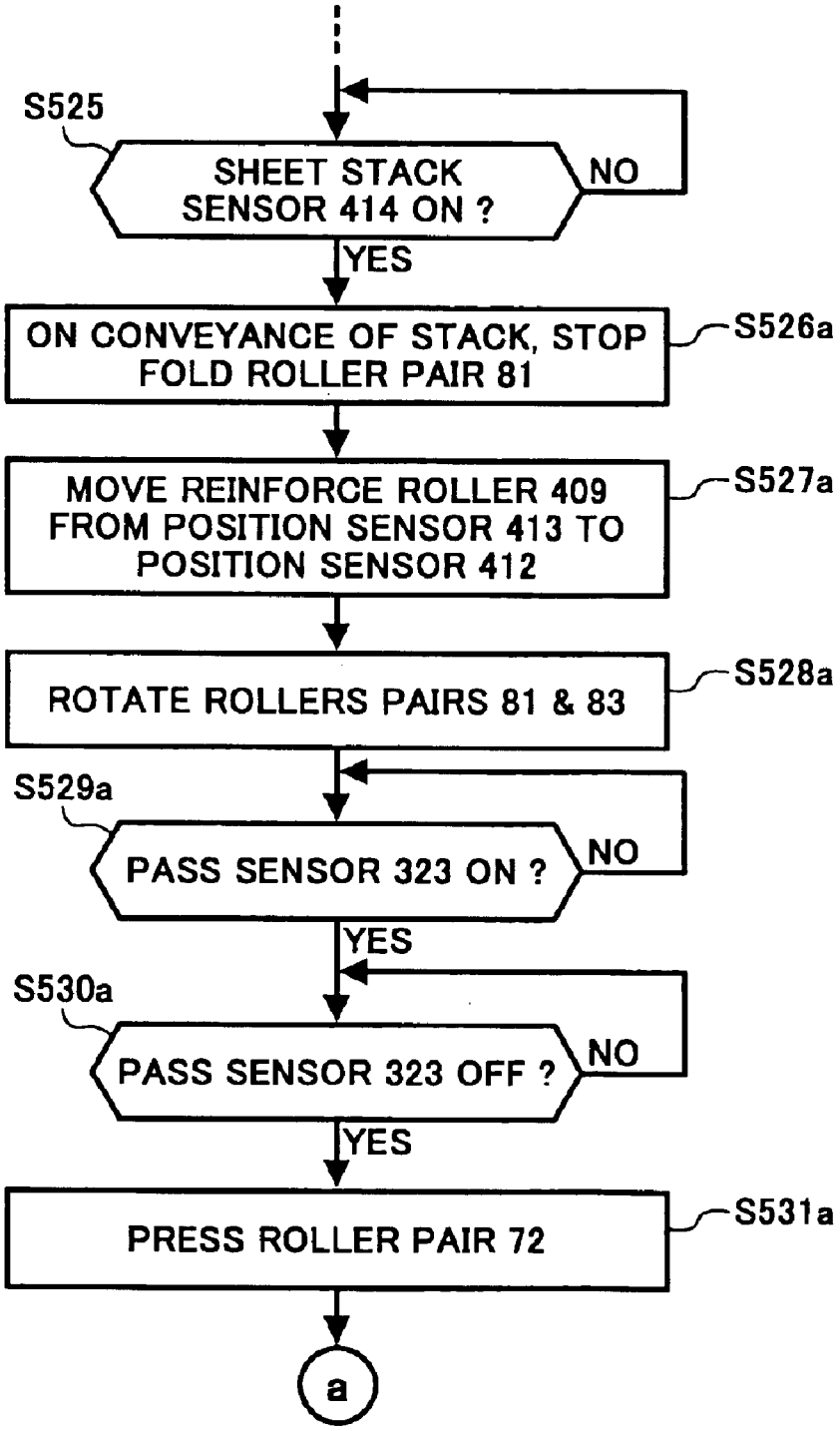
FIG. 76 is a flowchart showing part of a center staple and bind mode representative of a sixth embodiment of the present invention.
Figure 77:
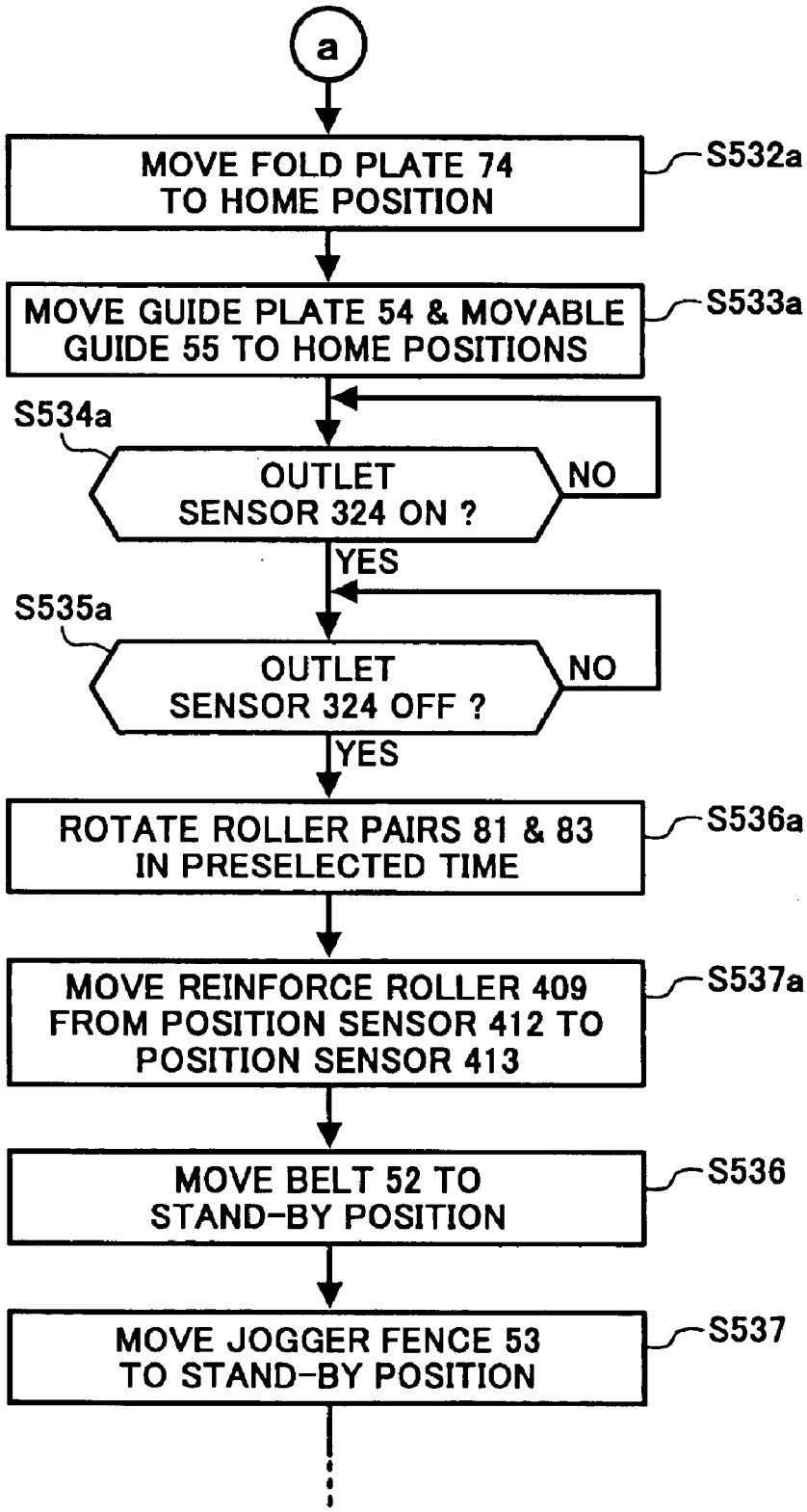
FIG. 77 is a flowchart showing another part of the center staple and bind mode.

FIGS. 76 and 77 show a center staple and bind mode or fold reinforcement mode representative of a sixth embodiment of the present invention. A step S153 shown in FIG. 76 follows the step S512 of FIG. 32. Because the procedure of FIG. 76 is identical with the procedure of FIGS. 32 through FIG. 34 except for steps S525 through S536, the following description will concentrate on differences between the two procedures.

As shown in FIG. 76, the fold roller pair 81 conveys a sheet stack until the sheet stack sensor 414 included in the reinforce roller unit 400 turns on (step S525). If the answer of the step S525 is YES, then the fold roller pair 81 is rotated by a preselected amount and then stopped (step S526*a*), thereby conveying the sheet stack to the pressing position. Subsequently, the pulse motor 401 is driven to cause the reinforce roller 409 to move from the position of the position sensor 412 to the position of the position sensor 412 while pressing the fold of the sheet stack (step S527*a*). Then, the fold roller pair 81 and lower outlet roller pair 32 are caused to start rotating (S528*a*).

As shown in FIG. 77, in the above condition, when the fold position pass sensor 323 turns on (YES, step S529*a*) and then turns off (YES, step S530*a*), the lower roller pair 72 is pressed (step S531*a*). At the same time, the fold plate 74 is returned on to the home position (step S532*a*) while the guide plate 54 and movable guide 55 are moved to their home positions (step S533*a*). Subsequently, when the lower outlet sensor 324 turns on (YES, step S534*a*) and then turns off (YES, step S535*a*), the fold roller pair 81 and lower roller pair 83 are further rotated for a preselected period of time and then stopped. (step S536*a*). Then, the reinforce roller 409 is moved from the position of the position sensor 412 to the position of the position sensor 413, i.e., to the home position (step S537*a*) while the belt 52 and jogger fence 53 are returned to their home positions (steps S536 and S537).

In the illustrative embodiment, the reinforce roller 409 is controlled with its home position being used as a reference, so that the return of the reinforce roller 409 to the home position, i.e., initialization is important. The return of the reinforce roller 409 to the home position in the center staple and bind mode of FIG. 77 will be described more specifically with reference to FIG. 78.

Figure 78:
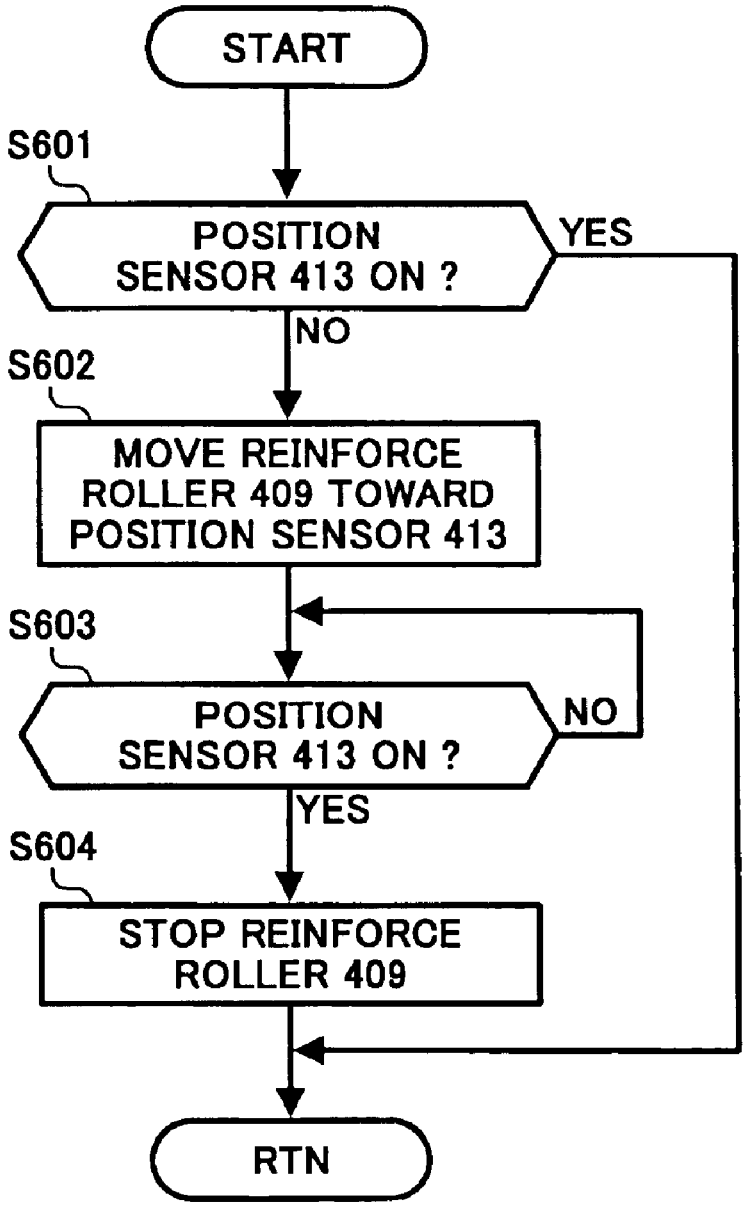
FIG. 78 is a flowchart showing a reinforce roller initializing procedure available with the sixth embodiment.

As shown in FIG. 78, if the position sensor or home position sensor 413 is in an ON state (YES, step S601), meaning that the current position of the reinforce member 409 is the home position, then the procedure simply returns. If the answer of the step S601 is NO, the pulse motor 402 is driven to move the reinforce member 409 toward the position sensor 413 (step S602). When the position sensor 413 turns on (step S603), the pulse motor 402 is turned off to cause the reinforce roller 409 to stop moving (steep S604).

Decision on an error that the illustrative embodiment makes will be described hereinafter. If the position sensor 413 does not turn on in the step S603 after the reinforce roller 409 has been moved toward the position sensor 413 in the step S602, then a sheet stack is, determined to have jammed the path. More specifically, the reinforce roller 409 is moved from the position of the position sensor 413 toward the position of the position sensor 412 after a sheet stack has been stopped at the preselected position. At this instant, if the position sensor 412 does not sense the reinforce roller 409 even after a preselected number of pulses input to the pulse motor 402 have been counted, then it is determined that an error, i.e., the locking of the mechanism, the stop of the roller 409 ascribable to a short drive torque or the step-out of the motor 402 has occurred. In this case, the pulse motor 401 is driven in the reverse direction to return the reinforce roller 409 toward the position of the position sensor 413. At this instant, if the position sensor 413 senses the reinforce roller 409 within a preselected period of time, then the reinforce roller 409 is stopped at the position of the position sensor 413 while a jam message is displayed on, e.g., the control panel of the image forming apparatus PR. Alternatively or in addition, a display for displaying such an error message may be mounted on the sheet finisher PD, if desired.

As stated above, if the position sensor 413 does not sense the reinforce roller 409 within a preselected period of time, the pulse motor 401 is turned off while a service call or similar message, showing that an error unable to be dealt with by the user has occurred, is displayed on, e.g., the control panel of the image forming apparatus PR. After reinforcement, the fold roller pair 81 and lower outlet roller pair 83 convey the sheet stack to the lower tray 203. At this instant, when the fold position pass sensor 323 senses the trailing edge of the sheet stack, the movable rear fence 73 is returned to the home position while the lower roller pair 72 is released to prepare for the next sheet stack. Alternatively, the rear fence 73 may not be returned to the home position if the next job deals with a sheet stack of the same sheet size and consisting of the same number of sheets.

Figure 79A:
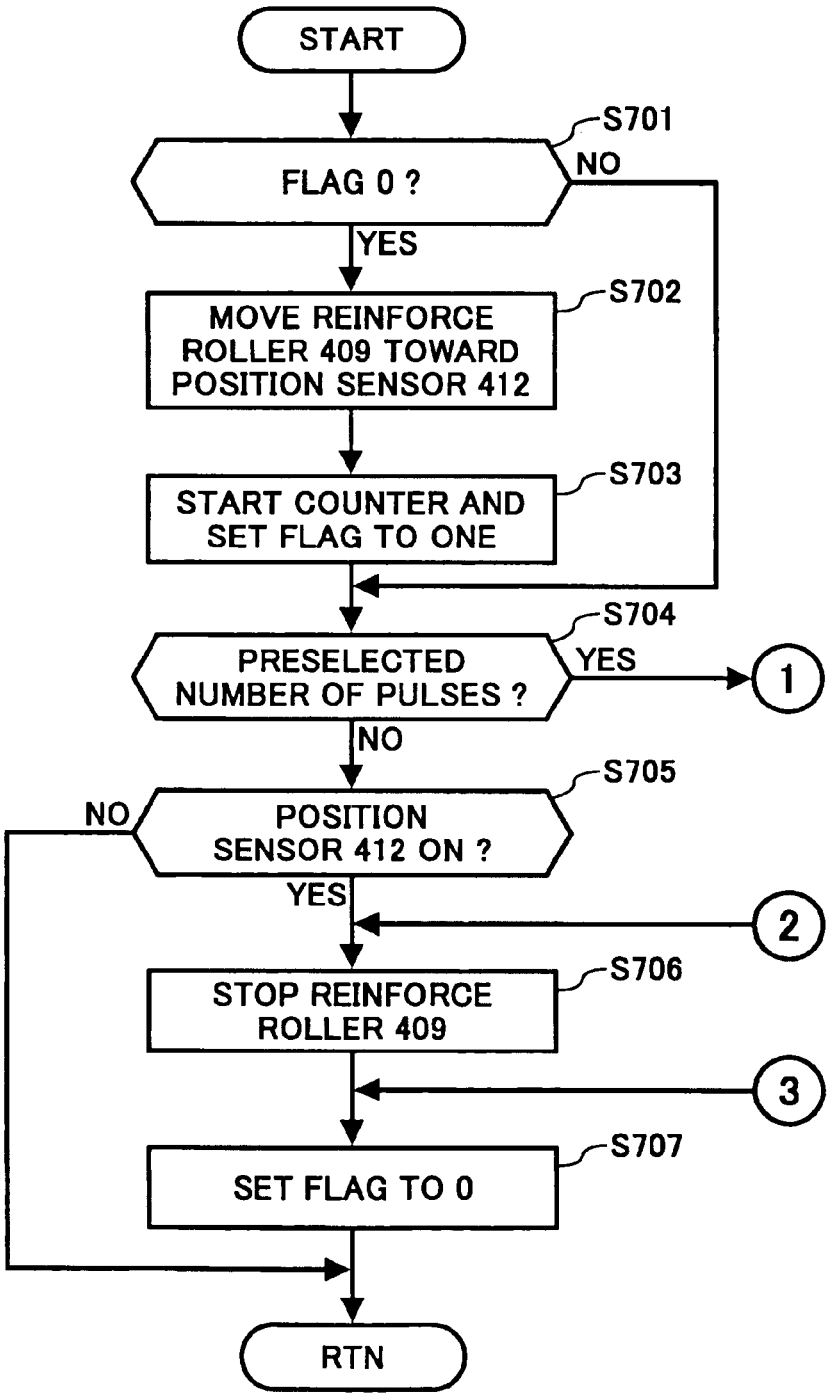
FIGS. 79A and 79B are flowcharts showing a decision procedure included in the sixth embodiment for dealing with an error.
Figure 79B:
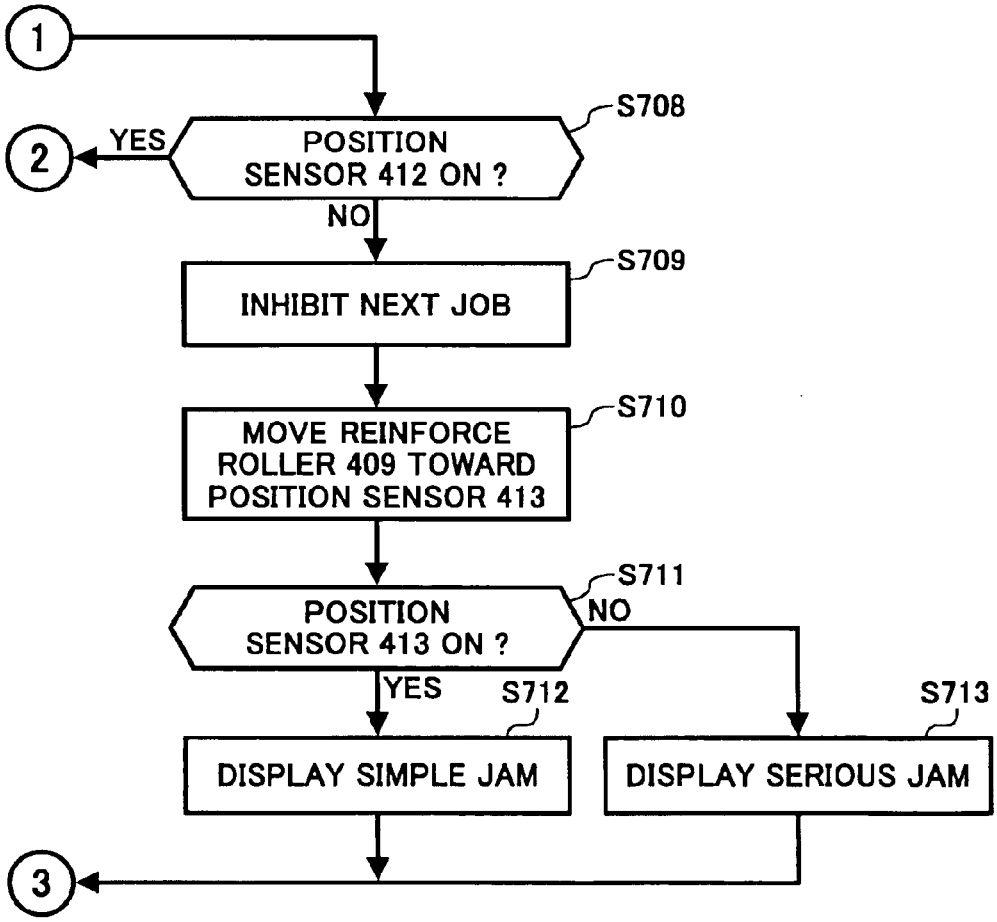

FIGS. 79A and 79B show the above error decision procedure more specifically. As shown, whether or not a movement start flag is (logical) ZERO is determined (step S701). If the answer of the step S701 is YES, then the reinforce roller 409 is moved toward the position of the position sensor 412 (step S702). At the same time, a counter, not shown, starts counting the number of pulses input to the pulse motor 402 while the movement start flag is set to (logical) ONE (step S703). Subsequently, whether or not the counter has counted a preselected number of pulses is determined (step S704). If the answer of the step S704 is NO, then whether or not the position sensor 412 has sensed the reinforce roller 409 is determined (step S705). If the answer of the step S705 is NO, the procedure returns to the step S704 because the movement start flag is ONE (YES, step S701). If the answer of the step S705 is YES, then the reinforce roller 409 is caused to stop moving (step S706) while the movement start flag is cleared, i.e., set to ZERO.

If the answer of the step S704 is YES, then whether or not the position sensor 412 has sensed the reinforce roller 409 is determined (step S708). If the answer of the step S708 is YES, then the procedure returns to the step S706. The movement of the reinforce roller 409 described so far is normal.

On the other hand, if the position sensor 412 is in an OFF state in the step S708, meaning that an error has occurred, the following job, i.e., the operation for folding a sheet stack at the center is interrupted (step S709). At the same time, the pulse motor 402 is rotated in the reverse direction to move the reinforce roller 409 toward the position of the position sensor 413 (step S710). Subsequently, if the position sensor 413 senses the reinforce roller 409 within a preselected period of time (YES, step S711), meaning that the roller 409 has returned to the home position despite any error, it is determined that the error is a simple jam. In this case, a message, showing a jam that can be dealt with by the user, is displayed on, e.g., the control panel of the image forming apparatus PR (step S712) while the movement start flag is returned to ZERO. If the answer of the step S711 is NO, meaning that the reinforce roller 409 is unable to move, then a message, showing a jam that cannot be dealt with by the user, is displayed (step S712). At the same time, the movement flag is returned to ZERO.

With the control described above, it is possible to prevent, when a jam that cannot be dealt with by the user occurs, the user from damaging the machine and making the error more serious by performing unexpected operation. Why the following job is interrupted in the step S709 is that when an error occurs during reinforcement, it is determined that a sheet stack being reinforced exceeds an allowable limit. This prevents the following sheet stack from being subject to the same error.

As for the rest of the configuration, the illustrative embodiment is identical with the previous embodiments.

As stated above, the illustrative embodiment allows a jam occurred during reinforcement to be surely dealt with for thereby protecting the machine from damage and reducing the downtime of the entire system.

Seventh Embodiment

Figure 80:
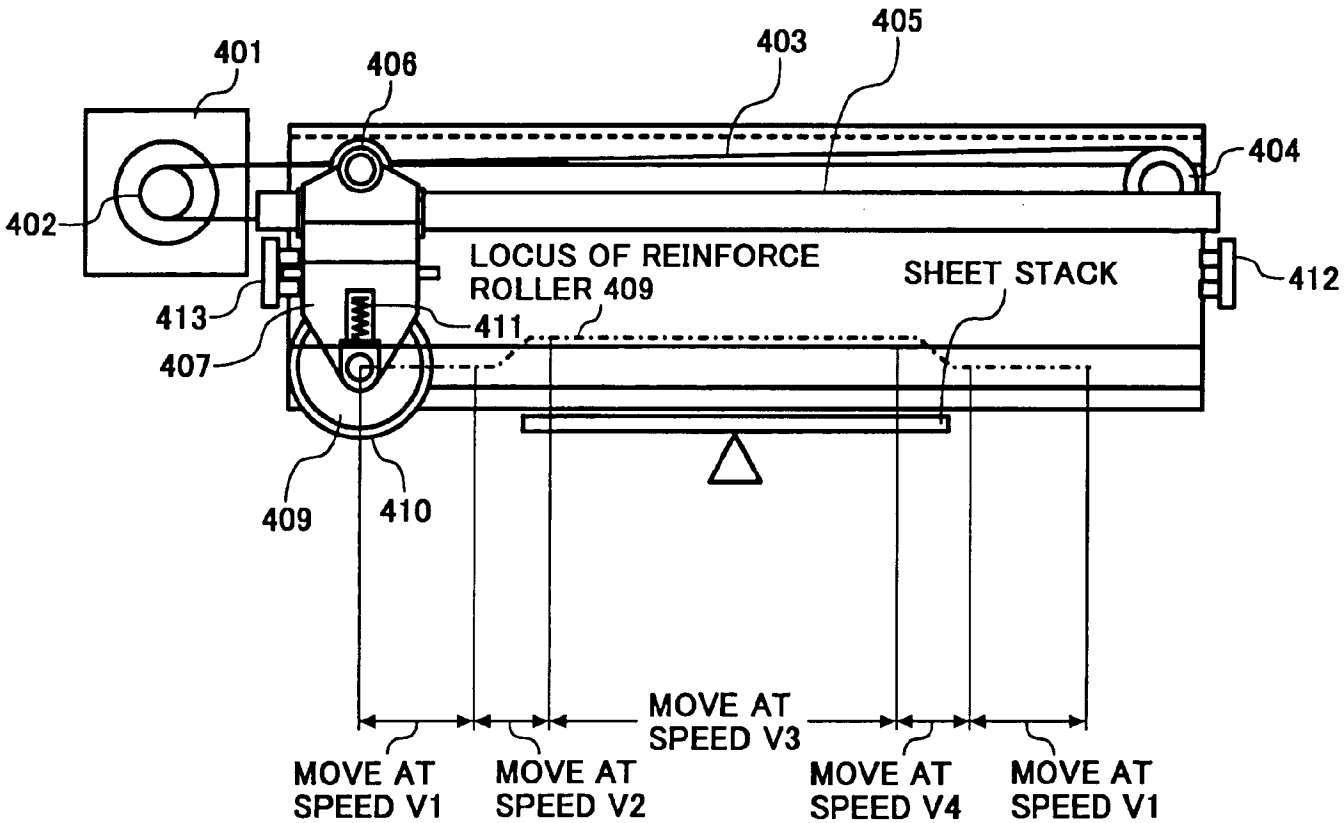
FIG. 80 shows a relation between the position and the speed of the reinforce roller representative of a seventh embodiment of the present invention.

FIG. 80 shows a seventh embodiment of the present invention. As shown, the reinforce roller 409 is moved from the home position to the vicinity of one edge of a sheet stack at a speed V1, moved at a speed V2 over the zone in which the roller 409 gets on the sheet stack, moved at a speed V3 to the vicinity of the other edge of the sheet stack while pressing the fold of the sheet stack, moved at a speed V4 over the zone in which the roller 409 comes down from the sheet stack, and then moved at the speed V1 to the position of the position sensor 413. Subsequently, when the sheet stack is conveyed to the outside of the reinforce roller unit 400, the reinforce roller 409 is returned to the position of the position sensor 413 at a speed V5.

The following relations hold between the speeds V1 through V5:

$$V1 \geqq V2$$

$$V2,\ V4 < V3$$

$$V5 > V3$$

In the illustrative embodiment, the speed V4 is selected to be equal to the speed V1. Alternatively, a speed V6 different from the speed v1 may be selected, in which case a relation of $V6 \leqq V4$ should hold.

The illustrative embodiment is substantially similar to FIG. 6 as to the center staple and bind mode operation and reinforce roller initializing operation. As for the rest of the configuration, the illustrative embodiment is identical with the previous embodiments.

As stated above, the illustrative embodiment can efficiently reinforce the fold of a sheet stack without producing noise or dislocating the sheet stack.

Eighth Embodiment

Figure 81:
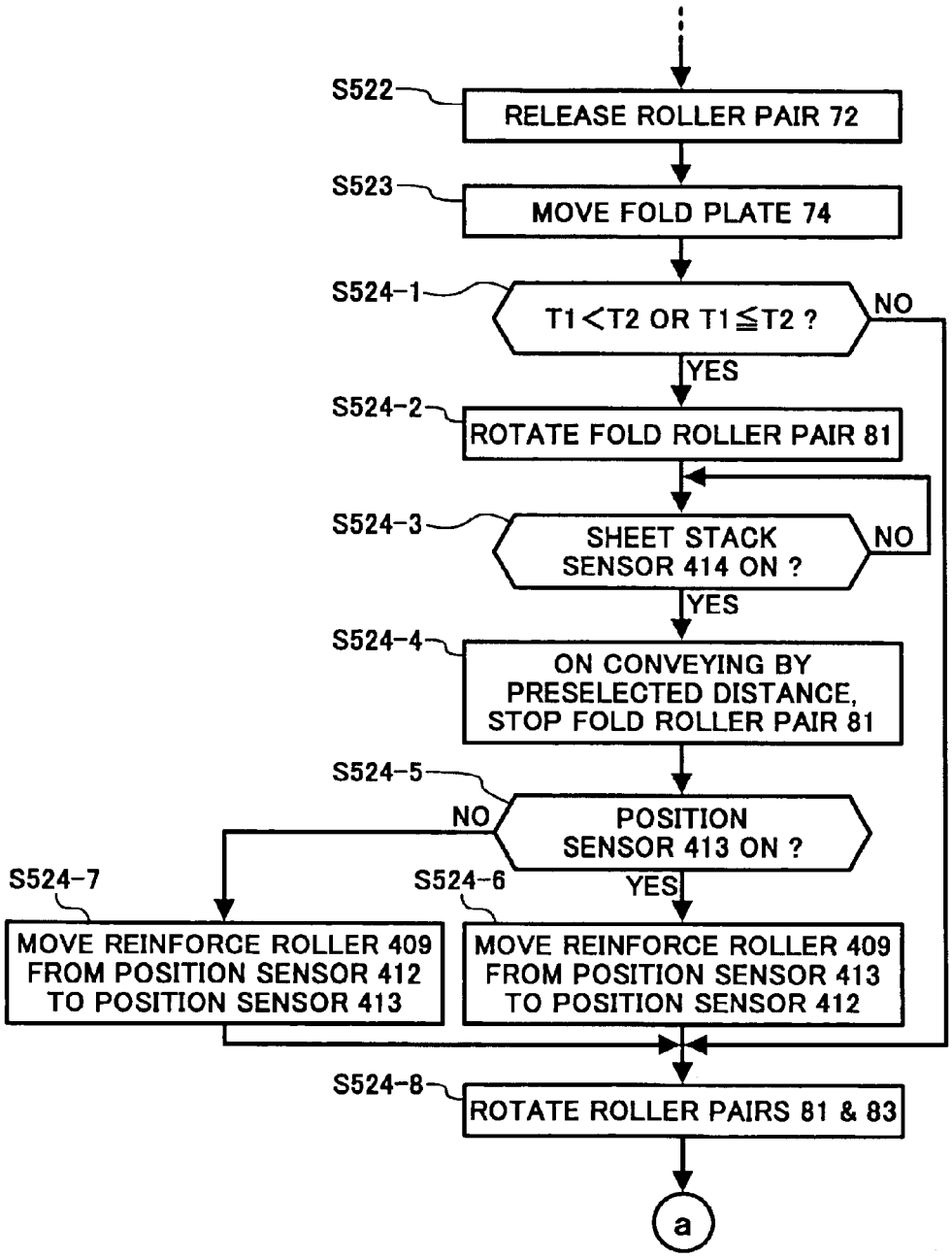
FIG. 81 is a flowchart showing part of a center staple and bind mode representative of an eighth embodiment of the present invention.
Figure 82:
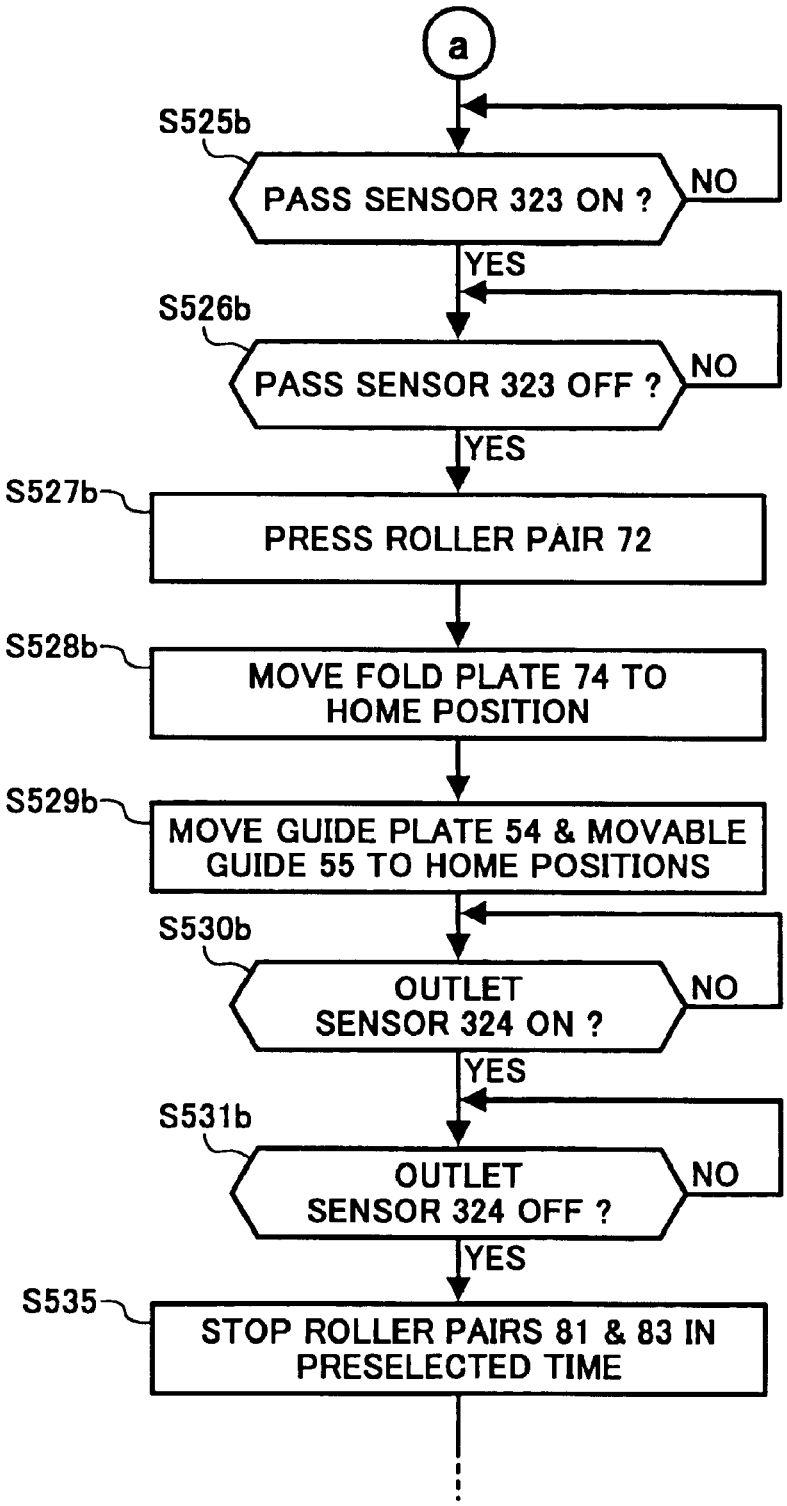
FIG. 82 shows another part of the center staple and bind mode.

FIGS. 81 and 82 show an eighth embodiment of the present invention. A step S513 shown in FIG. 81 follows the step S512 shown in FIG. 32. Because a procedure of FIGS. 81 and 82 is identical with the procedure of FIGS. 32 through 34 except for processing between the steps S523 and S535, let the following description concentrate on differences between the two procedures.

As shown in FIG. 81, the fold plate 74 starts folding a sheet stack at the center (step S523). Subsequently, assuming that a period of time necessary for the reinforce roller 409 to complete reinforcement is T1 and that a time interval between consecutive sheet stacks each having n sheets is T2, then the periods of time T1 and T2 are compared (step S524-1). If the period of time T1 is shorter than or equal to T2 (YES, step S524-1), then the fold roller pair 81 is caused to start rotating to fold the sheet stack (step S524-2). When the sheet stack sensor 414 of the reinforce roller unit 400 turns on (YES, step S524-3), meaning that the sheet stack thus folded has entered the reinforce roller unit 400, then the sheet stack is conveyed by a preselected distance to the pressing position, and then the fold roller pair 81 is caused to stop rotating (step S524-4). As a result, the sheet stack is nipped by the fold roller pair 81.

Subsequently, whether or not the position sensor is turned on, i.e., whether or not the reinforce roller 409 is located at the position of the position sensor 413 is determined (step S524-5). If the answer of the step S524-5 is NO, then the reinforce roller 409 is moved from the position of the position sensor 412 to the position of the position sensor 413 (step S524-7). If the answer of the step S524-5 is YES, the reinforce roller 409 is moved from the position of the position sensor 413 to the position of the position sensor 412 (step S524-6). Then, the fold roller pair 81 and lower roller pair 83 are caused to start rotating to convey the sheet stack (step S514-8). On the other hand, if the answer of the step S524-1 is NO, the procedure advances to the step S524-8 by skipping the reinforcement.

Thereafter, as shown in FIG. 82, when the fold position pass sensor 323 turns on (YES, step S525*b*) and then turns off (YES, step S526*b*), the lower roller pair 72 is pressed (step S527*b*) while the fold plate 74, guide plate 54 and movable guide 55 are returned to their home positions to prepare for the next sheet stack (steps S528*b* and S529*b*). When the trailing edge of the sheet stack moves away from the lower outlet sensor 324 (YES, step S531*b*), the fold roller pairs 81 and 82 and lower outlet roller pair 83 are further rotated by a preselected period of time and then caused to stop rotating (step S532).

Ninth Embodiment

Figure 83:
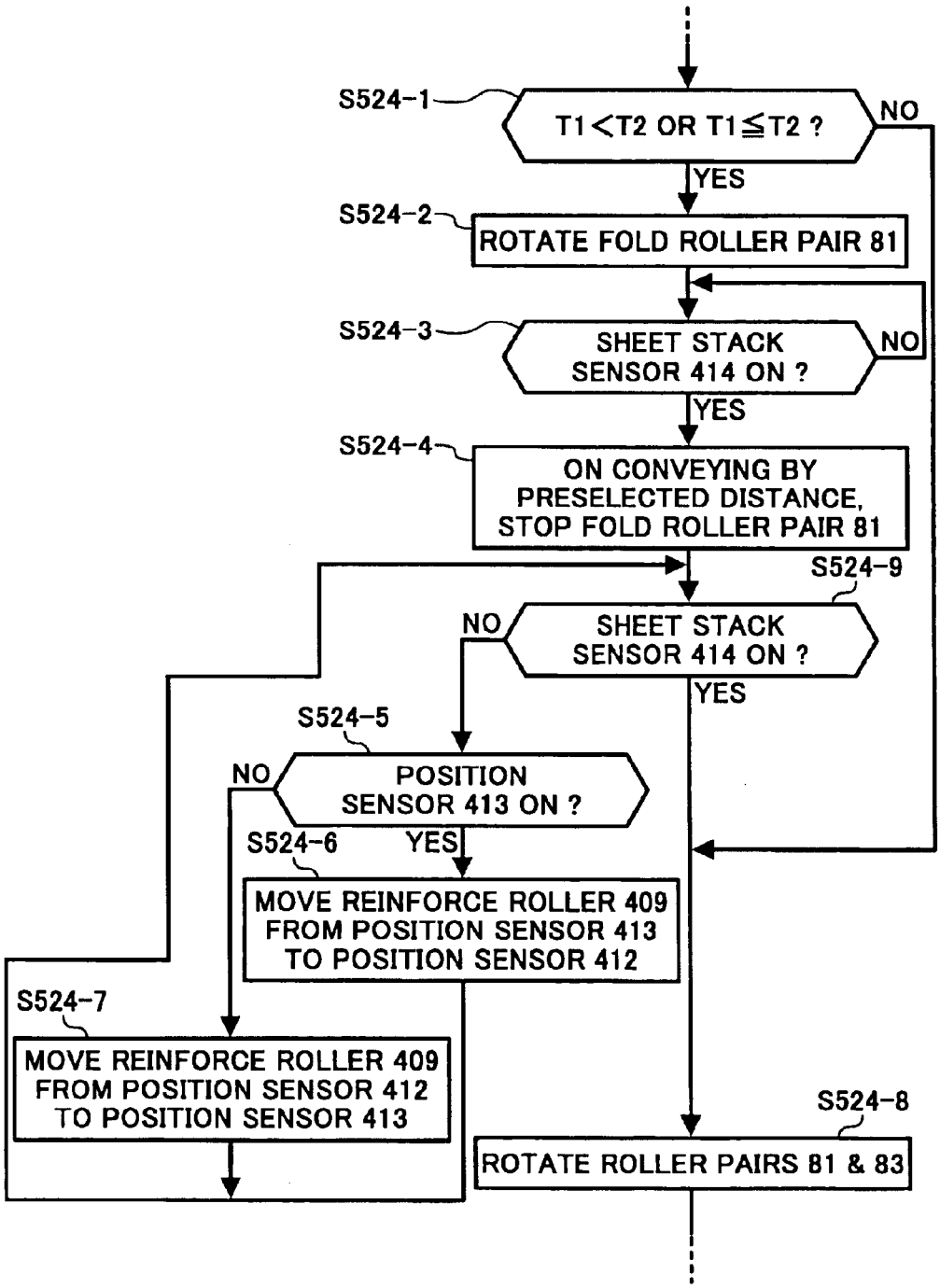
FIG. 83 is a flowchart showing part of a center staple and bind mode representative of a ninth embodiment of the present invention.

FIG. 83 shows a ninth embodiment of the present invention. Steps S501 through S524-4 and steps S524-8 through S539 shown in FIG. 83 are identical with the corresponding steps of the eighth embodiment and will not be described specifically in order to avoid redundancy.

As shown in FIG. 83, when the sheet stack sensor 414 of the reinforce roller unit 400 turns on (YES, step S524-3), meaning that a folded sheet stack has entered the reinforce roller unit 400, then the sheet stack is conveyed to the pressing position by a preselected distance, and then the fold roller pair 81 is caused to stop rotating (step S524-4) As a result, the sheet stack remains nipped by the fold roller pair 81. Subsequently, when the sheet stack sensor 321 turns on (YES, step 524-9), meaning that the sheet stack has arrived at a position just preceding the upper guide plate 92, then the fold roller pair 81 and lower outlet roller pair 83 are caused to start rotating because a period of time for reinforcing the fold of the sheet stack is not available (step S524-8).

If the answer of the step S524-9 is NO, then whether or not the position sensor 413 is in an ON state is determined because a period of time for reinforcement is available (step S524-5). If the answer of the step S524-5 is YES, meaning that the reinforce roller 409 is located at the position of the position sensor 413, then the reinforce roller 409 is moved from the position of the position sensor 413 to the position of the position sensor 412 while pressing the fold of the sheet stack (step S524-6). Subsequently, whether or not a sheet stack has arrived at the arrival sensor 321 is again determined (step S524-9). The procedure then returns to the step S524-8 if the answer of the step S524-9 is YES or returns to the step S524-5 if it is NO.

If the answer of the step S524-5 is NO, then the reinforce roller 409 is moved from the position of the position sensor 412 to the position of the position sensor 413 (step S524-7). The procedure then returns to the step S524-9.

If T1 is longer than or equal to T2, as determined in the step S524, then the procedure jumps to the step S524-8 by skipping the reinforcement.

As for the rest of the configuration, the illustrative embodiment is identical with the first embodiment.

As stated above, to press the fold of a sheet stack with the reinforce roller 409 as many times as possible, the illustrative embodiment uses the sensing means positioned upstream of the first fold roller pair 81 to repeatedly press the fold of the same sheet stack at allowable timing.

Figure 84:
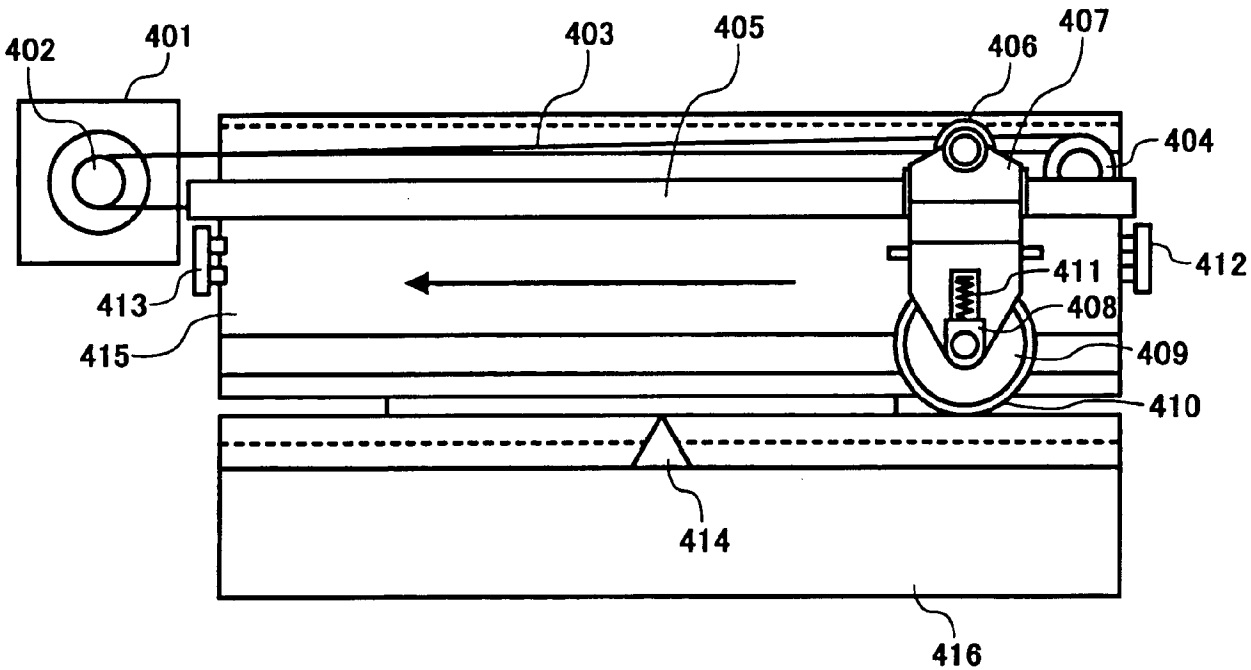
FIG. 84 shows the movement of the reinforce roller included in the ninth embodiment from a front position sensor toward a rear position sensor.
Figure 85:
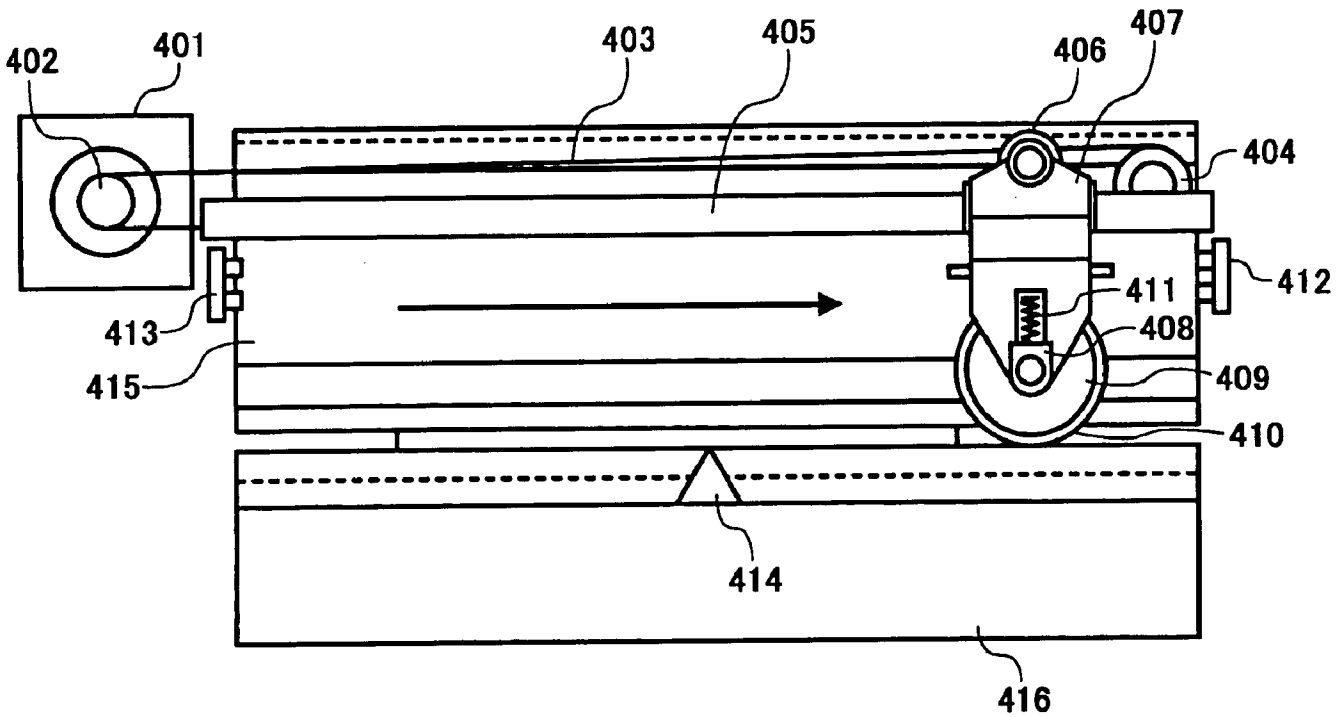
FIG. 85 shows the movement of the reinforce roller included in the ninth embodiment from the rear position sensor toward the front position sensor.
Figure 86:
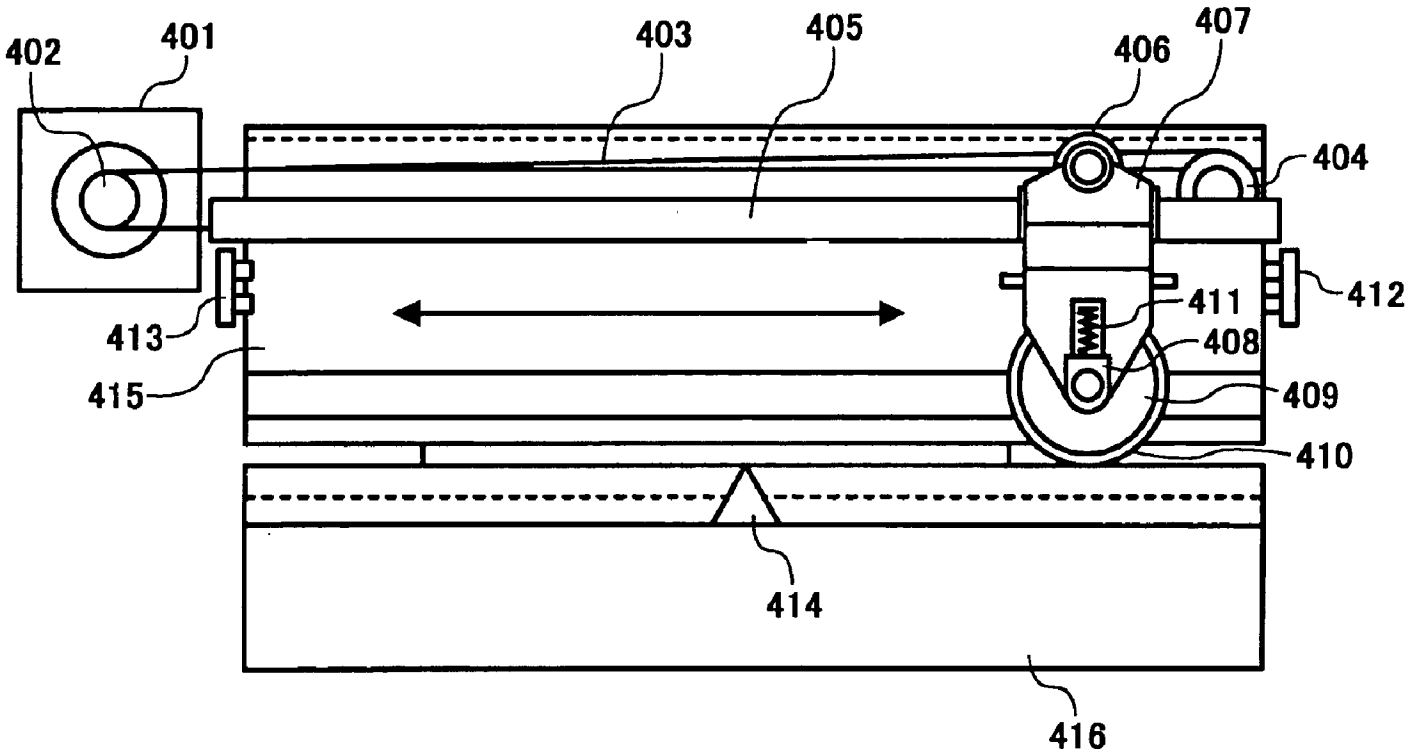
FIG. 86 shows how the reinforce roller moves back and forth between the front and rear positions sensors.

More specifically, as shown in FIG. 84, assume that the movement of the reinforce roller from the position sensor 412 to the position sensor 413, as shown in FIG. 84, or from the latter to the former, as shown in FIG. 85, is a single pressing action. Then, as shown in FIG. 86, the single pressing action is repeated until the sensing means positioned upstream of the first fold roller pair 81 senses the next sheet stack.

In the above condition, the larger the number of sheets constituting a single sheet stack, the longer the time interval between consecutive sheet stacks and therefore the larger the number of times of pressing available with the reinforce motor 409. Every sheet stack can therefore be sufficiently folded without regard to the number of sheets constituting it. Further, because the minimum period of time T1 necessary for the single pressing action is known beforehand, the pressing action is not available if the time interval T2 sensed by the sensing means is shorter than or equal to the period of time T1. In this case, the reinforcement is not executed. While the illustrative embodiment uses the arrival sensor 321 as sensing means stated above, extra sensing means may be positioned between the sheet sensor 310 and the fold roller pair 81 shown in FIG. 1, if desired.

Tenth Embodiment

Figure 87:
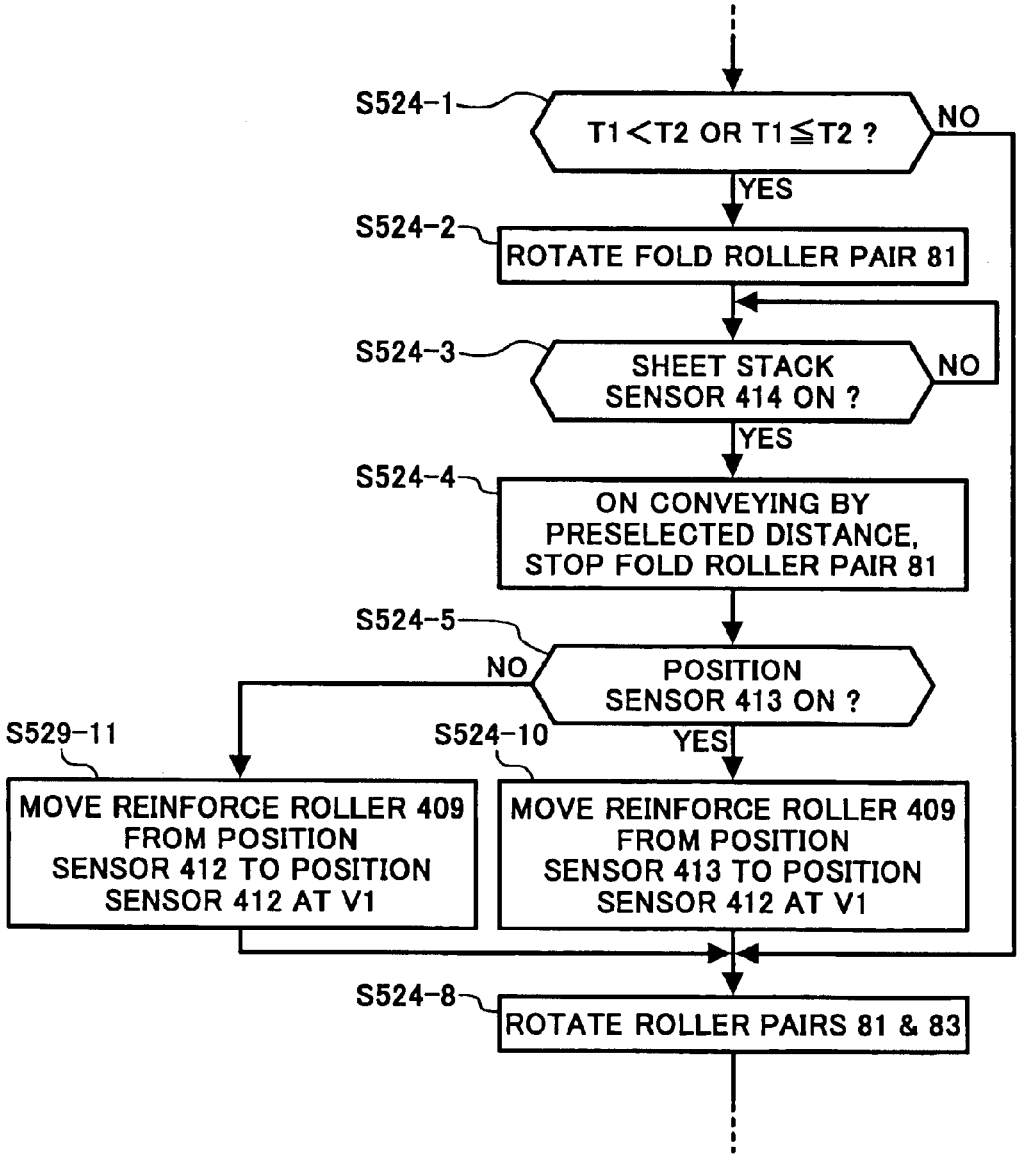
FIG. 87 is a flowchart demonstrating a enter staple and bind mode representative of a tenth embodiment of the present invention.
Figure 88:
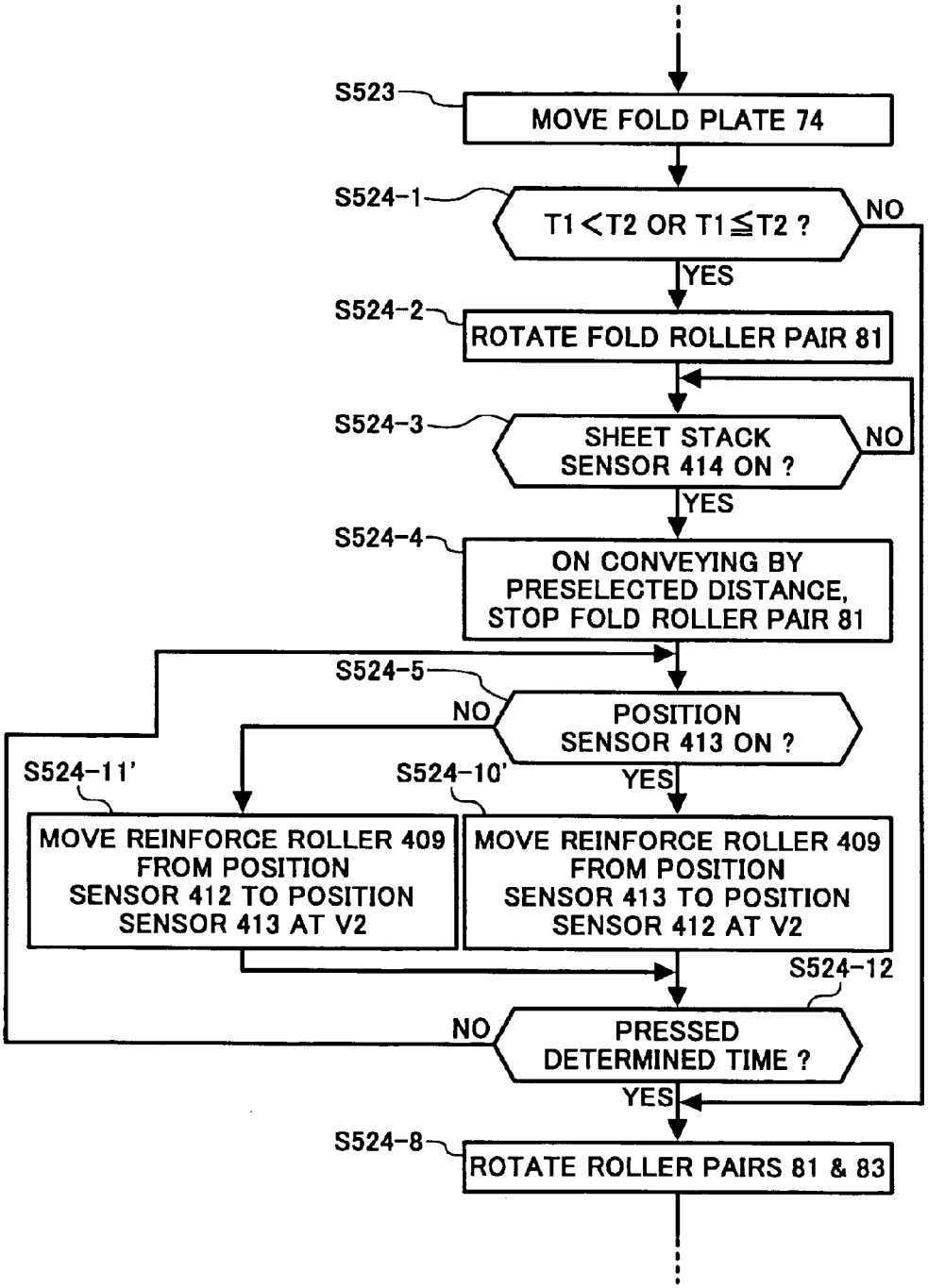
FIG. 88 is a flowchart showing a modification of the tenth embodiment.

FIGS. 87 and 88 show a tenth embodiment of the present invention. Steps S501 through S524-4 and steps S524-8 through S539 are identical with the corresponding steps of the eighth embodiment and will not be described specifically in order to avoid redundancy.

As shown in FIG. 87, when the sheet stack sensor 414 of the reinforce roller unit 400 turns on (YES, step S524-3), the fold roller pair 81 conveys a folded sheet stack, entered the reinforce roller unit 400, to the pressing position by a preselected position and is then caused to stop rotating (step S524-4). As a result, the sheet stack remains nipped by the fold roller pair 81.

Subsequently, whether or not the position sensor 413 has turned on is determined (step S524-5). If the answer of the step S524-5 is YES, then the reinforce roller 409 is moved from the position of the position sensor 413 to the position of the position sensor 412 while pressing the sheet stack (step S524-10). If the answer of the step S524-5 is NO, then the reinforce roller 409 is moved from the position of the position sensor 412 to the position of the position sensor 413 while pressing the sheet stack (step S524-11). After the step S524-10 or S524-11, the fold roller pair 81 and lower roller pair 83 are rotated to convey the sheet stack (step S524-8).

As for the rest of the configuration, the illustrative embodiment is identical with the eighth embodiment.

The longer the pressing time of the reinforce roller 409, the sharper the fold of a sheet stack. In light of this, when a plurality of sheet stacks should be sequentially reinforced, the illustrative embodiment increases the pressing time. More specifically, the time interval T2 between consecutive sheet stacks is calculated on the basis of information representative of the number of sheets constituting each sheet stack. It is therefore possible to calculate the speed V1 necessary for the reinforce roller 409 to press a sheet stack by moving from the position sensor 412 to the position sensor 413, as shown in FIG. 84, or from the latter to the former, as shown in FIG. 85, within the time interval T2. Therefore, if the reinforce roller 409 is moved in the direction of FIG. 84 or 85 at the speed V1 thus calculated while pressing a sheet stack, then the roller 409 can press the sheet stack by taking a sufficient period of time in accordance with the number of sheets of the sheet stack. The sheet stack can therefore be sufficiently pressed without regard to the number of sheets constituting it.

Further, as shown in FIG. 88, when the press roller 409 is caused to press a sheet stack a preselected number of times as in the procedure of FIG. 86, the speed V2 that implements the above number of times within the time interval T2 can be calculated. Therefore, by driving the reinforce roller 409 at the speed V2 thus calculated (step S524-10' or S524-11'), it is possible to press the fold of a sheet stack the preselected number of times without regard to the number of sheets constituting it (step S524-12).

Moreover, the minimum period of time T1 necessary for the single pressing action of the reinforce roller 409 is also known beforehand. If the time interval T2 is shorter than or equal to the period of time T1, i.e., if the pressing action is not available, then the pressing operation is not executed, i.e., the step S524-1 jumps to the step S524-8. It is to be noted that information representative of the number of sheets of a single sheet stack can be obtained from the image forming apparatus and the number of times of operation of jogging means.

Eleventh Embodiment

Figure 89:
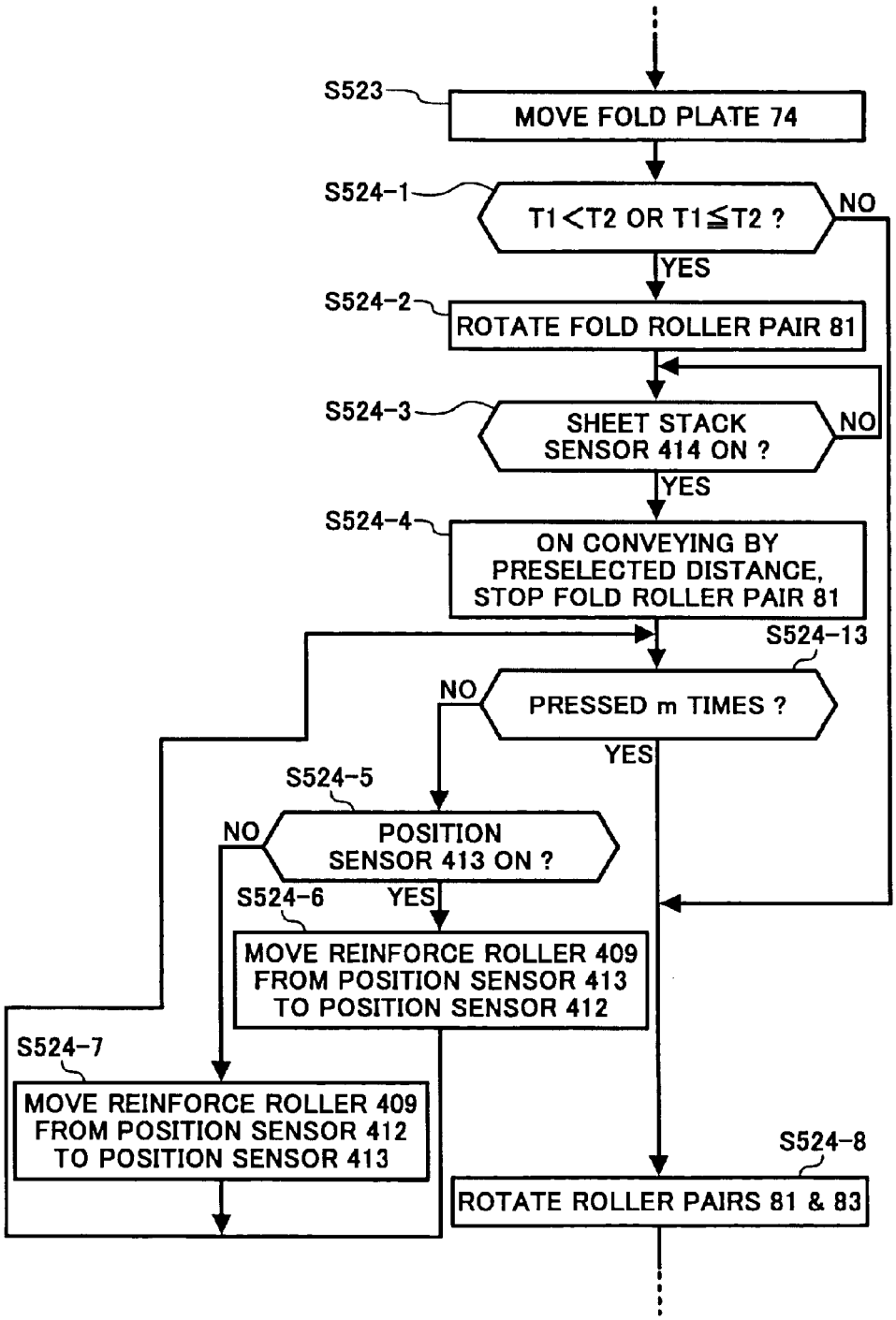
FIG. 89 is a flowchart showing a center staple and bind mode representative of a eleventh embodiment of the present invention.

FIG. 89 shows an eleventh embodiment of the present invention. Steps S501 through S523, steps S524-1 through S524-4 and steps S525 through S539 are identical with the corresponding steps of the eighth embodiment and will not be described specifically in order to avoid redundancy.

As shown in FIG. 89, whether or not the reinforce roller 409 has pressed the same sheet stack m times calculated, as stated earlier, is determined (step S524-13). If the answer of the step S524-13 is NO, then whether or not the position sensor 413 is in an ON state is determined (step S524-5). If the answer of the step S524-5 is YES, then the reinforce roller 409 is moved from the position of the position sensor 413 to the position of the position sensor 412 (step S524-6); if otherwise (NO, step S524-5), the roller 409 is moved from the position of the position sensor 412 to the position of the position sensor 413. Then, whether or not the reinforce roller 409 has pressed the sheet stack m times is again determined (step 524-13). If the answer of the step S524-13 is YES, then the fold roller pair 81 and lower outlet roller pair 38 are rotated (step S524-8). This is followed by the step S525 and successive steps.

On the other hand, if the time interval T2 is shorter than or equal to the period of time T1 (NO, step S524-1), the procedure jumps to the step S524-8 by skipping the reinforcement.

As for the rest of the configuration, the illustrative embodiment is identical with the eighth embodiment.

The larger the number of times of pressing, the sharper the fold of a sheet stack. In light of this, the illustrative embodiment calculates, when pressing a plurality of consecutive sheet stacks, the time interval V2 between the sheet stacks on the basis of the number of sheets constituting each sheet stack and then causes the reinforce roller 409 to repeatedly press the same sheet stack a preselected number of times within the time interval T2. More specifically, the illustrative embodiment calculates how many times m the reinforce roller 409 can press a sheet stack while moving from the position sensor 412 to the position sensor 413 or from the latter to the former, as shown in FIG. 86, and causes the roller 409 to press the sheet stack.

Further, the minimum period of time T1 necessary for the single pressing action of the reinforce roller 409 is also known beforehand. If the time interval T2 is shorter than or equal to the period of time T1, i.e., if the pressing action is not available, then the pressing operation is not executed. Again, information representative of the number of sheets of a single sheet stack can be obtained from the image forming apparatus and the number of times of operation of jogging means.

As stated above, the eighth to eleventh embodiments allow the reinforce roller 409 to surely reinforce the folds of consecutive sheet stacks without reducing productivity even when the interval between the sheet stacks is short. This can be done without regard to the number of sheets constituting each sheet stack.

Twelfth Embodiment

Figure 90:
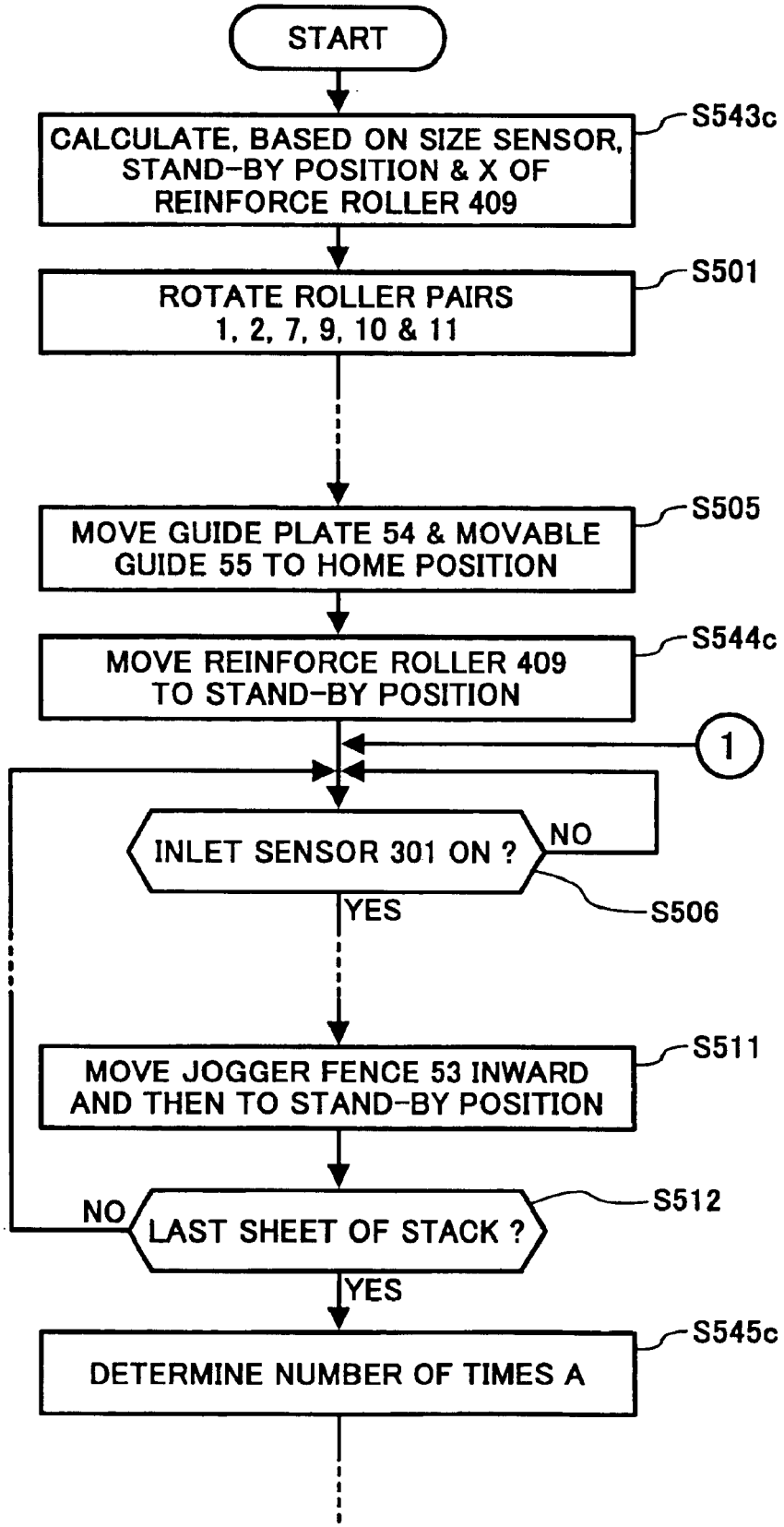
FIG. 90 is a flowchart showing part of a center staple and bind mode representative of a twelfth embodiment of the present invention.
Figure 91:
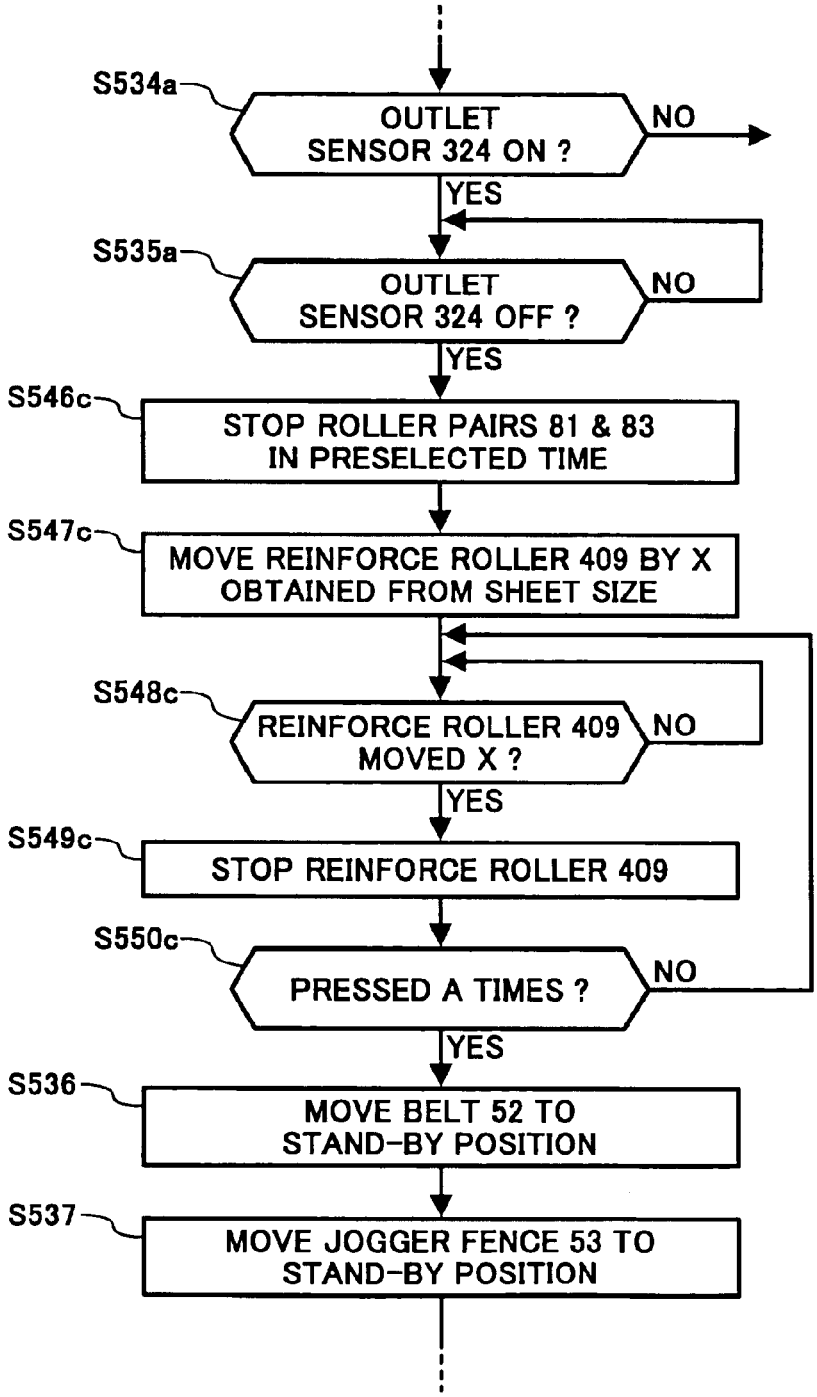
FIG. 91 is a flowchart showing another part of the center staple and bind mode.

FIGS. 90 and 91 show a twelfth embodiment of the present invention. The steps S501 through S505, steps S506 through S512 and steps S513 through S525 of the first embodiment shown in FIG. 32, the steps S526*a* through S535*a* of the sixth embodiment shown in FIGS. 76 and 77 and the steps S536 through S542 shown in FIG. 77 also apply to the illustrative embodiment. The following description will therefore concentrate on differences between the illustrative embodiment and the previous embodiments.

As shown in FIG. 90, on receiving size information from the image forming apparatus PR, the CPU 360 calculates a stand-by position of the reinforce roller 409 and a distance X by which the roller 409 should move for reinforcement (step S543*c*). Subsequently, after the steps S501 through S505, the CPU 360 moves the reinforce roller 409 to the stand-by position on the basis of the size information obtained in the step S6543*c* (step S544*c*). The CPU 360 then repeats the steps S506 through S512 with every sheet. When the last sheet of a single sheet stack arrives (YES, step S512), the CPU 360 determines, based on the number of sheets of the sheet stack known then, determines the number of times A the reinforce roller 409 should press the sheet stack in accordance with the number of sheets (step S545*c*). The number of times A may be one for one to five sheets, two for five to ten sheets and so forth or may be incremented by one for every five sheets.

Subsequently, after the steps S513 through S535*a*, the CPU 360 drives the fold roller pair 81 and lower outlet roller pair 83 for a preselected additional period of time and then stops driving them (step S546*c*). The CPU 360 then causes the reinforce roller 409 to start moving the distance X (step S547*c*) and then stop moving (steps S548*c* and S549*c*). Thereafter, when the reinforce roller 409 has moved A consecutive times (YES, step S550*c*), the CPU 360 causes the belt 52 and jogger fence 53 to the stand-by positions. Thereafter, the CPU 360 executes the steps S536 through S542 to thereby initialize the entire mechanism.

Thirteenth Embodiment

Figure 92:
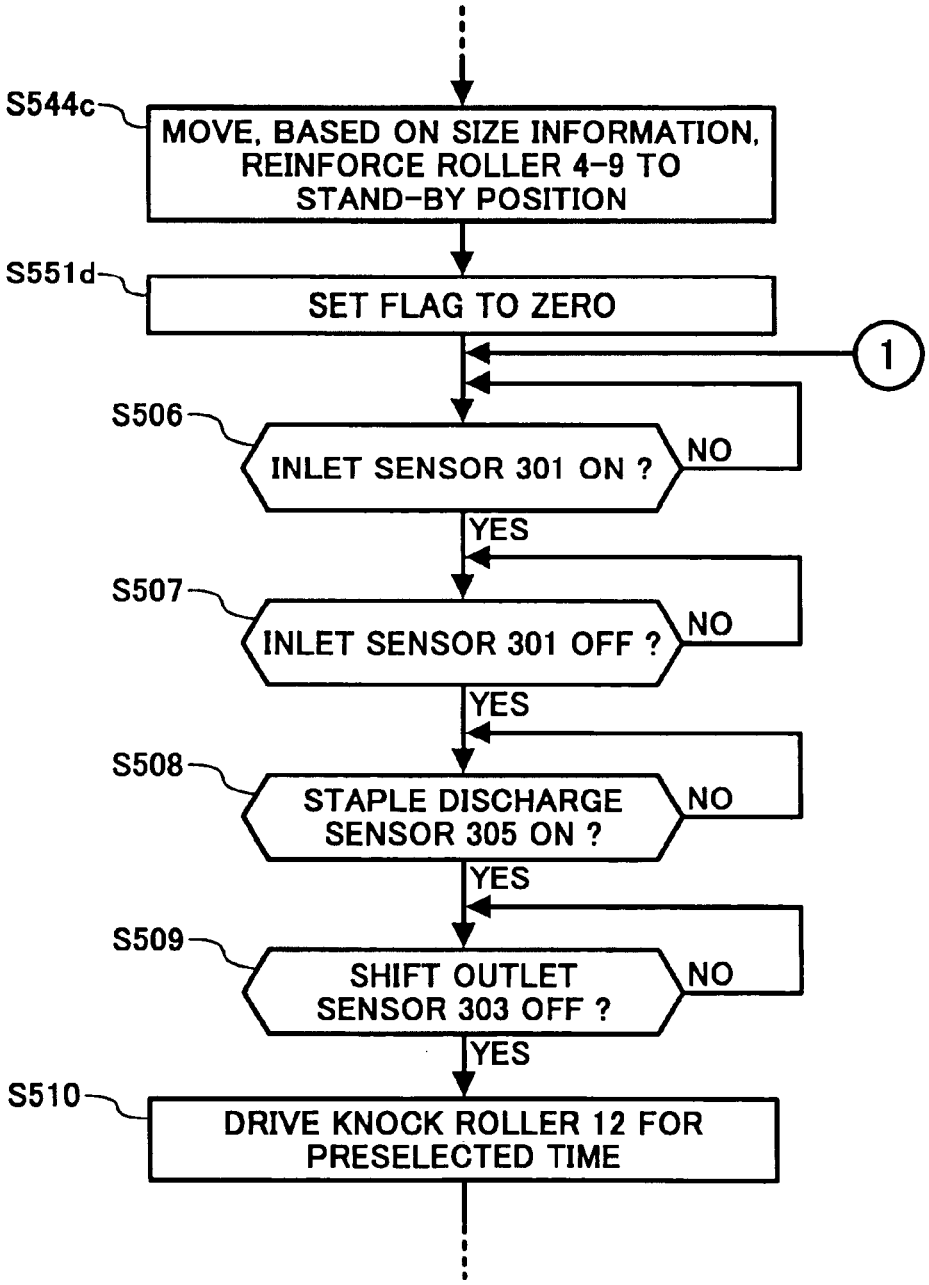
FIG. 92 is a flowchart showing part of a center staple and bind mode representative of a thirteenth embodiment of the present invention.
Figure 93:
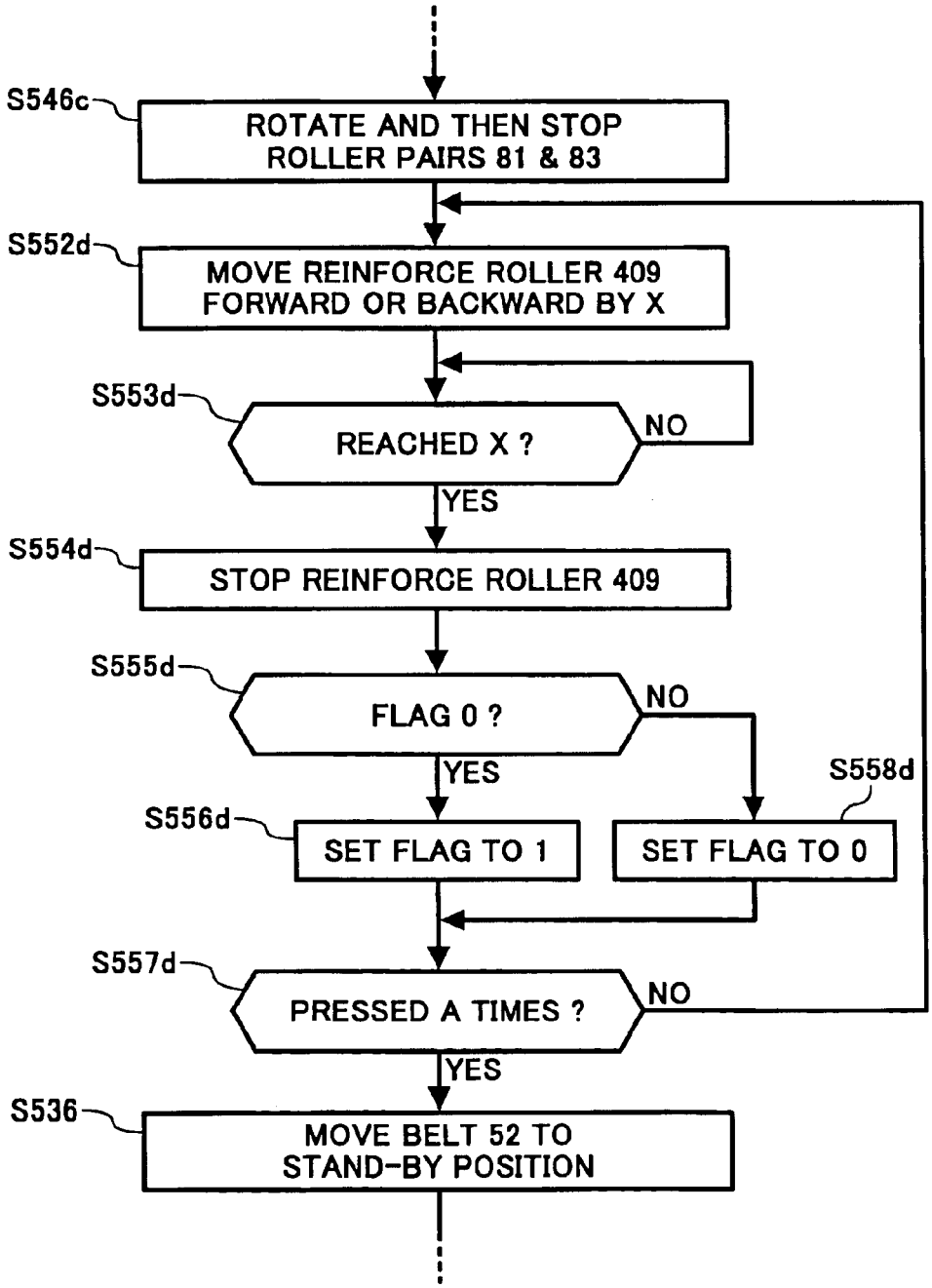
FIG. 93 is a flowchart showing another part of the center staple and bind mode.

FIGS. 92 and 93 show a thirteenth embodiment of the present invention. As shown in FIG. 92, the illustrative embodiment includes a step S551*d* between the steps S544*c* and 506 of the twelfth embodiment shown in FIG. 92. Also, as shown in FIG. 93, the illustrative embodiment substitutes steps S552*d* through S558*d*, which take account of the direction of movement of the reinforce roller 409, for the steps S547*c* through S549*c*. As for the rest of the configuration, the illustrative embodiment is identical with the twelfth embodiment.

As shown, after the step S544*c*, the CPU 360 resets a flag indicative of the direction of movement of the reinforce roller 709 (step S551*d*) and then causes the fold roller pair 81 and lower outlet roller 83 to stop rotating (step S546*c*). Subsequently, the CPU 360 causes the reinforce roller 409 to move, if the flag reset is ZERO, the distance X derived from the size information in the forward direction or to move, if the flag is ONE, the distance X in the reverse direction (step S552*d*). When the reinforce roller 409 has moved the distance X, the CPU 360 causes the reinforce roller 409 to stop moving (steps S553*d* and S554*d*), again checks the flag (step S555*d*), and sets, if the flag is ZERO, the flag to ONE (step S556*d*) or sets, if the flag is ONE, the flag to ZERO (step S558*d*). After repeating the above procedure A times (YES, step S557*d*), the CPU 360 executes the steps S537 through S542.

As stated above, in the twelfth and thirteenth embodiments, the reinforce roller 409 is moved to the stand-by position before pressing a sheet stack and then moved for pressing the sheet stack only by a distance two times as long as the distance between the stand-by position and the widthwise center of the sheet stack. This allows the reinforce roller 409 to start pressing the sheet stack at the earliest possible timing and move the minimum necessary distance during pressing, thereby reducing the pressing time and enhancing the durability of the roller 409.

Fourteenth Embodiment

Figure 94:
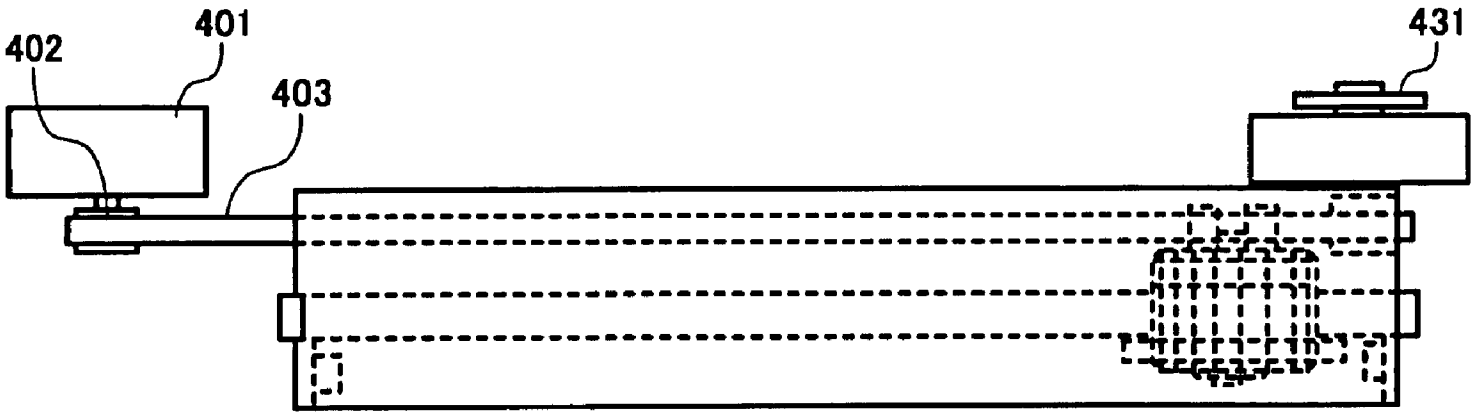
FIG. 94 is a plan view showing a reinforce roller unit representative of a fourteenth embodiment of the present invention.

FIGS. 94 through 94 show a fourteenth embodiment of the present invention. The center staple and bind mode operation of the eighth embodiment shown in FIGS. 81 and 82 also apply to the illustrative embodiment.

Figure 95:
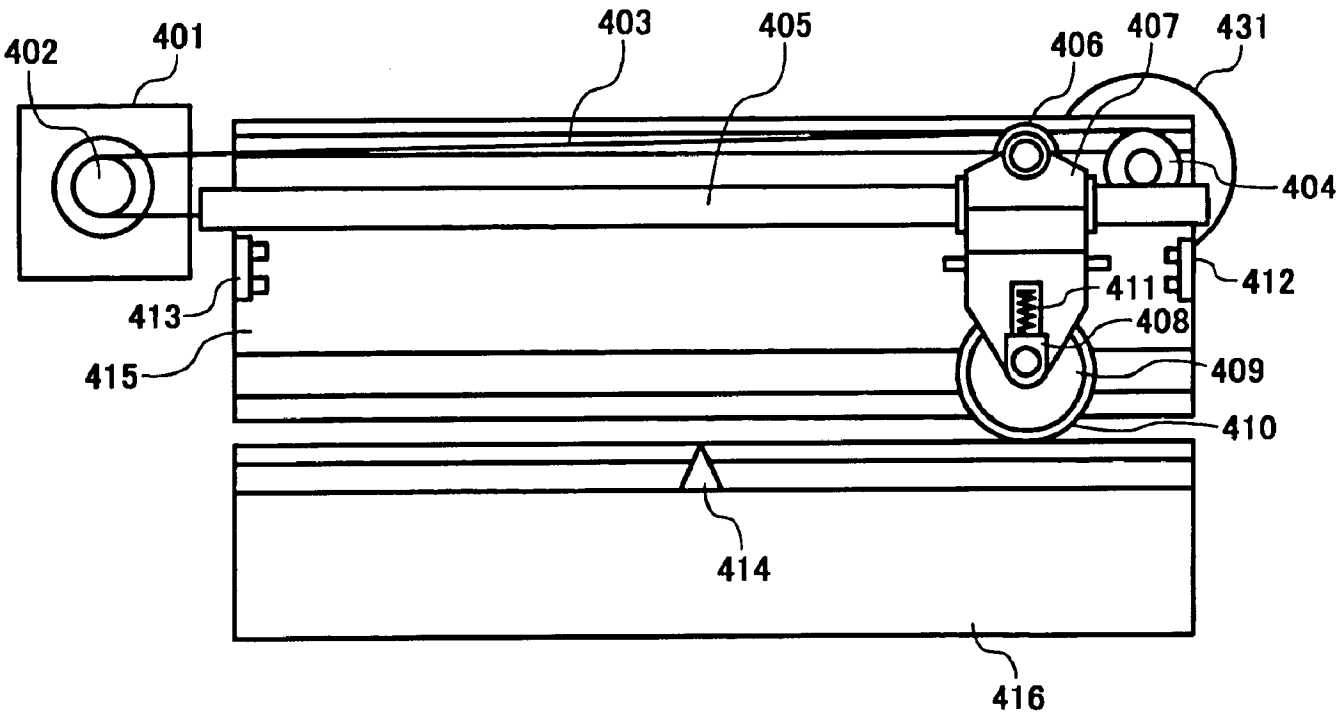
FIG. 95 is a front view of the fourteenth embodiment.
Figure 96:
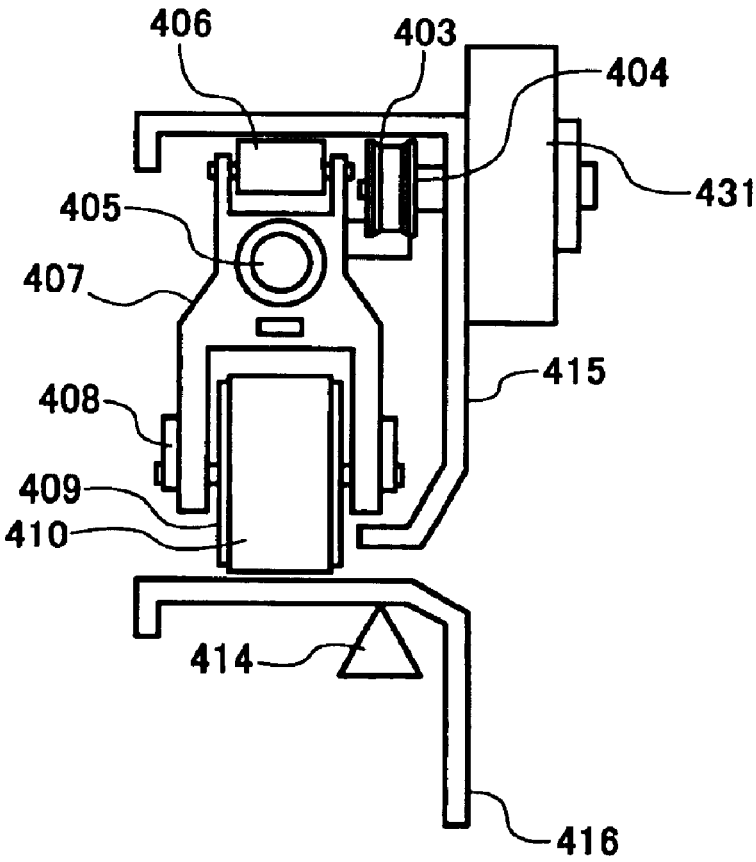
FIG. 96 is a side elevation of the fourteenth embodiment as seen from the right.

When the reinforce roller 409 stops moving halfway on a sheet stack due to a jam, the sheet stack sometimes cannot be removed from the reinforce roller unit 400, as stated earlier. In light of this, as shown in FIGS. 94 through 96, a lever 431 is directly connected to the shaft of the pulley 404, so that the pulley 404 and lever 431 can transfer rotation to each other. The lever 431 is implemented as a disk in consideration of movement to occur during usual pressing operation.

In the above configuration, when the operator rotates the lever 431 by hand, the rotation of the lever 431 is transferred to the slider 407 and reinforce roller 409 via the timing belt 403. This allows, when a sheet stack jams the reinforce roller unit 400, the operator to move the reinforce roller 409 to the outside of the pressing range and easily remove the sheet stack.

Fifteenth Embodiment

Figure 97:
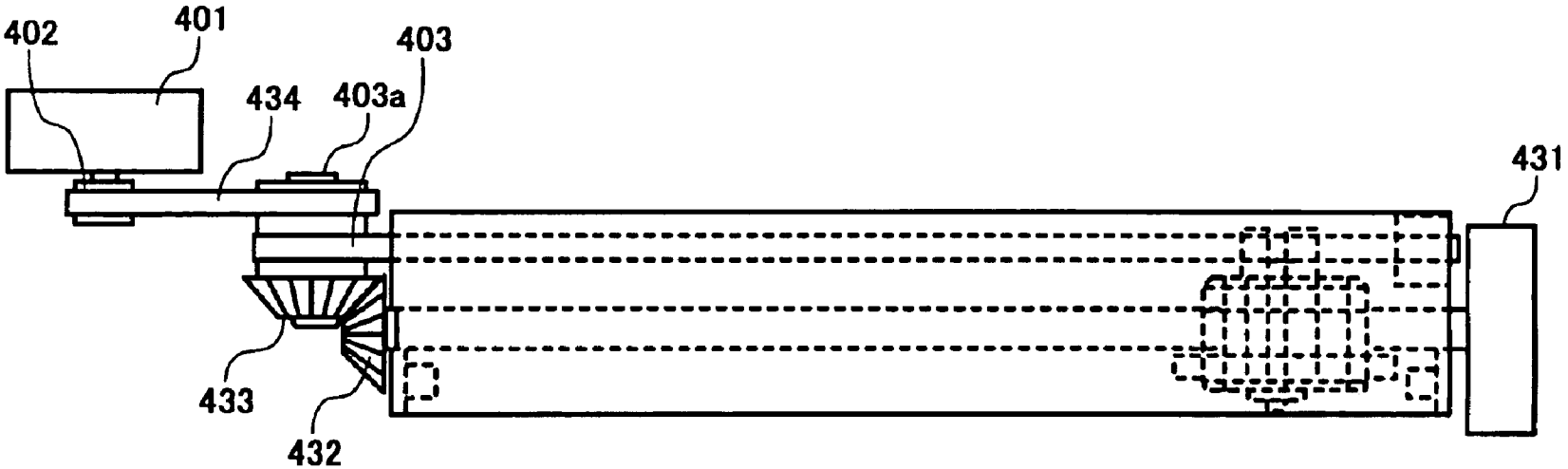
FIG. 97 is a plan view showing a reinforce roller unit representative of a fifteenth embodiment of the present invention.
Figure 98:
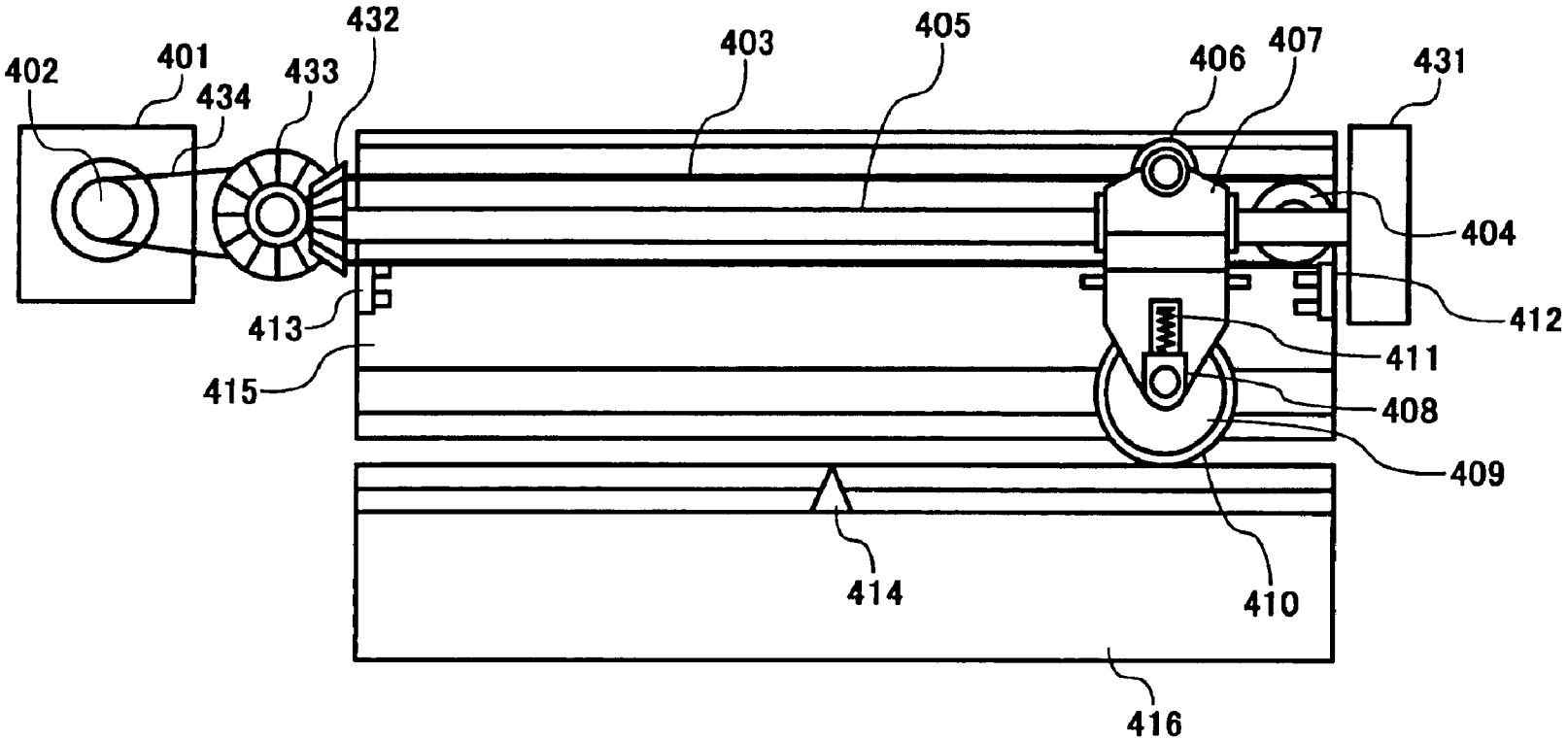
FIG. 98 is a front view of the fifteenth embodiment.
Figure 99:
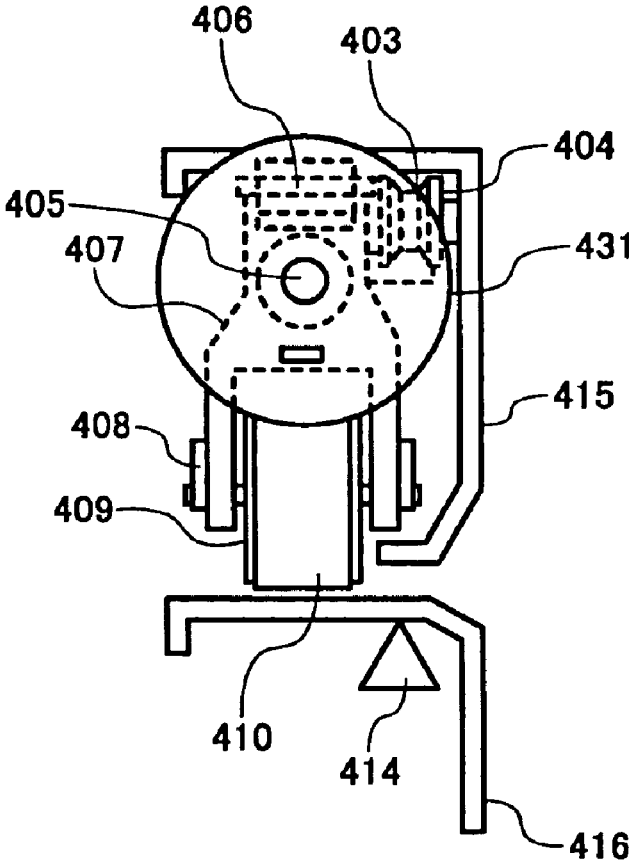
FIG. 99 is a side elevation of the fifteenth embodiment as seen from the right.

Reference will be made to FIGS. 97 through 99 for describing a fifteenth embodiment of the present invention. Because the illustrative embodiment is identical with the fourteenth embodiment except for the configuration of the reinforce roller unit 400, identical structural elements are designated by identical reference numerals and will not be described specifically.

As shown, the lever 431 and a first bevel gear 432 are respectively mounted on opposite ends of the guide member 405. Because the guide member 405 does not transfer the driving force, a second bevel gear 433 is mounted on a shaft 403*a* and held in mesh with the first bevel gear 432. A timing belt 434 is driven by a pulley 402 mounted on the output shaft of the pulse motor 401. The timing belt 434 and a timing pulley 403*a* over which the timing belt 434 is passed is provided on the shaft 403*a*. To cause the reinforce roller 409 to press a sheet stack, the output torque of the pulse motor 401 is transferred to the timing belt 403 via the timing belt 434. When the reinforce roller 409 stops moving halfway due to a jam, the operator moves the guide member 405 via the lever 431 by hand. As a result, a driving force is transferred from the first bevel gear 432 to the second bevel gear 433, so that the timing belt 403 is caused to turn while moving the reinforce roller 409.

While the illustrative embodiment mounts the lever 431 on the guide member 405, the movement of the lever 431 may alternatively be transferred to the guide member 405 via a pulley, timing belt and a gear by way of example.

Sixteenth Embodiment

A sixteenth embodiment of the present invention will be described with reference to FIGS. 100 through 107. Briefly, the illustrative embodiment allows the operator to remove a sheet stack by opening the upper guide plate 415 while allowing, as in the fourteenth and fifteenth embodiments, the operator to move the reinforce roller 409 via the lever 431.

Figure 100:
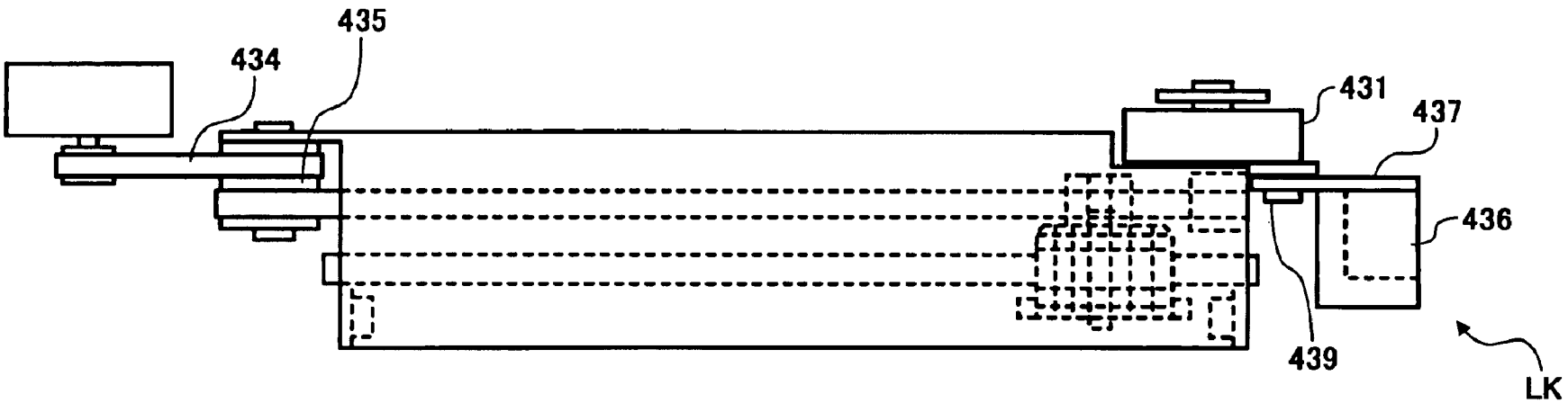
FIG. 100 is a plan view showing a reinforce roller unit representative of a sixteenth embodiment of the present invention.
Figure 101:
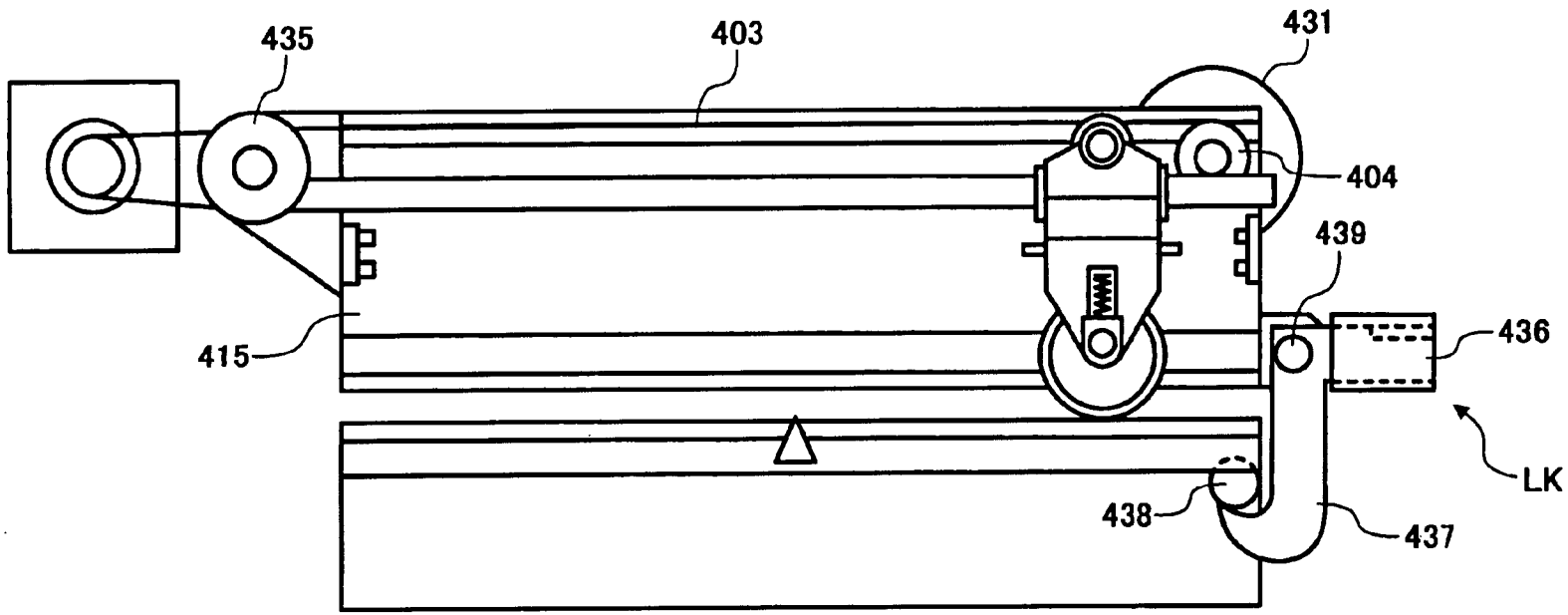
FIG. 101 is a front view of the sixteenth embodiment.
Figure 102:
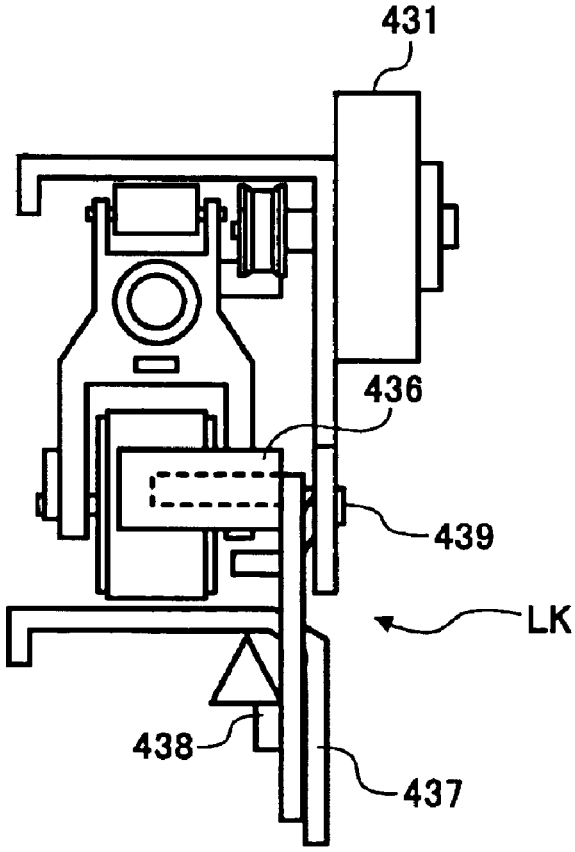
FIG. 102 is a side elevation of the sixteenth embodiment as seen from the right.

As shown in FIGS. 100 through 102, the output torque of the pulse motor 434 is transferred to the pulley 435 via the timing belt 434 to thereby drive the timing belt 403 passed over the pulleys 435 and 404, so that the reinforce roller 409 is moved to press a sheet stack. The upper guide plate 405, supporting the guide member 405, is angularly movable, or openable, about the axis of the pulley 435. Further, a locking mechanism LK is arranged on the upper guide plate 415 and made up of a lever 436, a link 437, a stop 438, and a shaft 439.

Figure 103:
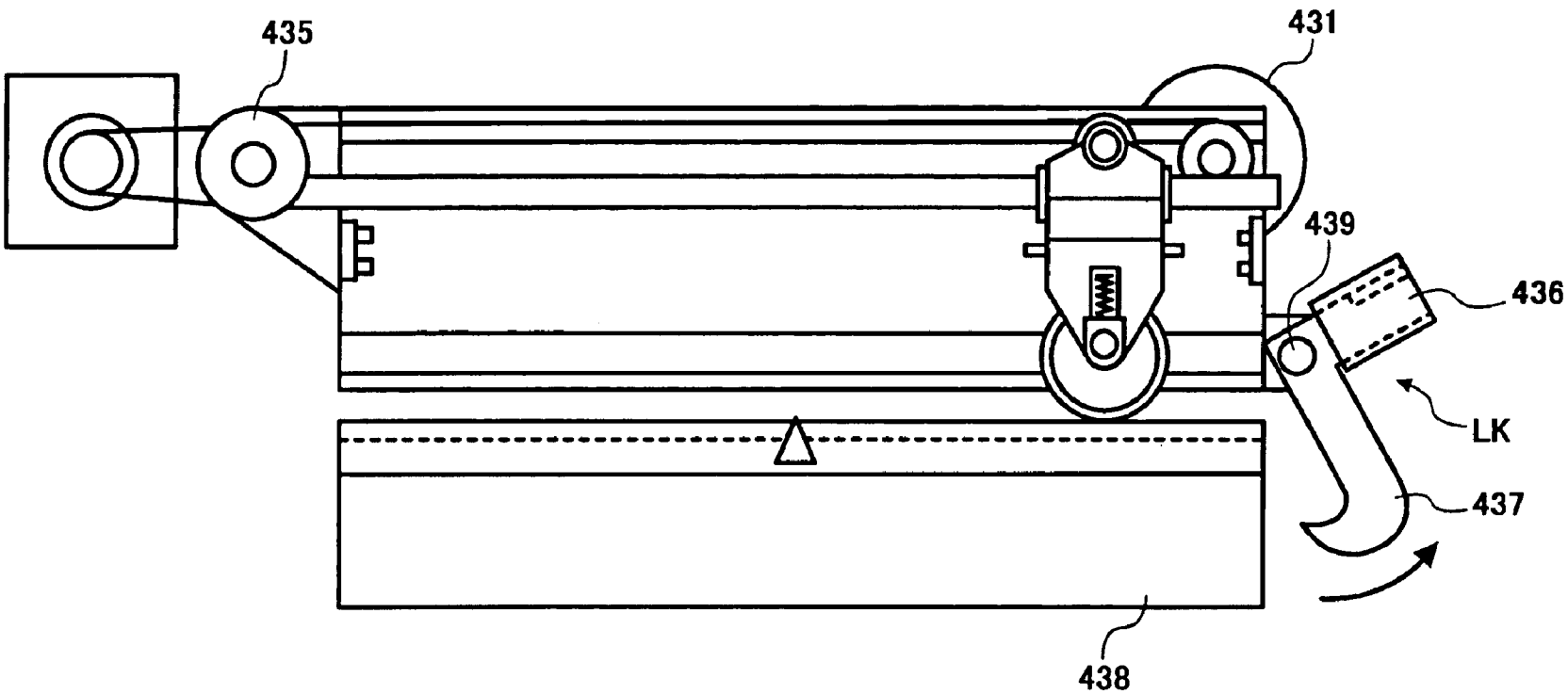
FIG. 103 shows an unlocked condition particular to the sixteenth embodiment.
Figure 104:
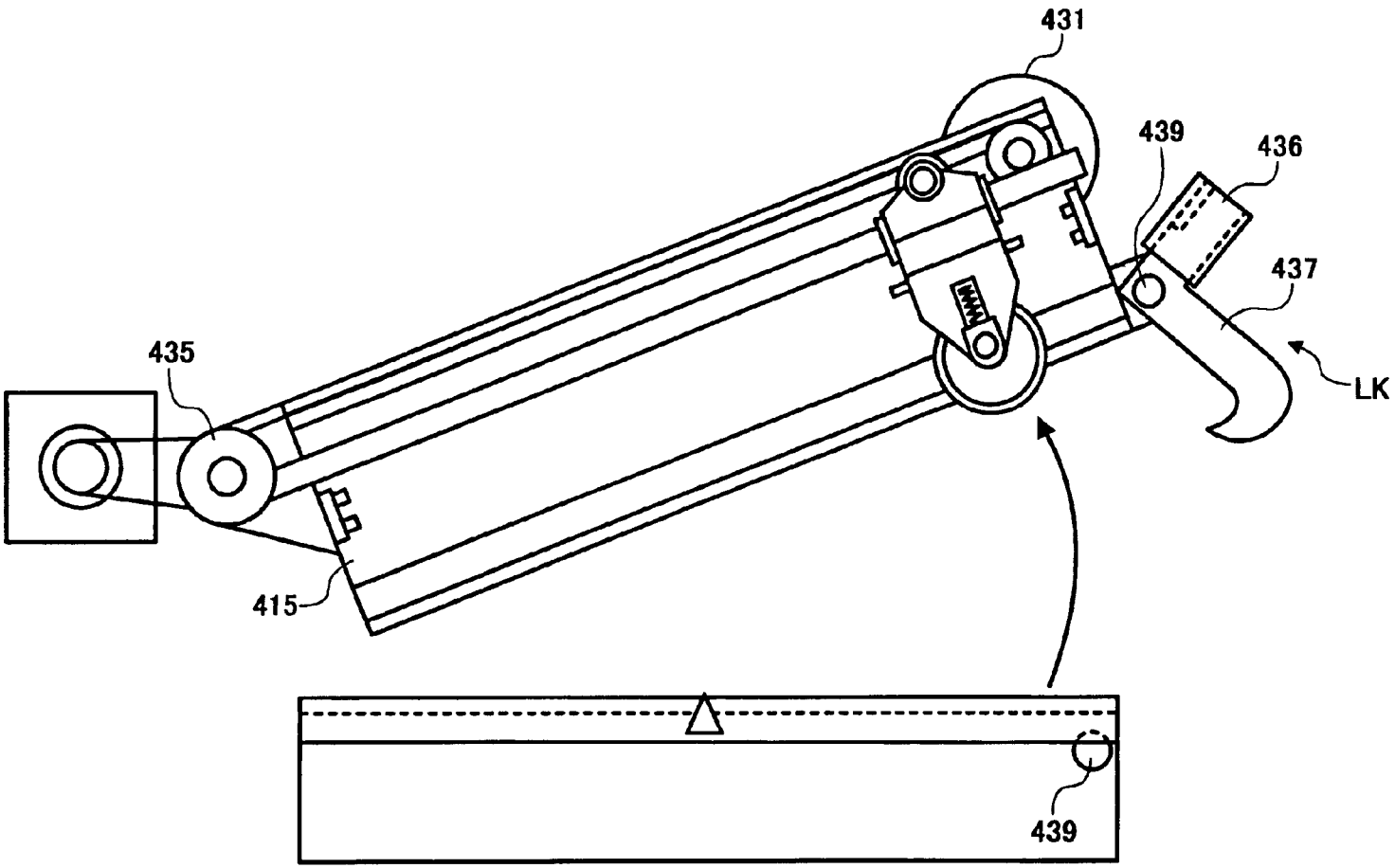
FIG. 104 shows an upper guide plate held in an open position in the sixteenth embodiment.

When part of a sheet stack, jamming the reinforce roller unit 400, obstructs the movement of the reinforce roller 409, the operator unlocks the locking mechanism LK, as shown in FIG. 103, and then opens the upper guide plate 415 loaded with the drive system for the reinforce roller 409, as shown in FIG. 104. In this condition, the operator can easily remove the sheet stack even when the sheet stack cannot be removed by operating the lever 431.

In an alternative configuration, the output torque of the pulse motor 401 is transferred to the pulley 435 via a gear, which is a substitute for the timing belt 434, while the upper guide plate 415 is openable about the axis of either one of the gear and pulley 435.

Figure 105:
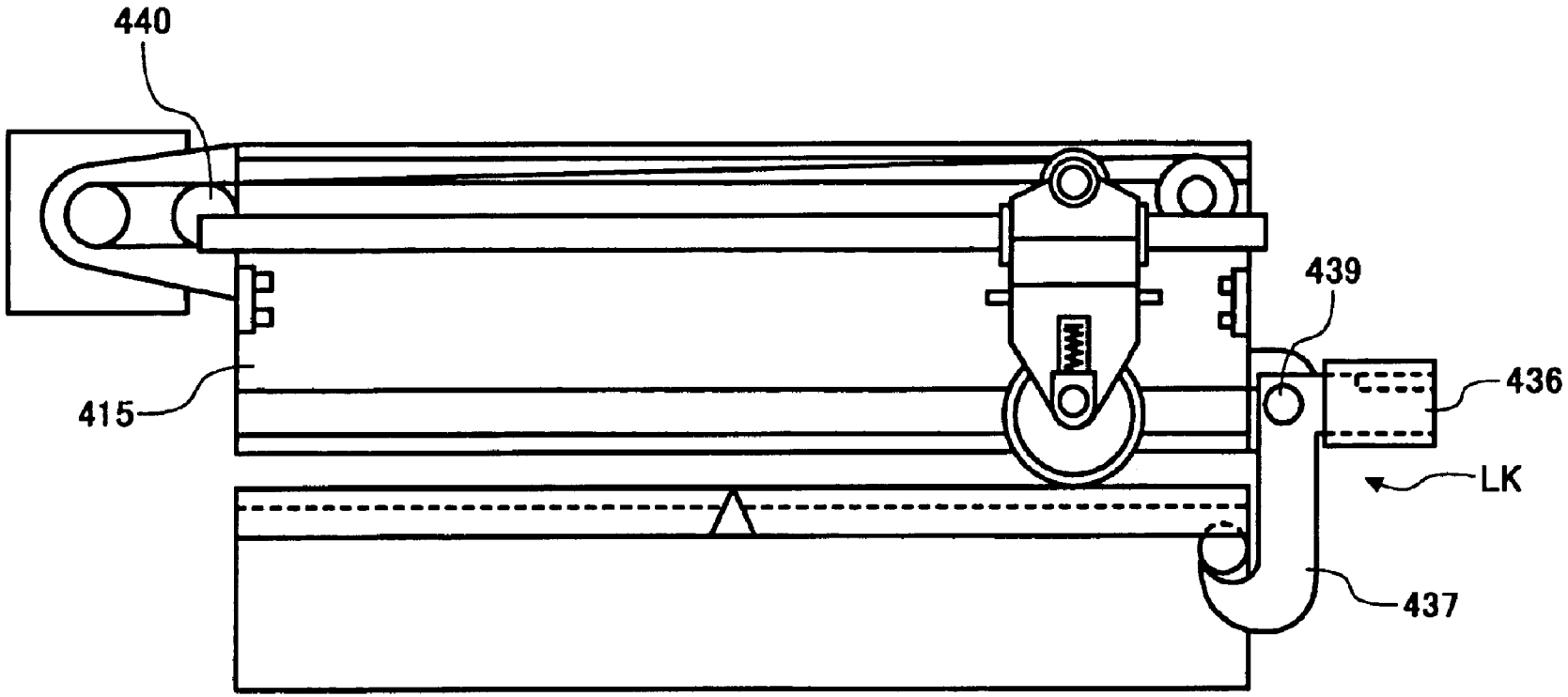
FIG. 105 is a front view showing a modification of the sixteenth embodiment.
Figure 106:
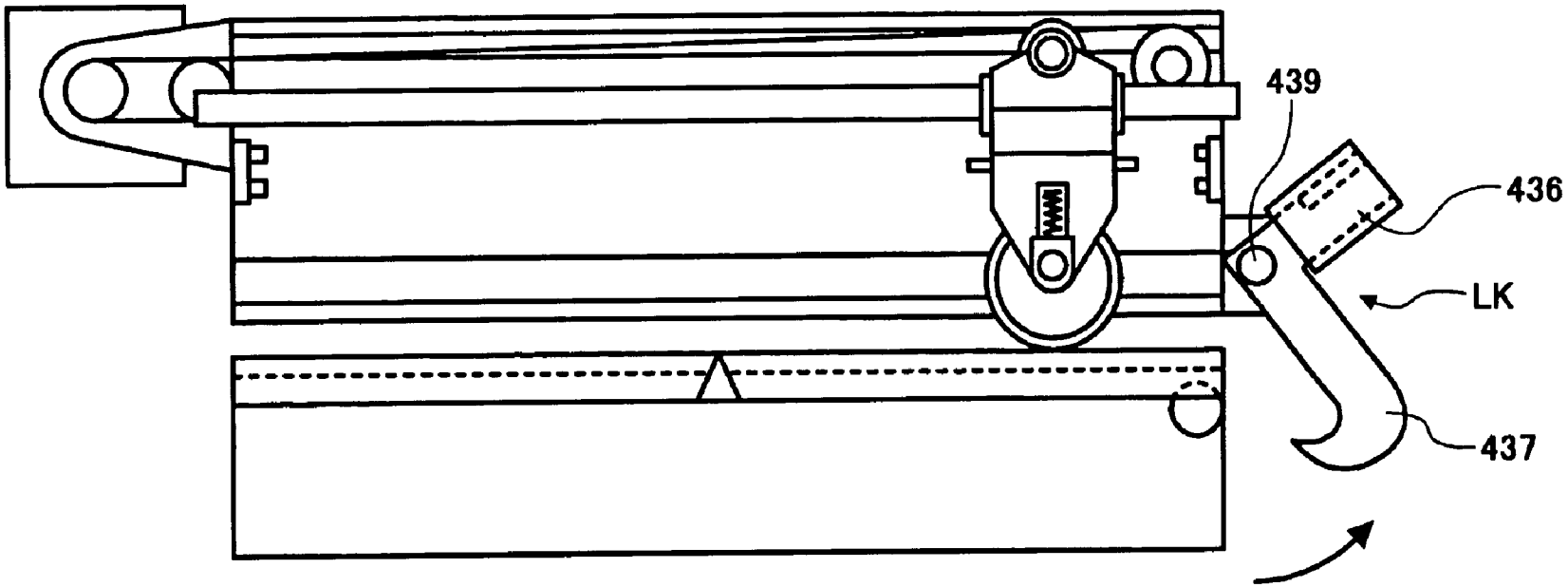
FIG. 106 shows an unlocked condition in the modification of FIG. 105.
Figure 107:
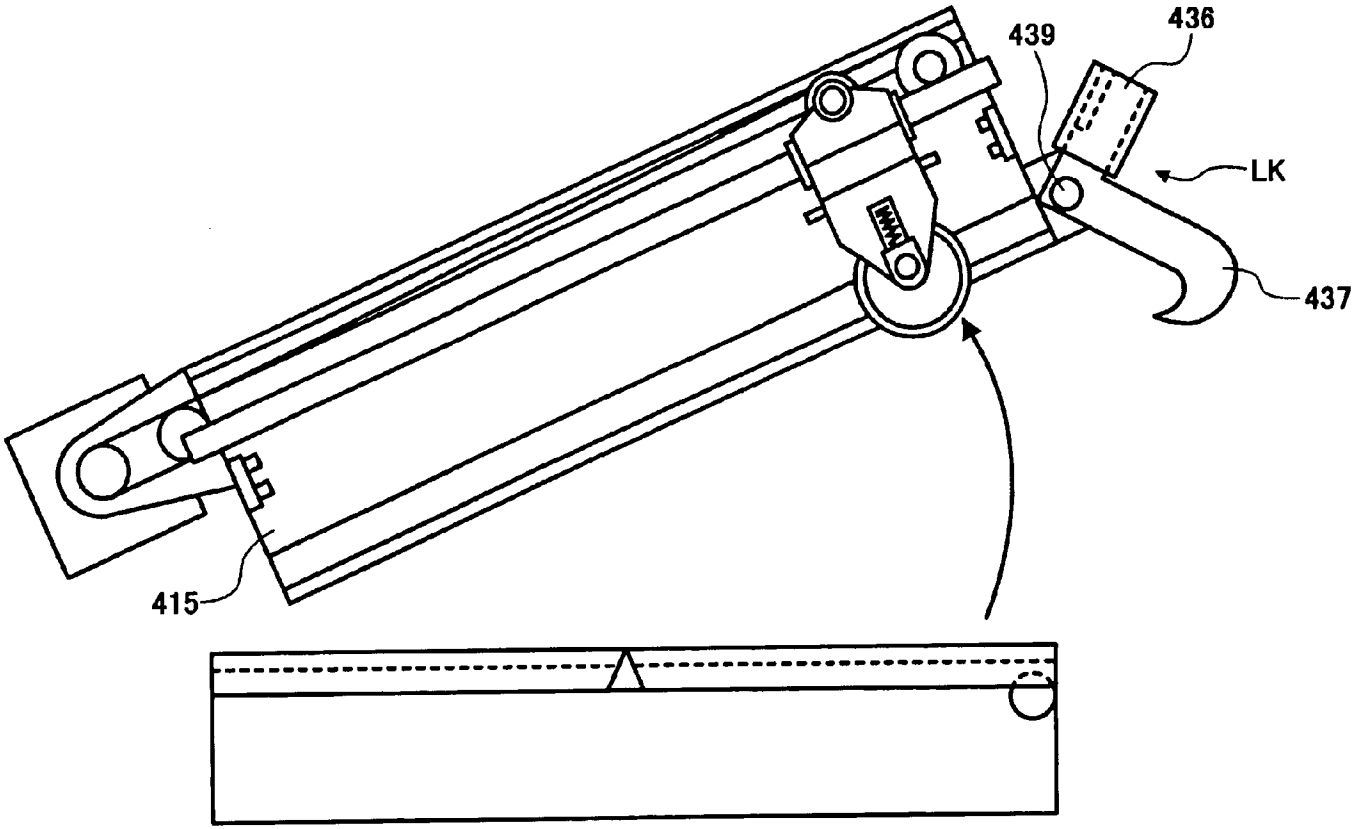
FIG. 107 shows the upper guide plate of FIG. 105 held in an open position.

FIGS. 105 and 106 shows a modification of the illustrative embodiment. As shown, the upper guide plate 415 supports the pulse motor 401. A shaft 440, supporting the upper guide plate 415 such that the plate 415 is angularly movable, is mounted on the plate 415. In this configuration, by unlocking the locking mechanism LK, as shown in FIG. 106, the operator can lift the drive system assigned to the reinforce roller 409 together with the upper guide plate 415 in order to remove a jamming sheet stack.

As for the rest of the construction, the illustrative embodiment is identical with the fourteenth embodiment.

Seventeenth Embodiment

Figure 108:
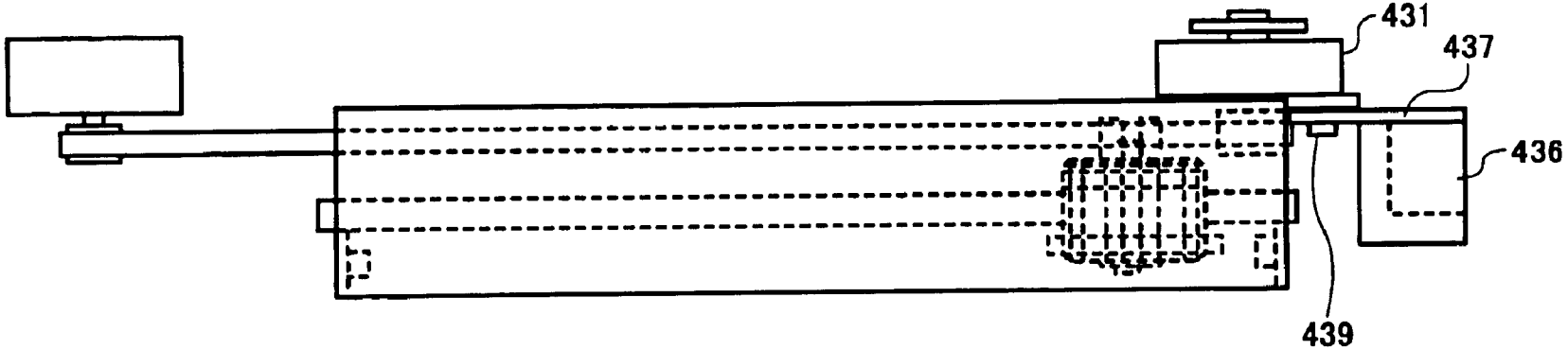
FIG. 108 is a plan view showing a seventeenth embodiment of the present invention.
Figure 109:
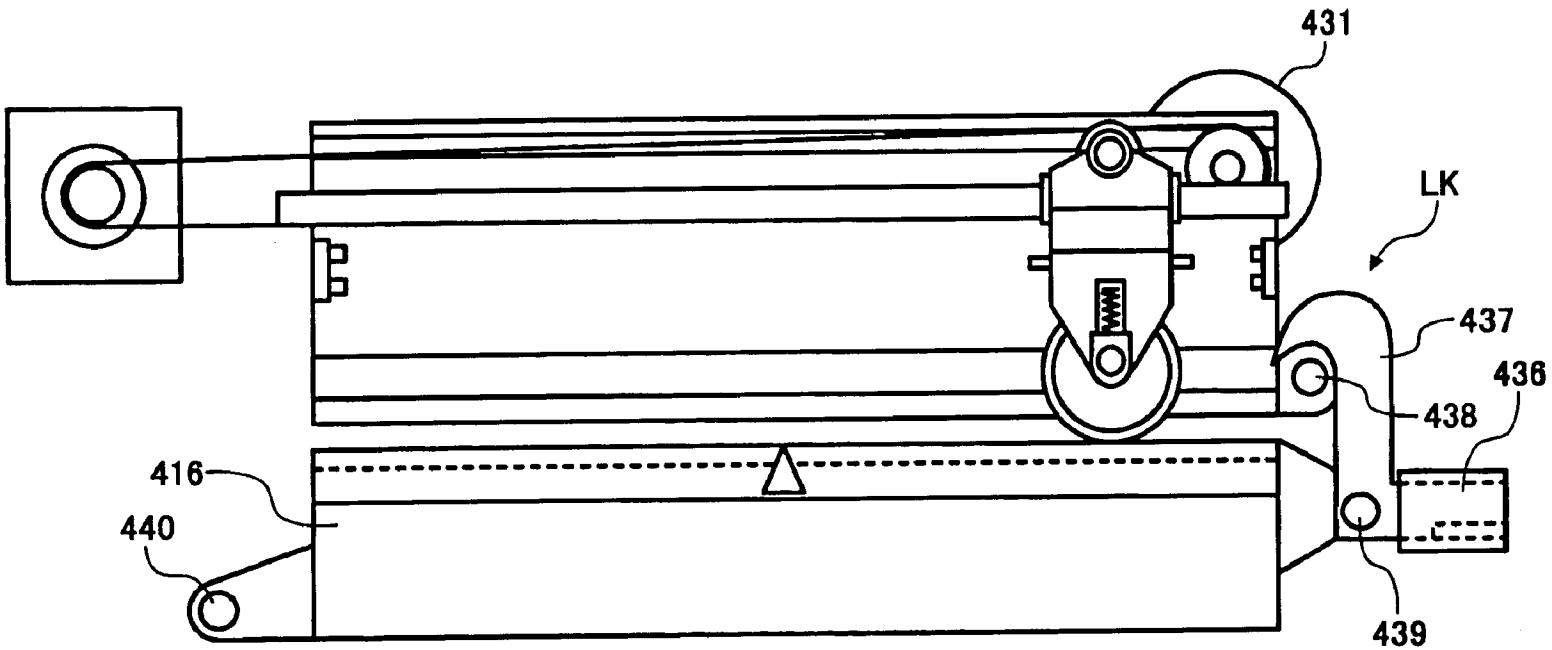
FIG. 109 is a front view of the seventeenth embodiment.
Figure 110:
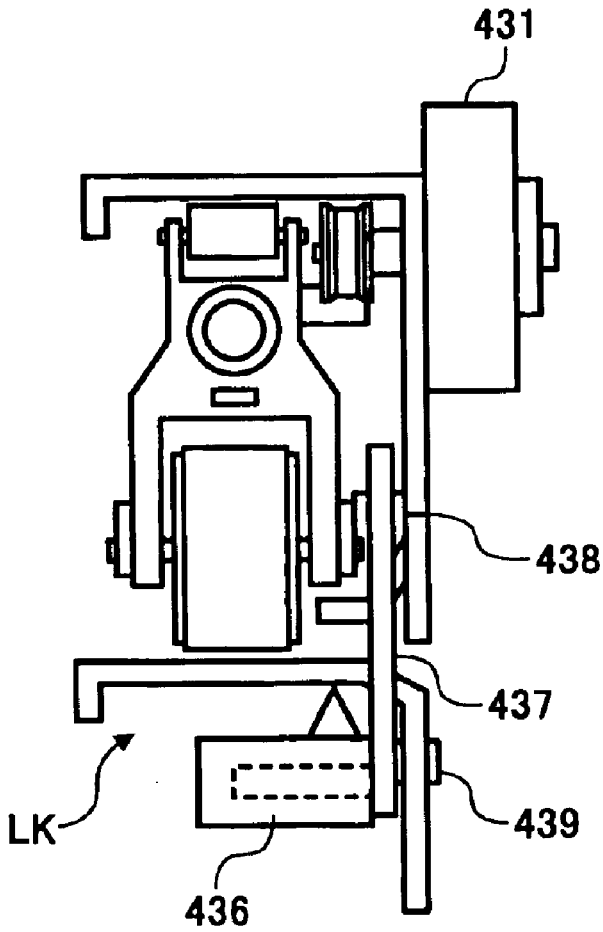
FIG. 110 is a side elevation of the seventeenth embodiment as seen from the right.

FIGS. 108 through 116 show a seventeenth embodiment of the present invention. The illustrative embodiment differs from the fourteenth embodiment in that it allows the lower guide plate 416 to be retracted. More specifically, as shown in FIGS. 108 through 110, the locking mechanism, made up of the lever 436, link 437, stop 438 and shaft 439, is mounted on the lower guide plate 416. The lower guide plate 416 is supported by a shaft 440, which is located at the opposite side to the locking mechanism LK and extends in the direction parallel to the direction of sheet conveyance, in such a manner as to be angularly movable.

Figure 111:
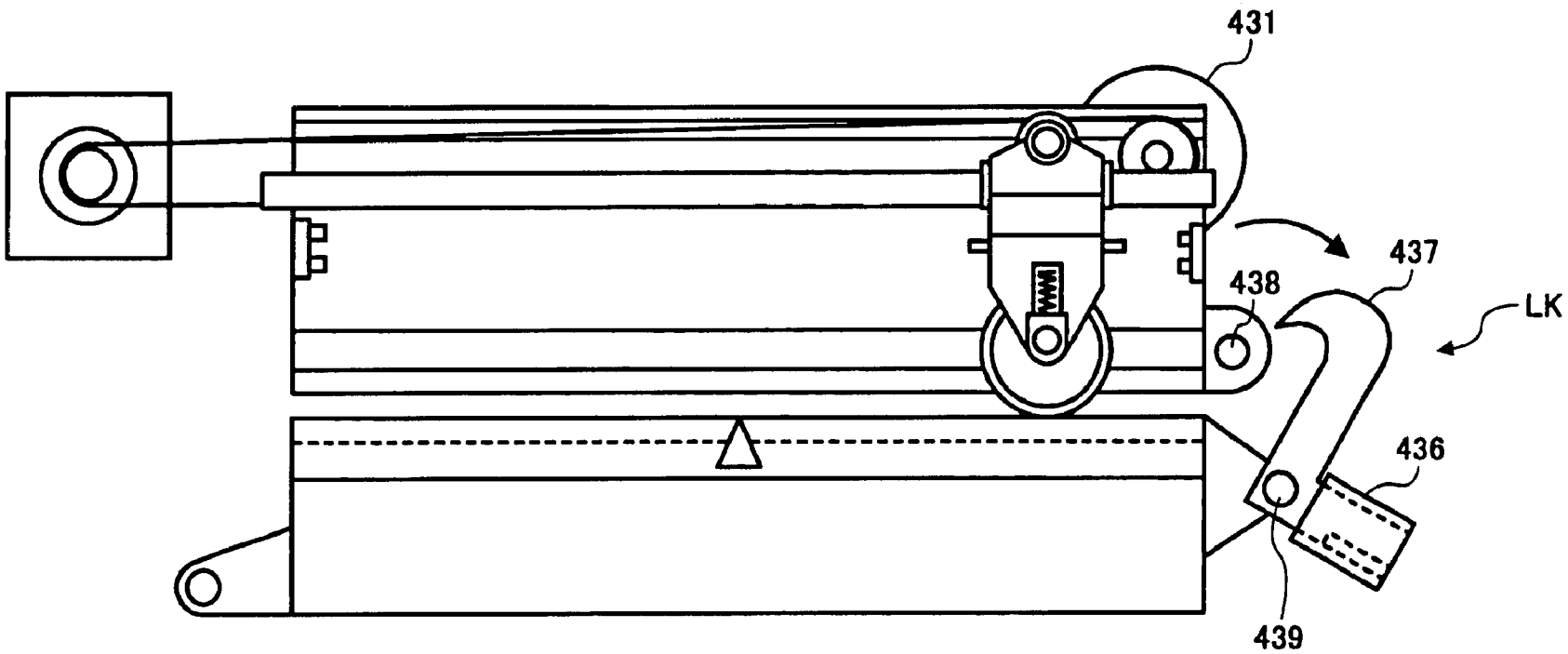
FIG. 111 shows an unlocked condition in the seventeenth embodiment.
Figure 112:
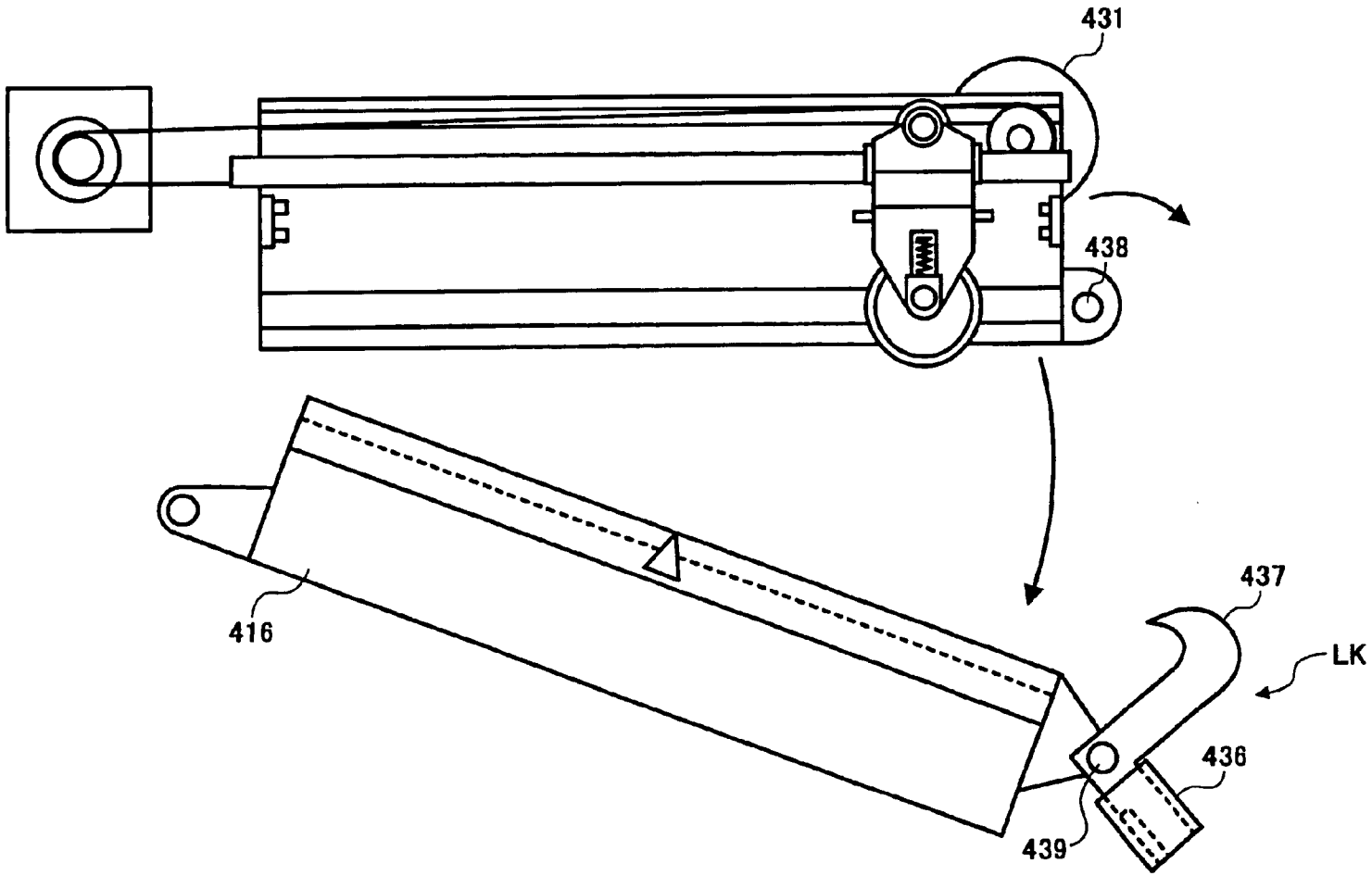
FIG. 112 shows the lower guide plate held in an open position in the seventeenth embodiment.
Figure 113:
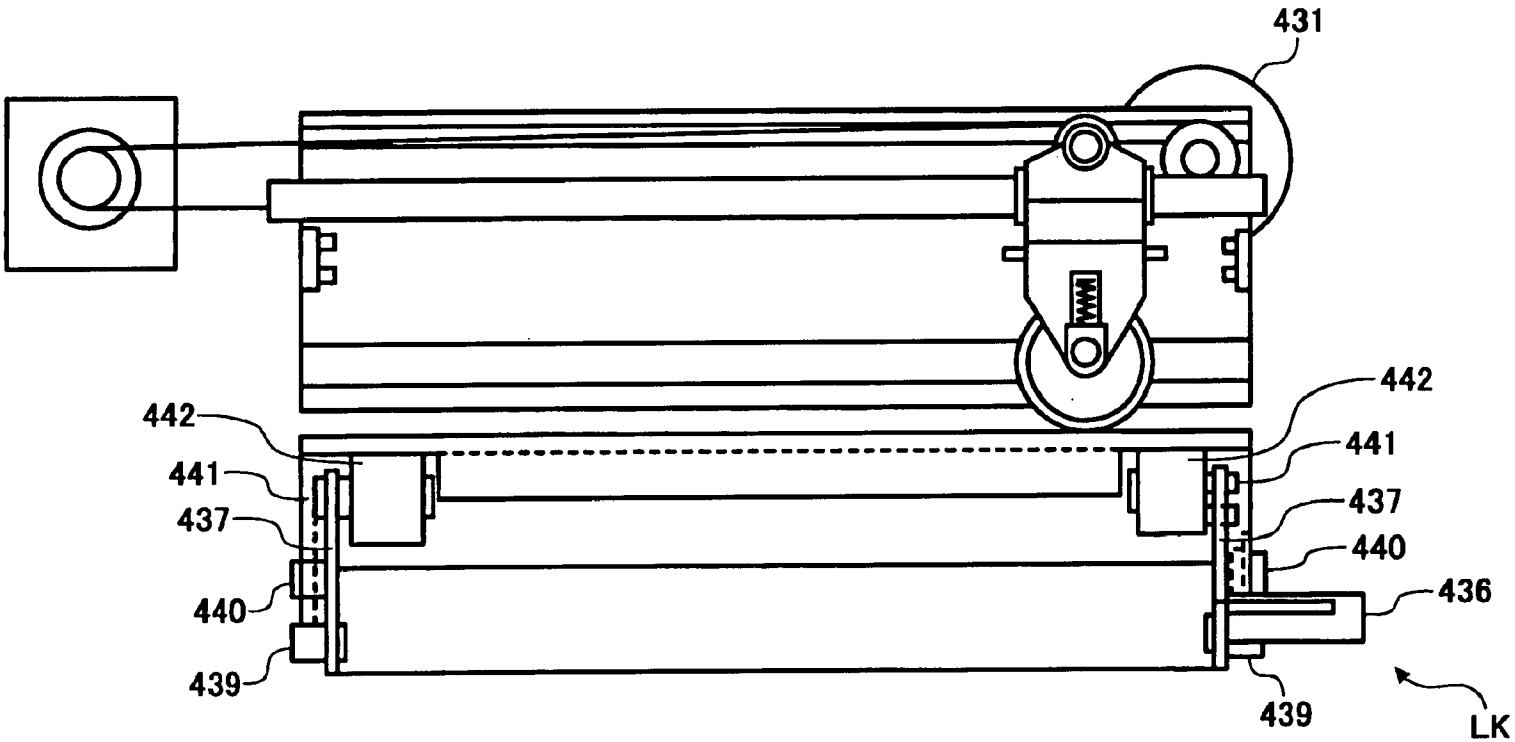
FIG. 113 is a front view showing a modification of the seventeenth embodiment.

As shown in FIGS. 111 and 112, when a sheet stack jams the reinforce roller unit 400, the operator can remove the sheet stack by unlocking the locking mechanism LK to thereby cause the lower guide plate 416 to bodily retract.

Figure 114:
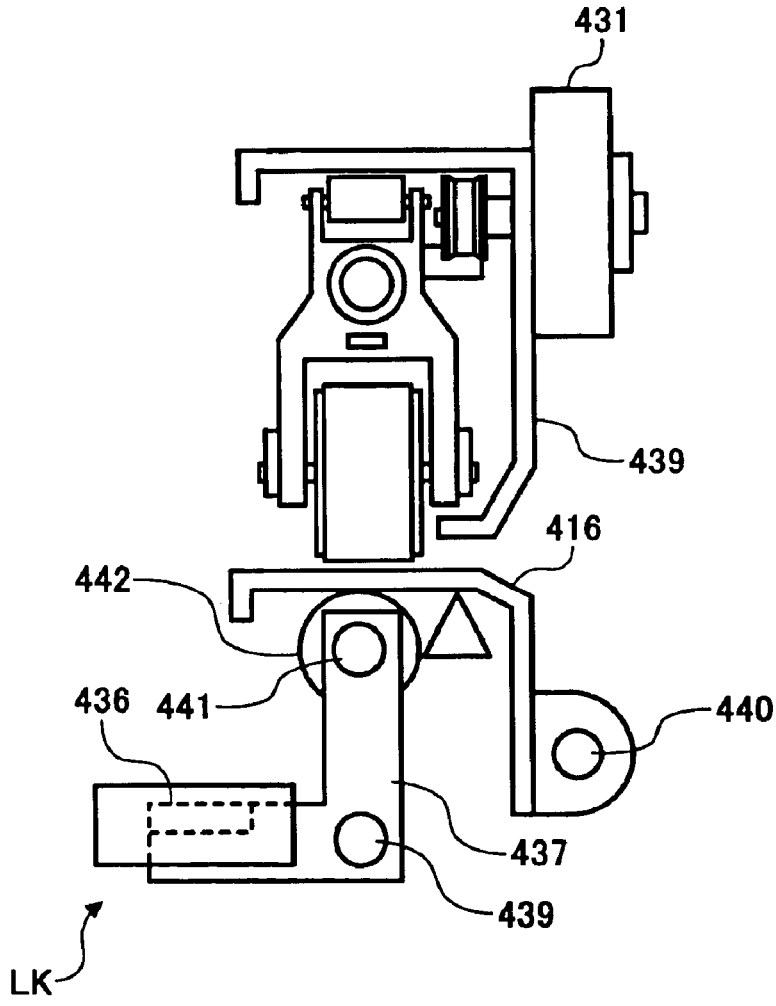
FIG. 114 is a side elevation of the modification of FIG. 113 as seen from the right.
Figure 115:
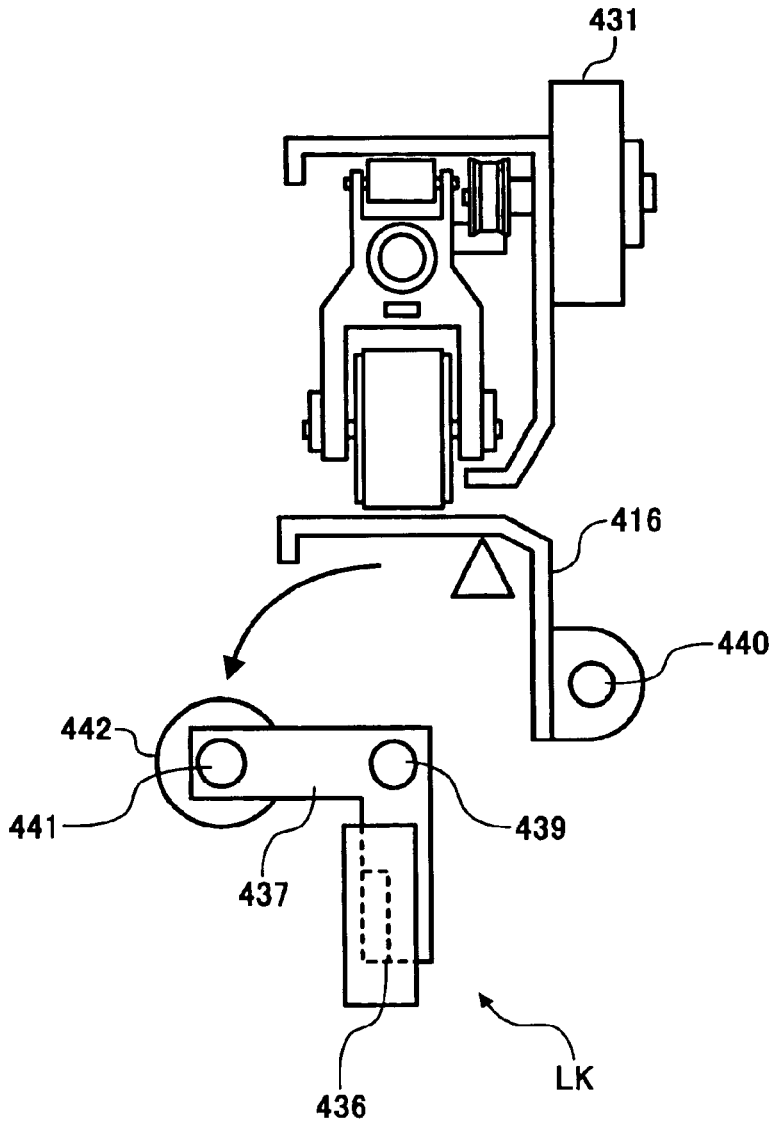
FIG. 115 shows an unlocked condition in the modification of FIG. 113.
Figure 116:
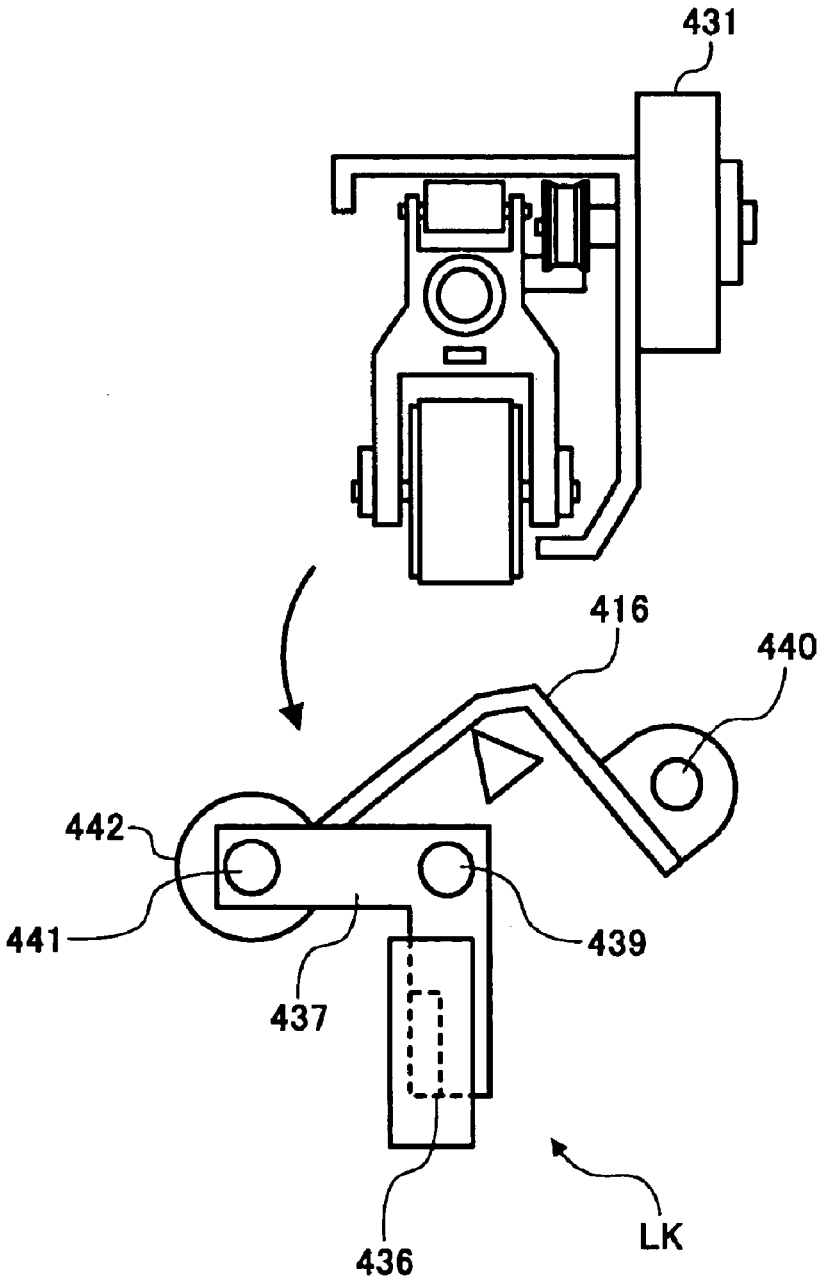
FIG. 116 shows the lower guide position held in an open position in the modification of FIG. 113.

FIGS. 113 through 116 show a modification of the illustrative embodiment. As shown, the shaft 440 extends perpendicularly to the direction of sheet conveyance. In this case, the locking mechanism LK includes a shaft 441 and a roller 442 in addition to the lever 436, link 437, stop 438 and shaft 439. More specifically, as shown in FIG. 114, the link 437 is generally L-shaped, as seen in a side elevation, and angularly movable about the shaft 439. The lever 436 is mounted on one end of the link 437 while the roller 442 is mounted on the other end of the link 437 via the shaft 441. As shown in FIGS. 115 and 116, by turning the lower guide plate 416 via the lever 436 and thereby uncovering the sheet path, the operator can easily remove a sheet path jamming the sheet path.

As for the rest of the construction, the illustrative embodiment is identical with the fourteenth embodiment.

In the above modification, when the operator turns the lever 431 by hand, the pulley 404 rotates with the result that the slider 407 and reinforce roller 409 are moved via the timing belt 403. Therefore, when a sheet stack jams the reinforce roller unit 400, the operator can remove the sheet stack by moving the reinforce roller 409 to the outside of the pressing range. Even when part of such a sheet stack blocks the movement of the reinforce roller 409, the operator can remove the sheet stack by unlocking the locking mechanism LK and moving the lower guide member 416.

As stated above, the fourteenth to seventeenth embodiments allow the operator to surely, easily remove a sheet stack jamming the reinforce roller unit 400 even when the reinforce roller 409 stops moving halfway on the sheet stack. This is true even when part of the sheet stack is spread and caught by the fold roller 409 or any one of the drive members.

Various modifications will become possible for those skilled in the art after receiving the teachings of the present disclosure without departing from the scope thereof.

What is claimed is:

1. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and shock absorbing means located at a contact position where said reinforce roller and said guide plate contact each other.

2. The finisher as claimed in claim 1, wherein said shock absorbing means comprises an elastic projection protruding from part of a circumferential surface of said reinforce roller that does not contact the stack.

3. The finisher as claimed in claim 2, wherein said projection comprises a flange-like member protruding from a side of said reinforce roller over the circumferential surface of said reinforce roller.

4. The finisher as claimed in claim 1, wherein said shock absorbing means comprises an elastic strip provided on a surface of said guide plate along the fold of the stack.

5. The finisher as claimed in claim 1, further comprising control means for causing said reinforce roller to reinforce the fold of the stack during each of a forward and a backward movement via said drive means.

6. The finisher as claimed in claim 1, further comprising a regulating member configured to prevent said reinforce roller from tilting when said reinforce roller moves on the fold of the stack while pressing said fold.

7. The finisher as claimed in claim 6, further comprising:

a support member supporting said reinforce roller; and a stationary guide member configured to guide said support member in a direction perpendicular to the direction of sheet conveyance;

wherein said regulating member comprises a stationary guide adjoining a locus of movement of said support member and an elongate slot formed in said guide plate in parallel to said guide member and receiving part of said support member, whereby said reinforce roller is movable while being restricted in movement in a circumferential direction of said guide member.

8. The finisher as claimed in claim 6, wherein said guide member is formed with a corner for restricting the movement of said support member in the circumferential direction of said guide member, so that said regulating member comprises said guide member.

9. The finisher as claimed in claim 6, wherein said guide member is polygonal in a section perpendicular to an axial direction of said guide member, so that said regulating member comprises said guide member.

10. The finisher as claimed in claim 6, wherein said guide member comprises two parallel guide members.

11. The finisher as claimed in claim 10, wherein said two guide members are mounted on said guide plate such that said support member is movable in a direction perpendicular to said guide plate.

12. The finisher as claimed in claim 11, further comprising biasing means for constantly biasing said support member toward said guide plate.

13. The finisher as claimed in claim 1, further comprising a regulating member configured to prevent a support member, which supports said reinforce roller, from tilting.

14. The finisher as claimed in claim 1, wherein when said reinforce roller is held in a stand-by position, a nip between said reinforce roller and said guide plate is positioned at a same height as the nip of said fold roller pair.

15. The finisher as claimed in claim 14, wherein said guide plate comprises:

supporting means for supporting said support member such that said support member is movable in an up-and-down direction perpendicular to the direction of sheet conveyance; and biasing means for exerting a pressing force equal to, but opposite in direction to, a pressing force of said reinforce roller.

16. The finisher as claimed in claim 14, wherein said guide plate comprises a regulating member configured to prevent said reinforce roller from tilting when moving on and pressing the fold of the stack.

17. The finisher as claimed in claim 1, wherein part of said reinforce roller contacting the stack comprises a high friction member.

18. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and control means for causing said reinforce roller to move at a lower speed when coming down from the stack onto said guide plate after pressing said stack than when pressing said stack, whereby an impact ascribable to contact of said reinforce roller with said guide plate is reduced.

19. The finisher as claimed in claim 18, wherein said control means lowers a moving speed of said reinforce roller not only during a forward movement but also during a backward movement.

20. The finisher as claimed in claim 18, further comprising a regulating member configured to prevent said reinforce roller from tilting when said reinforce roller moves on the fold of the stack while pressing said fold.

21. The finisher as claimed in claim 20, further comprising:

a support member supporting said reinforce roller; and a stationary guide member configured to guide said support member in a direction perpendicular to the direction of sheet conveyance;

wherein said regulating member comprises a stationary guide adjoining a locus of movement of said support member and an elongate slot formed in said guide plate in parallel to said guide member and receiving part of said support member, whereby said reinforce roller is movable while being restricted in movement in a circumferential direction of said guide member.

22. The finisher as claimed in claim 20, wherein said guide member is formed with a corner for restricting the movement of said support member in the circumferential direction of said guide member, so that said regulating member comprises said guide member.

23. The finisher as claimed in claim 20, wherein said guide member is polygonal in a section perpendicular to an axial direction of said guide member, so that said regulating member comprises said guide member.

24. The finisher as claimed in claim 20, wherein said guide member comprises two parallel guide members.

25. The finisher as claimed in claim 24, wherein said two guide members are mounted on said guide plate such that said support member is movable in a direction perpendicular to said guide plate.

26. The finisher as claimed in claim 25, further comprising biasing means for constantly biasing said support member toward said guide plate.

27. The finisher as claimed in claim 18, further comprising a regulating member configured to prevent a support member, which supports said reinforce roller, from tilting.

28. The finisher as claimed in claim 18, wherein when said reinforce roller is held in a stand-by position, a nip between said reinforce roller and said guide plate is positioned at a same height as the nip of said fold roller pair.

29. The finisher as claimed in claim 28, wherein said guide plate comprises:

supporting means for supporting said support member such that said support member is movable in an up-and-down direction perpendicular to the direction of sheet conveyance; and biasing means for exerting a pressing force equal to, but opposite in direction to, a pressing force of said reinforce roller.

30. The finisher as claimed in claim 28, wherein said guide plate comprises a regulating member configured to prevent said reinforce roller from tilting when moving on and pressing the fold of the stack.

31. The finisher as claimed in claim 18, wherein part of said reinforce roller contacting the stack comprises a high friction member.

32. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance;

a support member supporting said reinforce roller; and a stationary guide member configured to guide said support member in a direction perpendicular to the direction of sheet conveyance;

wherein said drive means causes said reinforce roller to move along said guide member.

33. The finisher as claimed in claim 32, further comprising a bend-preventing member configured to prevent, when said reinforce roller presses the stack, said guide member from bending due to a pressing force of said reinforce roller.

34. The finisher as claimed in claim 33, wherein said bend-preventing member comprises:

a guide positioned at a side opposite to said guide plate with respect to said guide member and extending in parallel to said guide member; and a contact member mounted on an end of said support member remote from said reinforce roller and contacting said guide;

wherein said reinforce roller is movable with said contact member contacting said guide.

35. The finisher as claimed in claim 32, further comprising a regulating member configured to prevent said reinforce roller from tilting when said reinforce roller moves on the fold of the stack while pressing said fold.

36. The finisher as claimed in claim 35, further comprising:

a support member supporting said reinforce roller; and a stationary guide member configured to guide said support member in a direction perpendicular to the direction of sheet conveyance;

wherein said regulating member comprises a stationary guide adjoining a locus of movement of said support member and an elongate slot formed in said guide plate in parallel to said guide member and receiving part of said support member, whereby said reinforce roller is movable while being restricted in movement in a circumferential direction of said guide member.

37. The finisher as claimed in claim 35, wherein said guide member is formed with a corner for restricting the movement of said support member in the circumferential direction of said guide member, so that said regulating member comprises said guide member.

38. The finisher as claimed in claim 35, wherein said guide member is polygonal in a section perpendicular to an axial direction of said guide member, so that said regulating member comprises said guide member.

39. The finisher as claimed in claim 35, wherein said guide member comprises two parallel guide members.

40. The finisher as claimed in claim 39, wherein said two guide members are mounted on said guide plate such that said support member is movable in a direction perpendicular to said guide plate.

41. The finisher as claimed in claim 40, further comprising biasing means for constantly biasing said support member toward said guide plate.

42. The finisher as claimed in claim 32, further comprising a regulating member configured to prevent a support member, which supports said reinforce roller, from tilting.

43. The finisher as claimed in claim 42, wherein when said reinforce roller is held in a stand-by position, a nip between said reinforce roller and said guide plate is positioned at a same height as the nip of said fold roller pair.

44. The finisher as claimed in claim 43, wherein said guide plate comprises:

supporting means for supporting said support member such that said support member is movable in an up-and-down direction perpendicular to the direction of sheet conveyance; and biasing means for exerting a pressing force equal to, but opposite in direction to, a pressing force of said reinforce roller.

45. The finisher as claimed in claim 43, wherein said guide plate comprises a regulating member configured to prevent said reinforce roller from tilting when moving on and pressing the fold of the stack.

46. The finisher as claimed in claim 32, wherein part of said reinforce roller contacting the stack comprises a high friction member.

47. An image forming system comprising:

an image forming apparatus comprising image forming means for forming an image on a sheet in accordance with input image data and sheet feeding means for feeding sheets to said image forming means one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and shock absorbing means located at a contact position where said reinforce roller and said guide plate contact each other.

48. An image forming system comprising:

an image forming apparatus comprising image forming means for forming an image on a sheet in accordance with input image data and sheet feeding means for feeding sheets to said image forming means one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and control means for causing said reinforce roller to move at a lower speed when coming down from the stack onto said guide plate after pressing said stack than when pressing said stack, whereby an impact ascribable to contact of said reinforce roller with said guide plate is reduced.

49. An image forming system comprising:

an image forming apparatus comprising image forming means for forming an image on a sheet in accordance with input image data and sheet feeding means for feeding sheets to said image forming means one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance;

a support member supporting said reinforce roller; and a stationary guide member configured to guide said support member in a direction perpendicular to the direction of sheet conveyance;

wherein said drive means causes said reinforce roller to move along said guide member.

50. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance;

monitoring means for monitoring a movement of said reinforce roller; and control means for causing, when an error is detected during movement of said reinforce roller, said reinforce roller to move to a home position and causing display means to display a jam message.

51. The finisher as claimed in claim 50, wherein said monitoring means comprises:

first sensing means for sensing the home position of said reinforce roller; and second sensing means for sensing an end-of-reinforcement position where said reinforce roller ends pressing the fold.

52. The finisher as claimed in claim 50, wherein when said reinforce roller fails to return to the home position within a preselected period of time, said control means determines that said reinforce roller is fully locked and unable to return and that and error unable to be dealt with by a user has occurred, while causing said display means to display an error message.

53. The finisher as claimed in claim 50, wherein when the error has occurred, said control means inhibits said reinforce roller from pressing a following stack of sheets.

54. An image forming system comprising:

an image forming apparatus comprising image forming means for forming an image on a sheet in accordance with input image data and sheet feeding means for feeding sheets to said image forming means one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance;

monitoring means for monitoring a movement of said reinforce roller; and control means for causing, when an error is detected during movement of said reinforce roller, said reinforce roller to move to a home position and causing display means to display a jam message.

55. The system as claimed in claim 54, wherein said display means is included in said image forming apparatus.

56. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate; and drive means for moving said reinforce roller in a direction perpendicular to a direction of sheet conveyance;

wherein said drive means causes a moving speed of said reinforce roller to vary from a time when said reinforce roller contacts the stack to a time when said reinforce roller does not contact said stack.

57. The finisher as claimed in claim 56, wherein said drive means causes said reinforce roller to move at a lower speed when getting on the stack than when rolling on said stack.

58. The finisher as claimed in claim 57, wherein said drive means increases the moving speed of said reinforce roller to a preselected speed after said reinforce roller has got on the stack.

59. The finisher as claimed in claim 56, wherein assuming that said reinforce roller moves at a speed V1 before getting on the stack, at a speed V2 when getting on said stack, at a speed V3 before coming down from said stack, at a speed V4 when coming down from said stack and at a speed V6 after coming down from said stack, then said drive means satisfies:

$$V1 \geqq V2$$

$$V6 \geqq V4$$

$$V3 > V2, V4.$$

60. The finisher as claimed in claim 56, wherein said drive means causes said reinforce roller to move at a higher speed when the stack is absent than when said stack is present.

61. An image forming system comprising:

an image forming apparatus comprising image forming means for forming an image on a sheet in accordance with input image data and sheet feeding means for feeding sheets to said image forming means one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate; and drive means for moving said reinforce roller in a direction perpendicular to a direction of sheet conveyance;

wherein said drive means causes a moving speed of said reinforce roller to vary from a time when said reinforce roller contacts the stack to a time when said reinforce roller does not contact said stack.

62. In a sheet finisher for pressing a fold of a sheet stack folded for thereby reinforcing said fold, control means determines whether or not to execute processing for pressing said fold in accordance with a number of sheets constituting said sheet stack.

63. The finisher as claimed in claim 62, wherein when the number of sheets is equal to or larger than a preselected value, said control means executes said processing.

64. The finisher as claimed in claim 63, wherein said control means varies a number of times of pressing in accordance with the number of sheets.

65. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and control means for controlling said drive means;

wherein said control means causes said reinforce roller to perform pressing in accordance with a number of sheets constituting the stack.

66. The finisher as claimed in claim 65, wherein said control means varies a moving speed of said reinforce roller during pressing in accordance with the number of sheets.

67. The finisher as claimed in claim 65, wherein said control means varies a number of times of pressing in accordance with the number of sheets.

68. The finisher as claimed in claim 65, further comprising sensing means positioned upstream of said reinforce roller in the direction of sheet conveyance for sensing the stack, wherein said control means causes said reinforce roller to continuously press the fold until said sensing means senses a following next stack of sheets.

69. The finisher as claimed in claim 68, wherein said control means varies a moving speed of said reinforce roller during pressing in accordance with the number of sheets.

70. The finisher as claimed in claim 65, wherein said control means varies a number of times of pressing in accordance with the number of sheets.

71. An image forming system comprising:

an image forming apparatus comprising image forming means for forming an image on a sheet in accordance with input image data and sheet feeding means for feeding sheets to said image forming means one by one; and a sheet finisher configured to press a fold of a sheet stack for thereby reinforcing said fold and comprising control means for determining whether or not to execute processing for pressing said fold in accordance with a number of sheets constituting said sheet stack.

72. An image forming system comprising:

an image forming apparatus comprising image forming means for forming an image on a sheet in accordance with input image data and sheet feeding means for feeding sheets to said image forming means one by one; and a sheet finisher configured to press a fold of a sheet stack folded for thereby reinforcing said fold and comprising control means for determining whether or not to execute processing for pressing said fold in accordance with a number of sheets constituting said sheet stack.

73. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and control means for controlling said drive means;

wherein said control means causes said reinforce roller to move to a position close to an edge of the stack to be pressed beforehand and wait at said position.

74. The finisher as claimed in claim 73, wherein said control means determines, when causing said reinforce roller to move to said position beforehand, a distance of movement in accordance with size information received.

75. The finisher as claimed in claim 74, wherein the distance of movement is selected to be two times as great as a distance between a stand-by position of said reinforce roller and a widthwise center of the stack to be pressed by said reinforce roller.

76. The finisher as claimed in claim 74, wherein the size information is received from an image forming apparatus from which the sheets are sequentially transferred to said finisher.

77. An image forming system comprising:

an image forming apparatus comprising image forming means for forming an image on a sheet in accordance with input image data and sheet feeding means for feeding sheets to said image forming means one by one; and a sheet finisher configured to fold a stack of sheets each carrying an image formed thereon;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

drive means for moving said reinforce roller in a direction perpendicular to a direction of sheet conveyance; and control means for controlling said drive means;

wherein said control means causes said reinforce roller to move to a position close to an edge of the stack to be pressed beforehand and wait at said position.

78. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

first drive means for causing said reinforce roller to move in a direction perpendicular to a direction of sheet conveyance with an electric driving force; and second drive means for allowing an operator to move said reinforce roller by hand.

79. The finisher as claimed in claim 78, wherein said first drive means comprises a motor, a drive pulley driven by said motor, a driven pulley and a belt passed over said drive pulley and said driven pulley, and said second drive means comprises a lever connected to said driven pulley for allowing the operator to rotate said driven pulley by hand.

80. The finisher as claimed in claim 78, further comprising releasing means for releasing said reinforce roller from the stack at a pressing position.

81. The finisher as claimed in claim 80, wherein said releasing means comprises:

a first guide member supporting said reinforce roller such that said reinforce roller is capable of moving in a direction perpendicular to the direction of sheet conveyance;

a first shaft supporting said first guide member such that said first guide member is angularly movable about one end thereof; and first locking means for selectively locking or unlocking said first guide member at said pressing position.

82. The finisher as claimed in claim 81, wherein said first shaft comprises a shaft of said driven pulley.

83. The finisher as claimed in claim 81, wherein said first drive means is supported by said first guide member while said first shaft is included in said first guide member.

84. The finisher as claimed in claim 80, wherein said releasing means comprises:

a second guide member receiving a pressing force of said reinforce roller;

a second shaft supporting said second guide member such that said second guide member is angularly movable in a direction perpendicular to the direction of sheet conveyance; and second locking means for selectively locking or unlocking said second guide member at a pressing position assigned to said reinforce roller.

85. The finisher as claimed in claim 80, wherein said releasing means comprises:

a second guide member receiving a pressing force of said reinforce roller;

a third shaft supporting said second guide member such that said second guide member is angularly movable in a direction perpendicular to the direction of sheet conveyance; and third locking means for selectively locking or unlocking said second guide member at a pressing position assigned to said reinforce roller.

86. An image forming system comprising:

an image forming apparatus comprising image forming means for forming an image on a sheet in accordance with input image data and sheet feeding means for feeding sheets to said image forming means one by one; and a sheet finisher configured to fold a stack of sheets each carrying an image formed thereon;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

first drive means for causing said reinforce roller to move in a direction perpendicular to a direction of sheet conveyance with an electric driving force; and second drive means for allowing an operator to move said reinforce roller by hand.

87. A sheet finisher configured to fold a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device configured to move said reinforce roller in a direction perpendicular to a direction of sheet conveyance; and a shock absorber located at a contact position where said reinforce roller and said guide plate contact each other.

88. The finisher as claimed in claim 87, wherein said shock absorber comprises an elastic projection protruding from part of a circumferential surface of said reinforce roller that does not contact the stack.

89. The finisher as claimed in claim 88, wherein said projection comprises a flange-like member protruding from a side of said reinforce roller over the circumferential surface of said reinforce roller.

90. The finisher as claimed in claim 87, wherein said shock absorber comprises an elastic strip provided on a surface of said guide plate along the fold of the stack.

91. The finisher as claimed in claim 87, further comprising a controller configured to cause said reinforce roller to reinforce the fold of the stack during each of a forward and a backward movement via said driver.

92. The finisher as claimed in claim 87, further comprising a regulating member configured to prevent said reinforce roller from tilting when said reinforce roller moves on the fold of the stack while pressing said fold.

93. The finisher as claimed in claim 92, further comprising:

a support member supporting said reinforce roller; and a stationary guide member configured to guide said support member in a direction perpendicular to the direction of sheet conveyance;

wherein said regulating member comprises a stationary guide adjoining a locus of movement of said support member and an elongate slot formed in said guide plate in parallel to said guide member and receiving part of said support member, whereby said reinforce roller is movable while being restricted in movement in a circumferential direction of said guide member.

94. The finisher as claimed in claim 92, wherein said guide member is formed with a corner configured to restrict the movement of said support member in the circumferential direction of said guide member, so that said regulating member comprises said guide member.

95. The finisher as claimed in claim 92, wherein said guide member is polygonal in a section perpendicular to an axial direction of said guide member, so that said regulating member comprises said guide member.

96. The finisher as claimed in claim 92, wherein said guide member comprises two parallel guide members.

97. The finisher as claimed in claim 96, wherein said two guide members are mounted on said guide plate such that said support member is movable in a direction perpendicular to said guide plate.

98. The finisher as claimed in claim 97, further comprising a bias device configured to bias said support member toward said guide plate.

99. The finisher as claimed in claim 87, further comprising a regulating member configured to prevent a support member, which supports said reinforce roller, from tilting.

100. The finisher as claimed in claim 87, wherein when said reinforce roller is held in a stand-by position, a nip between said reinforce roller and said guide plate is positioned at a same height as the nip of said fold roller pair.

101. The finisher as claimed in claim 100, wherein said guide plate comprises:

a support device configured to support said support member such that said support member is movable in an up-and-down direction perpendicular to the direction of sheet conveyance; and a bias device configured to exert a pressing force equal to, but opposite in direction to, a pressing force of said reinforce roller.

102. The finisher as claimed in claim 100, wherein said guide plate comprises a regulating member configured to prevent said reinforce roller from tilting when moving on and pressing the fold of the stack.

103. The finisher as claimed in claim 87, wherein part of said reinforce roller contacting the stack comprises a high friction member.

104. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device configured to move said reinforce roller in a direction perpendicular to a direction of sheet conveyance; and a controller configured to cause said reinforce roller to move at a lower speed when coming down from the stack onto said guide plate after pressing said stack than when pressing said stack, whereby an impact ascribable to contact of said reinforce roller with said guide plate is reduced.

105. The finisher as claimed in claim 104, wherein said controller lowers a moving speed of said reinforce roller not only during a forward movement but also during a backward movement.

106. The finisher as claimed in claim 104, further comprising a regulating member configured to prevent said reinforce roller from tilting when said reinforce roller moves on the fold of the stack while pressing said fold.

107. The finisher as claimed in claim 106, further comprising:

a support member configured to support said reinforce roller; and a stationary guide member configured to guide said support member in a direction perpendicular to the direction of sheet conveyance;

wherein said regulating member comprises a stationary guide adjoining a locus of movement of said support member and an elongate slot formed in said guide plate in parallel to said guide member and receiving part of said support member, whereby said reinforce roller is movable while being restricted in movement in a circumferential direction of said guide member.

108. The finisher as claimed in claim 106, wherein said guide member is formed with a corner configured to restrict the movement of said support member in the circumferential direction of said guide member, so that said regulating member comprises said guide member.

109. The finisher as claimed in claim 106, wherein said guide member is polygonal in a section perpendicular to an axial direction of said guide member, so that said regulating member comprises said guide member.

110. The finisher as claimed in claim 106, wherein said guide member comprises two parallel guide members.

111. The finisher as claimed in claim 110, wherein said two guide members are mounted on said guide plate such that said support member is movable is a direction perpendicular to said guide plate.

112. The finisher as claimed in claim 111, further comprising a bias device configured to constantly bias said support member toward said guide plate.

113. The finisher as claimed in claim 104, further comprising a regulating member configured to prevent a support member, which supports said reinforce roller, from tilting.

114. The finisher as claimed in claim 104, wherein when said reinforce roller is held in a stand-by position, a nip between said reinforce roller and said guide plate is positioned at a same height as the nip of said fold roller pair.

115. The finisher as claimed in claim 114, wherein said guide plate comprises:

a support device configured to support said support member such that said support member is movable in an up-and-down direction perpendicular to the direction of sheet conveyance; and a bias device configured to press with a force equal to, but opposite in direction to, a pressing force of said reinforce roller.

116. The finisher as claimed in claim 114, wherein said guide plate comprises a regulating member configured to prevent said reinfoce toller from tilting when moving on and pressing the fold of the stack.

117. The finisher as claimed in claim 104, wherein part of said reinforce roller contacting the stack comprises a high friction member.

118. A sheet finisher configured to fold a stack of sheets each of which includes an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device configured to move said reinforce roller in a direction perpendicular to a direction of sheet conveyance;

a support member configured to support said reinforce roller; and a stationary guide member configured to guide said support member in a direction perpendicular to the direction of sheet conveyance;

wherein said drive device causes said reinforce roller to move along said guide member.

119. The finisher as claimed in claim 118, further comprising a bend-prevention member configured to prevent, when said reinforce roller presses the stack, said guide member from bending due to a pressing force of said reinforce roller.

120. The finisher as claimed in claim 119, wherein said bend-prevention member comprises:

a guide positioned at a side opposite to said guide plate with respect to said guide member and extending in parallel to said guide member; and a contact member mounted on an end of said support member remote from said reinforce roller and contacting said guide;

wherein said reinforce roller is movable with said contact member contacting said guide.

121. The finisher as claimed in claim 118, further comprising a regulating member configured to prevent said reinforce roller from the tilting when said reinforce roller moves on the fold of the stack while pressing said fold.

122. The finisher as claimed in claim 121, futher comprising:

a support member supporting said reinforce roller; and a stationary guide member configured to guide said support member in a direction perpendicular to the direction of sheet conveyance;

wherein said regulating member comprises a stationary guide adjoining a locus of movement of said support member and an elongate slot formed in said guide plate in parallel to said guide member and receiving part of said support member, whereby said reinforce roller is movable while being restricted in movement in a circumferential direction of said guide member.

123. The finisher as claimed in claim 121, wherein said guide member is formed with a corner for restricting the movement of said support member in the circumferential direction of said guide member, so that said regulating member comprises said guide member.

124. The finisher as claimed in claim 121, wherein said guide member is polygonal in a section perpendicular to an axial direction of said guide member, so that said regulating member comprises said guide member.

125. The finisher as claimed in claim 121, wherein said guide member comprises two parallel guide members.

126. The finisher as claimed in claim 125, wherein said two guide members are mounted on said support member is movable in a direction perpendicular to said guide plate.

127. The finisher as claimed in claim 126, further comprising a device configured to constantly bias said support member toward said guide plate.

128. The finisher as claimed in claim 118, further comprising a regulating member configured to prevent a support member, which supports said reinforce roller, from tilting.

129. The finisher as claimed in claim 128, wherein when said reinforce roller is held in a stand-by position, a nip between said reinforce roller and said guide plate is positioned at a same height as the nip of said fold roller pair.

130. The finisher as claimed in claim 129, wherein said guide plate comprises:

a support device configured to support said support member such that said support member is movable in an up-and-down direction perpendicular to the direction of sheet conveyance; and a bias device configured to exert press with a force equal to, but opposite in direction to, a pressing force of said reinforce roller.

131. The finisher as claimed in claim 129, wherein said guide plate comprises a regulating member configured to prevent said reinforce roller from tilting when moving on and pressing the fold of the stack.

132. The finisher as claimed in claim 118, wherein part of said reinforce roller contacting the stack comprises a high friction member.

133. An image forming system comprising:

an image forming apparatus comprising an image forming device configured to form an image on a sheet in accordance with input image data and sheet feeder configured to feed sheets to said image forming device one by one; and a sheet finisher configured to fold a stack of sheets sequentially transferred from said image forming device;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device for moving said reinforce roller in a direction perpendicular to a direction of sheet conveyance; and a shock absorber located at a contact position where said reinforce roller and said guide plate contact each other.

134. An image forming system comprising:

an image forming apparatus comprising image forming apparatus configured to form an image on a sheet in accordance with input image data and sheet feeder configured to feed sheets to said image forming apparatus one by one; and a sheet finisher configured to a fold a stack of sheets sequentially transferred'from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device for moving said reinforce roller in a direction perpendicular to a direction of sheet conveyance; and a controller configured to cause said reinforce roller to move at a lower speed when coming down from the stack onto said guide plate after pressing said stack than when pressing said stack, whereby an impact ascribable to contact of said reinforce roller with said guide plate is reduced.

135. An image forming system comprising:

an image forming apparatus configured to form an image on a sheet in accordance with input image data and sheet feeder configured to feed sheets to said image forming apparatus one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinfoce roller and a guide plate;

a drive device configured to move said reinforce roller in a direction perpendicular to a direction of sheet conveyance;

a support member configured to support said reinforce roller; and a stationary guide member configured to guide said support member in a direction perpendicular to the direction of sheet conveyance;

wherein said drive causes said reinforce roller to move along said guide member.

136. A sheet finisher for folding a stack of sheets each carrying an image formed thereon, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device configured to move said reinforce roller in a direction perpendicular to a direction of sheet conveyance;

a monitoring apparatus configured to monitor a movement of said reinforce roller; and, a controller configured to cause said reinforce roller to move to a home position and to cause a display means to display a jam message when an error is detected during movement of said reinforce roller.

137. The finisher as claimed in claim 136, wherein said monitoring apparatus comprises:

a first sensor configured to sense the home position of said reinforce roller; and a second sensor configured to sense an end-of-reinforcement position where said reinforce roller ends pressing the fold.

138. The finisher as claimed in claim 136, wherein when said reinforce roller fails to the home position within a preselected period of time, said controller determines that said reinforce roller is fully locked and unable to return and that an error unable to be dealt with by a user has occurred, while causing said display means to display an error message.

139. The finisher as claimed in claim 136, wherein when the error has occurred, said controller inhibits said reinforce roller from pressing a following stack of sheets.

140. An image forming system comprising:

an image forming apparatus comprising an image forming device configured to form an image on a sheet in accordance with input image data sheet feeder configured to feed sheets to said image forming device one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device configured to move said reinforce roller in a direction perpendicular to a direction of sheet conveyance;

a monitoring device configured to monitor a movement of said reinforce roller; and a controller configured to cause said reinforce roller to move to a home position and to cause a display device to display a jam message when an error is detected during movement of said reinforce roller.

141. The system as claimed in claim 140, wherein said display means is included in said image forming apparatus.

142. A sheet finisher for folding a stack of sheets each carrying an image formed thereon, said sheet finisher comprising:

a fold roller pair configured to fold the stack of sheets being conveyed via a nip therof;

a reinforce roller configured to reinforce a fold of the stack of sheets folded by said fold roller pair between said reinfoce roller and a guide plate; and a drive configured to move said reinforce roller in a direction perpendicular to a direction of sheet conveyance;

wherein said drive device causes a moving speed of said reinforce roller to vary from a time when said reinforce roller contacts the stack to a time when said reinforce roller does not contact said stack.

143. The finisher as claimed in claim 142, wherein said drive device causes said reinforce roller to move at a lower speed when getting on the stack than when rolling on said stack.

144. The finisher as claimed in claim 143, wherein said drive device increases the moving speed of said reinforce roller to a preselected speed after said reinforce roller has got on the stack.

145. The finisher as claimed in claim 142, wherein assuming that said reinforce roller moves at a speed V1 before getting on the stack, at a speed V2 when getting on said stack, at a speed V3 before coming down from said stack, at a speed V4 when coming down from said stack and at a speed V6 after coming down from said stack, then said drive means satisfies:

$$V1 \geqq V2$$

$$V6 \geqq V4$$

$$V3 > V2,\ V4.$$

146. The finisher as claimed in claim 142, wherein said drive device causes said reinforce roller to move at a higher speed when the stack is absent than when said stack is present.

147. An image forming system comprising:

an image forming apparatus comprising an image forming device configured to form an image on a sheet in accordance with input image data and sheet feeder configured to feed sheets to said image forming device one by one; and a sheet finisher configured to fold a stack of sheets sequentially transferred from said image forming apparatus;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate; and a drive device configured to move said reinforce roller in a direction perpendicular to a direction of sheet conveyance;

wherein said drive device causes a moving speed of said reinforce roller to vary from a time when said reinforce roller contacts the stack to a time when said reinforce roller does not contact said stack.

148. In a sheet finisher configured to press a fold of a sheet stack folded and thereby reinforce said fold, a control device determines whether or not to execute pressing said fold in accordance with a number of sheets constituting said sheet stack.

149. The finisher as claimed in claim 148, wherein when the number of sheets is equal to or larger than a preselected value, said control device executes said processing.

150. The finisher as claimed in claim 149, wherein said control device varies a number of times of pressing in accordance with the number of sheets.

151. A sheet finisher configured to fold a stack of sheets each carrying an image formed thereon, said sheet finisher comprising:

a fold roller pair configured to fold the stack of sheets being conveyed via nip thereof;

a reinforce roller configured to reinforce a fold of the stack of sheets folded by said fold roller pair between said reinforce roller and a guide plate;

a drive device for moving said reinforce roller in a direction perpendicular to a direction of sheet conveyance; and a control device for controlling said drive means;

wherein said control device causes said reinforce roller to perform pressing in accordance with a number of sheets constituting the stack.

152. The finisher as claimed in claim 151, wherein said control device varies a moving speed of said reinforce roller during pressing in accordance with the number of sheets.

153. The finisher as claimed in claim 151, wherein said control device varies a number of times of pressing in accordance with the number of sheets.

154. The finisher as claimed in claim 151, further comprising a sensing device positioned upstream of said reinforce roller in the direction of sheet conveyance, wherein the sensing device is configured to sense the stack, and wherein said control device causes said reinforce roller to continously press the fold until said sensing device senses a following next stack of sheets.

155. The finisher as claimed in claim 154, wherein said control device varies a moving speed of said reinforce roller during pressing in accordance with the number of sheets.

156. The finisher as claimed in claim 151, wherein said control device varies a number of times of pressing in accordance with the number of sheets.

157. An image forming system comprising:

an image forming apparatus comprising image forming device configured to form an image on a sheet in accordance with an input image data and sheet feeding device configured to feed sheets to said image forming device one by one; and a sheet finisher configured to press a fold of a sheet stack for thereby reinforcing said fold and comprising control device configured to determine whether or not to execute processing for pressing said fold in accordance with a number of sheets constituting said sheet stack.

158. An image forming system comprising:

an image forming apparatus comprising an image forming device configured to form an image on a sheet in accordance with input image data and sheet feeding device configured to feed sheets to said image forming means one by one; and a sheet finisher configured to press a fold of a sheet stack folded, thereby reinforcing said fold and comprising a control device configured to determine whether or not to execute pressing said fold in accordance with a number of sheets constituting said sheet stack.

159. A sheet finisher for folding a stack of sheets each carrying an image formed theron, said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device configured to move said reinforce roller in a direction perpendicular to a direction of sheet conveyance; and a control device configured to control said drive device;

wherein said control means causes said reinforce roller to move to a position close to an edge of the stack to be pressed beforehand and wait at said position.

160. The finisher as claimed in claim 159, wherein said control device determines, when causing said reinforce roller to move to said position beforehand, a distance of movement in accordance with size information received.

161. The finisher as claimed in claim 160, wherein the distance of movement is selected to be two times as great as a distance between a stand-by position of said reinforce roller and a a widthwide center of the stack to be pressed by said reinforce roller.

162. The finisher as claimed in claim 160, wherein the size information is received from an image forming apparatus from which the sheets are sequentially transferred to said finisher.

163. An image forming system comprising:

an image forming apparatus comprising an image forming device configured to form an image on a sheet in accordance with input image data and sheet feeding device configured to feed sheets to said image forming device one by one; and a sheet finisher configured to fold a stack of sheets each carrying an image formed thereon;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a drive device for moving said reinforce roller in a direction perpendicular to a direction of sheet conveyance; and a control device configured to control the drive device;

wherein said control device causes said reinforce roller to move to a position close to an edge of the stack to be pressed beforehand and wait at said position.

164. A sheet finisher configured to fold a stack of sheets each carrying an image formed thereon, said sheet finisher comprising:

a fold roller pair configured to fold the stack of sheets being conveyed via a nip therof;

a reinforce roller configured to reinforce a fold of the stack of sheets folded by said fold roller pair between said reinforce roller and a guide plate;

a first drive device configured to cause said reinforce roller to move in a direction perpendicular to a direction of sheet conveyance with an electric driving force; and a second drive device configured to allow an operator to move said reinforce roller by hand.

165. The finisher as claimed in claim 164, wherein said first drive device comprises a motor, a drive pulley driven by said motor, a driven pulley and a belt passed over said drive pulley and said drive pulley and said driven pulley, and said second drive device comprises a lever connected to said driven pulley configured to allow the operator to rotate said driven pulley by hand.

166. The finisher as claimed in claim 164, further comprising a releasing device configured to release said reinforce roller from the stack at a pressing position.

167. The finisher as claimed in claim 166, wherein said releasing device comprises:

a first guide member supporting said reinforce roller such that said reinforce roller is configured to move in a direction perpendicular to the direction of sheet conveyance;

a first shaft supporting said first guide member such that first guide member is angularly movable about one end thereof; and a first locking device for selectivity locking or unlocking said first guide member at said pressing position.

168. The finisher as claimed in claim 167, wherein said first shaft comprises a shaft of said driven pulley.

169. The finisher as claimed in claim 167, wherein said first drive device is supported by said first guide member while said first shaft in included in said first guide member.

170. The finisher as claimed in claim 166, wherein said releasing device comprises:

a second guide member configured to receive a pressing force of said reinforce roller;

a second shaft configured to support said second guide member such that said second guide member is angularly movable in a direction perpendicular to the direction of sheet conveyance; and a second locking configured to selectivity lock or unlock said second guide member at a pressing position assigned to said reinforce roller.

171. The finisher as claimed in claim 166, wherein said releasing device comprises:

a second guide member configured to receive a pressing force of said reinforce roller;

a third shaft configured to support said second guide member such that said second guide member is angularly movable in a direction perpendicular to the direction of sheet conveyance; and a third locking device configured to selectivity lock or unlock said second guide member at a pressing position assigned to said reinforce roller.

172. An image forming system comprising:

an image forming apparatus comprising image forming device configured to form an image on a sheet in accordance with input image data and sheet feeding device configured to feed sheets to said image forming device one by one; and a sheet finisher configured to fold a stack of sheets each carrying an image formed thereon;

said sheet finisher comprising:

a fold roller pair configured to fold the stack of sheets being conveyed via a nip thereof;

a reinforce roller configured to reinforce a fold of the stack of sheets folded by said fold roller pair between said reinforce roller and a guide plate;

a first drive device configured to cause said reinforce roller to move in a direction perpendicular to a direction of sheet conveyance with an electric driving force; and a second drive device configured to allow an operator to move said reinforce roller by hand.

* * * * *